US007611829B2

(12) United States Patent
Deguchi et al.

(10) Patent No.: US 7,611,829 B2
(45) Date of Patent: Nov. 3, 2009

(54) SILVER HALIDE COLOR PHOTOGRAPHIC LIGHT-SENSITIVE MATERIAL AND COLOR IMAGE-FORMING METHOD

(75) Inventors: Yasuaki Deguchi, Minami-ashigara (JP); Shin Soejima, Minami-ashigara (JP); Naoto Ohshima, Minami-ashigara (JP); Tatsuya Ishizaka, Minami-ashigara (JP); Katsuyuki Takada, Minami-ashigara (JP); Futoshi Yoshida, Kanagawa-ken (JP); Atsushi Maruhashi, Kanagawa-ken (JP); Yoshinori Morimoto, Kanagawa-ken (JP); Takehisa Ohno, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/587,499

(22) PCT Filed: Jan. 27, 2005

(86) PCT No.: PCT/JP2005/001543

§ 371 (c)(1),
(2), (4) Date: Jul. 27, 2006

(87) PCT Pub. No.: WO2005/073804

PCT Pub. Date: Aug. 11, 2005

(65) Prior Publication Data

US 2007/0154853 A1 Jul. 5, 2007

(30) Foreign Application Priority Data

| | | |
|---|---|---|
| Jan. 30, 2004 | (JP) | 2004-023003 |
| Jan. 30, 2004 | (JP) | 2004-023260 |
| Jan. 30, 2004 | (JP) | 2004-024595 |
| Mar. 24, 2004 | (JP) | 2004-087485 |
| Mar. 24, 2004 | (JP) | 2004-087745 |

(51) Int. Cl.
*G03C 7/00* (2006.01)
*G03C 11/00* (2006.01)
*G03C 7/46* (2006.01)

(52) U.S. Cl. ..... 430/357; 430/363; 430/372; 430/374; 430/383; 430/384

(58) Field of Classification Search ..... 430/357, 430/363, 372, 374, 383, 384
See application file for complete search history.

(56) References Cited

U.S. PATENT DOCUMENTS

| | | | | |
|---|---|---|---|---|
| 5,198,328 | A | 3/1993 | Shiba et al. | |
| 5,320,938 | A | 6/1994 | House et al. | |
| 5,399,475 | A | 3/1995 | Hasebe et al. | |
| 6,569,610 | B2 * | 5/2003 | Yoshida | 430/434 |
| 6,949,334 | B2 * | 9/2005 | Ohshima et al. | 430/611 |
| 7,150,962 | B2 * | 12/2006 | Ohshima et al. | 430/357 |
| 2001/0022663 | A1 | 9/2001 | Ishikawa et al. | |
| 2002/0058216 | A1 | 5/2002 | Nakamura et al. | |
| 2002/0164550 | A1 | 11/2002 | Yoshida | |
| 2003/0228544 | A1 | 12/2003 | Ohshima et al. | |

FOREIGN PATENT DOCUMENTS

| | | | |
|---|---|---|---|
| JP | 4-198931 | A | 7/1992 |
| JP | 7-34103 | B2 | 4/1995 |
| JP | 2000-2936 | A | 1/2000 |
| JP | 2000-122209 | A | 4/2000 |
| JP | 2000-289901 | A | 10/2000 |
| JP | 2001-166411 | A | 6/2001 |
| JP | 2002-23295 | A | 1/2002 |

(Continued)

*Primary Examiner*—Geraldina Visconti
(74) *Attorney, Agent, or Firm*—Birch, Stewart, Kolasch & Birch, LLP

(57) ABSTRACT

A color-image forming method in a silver halide color photographic light-sensitive material, having the steps of: performing exposure of the light-sensitive material cut into sheets; and subjecting the exposed light-sensitive material sheets to photographic processing, while conveying them with conveying rollers, with the sheet conveying speed being 40.0 to 100 mm/sec; wherein the light-sensitive material to be exposed contains any of: 1) a dye-forming coupler of formula (IA), 2) a compound of formula (I), and 3) 1.4 mg/m$^2$ or more of a compound of formula (II);

Formula (IA)

Formula (I)

Formula (II)

wherein R' and R" are a substituent; Z is a hydrogen atom, or a coupling split-off group; A is an alkyl group, M is a cation, and R is an atom or group having 100 or lower total molecular weight.

9 Claims, 4 Drawing Sheets

FOREIGN PATENT DOCUMENTS

| | | | |
|---|---|---|---|
| JP | 2002-162707 | A | 6/2002 |
| JP | 2002-214714 | A | 7/2002 |
| JP | 2002-351000 | A | 12/2002 |
| JP | 2003-43604 | A | 2/2003 |
| JP | 2003-167320 | A | 6/2003 |
| JP | 2003-177500 | A | 6/2003 |
| JP | 2003-202657 | A | 7/2003 |
| JP | 2003-212384 | A | 7/2003 |
| JP | 2003-215776 | A | 7/2003 |
| JP | 2003-267587 | A | 9/2003 |
| JP | 2003-322931 | A | 11/2003 |
| JP | 2003-322932 | A | 11/2003 |
| JP | 2004-4421 | A | 1/2004 |
| JP | 2004-38183 | A | 2/2004 |
| JP | 2004-054025 | A | 2/2004 |

* cited by examiner

SILVER HALIDE COLOR PHOTOGRAPHIC LIGHT-SENSITIVE MATERIAL AND COLOR IMAGE-FORMING METHOD

TECHNICAL FIELD

The present invention relates to a silver halide color photographic light-sensitive material that is suitable for high-speed conveying processing, and to a color image-forming method using the same. More specifically, the invention relates to a color image-forming method by using a silver halide color photographic light-sensitive material and conveying the silver halide color photographic light-sensitive material in sheet form at a high speed in processes of photographic processing, which method can ensure color images formed with high quality and improvement in developer streaks, and further the invention relates to a silver halide color photographic light-sensitive material usable in the aforesaid method.

BACKGROUND ART

In recent years, high quality photographic light-sensitive materials suitable for rapid processing have been desired as a part of improvements in customer services for printing photographic information from digital cameras and as a measure for improving productivity in the photograph treatment service industry. In order to cope with this desire, it is generally carried out, at present, to subject photographic light-sensitive materials containing high-chloride emulsions (hereinafter referred to as high-chloride print materials also) to laser exposure and then to color-development processing (for instance, photographic processing is performed using Frontier 330 Series (trade name) and CP-48S Series Chemical (trade name), made by Fuji Photo Film Co., Ltd.). Further, for example, an exposure treatment system are being put to the market from each company in which system, the process since the exposure step is started until the drying step is finished is rapidly carried out in a total time about 4 minutes by shortening the time required from the exposure to the treatment (called latent image time in the field concerned) to about 10 seconds and carrying out the subsequent color developing treatment for 45 seconds (for example, in Frontier 350 manufactured by Fuji Photo Film Co., Ltd.). An exposure treatment using these systems is carried out in each photo processing shop, and the shop offers its service to return a photographic image to customers in about one hour from reception in these days. These systems are superior in shortening the time required until a photographic image is returned to customers.

With recent improvements in high-chloride print materials and photographic processing technology, the Dry-to-Dry time required to finish one sheet of print has become reduced to the order of 3 to 5 minutes. However, it is still hard to say that the rapidity of such high-chloride print material-utilized rapid processing systems is sufficient as compared with the rapidity of image formation by other color image formation systems (e.g. an electrostatic transfer system, a thermal transfer system, an inkjet system), and therefore it is desired to further reduce the total processing time required for a high-chloride print material to undergo all process steps from the start of development to the end of drying. On the other hand, high-chloride print materials have advantages of high productivity and quality stability over other systems. If it is possible to reduce the Dry-to-Dry time while maintaining high quality, further improvements in productivity can be achieved to result in improvement of profit for minilab print shops that are suffering decreased profitability.

The foregoing exposure-and-processing systems (e.g. a Frontier 350 (trade name)) enable returning of high-quality prints to customers through processes of capturing information from negative images formed by taking pictures, and performing image processing. Further, these systems enable conversion of digital information from image-recording media of digital cameras, which are enjoying an upsurge in their saturation level into laser-beam power and exposure of print materials to laser-beam power. Therefore, customers using services of making photographic prints from digital cameras in photo-developing shops is increasing. In performing print-making from digital cameras, the time required to return prints to each individual customer is determined by the image-capture time and the print-processing time. Accordingly, reducing the print-processing time can directly lead to short-time print service offered for customers, so intensive studies have been conducted on silver halide photographic materials and processing systems that permit faster processing.

Under these circumstances, various studies and efforts to develop methods to improve stability in continuous processing have been made in this industry. To improve productivity and enable rapid processing, it is required to develop (1) high-chloride print materials having rapid processing suitability (and permitting faster color development, faster desilvering, and faster washing), (2) minilabs enabling consistent formation of high image quality prints that are free of unevenness and streaks and have uniform and stable image quality throughout the print from white background to high-density areas, even when the processing speed is increased for processing speed acceleration, and (3) highly activated processing solutions forming neither precipitates nor deposits even when used in continuous processing. Of these developments, development of (1) high-chloride print materials, in particular, can greatly contribute to processing speed acceleration, and therefore intensive study of such materials has continued.

It is well known that images are formed in silver halide color photographic light-sensitive materials by utilizing exposed silver halide as an oxidant, and making an oxidized aromatic primary amine developing agent react with couplers, to produce dyes, such as indophenol, indoaniline, indamine, azomethine, phenoxazine and phenazine dyes. In this photography, a subtractive color process is used, and color images are formed from yellow, magenta and cyan dyes. Of these dye images, cyan dye images are usually formed from phenol- or naphthol-series couplers. However, the dyes formed from those couplers have undesirable absorptions in the yellow-to-magenta region, and have a problem of worsening color reproduction. Therefore, there is a need to solve the problem. Aiming to solve the problem, heterocyclic compounds having particular structures are proposed (e.g., in U.S. Pat. Nos. 4,728,598 and 4,873,183, and European Patent No. 0 249 453 A2), but those couplers each suffer a critical defect, such as low coupling activity or poor colorfastness of the dye formed. As couplers able to overcome such a problem, pyrrolotriazole-series couplers are proposed in U.S. Pat. No. 5,256,526 and European Patent No. 0 545 300. These couplers are outstanding for hue and coupling activity, but the dye images formed from them do not always have sufficient fastness, and their lightfastness, in particular, is inferior to those formed from conventional couplers. As such, there is also a need to overcome such a drawback. In addition, there arises the problem that, when the coupling activity of a coupler is raised by lowering pKa and rapid processing is carried out, a developing agent may be left in print owing to insufficient washing. The developing agent is converted into its oxidation product by air oxidation progresses gradually upon long-term storage of the print, and the oxidation product undergoes coupling reaction with the dissociated coupler in the print to produce a dye as stain. Further, the magenta dyes and the cyan dyes formed have high luminosity factor, such that even slight stains have strong influence on deterioration of white background.

On the other hand, to reduce the time period from reception to completion of printing, even with an accompanying concentrated increase in processing volume, it has been studied to increase the processing volume per unit of time by increasing the conveying speed throughout the processing. To consistently conveying photosensitive materials at increased speed, studies have been made to achieve high-speed conveying by nipping conveying of the photosensitive materials with many pairs of conveying rollers. However, there is apprehension that speeding up conveying may cause an increase in the physical load on photosensitive materials under conveying, to result in sensitivity variation by abrasion in the wet state. More specifically, when photosensitive materials come into contact with unforeseen extraneous substances or protuberances during conveying through processing solutions, and thereby some pressure is applied thereto, it is noted that there occurs a phenomenon in which the photosensitive materials undergo undesirable sensitization or desensitization; as a result, the prints obtained lose commercial value. U.S. Pat. No. 5,543,281 and JP-A-8-254800 ("JP-A" means unexamined published Japanese patent application) disclose the advantage that a photographic element containing silver chloride grains containing a phenyl mercaptotetrazole transition metal salt can reduce cyan stains generated in a developer contaminated by a bleach-fix solution, without causing deterioration in wet abrasion resistance. In addition, JP-A-2002-162707 discloses the art of improving wet abrasion sensitivity by use of a mercapto compound. However, those arts are not always sufficient for wet abrasion sensitivity improvements when photographic materials are conveyed at increased speeds, namely in the case of high-speed conveying. U.S. Pat. Nos. 4,957,855 and 5,320,938 have already disclosed that silver halide emulsions having reduced fog and excellent raw stock can be obtained by use of phenyl mercaptotetrazole and its derivatives. However, these methods have a drawback of exacerbating wet abrasion sensitivity. Under these circumstances, there has been a need to improve wet-state abrasion in the case of high-speed conveying.

In the photograph treatment service industry, color print systems for obtaining color prints from digital cameras, of late, in addition to obtaining them from color negatives and reversal materials, have come into widespread use in not only laboratories specialized in processing of prints but also photo-processing shops. The dominating exposure method adopted in those color print systems is moving from the so-called direct (analog) exposure method that is a method of performing surface exposure of photosensitive materials by being incident projection rays of photographic films such as color negatives on color papers, to a printing system that utilizes digital exposure and enables the making of color prints from digital cameras. A digital exposure method is becoming prevalent even in the case of images recorded on film, wherein the images are read with a photoelectric device, and thereby the information thereof is converted into digital signals; the signals are subjected to image processing, and then scanning exposure for recording images is performed, using recording light modulated in response to the image data obtained by the image processing.

As to the processes for color printing, on the other hand, technologies such as an inkjet process, a sublimation process and color xerography have progressed individually; as a result, these processes have become talked in terms of "Photographic Quality" and these processes are recognized as the processes for color printing. Among these contending technologies, the digital exposure systems using color photographic paper and performing exposure by laser-beam scanning are characterized by high image quality, high productivity, and high fastness of the images formed. Therefore, it is desired to foster enhancements of these characteristics and to provide higher-quality photographs with greater ease at lower prices. To further enhance the image quality in laser scanning exposure of color photographic paper, it is effective to increase the writing density of image data. In addition, speeding up the operations from exposure of color photographic paper to the end of photographic processing enables return of high-quality prints in a short time, on the order of several minutes after the receipt of a recording medium of a digital camera, in a print shop. As a result, the superiority of color prints using color photographic paper is increasingly enhanced. Therefore, it is vitally important that suitability for speeding up the entire process from exposure to the end of photographic processing be imparted to color photographic paper and an image-forming method using the color photographic paper.

Measures to perform the entire process from exposure to the end of photographic processing with rapidity have been examined from various standpoints. Silver halide emulsions used in color photographic paper are silver halide emulsions having high chloride contents, because of their requirement for rapid processing suitability. The development of high-chloride emulsions proceeds at high speed, and produces no development inhibitors such as Br ion and I ion. As a result, there occurs no accumulation of those ions in a developer, and the emulsions are stable to variations in processing factors. JP-A-2002-23295 discloses sensitizing dyes that produce slight residual color, aiming at shortening washing process time. Such speeding up in processing operations results in enhanced print productivity per unit of time, and therefore it is very important.

In those color print systems, photosensitive materials are wound in roll form and loaded in lightproof magazines used for storage of photosensitive materials, and they are drawn from the magazines and conveyed at the occasions of exposure and photographic processing. Hitherto color prints have been made by the so-called roll conveying system; namely, the system in which a photosensitive material undergoes exposure and photographic processing as it is held in roll form without being cut in the progress of processing; and, after completion of the processing, the thus processed photosensitive material is cut to the desired length, to deliver color prints on a sheet-by-sheet basis. This system requires the formation of frame information, to clearly indicate the sheet-by-sheet print boundaries, so it has the drawback that the areas bearing the frame information result in waste, and it has reduced productivity.

In recent years, there has been commercialization of color print systems adopting a sheet conveying method, in which a photosensitive material is cut into sheets of a size equivalent to a photo print sheet in advance, and then is subjected to exposure and photographic processing. In this sheet conveying method, a photosensitive material cut into sheets is conveyed by means of pairs of conveying rollers and a belt conveyor, and undergoes photographic processing. Herein, the photosensitive material in sheet form is development-processed after exposure. In the development-processing step also, the photosensitive material is conveyed by means of pairs of conveying rollers, as it is held in sheet form. Such a color print system is desired to increase the print output number per hour, and preferably such a high-productivity print system can be materialized a comparatively compact apparatus. Under these circumstances, systems that perform photographic processing operations at an ever-faster conveying speed are beginning to displace conventional conveying systems.

However, such increasing of conveying speed requires that photosensitive materials used in those systems, or color paper, have ever-higher suitability for high intensity exposure, photographic processing consistency and rapid processing suitability. To respond to these requirements, improvements in reciprocity characteristics of silver halide emulsions, improvements of couplers and coupler dispersions for ensuring color generation by efficient coupling reaction with oxidized color-developing agents, and improvements added to designs of photosensitive materials in their entirety, including the improvements mentioned above, have been studied in this industry. Although these efforts have been made, further improvements in photosensitive materials and photographic processing systems are desired to further enhance the productivity and handling characteristics required for the color photographic processing systems.

Photosensitive materials used in these systems, or color print materials, are required not to cause a sensitivity drop attributable to high intensity reciprocity law failure. This is because the photosensitive materials used therein, namely color print materials, undergo exposure at high intensity that is responsive to the digital exposure method of recording images by scanning with laser beams modulated by image data. In addition, it is desired that color print materials have consistent finish quality in the sense that they are highly resistant to developer streaks likely to occur in rapid processing under high-speed conveying, and they are less prone to being abraded by contact with guides and blades set in a conveying path through processing solutions.

To ensure favorable physical properties of films in manufacturing color print materials, the color print materials are stored at the factory for a time period of several days from the completion of coating operations to shipment, and the materials shipped from the factory are passed through distribution channels and used in photofinishing laboratories and photoprocessing shops. Preferably, the color print materials shipped from the factory are stored at low temperatures, but in fact, often they are left standing in places out of refrigeration; and worse, it often happens, depending on the district, that they are exposed to high temperature or high humidity situations. The method by which the property of hardening with rapidity and the property of raw stock after manufacturing are imparted to color print materials is described, e.g., in JP-A-2000-98527.

Under circumstances in which the variety of color print systems, including systems of a rapid type, has increased, the color print systems of a high-speed sheet conveying type enhanced in productivity are required to deliver high quality equivalent to traditional systems. As things stand now, however, they do not always meet quality requirements to a sufficient degree, specifically regarding the variations in developed color density and gradation, and the incidence of scratches. Further, it turns out that increases in variation of color generation and incidence of scratches occur especially when the storage histories (temperature and humidity) of color print materials after manufacturing are improper.

As stated above, silver halide emulsions used in color photographic paper are silver halide emulsions having high chloride contents, because of their requirement for rapid processing suitability. The development of high-chloride emulsions proceeds at high speed, and produces no development inhibitors such as Br ion and I ion. As a result, there occurs no accumulation of those ions in a developer, and the emulsions are stable to variations in processing factors.

By incorporating various forms of high-bromide phases into high-chloride emulsions, so that the phases are in a localized state, high sensitivities are attained (as described, e.g., in JP-A-2003-207865 and U.S. Pat. Nos. 5,399,475 and 5,284,743). Further, U.S. Pat. Nos. 5,726,005 and 5,736,310 disclose that high-speed emulsions reduced in high intensity failure are obtained by containing iodide so as to have its maximum concentration at the sub-surfaces of high-chloride emulsions. In addition, European Patent No. 0 928 988 A discloses, in its Examples that emulsions having excellent properties with respect to reciprocity raw failure, temperature dependency throughout exposure, and pressure resistance are obtained by incorporating specified compounds into emulsion grains that have I-bands formed at the time when the grain formation reaches 93% of its entire process, and an edge length of 0.218 μm, or a sphere-equivalent diameter of about 0.27 μm.

It is known to dope a silver chloride emulsion with an iridium (Ir) complex, to improve high intensity failure of the emulsion and obtain hard gradation even under high intensity. For instance, JP-B-7-34103 ("JP-B" means examined Japanese patent publication) discloses that the problem of latent-image sensitization is solved by forming localized phases having high silver bromide contents and doping the localized phases with iridium. U.S. Pat. No. 5,691,119 discloses the method of making the gradation in high intensity hard by the method of preparing an emulsion having localized phases high in silver bromide content. In addition, U.S. Pat. No. 5,360,712 discloses cases of improving high intensity failure by use of specified metal complexes having organic ligands.

However, none of those references suggest improvement of streak-form unevenness caused by high-density and high-speed exposure, and by reduction in the time period from exposure to color development.

Further, there has been commercialization of color print systems adopting a sheet conveying method, in which photographic paper is cut into sheets of a size equivalent to a photo print sheet in advance, and then light beams, modulated according to the image data, are deflected to a main scanning direction, and simultaneously therewith, the photographic paper is conveyed in a sub-scanning direction orthogonal to the main scanning direction, and further subjected to photographic processing as it is in sheet form. However, this conveying method has the problem of suffering exposure unevenness, because vibrations are caused by various factors during the conveying and are transferred to an exposed area of photographic paper. For instance, vibrations are transferred to, or load variations occur in, an exposed area of photographic paper by passage of the leading end or the trailing end of the photographic paper over a segment in which a level difference is present between a flatter guide supporting photographic paper in the exposure section and a conveying guide placed at the front of the exposure section, or by an action that the photographic paper takes to get over a conveying roller protruding from the flatter guide level, and thereby, exposure unevenness results.

JP-A-2003-212384, therefore, discloses the image-forming method of good quality by avoiding exposure unevenness from developing, wherein special hard metal rollers, made by adopting metal rollers suffering slight deformation as conveying roller pairs, and by providing rubber layers on the roller surfaces to enhance rollers' conveying performance, are placed so as to protrude their nip positions, and thereby vibrations of photosensitive materials are controlled to result in prevention of exposure unevenness. In this case, a photosensitive material is conducted to an exposure position by means of a pair of conveying rollers and a conveying guide, and it undergoes recording of images in a condition that it is nipped and fixed by pairs of rollers at two points situated in the vicinity of the exposure position so as to face each other across the exposure position, thereby securing the flatness.

In use of the aforementioned hard rollers providing exposure unevenness improvement in the sheet conveying method, however, it turned out that, in some cases, streaked unevenness came to develop in proximity to the points of passage over the hard rollers as the sub-scanning speed under exposure was increased. We have made intensive studies and have conducted tests on a wide variety of photosensitive materials, based on the assumption that the streaked unevenness was pressure sensitization caused by direct damage to emulsions from pressure. As a result thereof, it has been found that the streaked unevenness was not a phenomenon occurring only on the testing level regarded as low in pressure resistance in particular. Further, it has been found that the streaked unevenness developed conspicuously when photosensitive materials stored under circumstances of high temperature and low humidity underwent exposure. Thus, the streaked unevenness has proved to be a phenomenon ascribed to both ageing changes by storage history of photosensitive materials and damage to photosensitive materials under roller conveying.

As stated above, preferably photosensitive materials shipped from the factory are stored at low temperatures, but actually, often they are left standing in places out of refrigeration; and worse, it often happens, depending on the district, that they are exposed to high temperature or high humidity situations. Under circumstances in which color print systems have diversified into rapid types and so on, it is required for high-speed conveying color print systems enhanced in productivity to deliver high quality equivalent to that of color print systems currently in use.

JP-A-2002-23295 discloses that emulsions having excellent pressure resistance can be obtained by spectral sensitization with specified monomethine dyes, but it has no description of changes in photographic properties by variations in ageing of photosensitive materials under storage.

JP-A-2001-166411 discloses that the stability to changes in photographic properties by temperature variations under exposure can be improved by use of specified disulfide compounds, but it also has no description of changes in photographic properties by variations in ageing of photosensitive materials under storage.

DISCLOSURE OF INVENTION

The present invention resides in a color-image forming method in a silver halide color photographic light-sensitive material comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler and at least one light-insensitive hydrophilic colloid layer, which comprises the steps of:

performing image-wise exposure of the light-sensitive material cut into sheets; and subjecting the exposed light-sensitive material sheets to photographic processing including a color development process, a bleach-fix process, a rinsing process and a drying process, while conveying (transporting) the exposed light-sensitive material sheets by means of pairs of conveying rollers (transport rollers);

wherein the sheet conveying speed (transport speed) in the photographic processing being 40.0 mm/sec to 100 mm/sec;

wherein the silver halide color photographic light-sensitive material to be exposed contains any one component selected from the group consisting of:

1) at least one dye-forming coupler represented by the following formula (IA), 2) at least one compound represented by the following formula (I), and 3) 1.4 mg/m$^2$ or more of at least one compound represented by the following formula (II);

Formula (IA)

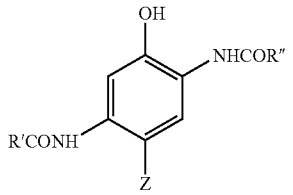

wherein, in formula (IA), R' and R" each independently represent a substituent, and Z represents a hydrogen atom, or a group capable of being split-off in a coupling reaction with an oxidized product of an aromatic primary amine color-developing agent;

Formula (I)

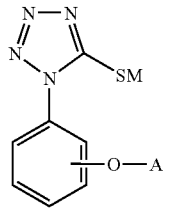

wherein, in formula (I), A represents a substituted or unsubstituted alkyl group, and M represents a cation; and Formula (II)

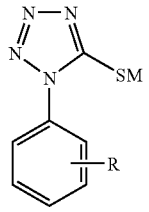

wherein, in formula (II), M represents a cation; and R represents an atom having an atomic weight of 100 or lower, or a group having a total molecular weight of 100 or lower.

Further, the present invention resides in a silver halide color photographic light-sensitive material, comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler and at least one light-insensitive hydrophilic colloid layer;

which forms a color image by image-wise exposure and by photographic processing including a color development process finished within 18 seconds, a bleach-fix process, a rinsing process and a drying process while it is conveyed (transported) in cut sheet form at a speed of 40.0 mm/sec to 100 mm/sec by means of conveying rollers; and which contains any one component selected from the group consisting of:

1) at least one dye-forming coupler represented by formula (IA) described above, 2) at least one compound represented by formula (I) described above, and 3) 1.4 mg/m$^2$ or more of at least one compound represented by formula (II) described above.

Further, the present invention resides in a color-image forming method in a silver halide color photographic light-sensitive material comprising a support and photographic constituent layers including at least one blue-sensitive silver halide emulsion layer containing a yellow-dye-forming coupler, at least one green-sensitive silver halide emulsion layer containing a magenta-dye-forming coupler and at least one red-sensitive silver halide emulsion layer containing a cyan-dye-forming coupler, comprising the steps of:

subjecting the light-sensitive material to a scanning light-exposure at a sub-scan conveying speed of 90 mm/sec or more; and conducting a color-forming photographic processing;

wherein at least one of the silver halide emulsion layers to be exposed contains a silver halide emulsion having a silver chloride content of at least 90 mol %; and wherein any of the following conditions a) to e) is satisfied:

a) the silver halide emulsion further has a silver bromide content of 0.1 to 4 mol %, and a silver bromide-containing phase is formed in layer form or has a region ranging in silver bromide content from 0.5 to 20 mol % at a depth of 20 nm or less below the emulsion grain surface;

b) the silver halide emulsion further has a silver iodide content of 0.02 to 1 mol %, and a silver iodide-containing phase is formed in layer form or has a region ranging in silver iodide content from 0.3 to 10 mol % at a depth of 20 nm or less below the emulsion grain surface;

c) the silver halide emulsion further has a hexacoordinate complex containing iridium as a central metal and having at least two different kinds of coordinate ligands;

d) the silver halide emulsion is further spectrally sensitized with at least one dye represented by the following formula (SI);

Formula (SI)

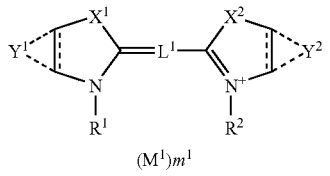

wherein, in formula (SI), $X^1$ and $X^2$ each represents an oxygen atom, a sulfur atom, a selenium atom, a tellurium atom, a nitrogen atom or a carbon atom; $Y^1$ represents a group of atoms necessary for forming a furan, pyrrole, thiophene ring or benzene ring which may be condensed with another 5- or 6-membered carbon ring or heterocycle or may have a substituent group; $Y^2$ represents a group of atoms necessary for forming a benzene ring or a 5- or 6-membered unsaturated heterocycle, which may be further condensed with another 5- or 6-membered carbon ring or heterocycle or may have a substituent group; a bond between two carbon atoms by which $Y^1$ and $Y^2$ are each condensed with the carbon ring or the heterocycle may be a single bond or a double bond; one of $R^1$ and $R^2$ is an alkyl group substituted by an acid group other than a sulfo group, and the other is an alkyl group substituted by a sulfo group; $L^1$ represents a methine group; $M^1$ represents a counter ion; and $m^1$ represents a number of 0 or more necessary for neutralizing a charge in a molecule; and e) the silver halide emulsion further has at least one inorganic sulfur or at least one compound represented by the following formula (Z);

$$R^{41}—S—S—R^{42} \qquad \text{Formula (Z)}$$

wherein, in formula (Z), $R^{41}$ and $R^{42}$ each represent an aliphatic group or an aromatic group independently, or combine with each other to form a ring.

Further, the present invention resides in a silver halide color photographic light-sensitive material, comprising a support and photographic constituent layers including at least one blue-sensitive silver halide emulsion layer containing a yellow-dye-forming coupler, at least one green-sensitive silver halide emulsion layer containing a magenta-dye-forming coupler and at least one red-sensitive silver halide emulsion layer containing a cyan-dye-forming coupler;

wherein the light-sensitive material is subjected to a scanning light-exposure at a sub-scan conveying speed of 90 mm/sec or more, and then a color-forming photographic processing, to form a color image;

wherein at least one of the silver halide emulsion layers to be exposed contains a silver halide emulsion having a silver chloride content of at least 90 mol %; and wherein any of the following conditions a) to e) is satisfied:

a) the silver halide emulsion further has a silver bromide content of 0.1 to 4 mol %, and a silver bromide-containing phase is formed in layer form or has a region ranging in silver bromide content from 0.5 to 20 mol % at a depth of 20 nm or less below the emulsion grain surface;

b) the silver halide emulsion further has a silver iodide content of 0.02 to 1 mol %, and a silver iodide-containing phase is formed in layer form or has a region ranging in silver iodide content from 0.3 to 10 mol % at a depth of 20 nm or less below the emulsion grain surface;

c) the silver halide emulsion further has a hexacoordinate complex containing iridium as a central metal and having at least two different kinds of coordinate ligands;

d) the silver halide emulsion is further spectrally sensitized with at least one dye represented by formula (SI) described above; and e) the silver halide emulsion further has at least one inorganic sulfur or at least one compound represented by formula (Z) described above.

Other and further features and advantages of the invention will appear more fully from the following description, taken in connection with the accompanying drawings.

BEST MODE FOR CARRYING OUT THE INVENTION

Figure 1:
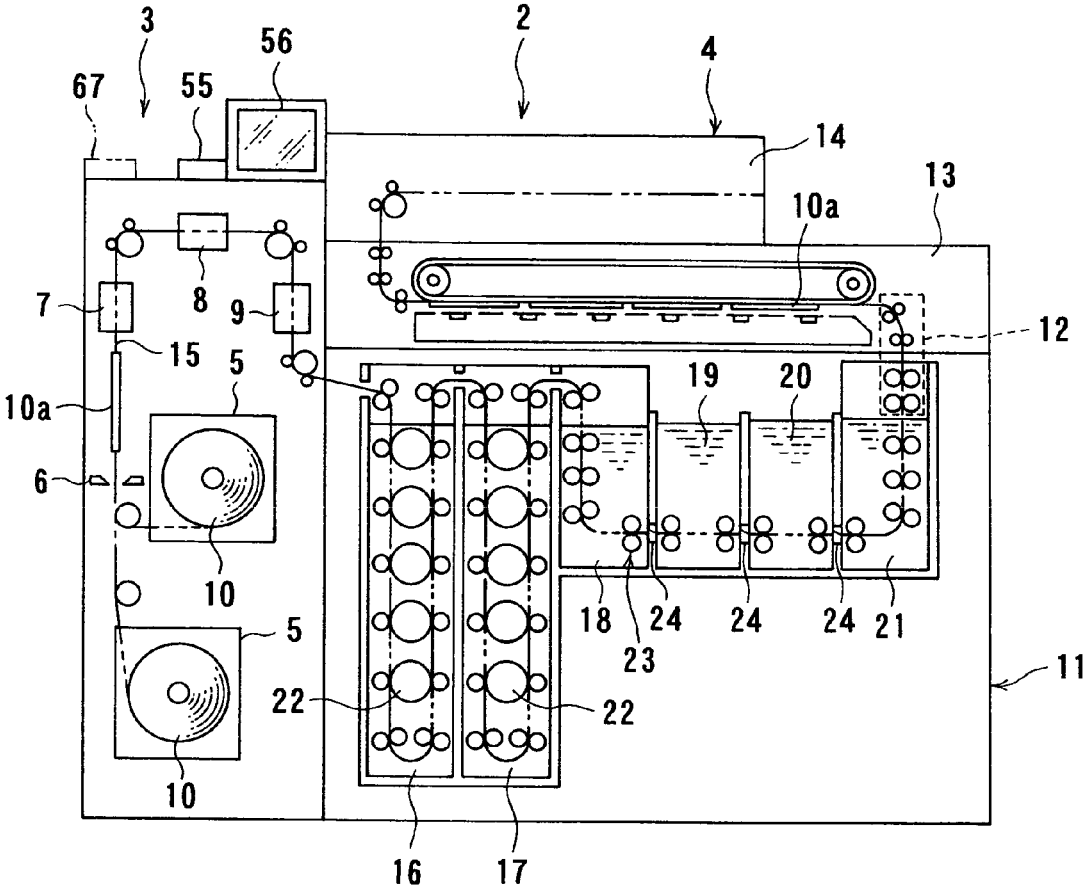
FIG. 1 is a schematic diagram showing an example of a printer processor usable in the present invention.

According to the present invention, there are provided the following means:

(1) A color-image forming method in a silver halide color photographic light-sensitive material comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler and at least one light-insensitive hydrophilic colloid layer, which comprises the steps of:

performing image-wise exposure of the light-sensitive material cut into sheets; and subjecting the exposed light-sensitive material sheets to photographic processing including a color development process, a bleach-fix process, a rinsing process and a drying process, while conveying the exposed light-sensitive material sheets by means of pairs of conveying rollers;

wherein the sheet conveying speed in the photographic processing being 40.0 mm/sec to 100 mm/sec;

wherein the silver halide color photographic light-sensitive material to be exposed contains any one component selected from the group consisting of:

1) at least one dye-forming coupler represented by the following formula (IA), 2) at least one compound represented by the following formula (I), and 3) 1.4 mg/m$^2$ or more of at least one compound represented by the following formula (II);

Formula (IA)

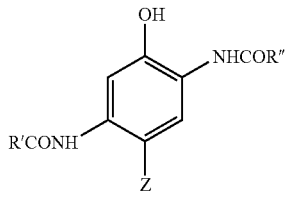

wherein, in formula (IA), R' and R" each independently represent a substituent, and Z represents a hydrogen atom, or a group capable of being split-off in a coupling reaction with an oxidized product of an aromatic primary amine color-developing agent;

Formula (I)

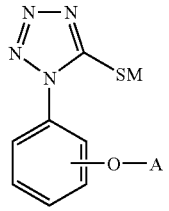

wherein, in formula (I), A represents a substituted or unsubstituted alkyl group, and M represents a cation; and Formula (II)

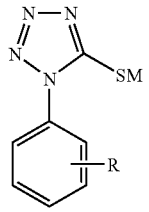

wherein, in formula (II), M represents a cation; and R represents an atom having an atomic weight of 100 or lower, or a group having a total molecular weight of 100 or lower;

(2) The color-image forming method as described in the above item (1), wherein the conveying speed in the photographic processing is from 42.0 mm/sec to 100 mm/sec;

(3) The color-image forming method as described in the above item (1), wherein the conveying speed in the photographic processing is from 45.0 mm/sec to 95 mm/sec;

(4) The color-image forming method as described in any one of the above items (1) to (3), wherein the rinsing process uses a tank structurally partitioned into a plurality of rooms with blade-form members for passing the light-sensitive material cut into sheets through rinse solutions in a horizontal direction;

(5) The color-image forming method as described in any one of the above items (1) to (4), wherein the silver halide color photographic light-sensitive material is nipped in and conveyed by two or more pairs of conveying rollers;

(6) The color-image forming method as described in any one of the above items (1) to (5), wherein the image-wise exposure is performed using a scanning exposure method on a per-pixel exposure time setting of $1\times10^{-3}$ second or shorter;

(7) The color-image forming method as described in any one of the above items (1) to (6), wherein the color-development process is performed at a processing time setting of 20 seconds or below;

(8) The color-image forming method as described in any one of the above items (1) to (7), wherein the color development process, the bleach-fix process and the drying process in the photographic processing are finished within 18 seconds, 18 seconds and 26 seconds, respectively;

(9) The color-image forming method as described in any one of the above items (1) to (8), wherein a processing time in the rinsing process is from 5 seconds to 25 seconds and a processing temperature in the rinsing process is from 40° C. to 50° C.;

(10) The color-image forming method as described in any one of the above items (1) to (8), wherein a total coating amount of silver in the silver halide color photographic light-sensitive material is 0.50 g/m$^2$ or below;

(11) A silver halide color photographic light-sensitive material, comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler and at least one light-insensitive hydrophilic colloid layer; which forms a color image by image-wise exposure and by photographic processing including a color development process finished within 18 seconds, a bleach-fix process, a rinsing process and a drying process while it is conveyed in cut sheet form at a speed of 40.0 mm/sec to 100 mm/sec by means of conveying rollers; and which contains any one component selected from the group consisting of:

1) at least one dye-forming coupler represented by formula (IA) described above, 2) at least one compound represented by formula (I) described above, and 3) 1.4 mg/m$^2$ or more of at least one compound represented by formula (II) described above;

(12) The silver halide color photographic light-sensitive material as described in the above item (11), wherein the conveying speed in the photographic processing is from 42.0 mm/sec to 100 mm/sec;

(13) The silver halide color photographic light-sensitive material as described in the above item (11), wherein the conveying speed in the photographic processing is from 45.0 mm/sec to 95 mm/sec;

(14) The silver halide color photographic light-sensitive material as described in any one of the above items (11) to (13), which undergoes the rinsing process by passing in a horizontal direction through rinse solutions in a tank structurally partitioned into a plurality of rooms with blade-form members;

(15) The silver halide color photographic light-sensitive material as described in any one of the above items (11) to (14), which is nipped in and conveyed by two or more pairs of conveying rollers;

(16) The silver halide color photographic light-sensitive material as described in any one of the above items (11) to (15), wherein the image-wise exposure is performed using a scanning exposure method on a per-pixel exposure time setting of $1\times10^{-3}$ second or shorter;

(17) The silver halide color photographic light-sensitive material as described in any one of the above items (11) to (16), wherein the color-development process is performed at a processing time setting of 20 seconds or below;

(18) The silver halide color photographic light-sensitive material as described in any one of the above items (11) to (16), which forms a color image by photographic processing including a color development process finished within 18 seconds, a bleach-fix process finished within 18 seconds, a rinsing process, and a drying process finished within 26 seconds;

(19) The silver halide color photographic light-sensitive material as described in any one of the above items (11) to (18), wherein a processing time in the rinsing process is from 5 seconds to 25 seconds and a processing temperature in the rinsing process is from 40° C. to 50° C.;

(20) The silver halide color photographic light-sensitive material as described in any one of the above items (11) to (19), wherein a total coating amount of silver in the silver halide color photographic light-sensitive material is 0.50 g/m$^2$ or below;

(Hereinafter, a first embodiment of the present invention means to include the image-forming methods described in the items (1) to (10) above, and the silver halide color photographic light-sensitive materials described in the items (11) to (20) above.)

(21) A color-image forming method in a silver halide color photographic light-sensitive material comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler and at least one light-insensitive hydrophilic colloid layer, which comprises the steps of:

performing image-wise exposure of the photographic light-sensitive material cut into sheets; and subjecting the exposed light-sensitive material sheets to photographic processing including a color development process, a bleach-fix process, a rinsing process and a drying process, while conveying the exposed light-sensitive material sheets by means of pairs of conveying rollers;

wherein the silver halide color photographic light-sensitive material to be exposed contains at least one dye-forming coupler represented by the following formula (M-1) and at least one dye-forming coupler represented by the following formula (IA);

wherein the light-sensitive material cut into sheets is conveyed at a speed of 40.0 mm/sec to 100 mm/sec in the photographic processing; and wherein the color development process, the bleach-fix process and the drying process in the photographic processing are finished within 18 seconds, 18 seconds and 26 seconds, respectively;

Formula (M-I)

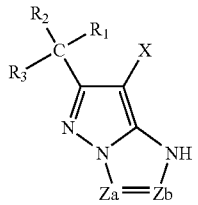

wherein, in formula (M-I), $R_1$, $R_2$, and $R_3$ represent a hydrogen atom or a substituent; one of Za and Zb represents a carbon atom having a hydrogen atom or a substituent, and the other represents a nitrogen atom; the substituent of Za or Zb may further have a substituent; and X represents a hydrogen atom or a group capable of being split-off upon a reaction with an oxidized product of an aromatic primary amine color-developing agent;

Formula (IA)

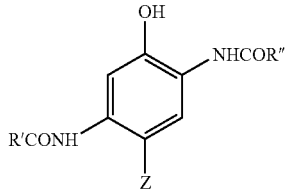

wherein, in formula (IA), R' and R" each independently represent a substituent, and Z represents a hydrogen atom, or a group capable of being split-off in a coupling reaction with an oxidized product of an aromatic primary amine color-developing agent;

(22) The color-image forming method as described in the above item (21), wherein the rinsing process uses a tank structurally partitioned into a plurality of rooms with blade-form members for passing the light-sensitive material cut into sheets through rinse solutions in a horizontal direction;

(23) The color-image forming method as described in the above item (21) or (22), wherein the conveying speed in the photographic processing is from 45.0 mm/sec to 95 mm/sec;

(24) The color-image forming method as described in any of the above items (21) to (23), wherein the dye-forming coupler represented by the formula (M-1) is a dye-forming coupler represented by the following formula (M-III);

Formula (M-III)

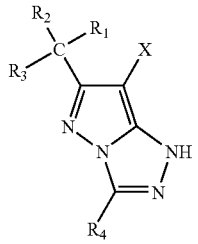

wherein, in formula (M-III), $R_1$, $R_2$, $R_3$ and $R_4$ represent a hydrogen atom or a substituent; and X represents a hydrogen atom or a group capable of being split-off upon a reaction with an oxidized product of an aromatic primary amine color-developing agent;

(25) The color-image forming method as described in any one of the above items (21) to (24), wherein the hydrophilic colloid layer is a layer made up of gelatin hardened substantially with a hardener represented by the following formula (HI);

$$X^{a1}—SO_2\text{-}L\text{-}SO_2—X^{a2}$$ Formula (HI)

wherein, in formula (HI), $X^{a1}$ and $X^{a2}$ each represent —CH═$CH_2$ or —$CH_2CH_2Y$ independently; $X^{a1}$ and $X^{a2}$ may be the same or different; Y represents a group capable of being replaced with a nucleophilic group or released in the form of HY by reaction with a base; and L represents a divalent linkage group, which may be substituted;

(26) The color-image forming method as described in the above item (25), wherein the silver halide color photographic light-sensitive material is substantially free of a chlorotriazine-series hardener and has a gelatin layer hardened substantially with a hardener represented by the formula (HI);

(27) A silver halide color photographic light-sensitive material, comprising at least one dye-forming coupler represented by formula (M-1) described above and at least one dye-forming coupler represented by formula (IA) described above; and which forms a color image by image-wise exposure and by photographic processing including a color development process finished within 18 seconds, a bleach-fix process finished within 18 seconds, a rinsing process, and a drying process finished within 26 seconds, while it is conveyed in cut sheet form at a speed of 40.0 mm/sec to 100 mm/sec by means of conveying rollers;

(28) The silver halide color photographic light-sensitive material as described in the above item (27), which undergoes the rinsing process by passing in a horizontal direction through rinse solutions in a tank structurally partitioned into a plurality of rooms with blade-form members;

(29) The silver halide color photographic light-sensitive material as described in the above item (27) or (28), wherein the conveying speed in the photographic processing is from 45.0 mm/sec to 95 mm/sec;

(30) The silver halide color photographic light-sensitive material as described in any one of the above items (27) to (29), wherein the dye-forming coupler represented by the formula (M-1) is a dye-forming coupler represented by formula (M-III) described above;

(31) The silver halide color photographic light-sensitive material as described in any one of the above items (27) to (30), wherein the hydrophilic colloid layer is a layer made up of gelatin hardened substantially with a hardener represented by formula (HI) described above;

(32) The silver halide color photographic light-sensitive material as described in any one of the above items (27) to (31), which is substantially free of a chlorotriazine hardener and includes gelatin hardened substantially with a hardener represented by formula (HI) described above;

(Hereinafter, a second embodiment of the present invention means to include the image-forming methods described in the items (21) to (26) above, and the silver halide color photographic light-sensitive materials described in the items (27) to (32) above.)

(33) A color-image forming method in a silver halide color photographic light-sensitive material comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler and at least one light-insensitive hydrophilic colloid layer, which comprises the steps of:

performing image-wise exposure of the light-sensitive material cut into sheets; and subjecting the exposed light-sensitive material sheets to photographic processing including a color development process, a bleach-fix process and a rinsing process, while conveying the exposed light-sensitive material sheets by means of pairs of conveying rollers;

wherein the light-sensitive material cut into sheets is conveyed at a speed of 42.0 mm/sec to 100 mm/sec in the photographic processing;

wherein the rinsing process uses a tank structurally partitioned into a plurality of rooms with blade-form members for passing the photographic material cut into sheets through rinse solutions in a horizontal direction; and wherein the silver halide color photographic light-sensitive material to be exposed contains at least one dye-forming coupler represented by the following formula (IA) in at least one of the red-sensitive emulsion layers;

Formula (IA)

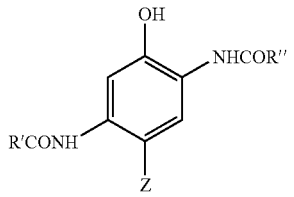

wherein, in formula (IA), R' and R" each independently represent a substituent, and Z represents a hydrogen atom, or a group capable of being split-off in a coupling reaction with an oxidized product of an aromatic primary amine color-developing agent;

(34) The color-image forming method as described in the above item (33), wherein the image-wise exposure is performed using a scanning exposure method on a per-pixel exposure time setting of $1\times10^{-3}$ second or shorter;

(35) The color-image forming method as described in the above item (33) or (34), wherein a total coating amount of silver in the silver halide color photographic light-sensitive material is 0.50 g/m$^2$ or below;

(36) The color-image forming method as described in any of the above items (33) to (35), wherein the silver halide color photographic light-sensitive material contains at least one compound represented by the following formula (M-II) in at least one green-sensitive silver halide emulsion layer;

Formula (M-II)

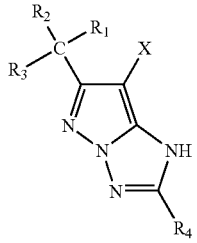

wherein, in formula (M-II), $R_1$, $R_2$, $R_3$ and $R_4$ each independently represent a hydrogen atom or a substituent; and X represents a hydrogen atom, or a group capable of being split-off in a coupling reaction with an oxidized product of an aromatic primary amine color-developing agent;

(37) The color-image forming method as described in any of the above items (33) to (36), wherein a processing time in the rinsing process is from 5 seconds to 25 seconds and a processing temperature in the rinsing process is from 40° C. to 50° C.;

(38) A silver halide color photographic light-sensitive material, to form a color image by image-wise exposure, and by photographic processing including a color development process, a bleach-fix process and a rinsing process using a tank structurally partitioned into a plurality of rooms with blade-form members for passing the photographic material cut into sheets through rinse solutions in a horizontal direction, while conveying the light-sensitive material cut into sheets at a speed of 42.0 mm/sec to 100 mm/sec by means of pairs of conveying rollers;

wherein the light-sensitive material to be exposed has photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler and at least one light-insensitive hydrophilic colloid layer, and further contains at least one compound represented by formula (IA) described above in at least one of the cyan-dye-forming coupler-containing red-sensitive silver halide emulsion layers;

(39) The silver halide color photographic light-sensitive material as described in the above item (38), which is subjected to image-wise exposure using a scanning exposure method on a per-pixel exposure time setting of $1\times10^{-3}$ second or shorter;

(40) The silver halide color photographic material as described in the above item (38) or (39), wherein a total coating amount of silver in the silver halide color photographic light-sensitive material is 0.50 g/m$^2$ or below;

(41) The silver halide color photographic material as described in any one of the above items (38) to (40), which contains at least one compound represented by formula (M-II) described above in at least one green-sensitive silver halide emulsion layer;

(42) The silver halide color photographic material as described in any one of the above items (38) to (41), wherein a processing time in the rinsing process is from 5 seconds to 25 seconds and a processing temperature in the rinsing process is from 40° C. to 50° C.;

(Hereinafter, a second embodiment of the present invention means to include the image-forming methods described in the items (33) to (37) above, and the silver halide color photographic light-sensitive materials described in the items (38) to (42) above.)

(43) A color-image forming method in a silver halide color photographic light-sensitive material comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler, at least one light-insensitive hydrophilic colloid layer and a compound represented by the following formula (I) in at least one of the photographic constituent layers, Formula (I)

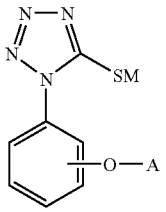

wherein, in formula (I), A represents a substituted or unsubstituted alkyl group, and M represents a cation;

which comprises the step of:

performing image-wise exposure of the light-sensitive material cut into sheets; and subjecting the exposed light-sensitive material sheets to photographic processing including a color development process, a bleach-fix process and a rinsing process;

wherein the silver halide color photographic light-sensitive material is processed by use of a processing machine in which conveying of the silver halide color photographic material is performed by nipping conveying with two or more pairs of conveying rollers at a conveying speed of 40.0 mm/sec to 100 mm/sec throughout the color-development process and subsequent processed;

(44) A color-image forming method in a silver halide color photographic light-sensitive material comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler, at least one light-insensitive hydrophilic colloid layer and contains a compound represented by the following formula (II) in an amount of 1.4 g/m$^2$ or greater in at least one of the photographic constituent layers, Formula (II)

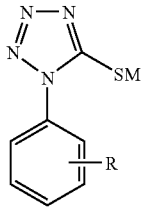

wherein, in formula (II), M represents a cation; and R represents an atom having an atomic weight of 100 or lower, or a group having a total molecular weight of 100 or lower;

which comprises the steps of:

performing image-wise exposure of the light-sensitive material cut into sheets; and subjecting the exposed light-sensitive material sheets to color photographic processing including a color development process, a bleach-fix process and a rinsing process by use of a processing machine in which conveying of the silver halide color photographic light-sensitive material is performed by nipping conveying with two or more pairs of conveying rollers at a conveying speed of 40.0 mm/sec to 100 mm/sec throughout the color-development process and subsequent processed;

(45) The color-image forming method as described in the above item (43) or (44), wherein the image-wise exposure is performed using a scanning exposure method on a per-pixel exposure time setting of $1\times10^{-4}$ second or shorter;

(46) The color-image forming method as described in any one of the above items (43) to (45), wherein the color-development process is performed at a processing time setting of 20 seconds or below;

(47) The color-image forming method as described in any one of the above items (43), (45) and (46), wherein the compound represented by the formula (I) is contained in an amount of 0.3 mg/m$^2$ or greater;

(48) The color-image forming method as described in any one of the above items (44) to (47), wherein the compound represented by the formula (II) is contained in an amount of 1.5 mg/m$^2$ or greater;

(49) A silver halide color photographic light-sensitive material, comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler, at least one light-insensitive hydrophilic colloid layer and a compound represented by formula (I) described above in at least one of the photographic constituent layers;

wherein the silver halide color photographic light-sensitive material is subjected to a cut-into-sheets operation, image-wise exposure and color photographic processing including a color development process, a bleach-fix process and a rinsing process; and wherein the silver halide color photographic light-sensitive material is processed by use of a processing machine in which conveying of the silver halide color photographic light-sensitive material is performed by nipping conveying with two or more pairs of conveying rollers at a conveying speed of 40.0 mm/sec to 100 mm/sec throughout the color-development process and the remainder of the photographic processing;

(50) A silver halide color photographic light-sensitive material, comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler, at least one light-insensitive hydrophilic colloid layer and a compound represented by formula (II) described above in an amount of 1.4 g/m$^2$ or greater in at least one of the photographic constituent layers;

wherein the silver halide color photographic light-sensitive material is subjected to a cut-into-sheets operation, image-wise exposure and color photographic processing including a color development process, a bleach-fix process and a rinsing process by use of a processing machine in which conveying of the silver halide color photographic material is performed by nipping conveying with two or more pairs of conveying rollers at a conveying speed of 40.0 mm/sec to 100 mm/sec throughout the color-development process and the remainder of the photographic processing;

(Hereinafter, a second embodiment of the present invention means to include the image-forming methods described in the items (43) to (48) above, and the silver halide color photographic light-sensitive materials described in the items (49) and (50) above.)

(51) A color-image forming method in a silver halide color photographic light-sensitive material comprising a support and photographic constituent layers including at least one blue-sensitive silver halide emulsion layer containing a yellow-dye-forming coupler, at least one green-sensitive silver halide emulsion layer containing a magenta-dye-forming coupler and at least one red-sensitive silver halide emulsion layer containing a cyan-dye-forming coupler, comprising the steps of:

subjecting the light-sensitive material to a scanning exposure at a sub-scan conveying speed of 90 mm/sec or more; and conducting a color-forming photographic processing;

wherein at least one of the silver halide emulsion layers to be exposed contains a silver halide emulsion having a silver chloride content of at least 90 mol %; and wherein any of the following conditions a) to e) is satisfied:

a) the silver halide emulsion further has a silver bromide content of 0.1 to 4 mol %, and a silver bromide-containing phase is formed in layer form, or the emulsion has a region ranging in silver bromide content from 0.5 to 20 mol % at a depth of 20 nm or less below the emulsion grain surface;

b) the silver halide emulsion further has a silver iodide content of 0.02 to 1 mol %, and a silver iodide-containing phase is formed in layer form, or the emulsion has a region ranging in silver iodide content from 0.3 to 10 mol % at a depth of 20 nm or less below the emulsion grain surface;

c) the silver halide emulsion further has a hexacoordinate complex containing iridium as a central metal and having at least two different kinds of coordinate ligands;

d) the silver halide emulsion is further spectrally sensitized with at least one dye represented by the following formula (SI);

Formula (SI)

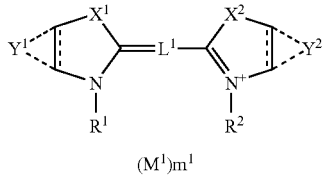

wherein, in formula (SI), $X^1$ and $X^2$ each represents an oxygen atom, a sulfur atom, a selenium atom, a tellurium atom, a nitrogen atom or a carbon atom;

$Y^1$ represents a group of atoms necessary for forming a furan, pyrrole, thiophene ring or benzene ring which may be condensed with another 5- or 6-membered carbon ring or heterocycle or may have a substituent group; $Y^2$ represents a group of atoms necessary for forming a benzene ring or a 5- or 6-membered unsaturated heterocycle, which may be further condensed with another 5- or 6-membered carbon ring or heterocycle or may have a substituent group; a bond between two carbon atoms by which $Y^1$ and $Y^2$ are each condensed with the carbon ring or the heterocycle may be a single bond or a double bond; one of $R^1$ and $R^2$ is an alkyl group substituted by an acid group other than a sulfo group, and the other is an alkyl group substituted by a sulfo group; $L^1$ represents a methine group; $M^1$ represents a counter ion; and $m^1$ represents a number of 0 or more necessary for neutralizing a charge in a molecule; and e) the silver halide emulsion further has at least one inorganic sulfur or at least one compound represented by following formula (Z);

$$R^{41}—S—S—R^{42}$$ Formula (Z)

wherein, in formula (Z), $R^{41}$ and $R^{42}$ each represent an aliphatic group or an aromatic group independently, or combine with each other to form a ring;

(52) The color-image forming method as described in the above item (51), wherein the scanning exposure is carried out at a raster interval of 500 μsec or below;

(53) The color-image forming method as described in the above item (51) or (52), wherein the color development starts within 12 seconds after completion of the scanning exposure;

(54) A silver halide color photographic light-sensitive material, comprising a support and photographic constituent layers including at least one blue-sensitive silver halide emulsion layer containing a yellow-dye-forming coupler, at least one green-sensitive silver halide emulsion layer containing a magenta-dye-forming coupler and at least one red-sensitive silver halide emulsion layer containing a cyan-dye-forming coupler;

wherein the light-sensitive material is subjected to a scanning exposure at a sub-scan conveying speed of 90 mm/sec or more, and then a color-forming photographic processing, to form a color image;

wherein at least one of the silver halide emulsion layers to be exposed contains a silver halide emulsion having a silver chloride content of at least 90 mol %; and wherein any of the following conditions a) to e) is satisfied:

a) the silver halide emulsion further has a silver bromide content of 0.1 to 4 mol %, and a silver bromide-containing phase is formed in layer form, or the emulsion has a region ranging in silver bromide content from 0.5 to 20 mol % at a depth of 20 nm or less below the emulsion grain surface;

b) the silver halide emulsion further has a silver iodide content of 0.02 to 1 mol %, and a silver iodide-containing phase is formed in layer form, or the emulsion has a region ranging in silver iodide content from 0.3 to 10 mol % at a depth of 20 nm or less below the emulsion grain surface;

c) the silver halide emulsion further has a hexacoordinate complex containing iridium as a central metal and having at least two different kinds of coordinate ligands;

d) the silver halide emulsion is further spectrally sensitized with at least one dye represented by formula (SI) described above; and e) the silver halide emulsion further has at least one inorganic sulfur or at least one compound represented by formula (Z) described above;

(55) The silver halide color photographic light-sensitive material as described in the above item (54), wherein the scanning exposure is carried out at a raster interval of 500 μsec or below;

(56) The silver halide color photographic light-sensitive material as described in the above item (54) or (55), wherein the color development starts within 12 seconds after completion of the scanning exposure;

(Hereinafter, a first embodiment of the present invention means to include the image-forming methods described in the items (51) to (53) above, and the silver halide color photographic light-sensitive materials described in the items (54) to (56) above.)

(57) The color-image forming method as described in any one of the above items (51) to (53), wherein the support is a reflective support;

wherein the scanning exposure is carried out at a raster interval of 500 μsec or below; and wherein the color development starts within 12 seconds after completion of the scanning exposure;

(58) A color-image forming method in a silver halide color photographic light-sensitive material, comprising, on a reflective support, at least one blue-sensitive silver halide emulsion layer containing an yellow-dye-forming coupler, at least one green-sensitive silver halide emulsion layer containing a magenta-dye-forming coupler and at least one red-sensitive silver halide emulsion layer containing a cyan-dye-forming coupler, which comprises the steps of:

subjecting the color photographic light-sensitive material to color-development processing after scanning exposure;

wherein at least one of the silver halide emulsion layers to be exposed contains a silver halide emulsion having a silver chloride content of at least 90 mol % and a silver bromide content of 0.1 to 4 mol %;

wherein the silver halide emulsion is a silver halide emulsion having a silver bromide-containing phase in layer form;

wherein the silver halide color photographic light-sensitive material is subjected to scanning exposure performed at a sub-scan conveying speed of 90 mm/sec or above with a raster interval of 500 μsec or below; and whether the color development starts within 12 seconds after completion of the scanning exposure;

(59) A color-image forming method in a silver halide color photographic light-sensitive material, comprising, on a reflective support, at least one blue-sensitive silver halide emulsion layer containing an yellow-dye-forming coupler, at least one green-sensitive silver halide emulsion layer containing a magenta-dye-forming coupler and at least one red-sensitive silver halide emulsion layer containing a cyan-dye-forming coupler, which comprises the steps of:

subjecting the color photographic light-sensitive material to color-development processing after scanning exposure;

wherein at least one of the silver halide emulsion layers to be exposed contains a silver halide emulsion having a silver chloride content of at least 90 mol % and a silver bromide content of 0.1 to 4 mol %;

wherein the silver halide emulsion is an silver halide emulsion having a region ranging in silver bromide content from 0.5 to 20 mol % at a depth of 20 nm or less below the emulsion grain surface;

wherein the silver halide color photographic light-sensitive material is subjected to scanning exposure performed at a sub-scan conveying speed of 90 mm/sec or above with a raster interval of 500 μsec or below; and whether the color development starts within 12 seconds after completion of the scanning exposure;

(60) A color-image forming method in a silver halide color photographic light-sensitive material, comprising, on a reflective support, at least one blue-sensitive silver halide emulsion layer containing an yellow-dye-forming coupler, at least one green-sensitive silver halide emulsion layer containing a magenta-dye-forming coupler and at least one red-sensitive silver halide emulsion layer containing a cyan-dye-forming coupler, which comprises the steps of:

subjecting the color photographic material to color-development processing after scanning exposure;

wherein at least one of the silver halide emulsion layers to be exposed contains a silver halide emulsion having a silver chloride content of at least 90 mol % and a silver iodide content of 0.02 to 1 mol %;

wherein the silver halide emulsion is a silver halide emulsion having a silver iodide-containing phase in layer form;

wherein the silver halide color photographic light-sensitive material is subjected to scanning exposure performed at a sub-scan conveying speed of 90 mm/sec or above with a raster interval of 500 μsec or below; and whether the color development starts within 12 seconds after completion of the scanning exposure;

(61) A color-image forming method in a silver halide color photographic light-sensitive material, comprising, on a reflective support, at least one blue-sensitive silver halide emulsion layer containing an yellow-dye-forming coupler, at least one green-sensitive silver halide emulsion layer containing a magenta-dye-forming coupler and at least one red-sensitive silver halide emulsion layer containing a cyan-dye-forming coupler, which comprises the steps of:

subjecting the color photographic light-sensitive material to color-development processing after scanning exposure;

wherein at least one of the silver halide emulsion layers to be exposed contains a silver halide emulsion having a silver chloride content of at least 90 mol % and a silver iodide content of 0.02 to 1 mol %;

wherein the silver halide emulsion is an silver halide emulsion having a region ranging in silver iodide content from 0.3 to 10 mol % at a depth of 20 nm or less below the emulsion grain surface;

wherein the silver halide color photographic light-sensitive material is subjected to scanning exposure performed at a sub-scan conveying speed of 90 mm/sec or above with a raster interval of 500 μsec or below; and whether the color development starts within 12 seconds after completion of the scanning exposure;

(62) A color-image forming method in a silver halide color photographic light-sensitive material, comprising, on a reflective support, at least one blue-sensitive silver halide emulsion layer containing an yellow-dye-forming coupler, at least one green-sensitive silver halide emulsion layer containing a magenta-dye-forming coupler and at least one red-sensitive silver halide emulsion layer containing a cyan-dye-forming coupler, which comprises the step of:

subjecting the color photographic light-sensitive material to color-development processing after scanning exposure;

wherein at least one of the silver halide emulsion layers to be exposed contains a silver halide emulsion having a silver chloride content of at least 90 mol % and a hexacoordinate complex containing iridium as a central metal and having at least two different kinds of coordinate ligands;

wherein the silver halide color photographic light-sensitive material is subjected to scanning exposure performed at a sub-scan conveying speed of 90 mm/sec or above with a raster interval of 500 μsec or below; and whether the color development starts within 12 seconds after completion of the scanning exposure;

(63) The color-image forming method as described in the above item (62);

wherein the hexacoordinate complex containing iridium as a central metal has a halogen ligand and an organic ligand;

(64) The color-image forming method as described in the above item (62);

wherein the hexacoordinate complex containing iridium as a central metal has a halogen ligand and another inorganic ligand;

(65) The color-image forming method as described in any one of the above items (54) to (56), wherein the support is a reflective support;

wherein the scanning exposure is carried out at a raster interval of 500 μsec or below; and wherein the color development starts within 12 seconds after completion of the scanning exposure;

(66) A silver halide color photographic light-sensitive material designed for scanning exposure, to form an image by scanning exposure at a sub-scan conveying speed of 90 mm/sec or above with a raster interval of 500 μsec or below and color development starting within 12 seconds after completion of the scanning exposure;

wherein the silver halide color photographic light-sensitive material has, on a reflective support, at least one blue-sensitive silver halide emulsion layer containing an yellow-dye-forming coupler, at least one green-sensitive silver halide emulsion layer containing a magenta-dye-forming coupler and at least one red-sensitive silver halide emulsion layer containing a cyan-dye-forming coupler;

wherein at least one of the silver halide emulsion layers to be exposed contains a silver halide emulsion having a silver chloride content of at least 90 mol % and a silver bromide content of 0.1 to 4 mol %; and wherein the silver halide emulsion is a silver halide emulsion having a silver bromide-containing phase in layer form;

(67) A silver halide color photographic light-sensitive material designed for scanning exposure, to form an image by scanning exposure at a sub-scan conveying speed of 90 mm/sec or above with a raster interval of 500 μsec or below and color development starting within 12 seconds after completion of the scanning exposure;

wherein the silver halide color photographic light-sensitive material has, on a reflective support, at least one blue-sensitive silver halide emulsion layer containing an yellow-dye-forming coupler, at least one green-sensitive silver halide emulsion layer containing a magenta-dye-forming coupler and at least one red-sensitive silver halide emulsion layer containing a cyan-dye-forming coupler;

wherein at least one of the silver halide emulsion layers to be exposed contains a silver halide emulsion having a silver chloride content of at least 90 mol % and a silver bromide content of 0.1 to 4 mol %; and wherein the silver halide emulsion is an silver halide emulsion having a region ranging in silver bromide content from 0.5 to 20 mol % at a depth of 20 nm or less below the emulsion grain surface;

(68) A silver halide color photographic light-sensitive material designed for scanning exposure, to form an image by scanning exposure at a sub-scan conveying speed of 90 mm/sec or above with a raster interval of 500 μsec or below and color development starting within 12 seconds after completion of the scanning exposure;

wherein the silver halide color photographic light-sensitive material has, on a reflective support, at least one blue-sensitive silver halide emulsion layer containing an yellow-dye-forming coupler, at least one green-sensitive silver halide emulsion layer containing a magenta-dye-forming coupler and at least one red-sensitive silver halide emulsion layer containing a cyan-dye-forming coupler;

wherein at least one of the silver halide emulsion layers to be exposed contains a silver halide emulsion having a silver chloride content of at least 90 mol % and a silver iodide content of 0.02 to 1 mol %; and wherein the silver halide emulsion is a silver halide emulsion having a silver iodide-containing phase in layer form;

(69) A silver halide color photographic light-sensitive material designed for scanning exposure, to form an image by scanning exposure at a sub-scan conveying speed of 90 mm/sec or above with a raster interval of 500 μsec or below and color development starting within 12 seconds after completion of the scanning exposure;

wherein the silver halide color photographic light-sensitive material has, on a reflective support, at least one blue-sensitive silver halide emulsion layer containing an yellow-dye-forming coupler, at least one green-sensitive silver halide emulsion layer containing a magenta-dye-forming coupler and at least one red-sensitive silver halide emulsion layer containing a cyan-dye-forming coupler;

wherein at least one of the silver halide emulsion layers to be exposed contains a silver halide emulsion having a silver chloride content of at least 90 mol % and a silver iodide content of 0.02 to 1 mol %; and wherein the silver halide emulsion is an silver halide emulsion having a region ranging in silver iodide content from 0.3 to 10 mol % at a depth of 20 nm or less below the emulsion grain surface;

(70) A silver halide color photographic light-sensitive material designed for scanning exposure, to form an image by scanning exposure at a sub-scan conveying speed of 90 mm/sec or above with a raster interval of 500 μsec or below and color development starting within 12 seconds after completion of the scanning exposure;

wherein the silver halide color photographic light-sensitive material has, on a reflective support, at least one blue-sensitive silver halide emulsion layer containing an yellow-dye-forming coupler, at least one green-sensitive silver halide emulsion layer containing a magenta-dye-forming coupler and at least one red-sensitive silver halide emulsion layer containing a cyan-dye-forming coupler;

wherein at least one of the silver halide emulsion layers to be exposed contains a silver halide emulsion having a silver chloride content of at least 90 mol % and containing a hexacoordinate complex containing iridium as a central atom and having at least two different kinds of coordinate ligands;

(71) The silver halide color photographic light-sensitive material as described in the above item (70);

wherein the hexacoordinate complex containing iridium as a central metal has a halogen ligand and an organic ligand;

(72) The silver halide color photographic light-sensitive material as described in the above item (70);

wherein the hexacoordinate complex containing iridium as a central metal has a halogen ligand and another inorganic ligand;

(Hereinafter, a sixth embodiment of the present invention means to include the image-forming methods described in the items (57) to (64) above, and the silver halide color photographic light-sensitive materials described in the items (65) to (72) above.)

(73) The color-image forming method as described in any one of the above item (51);

wherein the scanning light-exposure is carried out during conveying in a horizontal direction such that the silver halide color photographic light-sensitive material is conveyed by means of pairs of conveying rollers comprising hard rollers for image exposure; and wherein the silver halide emulsion is contained in the blue-sensitive silver halide emulsion layer;

(74) A color-image forming method in a silver halide color photographic light-sensitive material, comprising, on a support, at least one blue-sensitive silver halide emulsion layer containing a yellow-dye-forming coupler, at least one green-sensitive silver halide emulsion layer containing a magenta-dye-forming coupler and at least one red-sensitive silver halide emulsion layer containing a cyan-dye-forming coupler, which comprises the steps of:

starting color development after scanning exposure as it is conveyed by means of a pair of conveying rollers for image exposure;

wherein the scanning exposure is carried out during conveying in a horizontal direction under a condition that a conveying speed for sub-scanning is at least 90 mm/sec;

wherein hard rollers are used as conveying rollers for the image exposure; and wherein a silver halide emulsion contained to be exposed in the blue-sensitive emulsion layer has a silver chloride content of at least 90 mol % and is spectrally sensitized with at least one dye represented by the following formula (SI);

Formula (SI)

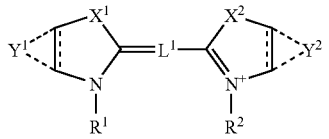

$(M^1)m^1$ wherein, in formula (SI), $X^1$ and $X^2$ each represents an oxygen atom, a sulfur atom, a selenium atom, a tellurium atom, a nitrogen atom or a carbon atom; $Y^1$ represents a group of atoms necessary for forming a furan, pyrrole, thiophene ring or benzene ring which may be condensed with another 5- or 6-membered carbon ring or heterocycle or may have a substituent group; $Y^2$ represents a group of atoms necessary for forming a benzene ring or a 5- or 6-membered unsaturated heterocycle, which may be further condensed with another 5- or 6-membered carbon ring or heterocycle or may have a substituent group; a bond between two carbon atoms by which $Y^1$ and $Y^2$ are each condensed with the carbon ring or the heterocycle may be a single bond or a double bond; one of $R^1$ and $R^2$ is an alkyl group substituted by an acid group other than a sulfo group, and the other is an alkyl group substituted by a sulfo group; $L^1$ represents a methine group; $M^1$ represents a counter ion; and $m^1$ represents a number of 0 or more necessary for neutralizing a charge in a molecule;

(75) The color-image forming method according to the above item (74), wherein the dye represented by the formula (SI) is a dye represented by following formula (SII) or (SIII);

Formula (SII)

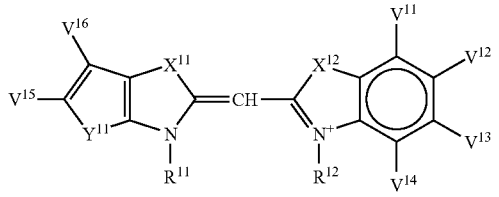

$(M^{11})m^{11}$ wherein, in formula (SII), $Y^{11}$ represents an oxygen atom, a sulfur atom or N—$R^{13}$; $R^{13}$ represents a hydrogen atom or an alkyl group; $V^{15}$ and $V^{16}$ each represents a hydrogen atom or a monovalent substituent group; $X^{11}$ and $X^{12}$ each represents an oxygen atom or a sulfur atom; one of $R^{11}$ and $R^{12}$ is an alkyl group substituted by an acid group other than a sulfo group, and the other is an alkyl group substituted by a sulfo group; $V^{11}$, $V^{12}$, $V^{13}$ and $V^{14}$ each represents a hydrogen atom or a monovalent substituent group; $M^{11}$ represents a counter ion; and $m^{11}$ represents a number of 0 or more necessary for neutralizing a charge in a molecule;

Formula (SIII)

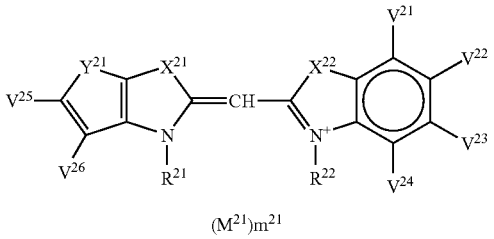

$(M^{21})m^{21}$ wherein, in formula (SIII), $Y^{21}$ represents an oxygen atom, a sulfur atom or N—$R^{23}$, in which $R^{23}$ represents a hydrogen atom or an alkyl group; $V^{25}$ and $V^{26}$ each represents a hydrogen atom or a monovalent substituent group; $X^{21}$ and $X^{22}$ each represents an oxygen atom or a sulfur atom; one of $R^{21}$ and $R^{22}$ is an alkyl group substituted by an acid group other than a sulfo group, and the other is an alkyl group substituted by a sulfo group; $V^{21}$, $V^{22}$, $V^{23}$ and $V^{24}$ each represents a hydrogen atom or a monovalent substituent group; $M^{21}$ represents a counter ion; and $m^{21}$ represents a number of 0 or more necessary for neutralizing a charge in a molecule;

(76) The color-image forming method according to the above item (74), wherein the dye represented by the formula (SI) is a dye represented by following formula (SIV);

Formula (SIV)

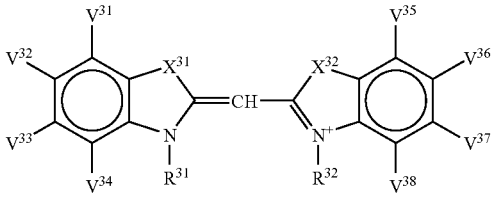

$(M^{31})m^{31}$ wherein, in formula (SIV), $X^{31}$ and $X^{32}$ each represents an oxygen atom or a sulfur atom; one of $R^{31}$ and $R^{32}$ is an alkyl group substituted by an acid group other than a sulfo group, and the other is an alkyl group substituted by a sulfo group; $V^{31}$, $V^{32}$, $V^{33}$, $V^{34}$, $V^{35}$, $V^{36}$, $V^{37}$ and $V^{38}$ each represents a hydrogen atom or a monovalent substituent group, in which two adjacent substituent groups of $V^{31}$, $V^{32}$, $V^{33}$, $V^{34}$, $V^{35}$, $V^{36}$, $V^{37}$ and $V^{38}$ may combine with each other to form a saturated or unsaturated condensed ring; $M^{31}$ represents a counter ion; and $m^{31}$ represents a number of 0 or more necessary for neutralizing a charge in a molecule;

(77) A color-image forming method in a silver halide color photographic light-sensitive material, comprising, on a support, at least one blue-sensitive silver halide emulsion layer containing a yellow-dye-forming coupler, at least one green-sensitive silver halide emulsion layer containing a magenta-dye-forming coupler and at least one red-sensitive silver halide emulsion layer containing a cyan-dye-forming coupler, which comprises the steps of:

starting color development after scanning exposure as it is conveyed by means of a pair of conveying rollers for image exposure;

wherein the scanning exposure is carried out during conveying in a horizontal direction under a condition that a conveying speed for sub-scanning is at least 90 mm/sec;

wherein hard rollers are used as conveying rollers for the image exposure; and wherein a silver halide emulsion contained to be exposed in the blue-sensitive emulsion layer has a silver chloride content of at least 90 mol % and contains at least one inorganic sulfur or at least one compound represented by the following formula (Z);

$R^{41}$—S—S—$R^{42}$ Formula (Z)

wherein, in formula (Z), $R^{41}$ and $R^{42}$ each represent an aliphatic group or an aromatic group independently, or combine with each other to form a ring;

(78) The color-image forming method as described in any of the above items (73) to (77);

wherein the hard rollers are rollers formed by providing metal shafts with urethane coatings containing resin beads;

(79) The silver halide color photographic light-sensitive material as described in any one of the above item (54);

wherein the scanning light-exposure is carried out during conveying in a horizontal direction such that the silver halide color photographic light-sensitive material is conveyed by means of pairs of conveying rollers comprising hard rollers for image exposure; and wherein the silver halide emulsion is contained in the blue-sensitive silver halide emulsion layer;

(80) A silver halide color photographic light-sensitive material for scanning exposure use, that is subjected to color development after scanning exposure as it is conveyed in a horizontal direction under a condition that hard rollers are used as conveying rollers for image exposure and a conveying speed for sub-scanning is at least 90 mm/sec;

wherein the silver halide color photographic light-sensitive material has, on a support, at least one blue-sensitive silver halide emulsion layer containing a yellow-dye-forming coupler, at least one green-sensitive silver halide emulsion layer containing a magenta-dye-forming coupler and at least one red-sensitive silver halide emulsion layer containing a cyan-dye-forming coupler; and wherein the blue-sensitive silver halide emulsion layer to be exposed includes silver halide grains having a silver chloride content of at least 90 % by mole and being spectrally sensitized with at least one dye represented by formula (SI) described above;

(81) The silver halide color photographic light-sensitive material according to the above item (80), wherein the dye represented by formula (SI) is a dye represented by formula (SII) or (SIII) described above:

(82) The silver halide color photographic light-sensitive material according to the above item (80), wherein the dye represented by formula (SI) is a dye represented by formula (SIV) described above:

(83) A silver halide color photographic light-sensitive material for scanning exposure use, that is subjected to color development after scanning exposure as it is conveyed in a horizontal direction under a condition that hard rollers are used as conveying rollers for image exposure and a conveying speed for sub-scanning is at least 90 mm/sec;

wherein the silver halide color photographic light-sensitive material has, on a support, at least one blue-sensitive silver halide emulsion layer containing a yellow-dye-forming coupler, at least one green-sensitive silver halide emulsion layer containing a magenta-dye-forming coupler and at least one red-sensitive silver halide emulsion layer containing a cyan-dye-forming coupler; and wherein the blue-sensitive silver halide emulsion layer to be exposed includes silver halide grains having a silver chloride content of at least 90 % by mole and containing at least one inorganic sulfur or at least one compound represented by formula (Z) described above; and

(84) The silver halide color photographic light-sensitive material as described in any of the above items (79) to (83), wherein the hard rollers are rollers formed by providing metal shafts with urethane coatings containing resin beads.

(Hereinafter, a seventh embodiment of the present invention means to include the image-forming methods described in the items (73) to (78) above, and the silver halide color photographic light-sensitive materials described in the items (79) to (84) above.)

Herein, the present invention means to include all of the above first, second, third, forth, fifth, sixth and seventh embodiments, unless otherwise specified.

The present invention is described below in more detail.

In accordance with the image-forming method and the color photographic light-sensitive material of the present invention, a silver halide color photographic light-sensitive material is preferably subjected to photographic processing while being conveyed by means of pairs of conveyor rollers after it undergoes cutting into sheets and image-wise exposure, thereby forming images.

The exposure step may be done before or after the cutting step, or the photographic material may be cut into sheet as it undergoes exposure. In the present invention, it is preferable to carry out the cutting step before the exposure step.

Besides being used in a printing system utilizing a usual negative printer, the silver halide color photographic light-sensitive material of the present invention is also suitable for scanning exposure methods using cathode-ray tubes (CRTs) and laser beams. In the latter methods, image-wise exposure is performed on the basis of image information. The light-sensitive material of the present invention can be preferably used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources would be a semiconductor laser.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of nonlinear optical crystal with a semiconductor laser or a solid state laser using a semiconductor as an excitation light source, blue light and green light can be obtained. Accordingly, it is possible to have the spectral sensitivity maximum of a light-sensitive material in normal three wavelength regions of blue, green and red. In the present invention, preferably in the second or third embodiments of the present invention, the exposure time in such a scanning exposure is defined as the time necessary to expose the size of the picture element with the density of the picture element being 400 dpi, and preferred exposure time is $1\times10^{-3}$ sec or less, more preferably $1\times10^{-4}$ sec or less, and further preferably $1\times10^{-6}$ sec or less. In the present invention, preferably in the forth, sixth or seventh embodiments of the present invention, the exposure time in such a scanning exposure is defined as the time necessary to expose the size of the picture element with the density of the picture element being 300 dpi, and preferred exposure time is $1\times10^{-4}$ sec or less, and further preferably $1\times10^{-6}$ sec or less. The effects of the present invention tends to be more easily exhibited, under the conditions where reciprocity law failure occurs at the time of high illuminance exposure and where silver development in a shadow portion is difficult to occur. However, at low illuminance exposure, similar effects can be obtained.

Examples of the semiconductor laser include blue semiconductor laser having a wavelength of 430 to 450 nm (Presentation by Nichia Corporation at the 48th Applied Physics Related Joint Meeting, in March, 2001), a blue laser at about 470 nm obtained by wavelength modulation of a semiconductor laser (oscillation wavelength about 940 nm) with a SHG crystal of $LiNbO_3$ having a reversed domain structure in the form of a wave guide, a green laser at about 530 nm obtained by wavelength modulation of a semiconductor laser (oscillation wavelength about 1,060 nm) with a SHG crystal of $LiNbO_3$ having a reversed domain structure in the form of a wave guide, a red semiconductor laser having a wavelength of about 685 nm (Type No. HL6738MG (trade name), manufactured by Hitachi, Ltd.), a red semiconductor laser having a wavelength of about 650 nm (Type No. HL6501MG (trade name), manufactured by Hitachi, Ltd.), and the like.

It is preferred that the silver halide color photographic light-sensitive material of the present invention is imagewise exposed to coherent light from a blue laser having an emission wavelength of 420 nm to 460 nm, preferably 430 nm to 460 nm. Among the blue lasers, it is particularly preferable to use a blue semiconductor laser.

Exposure to light may be performed in plural times to the same photosensitive layer (emulsion layer). In this case, it is preferred that the exposure is performed at least two times. Particularly preferably, an exposure time is $1\times10^{-4}$ to $1\times10^{-8}$ second. In the case where the exposure time is $1\times10^{-5}$ to $1\times10^{-8}$ second, it is preferred that the exposure be performed at least eight times. As a light source, any light source may be used. For example, a gas laser, a solid laser (LD), a LED (organic or inorganic), a Xe light source with a restricted spot. In particular, a solid laser and LED are preferred. The light source must be spectrally separated to color-sensitive wavelength of each dye-forming layer. For this purpose, a suitable color filter (which contains or is deposited with a dye) is used or the oscillation wavelength of LD or LED may be selected.

Further, both of these may be used in combination. The spot diameter of the light source is not particularly limited and is preferably 5 to 250 μm, and particularly preferably 10 to 100 μm, in terms of a half width value of light intensity. The shape of the spot may be any of a circle, an ellipse, or a rectangle. The distribution of the quantity of light of one spot may be of a Gaussian distribution. In particular, the light source may either consist of one or an array of plural light sources.

In the present invention, preferably, exposure to light is performed by scanning exposure. The light source may be scanned, or the light-sensitive material may be scanned. Also, both may be scanned.

The exposure time for a single run is defined by the following equation.

Exposure time=Spot diameter/Moving speed of light source (or Moving speed of light-sensitive material)

Here, the spot diameter refers to the diameter of a spot (the width that intensity becomes more than 13.5% for peak intensity in case of Gaussian beam, unit: μm) in the direction in which the light source used in scanning exposure moves at the time of exposure. Further, the moving speed of light source refers to the speed (unit: μm/second) at which the light source used for scanning exposure moves per unit time.

Generally, the spot diameter does not have to be the same as the diameter of the pixel, and may be either greater or smaller than that. The number of times of exposure as used herein refers to the number of times of irradiation of light is sensed by the same color-sensitive layer at a single point (pixel) of the light-sensitive material. In the case where irradiation is performed in plural times, it refers to the number of times of exposure performed at an intensity ⅕ time or more of the maximum intensity of light to which the material is exposed. Therefore, exposure performed at an intensity below ⅕ time of the maximum intensity of light, stray light, or overlap between the spots, are not counted into the number of times.

The exposure is not limited to the scanning exposure methods using those light sources, but it can also be performed according to the exposure method adopted in a print system using a usual negative printer or the scanning exposure method using a cathode-ray tube (CRT). The cathode ray tube exposure apparatus is simpler and more compact, and therefore less expensive than an apparatus using a laser. Further, optical axis and color can easily be adjusted. In a cathode ray tube which is used for image-wise exposure, various light-emitting materials which emit a light in the spectral region, are used if necessary. For example, any one of red-light-emitting materials, green-light-emitting materials and blue-light-emitting materials, or a mixture of two or more of these light-emitting materials may be used.

In the case where the light-sensitive material has a plurality of light-sensitive layers each having different spectral sensitivity distribution from each other and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface successive exposure, may be used. Generally, among these methods, the surface successive exposure is preferred, from the viewpoint of high-image quality enhancement, because a cathode ray tube having a high resolving power can be used.

In the next place, color photographic processing is described.

The color photographic processing applied to the present light-sensitive material and the present image formation method includes at least a color-development process, a bleach-fix process, a rinsing process and a drying process. In general the light-sensitive material undergoes these processes in the order of the above description. The term "rinsing process" as used in the present invention is intended to include a washing process or a stabilizing process (also referred to as a stabilizing bath alternative to washing or a stabilizing bath for image stabilization).

Further, auxiliary processes, such as a rinsing process, an intermediate washing process and a neutralizing process, may be inserted between two successive processes in the color photographic processing. A bleach-fix bath is used for desilvering, and the desilvering process in the present invention is performed in one-step process using a bleach-fix bath. In addition, it is possible to provide an image-stabilizing bath for the purpose of image stabilization in addition to a stabilizing bath alternative to washing bath in place of a washing process between the washing or the stabilizing process and the drying process.

In the present invention, preferably in the second embodiment of the present invention, the color developer time (that is, time for conducting color-development process) is, preferably, 18 seconds or less, more preferably, 18 seconds or less and 6 seconds or more, and, most preferably, 18 seconds or less and 12 seconds or more. In the same manner, the bleach-fix time (that is, the time for conducting the bleach-fix process) is, preferably, 18 seconds or less, more preferably, 18 seconds or less and 6 seconds or more; and most preferably, 18 seconds or less and 12 seconds or more. Further, the rinsing (water washing or stabilizing) time (that is, time for conducting rinsing process) is, preferably, 30 seconds or less (more preferably, 30 seconds or less and 6 seconds or more), more preferably, 25 seconds or less (more preferably, 25 seconds or less and 6 seconds or more), and further preferably, 25 seconds or less and 12 seconds or more. The drying process is preferably, 26 seconds or less (more preferably, 26 seconds or less and 6 seconds or more), and further preferably, 26 seconds or less and 8 seconds or more.

In the present invention, preferably in the third embodiment of the present invention, color developer time is preferably 45 seconds or less (further preferably 6 to 45 seconds), more preferably 30 seconds or less (further preferably 6 to 30 seconds), still more preferably 28 seconds or less (further preferably 6 to 28 seconds), particularly preferably from 25 to 6 seconds, and most preferably from 19 to 6 seconds. Bleach-fixing time is preferably 45 seconds or less and 1 second or more, more preferably 28 seconds or less and 1 second or more, still more preferably from 25 to 6 seconds, and particularly preferably from 19 to 6 seconds. The silver halide light-sensitive material of the present invention undergoes not only rapid color-development process but also rapid bleach-fix process. Rinsing (water washing or stabilization) time is preferably 25 seconds or less and 5 seconds or more, more preferably 20 seconds or less and 5 seconds or more, further preferably 18 seconds or less and 12 seconds or more, and still more preferably from 17 to 16 seconds.

In the present invention, preferably in the forth, sixth or seventh embodiment of the present invention, the light-sensitive material of the present invention can be preferably used as a light-sensitive material having rapid processing suitability. In the case of conducting rapid processing, the color developer time is preferably 30 sec or less, more preferably from 25 sec to 6 sec, and further preferably from 20 sec to 6 sec. Likewise, the blix time is preferably 30 sec or less, more preferably from 25 sec to 6 sec, and further preferably from 20 sec to 6 sec. Further, the washing or stabilizing time is preferably 60 sec or less, and more preferably from 40 sec to 6 sec.

In the present invention, preferably in the forth, sixth or seventh embodiment of the present invention, the color development time suitable for the light-sensitive materials of the present invention is 20 seconds or below (preferably 6 to 20 seconds, far preferably 6 to 15 seconds). The expression "color photographic processing carried out under a color development time of 20 seconds or below" means that the color development time, not the total time required for color photographic processing, is 20 seconds or below.

Herein, the term "color developer (processing) time" as used herein means a period of time required from the beginning of dipping a light-sensitive material into a color developing solution until the light-sensitive material is dipped into a bleach-fix bath in the subsequent processing step. For example, when a processing is carried out using an autoprocessor or the like, the color developer time is the sum total of a time in which a light-sensitive material has been dipped in a color developing solution (so-called "time in the solution") and a time in which the light-sensitive material has left the color developing solution and been conveyed in air toward a bleach-fixing bath in the subsequent processing step (so-called "time in the air"). Likewise, the term "blix time" as used herein means a period of time required from the beginning of dipping a light-sensitive material into a bleach-fix bath until the light-sensitive material is dipped into a rinse bath (a washing or a stabilizing bath) in the subsequent processing step. Further, the term "rinse (washing or stabilizing) time" as used herein means a period of time required from the beginning of dipping a light-sensitive material into a rinse solution (a washing solution or a stabilizing solution) until the end of the dipping toward a drying process (so-called "time in the solution").

In the drying process, with a view point of decreasing the amount of water carried to the image layer of the silver halide color photographic light-sensitive material, it is possible to promote drying by absorbing the water content by a squeeze roller or cloth just after the rinsing process. Further, of course, the drying can be accelerated by increasing the temperature or changing the shape of the nozzle to make the drying blow more effective. Further, as described in JP-A-3-157650, the drying can also be accelerated by adjusting the angle of blow of the drying blow to the light-sensitive material or by a removing method of discharged blow.

The temperature of the processing solutions in a color development process, a bleach-fix process and a rinsing process is generally from 30 to 40° C., and, in the present invention, preferably in the second embodiment of the present invention, preferably from 38 to 60° C., and more preferably from 40 to 50° C. The temperature in the drying step is preferably from 50 to 90° C., and more preferably from 60 to 85° C.

In the present invention, preferably in the third embodiment of the present invention, the processing solution temperature in rapid processing is preferably from 38 to 60° C., and more preferably from 40 to 50° C. The temperature of the processing solution in a rinsing process is preferably from 40 to 50° C., further preferably from 42 to 48° C., and most preferably from 43 to 47° C.

The amount of rinse solution to be used in the rinsing process is selected from a broad range depending on characteristics or uses of the light-sensitive material (e.g. the kind of materials used, such as couplers), the temperature of rinse solutions (washing Water), the number (of stages) of rinse solutions (washing tanks), and other various conditions. For example, the relation between the number of washing tanks and the quantity of water in a multi-stage counter-flow system can be obtained by the method described in "Journal of the Society of Motion Picture and Television Engineers", Vol. 64, pp. 248-253 (May 1955).

In the present invention, the number of steps in a multi-stage counter-flow system is preferably 3 to 15, and particularly preferably 3 to 10.

A multistage, counter-flow method can remarkably reduce the amount of rinse solutions, but this method is associated with such the problems that the increase of the dwell time of water in the tank causes the bacterial growth and that the floating matter thus created adheres to the light-sensitive material. As a means to solve those problems, a rinse solution containing the aforementioned bacteria- and fungi-preventing agent is preferable.

Constituents of a processing composition used in each of the foregoing processing operations and a processing solution prepared from the processing composition are described below.

The constituents used in each processing are described as a single unit without differentiating between a processing composition (processing agent) and a processing solution prepared from the processing composition, except for special cases. As a rule, the constituent concentrations described below are those in the processing solution prepared.

Each processing composition is mixed with a prescribed proportion of solvent such as water at the occasion of use, thereby preparing mother liquor (tank solution) or a replenisher. In the specification, both tank solution and replenisher are expressed as a prepared solution unless differentiation between them bears a special meaning.

The color developer composition and the color developer replenisher contain a color-developing agent.

Preferable examples of the color-developing agent include known aromatic primary amine color-developing agents, particularly p-phenylenediamine derivatives. Typical examples are shown hereinbelow, but the present invention is not limited to these examples.

1) N,N-diethyl-p-phenylenediamine
2) 4-amino-N,N-diethyl-3-methylaniline
3) 4-amino-N-(β-hydroxyethyl)-N-methylaniline
4) 4-amino-N-ethyl-N-(β-hydroxyethyl)aniline
5) 4-amino-N-ethyl-N-(β-hydroxyethyl)-3-methylaniline
6) 4-amino-N-ethyl-N-(3-hydroxypropyl)-3-methylaniline
7) 4-amino-N-ethyl-N-(4-hydroxybutyl)-3-methylaniline
8) 4-amino-N-ethyl-N-(β-methanesulfonamidoethyl)-3-methylaniline
9) 4-amino-N,N-diethyl-3-(β-hydroxyethyl)aniline
10) 4-amino-N-ethyl-N-(β-methoxyethyl)-3-methylaniline
11) 4-amino-N-(β-ethoxyethyl)-N-ethyl-3-methylaniline
12) 4-amino-N-(3-carbamoylpropyl)-N-n-propyl-3-methylaniline
13) 4-amino-N-(4-carbamoylbutyl-N-n-propyl-3-methylaniline
14) N-(4-amino-3-methylphenyl)-3-hydroxypyrrolidine
15) N-(4-amino-3-methylphenyl)-3-(hydroxymethyl)-pyrrolidine
16) N-(4-amino-3-methylphenyl)-3-pyrrolidinecarboxyamide Among the aforementioned p-phenylenediamine derivatives, the exemplified compounds 5), 6), 7), 8) and 12) are particularly preferable and among these compounds, the compounds 5) and 8) are most preferable. These p-phenylenediamine derivatives are generally in the form of a salt, such as a sulfate, hydrochloride, sulfite, naphthalene disulfonate and p-toluene sulfonate, in the state of a solid material.

The concentration of the aromatic primary amine developing agent in a processing agent or the color-developing agent in the prepared solution is determined so that concentration becomes preferably 2 mmol to 200 mmol, more preferably 6 mmol to 100 mmol and further preferably 10 mmol to 40 mmol per 1 L of the developer.

The color developer solution may include a small amount of a sulfite ion depending on the type of the intended photographic material, or may not substantially include such an ion in some instances. However, to include a small amount of a sulfite ion is preferred.

Moreover, a small amount of hydroxylamine may be included. When the color developer solution contains hydroxylamine (in general, used in the form of hydrochloride or sulfate, however, the form of the salt is abbreviated hereinafter), it acts as a preservative of the developer liquid similarly to the sulfite ion. However, the amount of hydroxylamine to be added must also be controlled to be small because it may concomitantly affect the photographic characteristics due to the silver development activity of the hydroxylamine itself.

The color developer may contain, as a preservative, an organic preservative, instead of the above hydroxylamine or sulfite ions. Here, the organic preservative means whole the organic compounds which decrease the deterioration speed of aromatic primary amine color-developing agents when it is added to a processing solution for a light-sensitive material. Namely, the preservative is any of organic compounds having the ability of preventing the oxidation of a color-developing agent caused by oxygen and the like. Among these organic compounds, particularly effective organic preservatives are the above hydroxylamine derivatives, hydroxamic acids, hydrazides, phenols, α-hydroxyketones, α-aminoketones, saccharides, monoamines, diamines, polyamines, quaternary ammonium salts, nitroxy radicals, alcohols, oximes, diamide compounds, and amines having fused rings.

These compounds are disclosed in each publication or specification of JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, JP-A-52-143020, and JP-B-48-30496.

To the color developer solutions may be added a chlorine ion as needed in the instance of for example, the developer for use in the color paper. The color developer solution (particularly, the developer for use in the color paper) may contain $3.5\times10^{-2}$ to $1.5\times10^{-1}$ mol/L of a chlorine ion, in general. However, the chlorine ion is usually released to the developer liquid as a byproduct of the development, therefore, it may be often unnecessary to add to the replenishing liquids. The developer used in the light-sensitive material for taking photographs, the chlorine ion may not be included.

With respect to bromine ions, the concentration of bromine ions in a color developing solution is preferably from 1 to $5\times10^{-3}$ mol/L or so for processing the materials for photographing and preferably $1.0\times10^{-3}$ mol/L or less for processing the materials for printing. It is not necessary to add bromine ions to the composition for a color developer replenisher in many cases similarly to the above chlorine ions.

The color developer solution preferably has the pH of 9.0 to 13.5, and the replenishing solution thereof preferably has the pH of 9.0 to 13.5. To this end, the color developer solution and the replenishing solution thereof can include an alkali chemical, buffering agent, as well as an acid chemical as needed to keep the pH value of the liquid.

When the color developer solution is prepared, any of various buffering agents is preferably used to keep the pH as described above. Examples of the buffering agent which may be used include carbonate, phosphate, borate, tetraborate, hydroxybenzoate, glycylate, N,N-dimethylglycylate, leucine salt, norleucine salt, guanine salt, 3,4-dihydroxyphenylalanine salt, alanine salt, amino butyrate, 2-amino-2-methyl-1,3-propanediol salt, valine salt, proline salt, trishydroxyaminomethane salt, lysine salt and the like. Particularly, carbonate, phosphate, tetraborate and hydroxybenzoate are advantageous in that: they are excellent in buffering capacity within a higher range of pH of 9.0 or more; they do not have adverse effects on photographic properties (e.g., fogging and the like) even though they are added to a color developer solution; and they are inexpensive. Accordingly, it is particularly preferred that any of these buffering agents is employed.

Specific examples of these buffering agents include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfo salicylate) and the like. However, the buffering agents of the present invention are not limited these compounds.

The buffering agent is not a component which is subjected to a reaction and consumption. Thus the amount of the buffering agent to be added in the composition is determined so that the concentration becomes preferably 0.01 to 2 mol, more preferably 0.1 to 0.5 mol per 1 liter of both of the color developer solution and replenishing liquid prepared from the processing agent.

To the color developer solution may be added for example, a precipitation inhibiting agent to calcium or magnesium as well as any of various chelating agents which also serve as a stability improving agent, as other components of the color developer solution. Examples of them include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol-ether diaminetetraacetic acid, ethylenediamineortho-hydroxyphenyl acetic acid, ethylenediaminedisuccinic acid (SS form), N-(2-carboxylateethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, 1,2-dihydroxybenzene-4,6-disulfonic acid and the like.

These chelating agents may be used in combination of more than two as needed. Further, the amount of these chelating agents may be a sufficient amount to sequester the metal ion in the color developer solution. For example, the chelating agent is added to give 0.1 g to 10 g per 1 liter.

To the color developer solution may be also added an optional development accelerator as needed. Examples of the development accelerator which may be added as needed include thioether based compounds presented in JP-B Nos. 37-16088, 37-5987, 38-7826, 44-12380 and 45-9019, U.S. Pat. No. 3,813,247, and the like; polyalkylene oxides presented in JP-B Nos. 37-16088 and 42-25201, U.S. Pat. No. 3,128,183, JP-B Nos. 41-11431 and 42-23883, U.S. Pat. No. 3,532,501, and the like; as well as 1-phenyl-3-pyrazolidones or imidazoles. The amount of the accelerator to be added in the composition is determined so that the concentration becomes preferably 0.001 to 0.2 mol, more preferably 0.01 to 0.05 mol per 1 liter of both of the color developer solution and replenishing liquid thereof.

To the color developer solution can be added an optional anti-foggant as needed in addition to the aforementioned halogen ion. Representative examples of organic anti-foggant include nitrogenated heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethyl-benzimidazole, indazole, hydroxyazaindolydine and adenine.

To the color developer solution may be added any of various types of surfactants as needed such as alkylsulfonic acid, aryl sulfonic acid, aliphatic carboxylic acid and aromatic carboxylic acid. The amount of the surfactant to be added in the composition is determined so that the concentration becomes preferably 0.0001 to 0.2 mol, more preferably 0.001 to 0.05 mol per 1 liter of both of the color developer solution and replenishing liquid prepared from the processing agent.

In the present invention, a fluorescent whitening agent may be used if necessary. Examples of preferable fluorescent whitening agent include bis(triazinylamino)stilbene sulfonic acid compounds. As bis(triazinylamino)stilbene sulfonic acid compound, known or commercially available diaminostilbene whitening agents can be used. As known bistriazinyldiaminostilbenedisulfonic acid compound, the compounds described in JP-A-6-329936, JP-A-7-140625 or JP-A-10-104809 are preferable. The commercially available compounds are described in, for example, "Senshoku Note (Notebook on Dyeing)", 9th edition (Shikisensha Co., Ltd.), pp. 165 to 168. Among the products described in this publication, Blankophor BSUliq, Blankophor REU, or Hakkol BRK (each trade names) are preferred.

As the bleaching agents which are used for processing in combination with the above color development processing composition, known bleaching agents in addition to iron (III) complex salts of aminopolycarboxylic acid can be used. The bleaching agents which can be used in combination include iron(III) complex salts of organic acids, e.g., citric acid, tartaric acid and malic acid, persulfate, and hydrogen peroxide are exemplified.

The preferred examples of aminopolycarboxylic acids iron (III) complex salts are the iron(III) complex salts of the following aminopolycarboxylic acids, e.g., biodegradable ethylenediaminedisuccinic acid (SS body), N-(2-carboxylatoethyl)-L-aspartic acid, β-alaninediacetic acid, methyliminodiacetic acid, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid, and glycol ether diaminetetraacetic acid can be exemplified. These compounds may be any one of sodium, potassium, lithium and ammonium salts. Of these compounds, ethylenediaminedisuccinic acid (SS form), N-(2-carboxylateethyl)-L-aspartic acid, β-alaninediacetic acid, ethylenediaminetetraacetic acid, 1,3-diaminopropanetetraacetic acid and methyliminodiacetic acid are preferred, because the iron (III) complex salt thereof is favorable in photographic characteristics. These ferric iron complex salts may be used in their complex salt forms, and a ferric ion complex salt may be formed in a solution using a ferric salt, for example, ferric sulfate, ferric chloride, ferric nitrate, ferric sulfate ammonium, ferric phosphate or the like, with a chelating agent such as an aminopolycarboxylic acid. Further, the chelating agent may be used in excess, at equal to or more amount required for forming the ferric ion complex salt.

The concentration of the bleaching agent in a bleaching agent part is decided so that the concentration of the bleaching agent in a processing solution prepared from the processing composition becomes preferably from 0.01 to 1.0 mol/liter, more preferably from 0.03 to 0.80 mol/liter, still more preferably from 0.05 to 0.70 mol/liter, and most preferably from 0.07 to 0.50 mol/liter.

It is preferred that a bleaching agent part contains various known organic acids (e.g., acetic acid, lactic acid, glycolic acid, succinic acid, maleic acid, malonic acid, citric acid, sulfo succinic acid, tartaric acid, glutaric acid), organic bases (e.g., imidazole, dimethylimidazole), or a compound represented by formula (A-a) disclosed in JP-A-9-211819 including 2-picolic acid, and a compound represented by formula (B-b) disclosed in the same patent including kojic acid. The addition amount of these compounds is set so that the concentration of the processing solution prepared becomes preferably from 0.005 to 3.0 mol/L, and more preferably from 0.05 to 1.5 mol/L.

A fixing agent part which constitutes the processing composition of a bleach-fixing solution in combination with the bleaching agent part can contain any fixing chemicals as the fixing agent, for example, one or two or more compounds selected from water-soluble silver halide solvents can be used as mixture, such as thiosulfates, e.g., sodium thiosulfate and ammonium thiosulfate, thiocyanates, e.g., sodium thiocyanate and ammonium thiocyanate, thioether compounds, e.g., ethylenebis-thioglycolic acid and 3,6-dithia-1,8-octanediol, and thioureas. Further, a specific bleach-fixing solution comprising a combination of a fixing agent and a great amount of halide, e.g., potassium iodide, as disclosed in JP-A-55-155354 can also be used in the present invention. Thiosulfate, in particular, ammonium thiosulfate, is preferably used in the present invention. The addition amount of the fixing chemicals in a fixing agent part is set so that the concentration of the prepared bleach-fixing solution becomes preferably from 0.1 to 3 mol, more preferably from 0.2 to 2.0 mol, per liter of the prepared solution.

It is preferred that the fixing agent part contains, as a preservative, sulfite ion-releasing compounds such as sulfite, bisulfite, and metabisulfite, and arylsulfinic acids such as p-toluene-sulfinic acid and m-carboxybenzenesulfinic acid. It is preferred to contain these compounds in an amount of from about 0.02 to about 1.0 mol/L (as the concentration of the prepared processing solution) in terms of a sulfite ion or sulfinate ion.

A bleach-fixing solution prepared by mixing a bleaching agent part and a fixing agent part and adding, if necessary, a small amount of water is described below. The constitutional components of bleach-fixing solution which may be contained in either a bleaching agent part or a fixing agent part are also described below.

The bleach-fix solution has the pH of preferably 3 to 8, and particularly preferably 4 to 8. Although de-silvering characteristics are improved when the pH is lower than this range, deterioration of the liquid and conversion of a cyan dye into a leuco dye may be accelerated. To the contrary, when the pH is higher than this range, de-silvering is belated, and occurrence of stain is facilitated.

To the bleach-fix solution can be added potassium hydroxide, sodium hydroxide, lithium hydroxide, lithium carbonate, sodium carbonate or potassium carbonate which is alkali, or acidic or alkaline buffering agent or the like as needed for the purpose of adjusting the pH.

A noticeable reduction in volume of a replenisher for the bleach-fix bath is possible by the formula to which the bleach-fix processing composition used in the present invention is made. The replenisher volume is preferably 60 ml or less, more preferably from 20 to 50 ml, far preferably from 25 to 45 ml, most preferably from 25 to 40 ml, per $m^2$ of light-sensitive material. The replenishing rate of a bleach-fixing solution is preferably divided to a bleaching agent part and a fixing agent part, and in this case, the replenishing rate of the bleach-fixing solution is the sum total of the replenishing rates of the bleaching agent part and the fixing agent part. The replenishing rate of a rinsing solution (a washing water and/or a stabilizing solution) is preferably from 50 to 220 ml, more preferably from 50 to 200 ml as the total of the rinsing solution.

After the completion of fixing or bleach-fixing, a rinse bath may be used. It may be said that a rinse bath is a stabilization bath as a substitute for water-washing or a stabilization bath for image stabilization. It may be said merely that these stabilization baths are stabilizing baths. Since these baths are operated at a low concentration, the effects of processing agents are not large. However, the processing agents may be prepared if necessary. The methods for decreasing calcium and magnesium, which are described in JP-A-62-288838, can be applied very effectively to the processing agents for the stabilization baths. In addition, isothiazolone compounds and thiabendazoles described in JP-A-57-8542, chlorine-based bactericides such as sodium salt of chlorinated isocyanuric acid described in JP-A-61-120145, benzotriazole and copper ions described in JP-A-61-267761, bactericides described in "Chemistry of the Prevention of Bacteria and Fungi" (1986), by Hiroshi Horiguchi, Sankyo Publishing Co., Ltd., bactericides described in "Reduction and Sterilization of Microorganisms and Fugni-Preventing Technologies" (1982), ed., Eisei Gijutsu Kai, and bactericides described in "Dictionary of Bacteria and Fungi Preventing Agents", ed., Kogyo Gijutsu Kai, Japan Microorganisms and Fugni-Preventing Technologies Association (1986) can also be used.

Next the processor usable for the above-mentioned processing is illustrated.

The development processing of the present invention is particularly preferably performed with an automatic processor. Automatic processors which are preferably used in the present invention are described below.

In processing the light-sensitive material of the present invention, any processing equipment can be used as far as it is designed to perform conveyance of the light-sensitive material in accordance with nip conveyance using two or more pairs of conveyor rollers throughout the color-development process and the remainder of the processing.

The number and the pressure of rollers installed in processing equipment used in the present invention have no particular restriction so far as the present light-sensitive material is conveyed consistently at a conveyance speed according to the present invention, preferably the first to forth embodiments of the present invention. As to the processor usable in the present invention, any processor can be used with no particular restrictions as far as it is within the scope of the present invention.

It is preferred in the present invention, preferably in the second embodiment of the present invention, that the linear velocity of conveyance of automatic processors is preferably 40 to 100 mm/second, and particularly preferably from 45 to 95 mm/second.

It is preferred in the present invention, preferably in the third embodiment of the present invention, that the linear velocity of conveyance of automatic processors is preferably 42 to 100 mm/second, more preferably from 42 to 50 mm/second, and particularly preferably from 43.0 to 47.0 mm/second.

In the forth embodiment of the present invention, the conveyance speed of the light-sensitive material is preferably from 40 mm/second to 100 mm/second, more preferably from 44 mm/second to 100 mm/second.

With automatic processors for color papers, there are systems of conveyance by, e.g., performing development processing after cutting a color paper to a final size (a sheet-type conveying system), and by performing development processing of a color paper in a long rolled state and cutting the color paper to a final size after development processing (a cinema-type conveying system). A sheet type conveying system is preferred, since about 2 mm between-images is wasted on a light-sensitive material with cinema-type conveying system.

It is preferred that the contact area of air with the processing solution in a processing tank and a replenisher tank (open area) for use in the present invention is as small as possible. For example, taking the value obtained by dividing the open area ($cm^2$) by the volume of the processing solution in a tank ($cm^3$) as the open factor, the open factor is preferably 0.01 to 0.02 ($cm^{-1}$).

It is preferred to provide a solid or liquid non-contact means with air which is floating on the surface of the solution in a processing tank or a replenisher tank to reduce the area being in contact with air.

Specifically, means of floating a floating lid of plastics on the liquid level or covering the liquid level with a liquid immiscible with and not chemically reacting with a processing solution are preferred. Liquid paraffin and liquid saturated hydrocarbon are preferred examples of such liquids.

In the present invention, in order to carry out the processing rapidly, the time during which the light-sensitive material is in air for being transferred between the processing solutions, i.e., the crossover time is preferably as short as possible. The crossover time is preferably 10 seconds or less, more preferably 7 seconds or less, and further preferably 5 seconds or less.

As a method to completely get rid of crossover time, it is particularly preferred to use the submerged conveying structure by blades disclosed in JP-A-2002-55422. According to this method, crossover time can be made zero by providing a blade between processing tanks, to thereby prevent a solution from leaking and pass a light-sensitive material.

It is particularly preferred to provide the above submerged conveying structure by blades with the liquid circulating structure having the downward liquid-circulating direction disclosed in JP-A-2002-339383, and set up a pleated filter of a porous material in the system of circulation.

In the processing solutions for use in the present invention, it is preferable to carry out so-called evaporation correction, that is, supply of water in an amount equivalent to the evaporated amount of the processing solution. This correction is preferable particularly in the color-developing solution and bleach-fixing solution.

Although the method for supplying the water is not particularly limited, the methods described in JP-A-1-254959 and JP-A-1-254960 are preferable, which methods comprise: providing a monitoring water tank other than a bleaching tank, seeking the amount of evaporated water in the monitoring water tank, calculating the amount of evaporated water in the bleaching tank based on the amount of evaporated water in the monitoring water tank, and supplying water in proportion with the evaporated amount to the bleaching tank. Alternatively, the methods are based on evaporation correction using a liquid level sensor or an overflow sensor. The most preferred correcting method is the one comprising adding water based on the anticipated amount of evaporation and is described in Journal of Technical Disclosure No. 94-49925, right column, line 26, on page 1 to left column, line 28, on page 3, issued from Japan Institution of Innovation and Invention. This method comprises adding water in an amount calculated by the factors based on the operated time and unoperated time of the automatic processor and the information of the time for temperature control.

Further, a measure to reduce the evaporated amount is also preferable.

As a means to reduce the evaporated amount, it is particularly preferable to "keeping the humidity of the upper space of the processing tank at a value of 80% RH or more" as described in JP-A-6-110171. Further, it is particularly preferable to provide an evaporation preventing rack and a roller-type automatic cleaning mechanism, as described in FIGS. 1 and 2 of the above JP-A-6-110171. An exhausting fan is usually provided for prevention of dew condensation at the time when the temperature is controlled. The exhaust air volume is preferably 0.1 to 1 $m^3$ per minute and particularly preferably 0.2 to 0.4 $m^3$ per minute.

Drying conditions of a light-sensitive material also affect the evaporation of a processing solution. As a way of drying, it is preferable that air blown from a blower and heated by a heater is supplied as drying air to a drying chamber and circulated therein. A ceramic hot air heater is preferably used for drying, and a supply air capacity is preferably from 4 to 20 $m^3$/minute, and particularly preferably from 6 to 10 $m^3$/minute.

The installation position of a temperature detector for the drying air may be either the upstream or the downstream of a light-sensitive material-conveying path as far as it is on the drying air circulation path. And the temperature detector may be placed in either the front or the back of the paper transit position on the dry air circulation path. The temperature can be controlled according to a moisture content of light-sensitive material. In the case of color photographic paper usable in the present invention, the most suitable temperature of drying air is from 50° C. to 90° C. The drying time suitable for the present invention is within 26 seconds, preferably from 26 to 6 seconds, particularly preferably from 26 to 8 seconds, from the viewpoint that very-short-term finish in a drying section of a compact design is advantageous to system efficiency. The term "drying time" as used herein refers to the time required for completion of constant-rate drying on the emulsion side.

There are used various materials of parts in an automatic processor, and preferred materials are described below.

Modified PPO (modified polyphenylene oxide) and modified PPE (modified polyphenylene ether) resins are preferred as the materials of tanks such as a processing tank and a temperature controlling tank. The example of modified PPO includes "Noryl" (manufactured by Nippon G.E. Plastics Co.), and the examples of modified PPE include "Zailon" (manufactured by Asahi Chemical Industry Co., Ltd.) and "Yupiace" (manufactured by Mitsubishi Gas Chemical Co., Inc.). Further, these materials are suitable for the parts which are possible to be in contact with a processing solution, e.g., a processing rack and a crossover.

PVC (polyvinyl chloride), PP (polypropylene), PE (polyethylene) and TPX (polymethylpentene) resins are suitable as the materials for the roller of a processing part. In addition, these materials are usable for other parts which are possible to be in contact with a processing solution. A PE resin is also preferred as the material for a replenisher tank made by blow molding.

PA (polyamide), PBT (polybutyleneterephthalate), UHMPE (ultra high molecular weight polyethylene), PPS (polyphenylenesulfide), LCP (total aromatic polyester resin, liquid crystal polymer) resins are preferred as the materials for processing parts, gears, sprockets and bearings.

A PA resin is a polyamide resin, e.g., 66 nylon, 12 nylon and 6 nylon, and those containing glass fibers and carbon fibers are fast to swelling by processing solutions and usable in the present invention.

High molecular weight products such as an MC nylon and a compression-molded product are usable without fiber reinforcement. A UHMPE resin is preferably not reinforced, and the preferred and commercially available products of UHMPE resins include "Lubmer" and "Hizex Million" (manufactured by Mitsui Petrochemical Industries, Ltd.), "New Light" (manufactured by Sakushin Kogyo Co., Ltd.), and "Sunfine" (manufactured by Asahi Chemical Industry Co., Ltd.). The molecular weight of these products is preferably 1,000,000 or more, and more preferably from 1,000,000 to 5,000,000.

PPS resins are preferably reinforced with glass fibers or carbon fibers. The examples of commercially available LCP resins include "Victrex" (manufactured by ICI Japan Co., Ltd.) "Ekonol" (manufactured by Sumitomo Chemical Co., Ltd.), "Zaider" (manufactured by Nippon Oil Co., Ltd.), and "Vectra" (manufactured by Polyplastics Co., Ltd.).

Ultrahigh tenacity polyethylene fibers or polyvinylidene fluoride resins disclosed in JP-A-4-151656 are preferably used as the materials of a conveyor belt.

Nylon and polyethylene are preferred as the material of the conveyor belt used for conveying the light sensitive material in the dry section.

Vinyl chloride foam resins, silicone foam resins and urethane foam resins are preferred as the soft materials for squeegee rollers and the like. The example of urethane foam resin includes "Lubicel" (manufactured by Toyo Polymer Co., Ltd.).

An EPDM rubber, a silicone rubber and a byton rubber are preferably used as the rubber materials for the coupling of piping, the coupling of an agitation jet pipe and sealing materials.

It is also preferred that chemicals are directly added to a processing tank together with water corresponding to a diluting rate. Further, it is also preferred to make a replenisher automatically by dissolving and diluting chemicals in a replenisher tank by using an automatic preparing unit.

An internal structure of a digital printer processor preferably used in the present invention, preferably in the second and third embodiments of the present invention, is shown diagrammatically in FIG. 1, and illustrated below. However, this internal structure is not construed as limiting the scope of the present invention.

In FIG. 1, the printer processor 2 is made up of a printer unit 3 and a processor unit 4. The printer unit 3 includes a magazine 5, a cutter 6, a back-print section 7, an exposure section 8 and an allocation section 9. A band-form light-sensitive material 10 set in the magazine 5 is cut with the cutter 6 according to the print sizes desired and made into a light-sensitive material 10*a* in cut-sheet form. The light-sensitive material 10*a* is conveyed toward the exposure section 8 along the conveyance path 15 shown by a double-dot-dash line in FIG. 1. On the way to the exposure section 8, printing of a frame number and correction data is done in the back-print section 7. And in the exposure section 8 images are recorded on the light-receptive side of the light-sensitive material 10*a* by exposure based on image data. Thereafter, the exposed light-sensitive material 10*a* is allocated so as to form a single file or a multiple file in the allocation section 9 according to the sizes and the number of prints to be made, and conveyed to the processor unit 4.

The processor unit 4 includes a photographic processing section 11, a squeegee section 12, a drying section 13 and a sorter section 14. The photographic processing section 11 is equipped with a developing tank 16, a bleach-fix tank 17 and first to fourth rinsing tanks (washing tanks) 18 to 21, which are arranged in order of increasing distance from the upstream side (the left side in the FIG. 1) of the conveying direction of the light-sensitive material 10*a*. A specified amount of developer is stored in the developing tank 16, a specified amount of bleach-fix solutions in the bleach-fix tank 17, and specified amounts of rinse solutions (washing water) in the first to forth rinsing tanks (washing tanks) 18 to 21. A conveyor rack 22 having a plurality of conveyor rollers for conveying the light-sensitive material 10*a* along the path having a shape of approximately the letter "U" is installed within each of the developing tank 16 and the bleach-fix tank 17. The rinsing tanks (washing tanks) 18 to 21 are equipped with pairs of conveyor rollers 23 for conveying the light-sensitive material 10*a* along the path shaped like the letter "U" across the tanks. The light-sensitive material 10*a* is fed into each of the tanks 16 to 21 by means of the conveyor racks 22 and pairs of conveyor rollers 23 and subjected to photographic processing.

In the rinsing tanks (washing tanks) 18 to 21, the light-sensitive material 10*a* is fed into a subsequent tank via a submerged squeegee section 24 installed in a partition (wall). The submerged squeegee section 24 is equipped with a blade (i.e. a blade-form member) made of an elastically deformable thin plate. This blade permits passage of the light-sensitive material 10*a* therethrough, and inhibits the effusion of a washing solution. This solution-shutting off blade makes it possible to squeegee the light-sensitive material with the blade and the bottom of the squeegee section. The light-sensitive material 10*a* having undergone photographic processing gets rid of water drops adhering thereto in a squeegee section 12, and fed into the drying section 13. Alternatively, as with other processing tanks 16 and 17, the conveying system using a conveyor rack may be adopted instead of the submerged squeegee section 24. In the present invention, a pair of blades may be utilized to form the squeegee section.

In this process, the light-sensitive material 10*a* is passed through the rinse water in a horizontal direction. In other words, the light-sensitive material 10*a* is conveyed via a blade partitioning the rinsing tank in a condition that its surface on the emulsion-coated side is parallel to the solution level.

Such submerged conveyance as mentioned above makes it possible to achieve rapid processing without impairment of washing effect, so it is most suitable for use in the present invention.

The term "blade" as used herein means a member that constitutes a separator fitted in a partition, via which a light-sensitive material is conveyed from one processing tank to another processing tank in a submerged condition without conveyance through the air when the light-sensitive material moves from a preceding tank to a subsequent tank in a system of processing a light-sensitive material with processing solutions stored in a plurality of processing tanks, and prevents leakage of solutions from occurring between processing tanks by sealing the separator in a submerged condition. Examples of a material suitable for such a blade include polyurethane resins having JIS A hardness of 80 to 99 degrees. Of these resins, thermosetting polyurethane derived from polyether prepolymer is most suitable as a blade material used in a solution for a long time.

Figure 3:
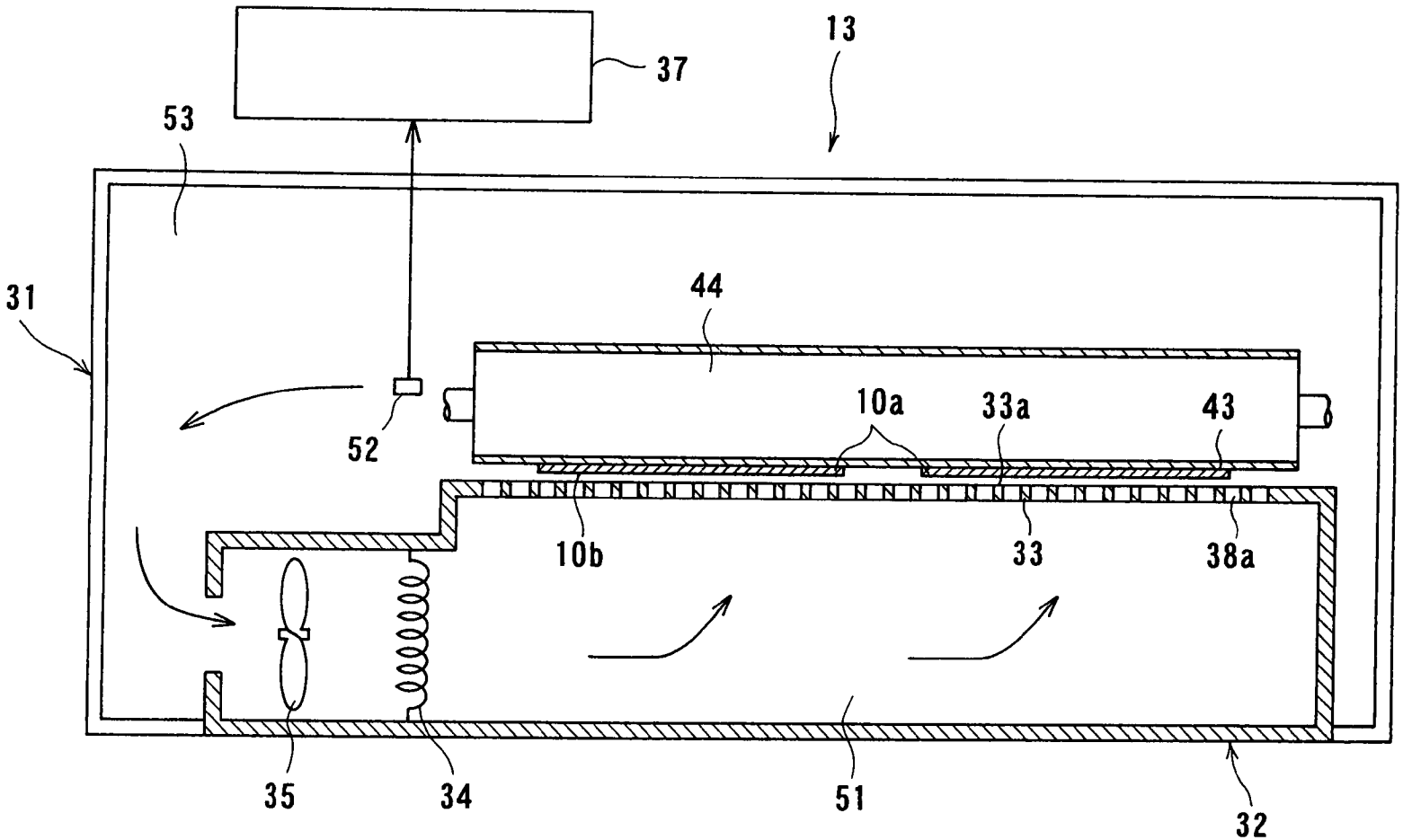
FIG. 3 is a schematic side view showing an example of a structure of the drying section included in a printer processor usable in the present invention.

In FIG. 1, 55 represents a key-in section, 56 represents a display, and 67 represents an outside temperature-humidity sensor. In FIG. 3, numeral 37 represents a system controller, 52 represents a temperature sensor, As an example of a rinsing process using a rinsing tank structurally partitioned into a plurality of rooms with blade-form members for passing a light-sensitive material cut into sheets through rinse solutions in a horizontal direction, there is a case where, when a light-sensitive material is passed through rinse solutions 18 to 21 filled in first to fourth rinsing rooms shown in FIG. 1, it is conveyed via each blade partitioning the rinsing tank in a condition that its surface on the emulsion-coated side is parallel to the solution level.

In the foregoing way, image output are produced on the silver halide color photographic light-sensitive material.

The preferred scanning exposure methods which can be applied to the present invention are described in detail in the publications listed in the table 1 shown below.

It is preferred to use a band stop filter, as described in U.S. Pat. No. 4,880,726, when the light-sensitive material of the present invention is subjected to exposure with a printer. Color mixing of light can be excluded and color reproducibility is remarkably improved by the above means.

In the present invention, a yellow microdot pattern may be previously pre-exposed before giving an image information, to thereby perform a copy restraint, as described in European Patent Nos. 0789270A1 and 0789480A1.

Further, in order to process the light-sensitive material of the present invention, processing materials and processing methods described in JP-A-2-207250, page 26, right lower column, line 1, to page 34, right upper column, line 9, and in JP-A4-97355, page 5, left upper column, line 17, to page 18, right lower column, line 20, can be applied. Further, as the preservative for use in the developing solution, compounds described in the patent publications listed in the following table 1 can be used.

As an example of a color-development process, there is a case where processing is carried out using a processing solution prepared by subjecting a light-sensitive material having undergone image-wise exposure via negative film of normal density to continuous processing wherein the system as shown in FIG. 1 and the processing chemical, CP49E Chemical (trade name) produced by Fuji Photo Film Co., Ltd., are used and the processing is continued until the volume of the color developer replenisher reaches twice the volume of the color developing tank.

Figure 2:
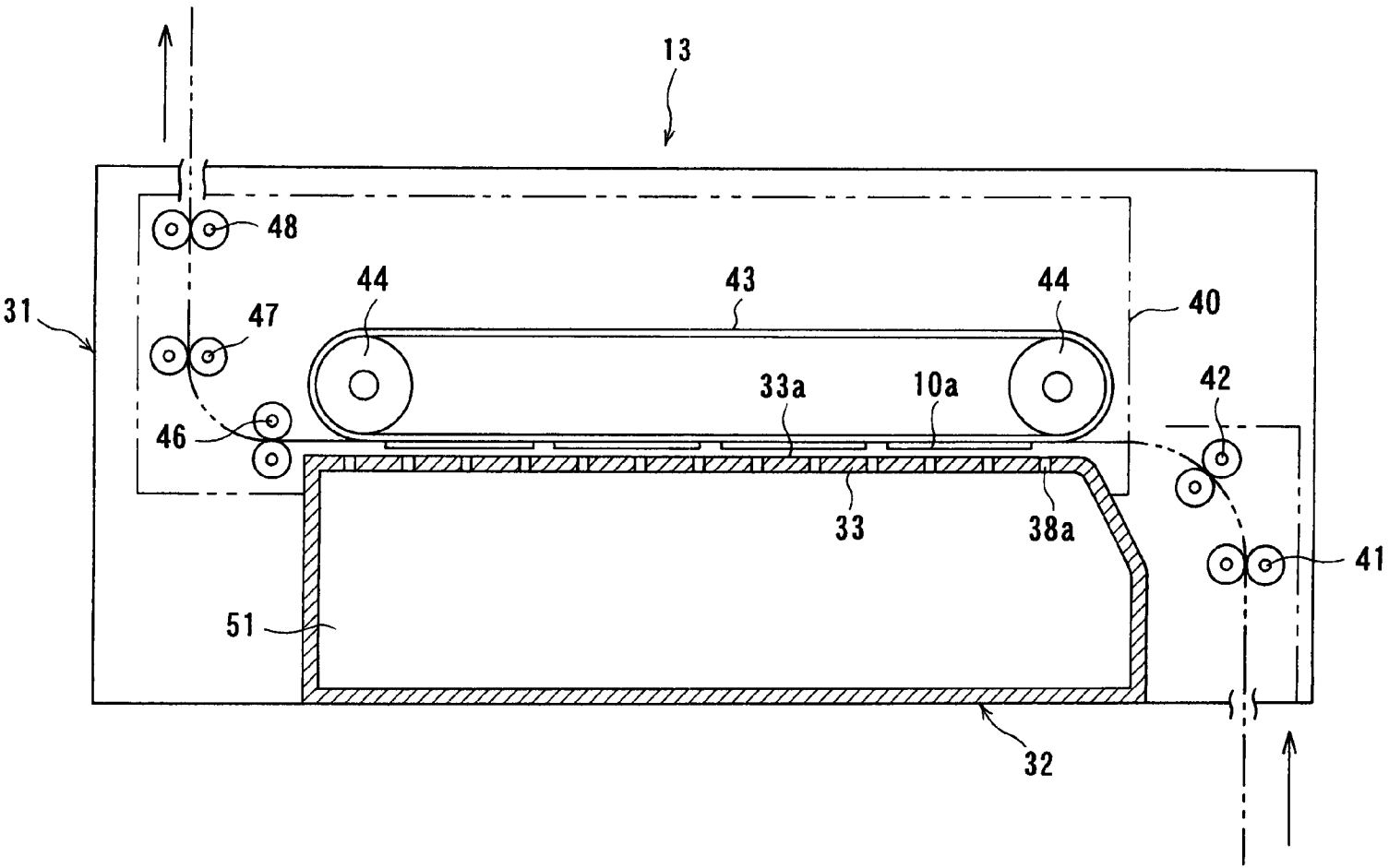
FIG. 2 is a schematic front view showing an example of a structure of the drying section included in a printer processor usable in the present invention.

As shown in FIG. 2 and FIG. 3, the light-sensitive material 10*a* having undergone the rinsing process (washing process) is dried in a drying section 13. The drying section 13 includes a drying chamber 31, a blast duct 32, a heater 34, a blower 35 and a conveyor rack 40.

The conveyor rack 40 includes a conveyor belt 43 and pairs of conveyor rollers 46, 47 and 48, to which the light-sensitive material 10*a* is conveyed in the order of described, and forms a light-sensitive material-conveying path. The light-sensitive material 10*a* fed from the development-processing section 11 is nipped in and conveyed by pairs of squeegee rollers 41 and 42 in the squeegee section 12, and further sent to the conveyor belt 43. Through nip in and conveyance by the squeegee rollers, the water adhering to light-sensitive material 10*a* is removed.

The conveyor belt 43 is an endless belt made of a mesh and looped over rollers 44. The light-sensitive material 10*a* fed from the squeegee roller pair 42, as described hereinafter, is conveyed in a condition that the back surface thereof (the surface opposed to the surface on the image-recorded side) is pressed against the conveyor belt 43 by dry air impinging thereon from nozzles 38 of a guide plate 33, and sent to the first pair of conveyor rollers 46. Thus, the light-sensitive material 10*a* is conveyed in a state that its surface on the image-recorded side 10*b* is alienated from the guide plate 33. So it becomes possible to prevent the surface on the image-recorded side from being bruised by sliding contact with the guide plate 33. In addition, as described in Japanese Patent Application No. 2003-416907, a plurality of rollers with skewers jutting from the guide plate 33 are placed and support the vicinity of margins of the light-sensitive material, and thereby sliding contact between the guide plate 33 and the image-recorded side 10*b* of the light-sensitive material 10*a* can be prevented effectively.

The blast duct 32 is provided with the guide plate 33 along the path for conveying the light-sensitive material in a position facing on the light-sensitive material 10*a*. The guide plate 33 is made from aluminum and, as described in Japanese Patent Application No. 2003-413560, configured so that a heat insulator is present between the guide plate and a periphery member constructing a drying chamber. Owing to such a configuration, drying air can render the temperature distribution of the guide plate 33 uniform and yield a result favorable for enhancement of drying efficiency. With the intention of further enhancing drying efficiency, the guide plate 33 may be painted black on the light-sensitive material-opposed side 33*b*. By this painting, thermal conductivity of the guide plate 33 and thermal emissivity to the light-sensitive material 10*a* can be increased (to a total emmisivity of at least 0.9). Thus, drying is effected by not only hot air but also thermal emission. The guide plate 33 has many nozzle rows 38 aligned along the light-sensitive material-conveying direction. Each of the nozzle rows 38 is made up of many nozzles 38*a* arranged with a specified pitch so as to blow the drying air uniformly on the surface of the light-sensitive material in a direction perpendicular to the light-sensitive material-conveying direction. Therefore, even when the light-sensitive material 10*a* conveyed on the conveyor belt 43 forms a multiple file, a difference in progress of drying can be minimized between the light-sensitive materials 10*a* conveyed in different files.

As shown in FIG. 2 and FIG. 3, a path 51 for a supply of drying air is formed inside the blast duct 32 in order to emit blasts of drying air from the nozzles 38*a*. And the heater 34 and the blower 35 are installed in the path 51. The blower 35 includes a cross-flow fan and makes the dying air circulate in the drying section 13. The electric heater 34 is controlled with a temperature controller so that the drying air has a constant temperature of, e.g., 80° C.

Figure 4:
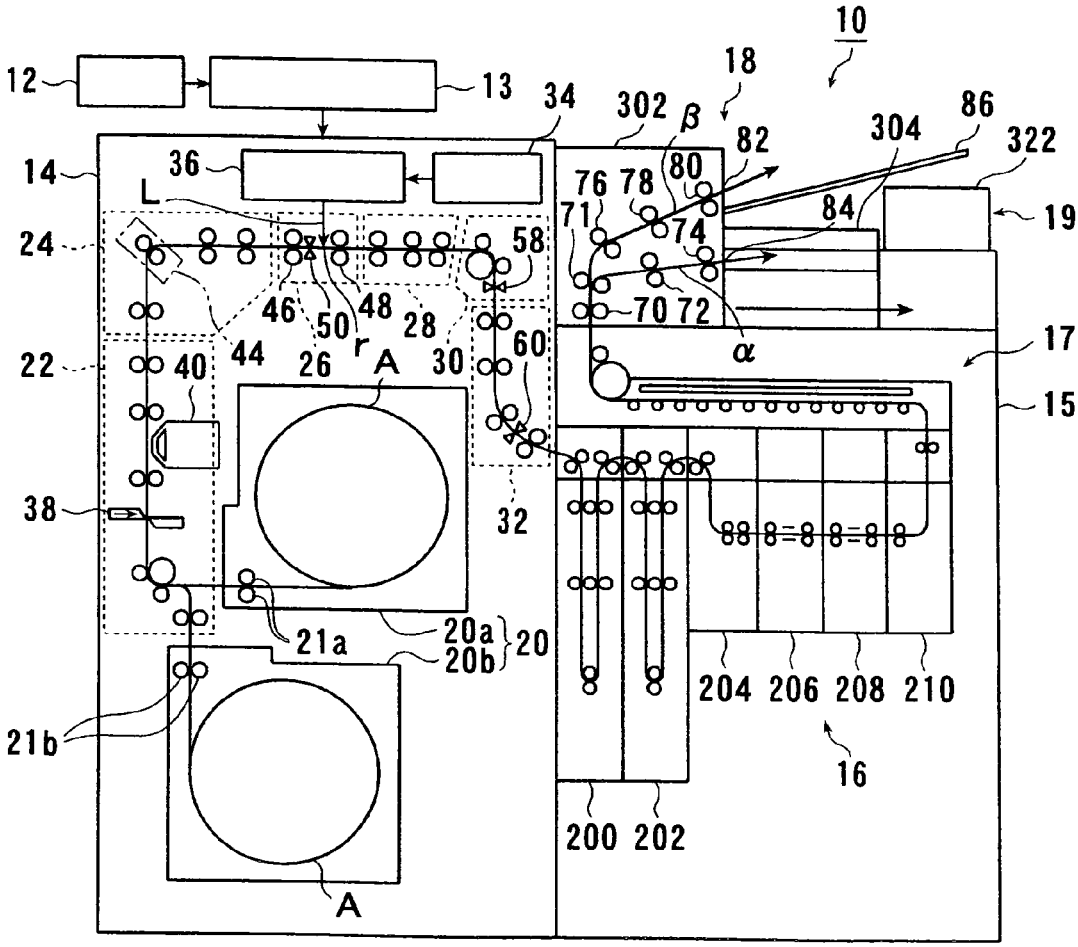
FIG. 4 is a schematic diagram showing an example of a printer processor usable in the present invention.

An example of image-forming equipment used for exposure processing of light-sensitive materials in the present invention, preferably in the sixth or seventh embodiment of the present invention, is the equipment shown in FIG. 4.

The image-forming equipment 110 shown in FIG. 4 has a scanner 112, an image processing device 113, a printer 114, a processors 115 and a sorter 119. The printer 114 is a recording apparatus utilizing scanning of light beams for exposure of light-sensitive materials and recording image information on the light-sensitive materials. In the printer 114, a web of light-sensitive material A in roll form is drawn out by a specified length, cut into a sheet (hereinafter referred to as "sheet body" as well) and transported to the exposing position, whereas optical beams L modulated in accordance with the image data supplied from the image processing unit 113 are deflected in the main scanning direction while, at the same time, the light-sensitive material in the form of a sheet is transported in an auxiliary scanning direction, whereby the optical beams L scan over the light-sensitive material to expose it and form a latent image. Herein, the term "sub-scan" refers to the conveyance of a light-sensitive material in a direction perpendicular to the direction of a main scan performing scanning exposure, namely the conveyance for giving two-dimensional exposure to a light-sensitive material.

116 is a photographic processing section, 117 is a drying processing section, 118 is a swingback section, 120 is a supply section, 120*a* and 120*b* each are a magazine, 121*a* and 121*b* each are a pair of pullout rollers, 122 is a back-print section, 124 is a registering section, 130 is an allocation section, 132 is a conveyance section, 140 is a back-print head, 144 is a roller pair for registering, 158 is a position detecting sensor, 160, 170, 171, 172, 174, 176, 178 and 180 each are a conveyor roller, 182 and 184 each are an exit, 186 is an illuvial tray, 200 is a developing tank, 202 is a fix-bleaching tank, 204 is a first washing tank, 206 is a second washing tank, 208 is a third washing tank, 210 is a forth washing tank, 302 is a conveyance unit, 304 is a swingback unit, 322 is a tray, α is a conveyance path, and β is a conveyance path.

The printer 114 in the image-forming equipment 110 is connected to the image processing unit 113 which in turn is connected to the scanner 112. The processor 115 is connected adjacent the printer 114 such that it receives the exposed light-sensitive material emerging from the printer 114. Note that the image-forming equipment 110 has a control section (a controller) 134 that controls its operation. The printer 114 is provided with two or more pairs of rollers for conveying the sheet body. The sheet body is conveyed using those pairs of rollers at a predetermined conveyance speed (hereinafter referred to as "first conveyance speed" as well).

The scanner 112 photoelectrically reads the projected light from the image on the film with an image sensor such as a CCD sensor, picks up the image data associated with the film (image data signals) and send them to the image processing unit 113.

In the image processing unit 113, the supplied image data is subjected to specified image processing steps and then sent to the printer 114 as image data (exposing conditions) for recording an image. Note that image processing unit 113 may be so configured that the image data as obtained by shooting with a digital still camera or the like is sent to the printer 114.

In the processor 115, the exposed sheet body (light-sensitive material) bearing the latent image is subjected to specified development and other processing steps, thereby producing a print that reproduces the image on the film. The processor 115 is provided with two or more pairs of rollers for conveying the sheet body. In the processor 115 also, the sheets are conveyed using those pairs of rollers at a predetermined conveyance speed (hereinafter referred to as "second conveyance speed" as well). Herein, the exposed sheet body undergoes photographic processing.

The sorter 119 collects the processed and dried sheet body, e.g., on a roll-of-film basis into groups.

The sub-scan roller pairs 146 and 148 are each made up of a conveyor roller (drive roller) for image exposure and a nip roller. The sub-scan rollers (or drive rollers exerting a driving force on the sheet body) used herein are hard rollers provided with special coatings, and the nip rollers imparting nip power thereto are rubber rollers having shaft rigidity and rubber hardness adjusted to individually specified values. The wording "conveyor rollers for image exposure" as used herein refers to the drive rollers for conveying a light-sensitive material in a sub-scanning direction. These drive rollers pair up with nip rollers to produce nip power (So, they are also referred to as sub-scan roller pairs) and convey a light-sensitive material in a sub-scanning direction. The term "hard rollers" as used herein refers to the metal rollers having special coatings on their respective surfaces. When the light-sensitive material is conveyed, the light-sensitive material can be nipped by the hard roller via point contact.

The drive roller is a hard roller made by providing a metal shaft surface with a coating of resin beads-containing urethane. By giving the coating to a metal shaft, the roller surface is prevented from deforming and the sub-scan conveyance can be performed with high accuracy, and besides, the roller surface can be kept smooth and thereby the drive roller can avoid making scratches on the sheet body and wearing the nip roller. For enhancing durability of the drive roller surface itself, it is appropriate that the urethane coating contain resin beads. The bead diameter of the resin beads contained in the urethane coating is preferably from 5 to 90 μm, far preferably from 5 to 30 μm, and the resin beads content is preferably from 10 to 40%. In the present invention, preferably in the seventh embodiment of the present invention, the thickness of the urethane coating of each drive roller is preferably from 20 to 100 μm, more preferably 25 to 50 μm. Additionally, the coating thickness is determined by the bead diameter selected.

The nip roller is a rubber roller having a rubber layer on a metal shaft. The hardness of the nip roller used in the present invention, preferably in the seventh embodiment of the present invention, is adjusted to preferably a hardness A range of 35 to 75 degrees (JIS K 6253), far preferably a hardness A range of 40 to 60 degrees (JIS K 6253). The rubber hardness falling short of the foregoing range brings about an increase in the load imposed on the interface between the drive roller and the nip roller increases and results in impairment of conveyance accuracy. On the other hand, the rubber hardness increased beyond the foregoing range brings about an increase in impacts of landing and takeoff actions of the nip roller and results in fluctuations in conveyance speed. The rubber material has no particular restriction so far as it enables hardness adjustment to the specified range described above for the present invention, but specifically EPDM, silicone, NBR and urethane can be given as examples thereof. As to the rigidity of the nip roller shaft, it is preferable that the nip roll has strength high enough to control the deformation quantity at the time of nip to the specified value or below. The term "deformation quantity" as used herein is defined by the sum of rubber deformation and roller shaft deflection. Herein, the deformation quantity is preferably 1.5 times or below the thickness of the sheet body, far preferably equal to or less than the thickness of the sheet body.

The exposing section 126 is composed of an exposing unit 136 connected to the image processing unit 113, auxiliary scanning roller pairs 146 and 148 that are provided upstream and downstream in the direction of transport such that they are on opposite sides of the exposing position r where the sheet body is exposed by scanning with the optical beams L issuing from the exposing unit 136 and which transport the sheet body at a specified speed for auxiliary scanning, and position detecting sensor 150 that is provided between the exposing position r and the auxiliary scanning roller pair 146 and which detects a pass of the sheet.

The exposing unit 136 may be a known optical beam scanning device which employs laser beams or other optical beams as recording light. This exposing unit 136 is typically composed of the following components: light sources that issue optical beams L in respective association with exposing of the sheet body to red (R) light, green (G) light and blue (B) light; modulating means such as AOM (acousto-optic modulator) which modulates the optical beams L from those light sources in accordance with the processed image data being supplied from the image processing unit 113; a light deflector such as a polygonal mirror which deflects the modulated optical beams L in a direction (main scanning direction) perpendicular to the direction of transport, and a mirror for adjusting the optical path of an fθ (scanning) lens such that the optical beams L deflected in the main scanning direction are focused to a specified beam diameter at a specified position on the exposing position r.

Alternatively, one may adopt digital exposure means that employ a variety of light-emitting arrays and space modulator arrays that extend in a direction perpendicular to the direction of transport, including a PDP (plasma display) array, an ELD (electroluminescence display) array, an LED (light-emitting diode) array, an LCD (liquid-crystal display) array, a DMD (digital micromirror device, registered trademark), and a laser array.

The width over which the laser beams L perform main scanning at the exposing position r in the exposing unit 136 is so set that it is associated with the width of the sheet body. The above-described operation of the exposing unit 136 is controlled by the control signals from the control section 134.

The optical beams L as the recording light are deflected in the main scanning direction (vertical direction to the paper on which FIG. 4 is drawn) as the sheet body is transported by means of the auxiliary scanning roller pairs 146 and 148. Thus, by means of the optical beams L modulated in accordance with the image data, the sheet body is exposed by two-dimensional scanning and a latent image is recorded. The present invention is preferable for its effects when the speed of a sheet body conveyed by pairs of rollers for the sub-scan is 90 mm/sec or above.

It should be noted here that the auxiliary scanning roller pairs 146 and 148 may be replaced by a scan transport mechanism that employs an exposure drum for transporting the sheet body as it is held in the exposing position r and two nip rollers on opposite sides of the exposing position r which are in contact with the exposure drum. Either configuration may be adopted as long as it is at least capable of recording an image on the sheet body in transport by performing scanning in a direction perpendicular to the direction of transport of the sheet body.

The sub-scan accepting section 128 is a section provided with two or more pairs of rollers supporting the front part of each sheet body protruding from the exposure section 126 by conveyance under recording in the exposure section 126, and has, e.g., 3 pairs of rollers. Each roller pair consists of a driving roller and a nip roller that is movable with respect to the driving roller so that it disengages the sheet out of the nipped state. The transport of the sheet body by means of the roller pairs is at the same speed as the transport by means of the auxiliary scanning roller pairs.

At the times when the front and the rear of a sheet of paper pass through a driving roller section during exposure recording, nip rollers are controlled so as to be alienated from the driving rollers and not to nip the sheet body. More specifically, after the front of the sheet body passes between a pair of rollers placed in an alienated state on the downstream side of the exposure point, the nip roller of the pair of rollers on the downstream side of the exposure point is brought into contact with the driving roller and nips the sheet body. And in this condition the sheet body is conveyed. In addition, just before the conclusion of passage of the rear of the sheet body between a pair of rollers on the upstream side of the exposure point, the nip of the pair of rollers on the upstream side of the exposure point is released; as a result, the sheet body is nipped only by the pair of rollers on the downstream side of exposure point and conveyed. This is because such a nip control can avoid causing a displacement from the exposure position of the sheet body and uneven exposure by minute vibrations resulting from passage of the front or the rear of a sheet body through the roller section as the nip rollers are in a nip state. Of course, the actions of the sub-scan accepting section 128 are controlled by control signals provided from the control section 134.

The present invention, preferably the sixth or seventh embodiment of the present invention, the sub-scan conveyance speed is preferably 90 mm/sec or above (more preferably from 90 mm/sec to 300 mm/sec), further preferably from 95 mm/sec to 200 mm/sec. The raster interval is preferably 500 μsec or below, more preferably 150 to 500 μsec, and further preferably 200 to 450 μsec. The term "raster interval" refers to the time interval at which light-beam exposure is performed intermittently in a direction of the sub-scan conveyance, more specifically, the time interval between exposures of some pixel and the pixel next thereto in the direction of sub-scan conveyance.

The time between the finish of scanning exposure and the start of color development is a latent image retention time corresponding to the time elapsed between the scanning exposure of some point on a light-sensitive material and the immersion of that point in a color developer through the medium of a conveying operation. When the light-sensitive material is conveyed in the sheet body and subjected to exposure processing, the sheet body in their entirety is not necessarily in a state of latent image retention defined in the present invention, preferably in the sixth embodiment of the present invention, but the time requirements according to the present invention may be satisfied by some exposed point on a sheet body. The time between the finish of scanning exposure and the start of color development is generally within 12 seconds (preferably from 1 to 12 seconds). And for such a time it is favorable to be within 10 seconds (preferably from 1 to 10 seconds), more favorable to be within 8 seconds (preferably from 1 to 8 seconds), and most favorable to be from 1 seconds to 5 seconds.

The compounds can be used for the present invention are described in detail below.

The group that can be used in the present invention is described in detail below.

In the present invention, when a specific site is called "a group", the site itself may not be substituted or may be substituted by one or more (to a possible maximum number) substituents. For example, "an alkyl group" means a substituted or unsubstituted alkyl group. Furthermore, the substituents which can be used in the compound for use in the present invention, include, irrespective of the presence or absence of substitution, any substituent.

The substituent represented by W may be any substituent and is not particularly limited, and, examples thereof include a halogen atom, an alkyl group [including cycloalkyl group, bicycloalkyl group and tricycloalkyl group, and also including an alkenyl group (including cycloalkenyl group and bicycloalkenyl group) and an alkynyl group], an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phophinyl group, a phosphinyloxy group, a phosphinylamino group, a phospho group, a silyl group, a hydrazino group, a ureido group, a boronic acid group, a phosphate group, a sulfate group, and other known substituents.

More specifically, W represents a halogen atom (e.g., fluorine, chlorine, bromine, iodine), an alkyl group [which means a linear, branched or cyclic substituted or unsubstituted alkyl group and which includes an alkyl group (preferably an alkyl group having from 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecyl-cyclohexyl), a bicycloalkyl group (preferably a substituted or unsubstituted bicycloalkyl group having from 5 to 30 carbon atoms, namely, a monovalent group resultant from removing one hydrogen atom of a bicycloalkane having from 5 to 30 carbon atoms, e.g., bicyclo[1,2,2]heptan-2-yl, bicyclo[2,2,2]octan-3-yl), and a tricyclo-structure having many cyclic structures, the alkyl group in the substituents described below (for example, an alkyl group in an alkylthio group) means an alkyl group having such a concept and further includes an alkenyl group and an alkynyl group], an alkenyl group [which means a linear, branched or cyclic substituted or unsubstituted alkenyl group and which includes an alkenyl group (preferably a substituted or unsubstituted alkenyl group having from 2 to 30 carbon atoms, e.g., vinyl, allyl, prenyl, geranyl, oreyl), a cycloalkenyl group (preferably a substituted or unsubstituted cycloalkenyl group having from 3 to 30 carbon atoms, namely, a monovalent group resultant from removing one hydrogen atom of a cycloalkene having from 3 to 30 carbon atoms, e.g., 2-cyclopenten-1-yl, 2-cyclohexen-1-yl), and a bicycloalkenyl group (a substituted or unsubstituted bicycloalkenyl group, preferably a substituted or unsubstituted bicycloalkenyl group having from 5 to 30 carbon atoms, namely, a monovalent group resultant from removing one hydrogen atom of a bicycloalkane having one double bond, e.g., bicyclo[2,2,1 ]hept-2-en-1-yl, bicyclo[2,2,2]oct-2-en-4-yl)], an alkynyl group (preferably a substituted or unsubstituted alkynyl group having from 2 to 30 carbon atoms, e.g., ethynyl, propargyl, trimethylsilylethynyl), an aryl group (preferably a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably a monovalent group resultant from removing one hydrogen atom of a 5- or 6-membered substituted or unsubstituted aromatic or non-aromatic heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl; the heterocyclic group may also be a cationic heterocyclic group such as 1-methyl-2-pyridinio and 1-methyl-2-quinolinio), a cyano group, a hydroxyl group, a nitro group, a carboxyl group, an alkoxy group (preferably a substituted or unsubstituted alkoxy group having from 1 to 30 carbon atoms, e.g., methoxy, ethoxy, isopropoxy, tert-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-tert-butylphenoxy, 3-nitrophenoxy, 2-tetradecanoylaminophenoxy), a silyloxy group (preferably a silyloxy group having from 3 to 20 carbon atoms, e.g., trimethylsilyloxy, tert-butyldimethylsilyloxy), a heterocyclic oxy group (preferably a substituted or unsubstituted heterocyclic oxy group having from 2 to 30 carbon atoms, e.g., 1-phenyltetrazol-5-oxy, 2-tetrahydropyranyloxy), an acyloxy group (preferably a formyloxy group, a substituted or unsubstituted alkylcarbonyloxy group having from 2 to 30 carbon atoms or a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, tert-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxycarbonyloxy), an amino group (preferably an amino group, a substituted or unsubstituted alkylamino group having from 1 to 30 carbon atoms or a substituted or unsubstituted anilino group having from 6 to 30 carbon atoms, e.g., amino, methylamino, dimethylamino, anilino, N-methylanilino, diphenylamino), an ammonio group (preferably an ammonio group or an ammonio group substituted by a substituted or unsubstituted alkyl, aryl or heterocyclic group having from 1 to 30 carbon atoms, e.g., trimethylammonio, triethylammonio, diphenylmethylammonio), an acylamino group (preferably a formylamino group, a substituted or unsubstituted alkylcarbonylamino group having from 1 to 30 carbon atoms or a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino),an aminocarbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), an alkoxycarbonylamino group (preferably a substituted or unsubstituted alkoxycarbonylamino group having from 2 to 30 carbon atoms, e.g., methoxycarbonylamino, ethoxycarbonylamino, tert-butoxycarbonylamino, n-octadecyloxycarbonylamino, N-methylmethoxycarbonylamino), an aryloxycarbonylamino group (preferably a substituted or unsubstituted aryloxycarbonylamino group having from 7 to 30 carbon atoms, e.g., phenoxycarbonylamino, p-chlorophenoxycarbonylamino, m-(n-octyloxy)phenoxycarbonylamino), a sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino), an alkyl- or aryl-sulfonylamino group (preferably a substituted or unsubstituted alkanesulfonylamino group having from 1 to 30 carbon atoms or a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio group having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzothiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkyl- or aryl-sulfinyl group (preferably a substituted or unsubstituted alkylsulfinyl group having from 1 to 30 carbon atoms or a substituted or unsubstituted arylsulfinyl group having from 6 to 30 carbon atoms, e.g., methylsulfinyl, ethylsulfinyl, phenylsulfinyl, p-methylphenylsulfinyl), an alkyl- or aryl-sulfonyl group (preferably a substituted or unsubstituted alkylsulfonyl group having from 1 to 30 carbon atoms or a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms or a substituted or unsubstituted heterocyclic carbonyl group having from 4 to 30 carbon atoms and being bonded to a carbonyl group through a carbon atom, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxycarbonyl, m-nitrophenoxycarbonyl, p-tert-butylphenoxycarbonyl), an alkoxycarbonyl group (preferably a substituted or unsubstituted alkoxycarbonyl group having from 2 to 30 carbon atoms, e.g., methoxycarbonyl, ethoxycarbonyl, tert-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)-carbamoyl), an aryl- or heterocyclic-azo group (preferably a substituted or unsubstituted arylazo group having from 6 to 30 carbon atoms or a substituted or unsubstituted heterocyclic-azo group having from 3 to 30 carbon atoms, e.g., phenylazo, p-chlorophenylazo, 5-ethylthio-1,3,4-thiadiazol-2-ylazo), an imido group (preferably N-succinimido, N-phthalimido), a phosphino group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino), a phospho group, a silyl group (preferably a substituted or unsubstituted silyl group having from 3 to 30 carbon atoms, e.g., trimethylsilyl, tert-butyidimethylsilyl, phenyldimethylsilyl), a hydrazino group (preferably a substituted or unsubstituted hydrazino group having from 0 to 30 carbon atoms, e.g., trimethylhydrazino) or a ureido group (preferably a substituted or unsubstituted ureido group having from 0 to 30 carbon atoms, e.g., N,N-dimethylureido).

The substituent represented by W may also have a structure condensed with a ring (an aromatic or non-aromatic hydrocarbon ring, a heterocyclic ring or a polycyclic condensed ring formed by the combination of these rings, e.g., benzene ring, naphthalene ring, anthracene ring, quinoline ring, phenanthrene ring, fluorene ring, triphenylene ring, naphthacene ring, biphenyl ring, pyrrole ring, furan ring, thiophene ring, imidazole ring, oxazole ring, thiazole ring, pyridine ring, pyrazine ring, pyrimidine ring, pyridazine ring, indolizine ring, indole ring, benzofuran ring, benzothiophene ring, isobenzofuran ring, quinolizine ring, isoquinoline ring, phthalazine ring, naphthyridine ring, quinoxaline ring, quinoxazoline ring, quinoline ring, carbazole ring, phenanthridine ring, acridine ring, phenanthroline ring, thianthrene ring, chromene ring, xanthene ring, phenoxathiine ring, phenothiazine ring, phenazine ring).

Among these substituents W, those having a hydrogen atom may be deprived of the hydrogen atom and substituted by the above-described substituent. Examples of this functional group include —$CONHSO_2$— group (sulfonylcarbamoyl group, carbonylsulfamoyl group), —CONHCO— group (carbonylcarbamoyl group), and —$SO_2NHSO_2$— group (sulfonylsulfamoyl group).

Specific examples thereof include an alkylcarbonylaminosulfonyl group (e.g., acetylaminosulfonyl), an arylcarbonylaminosulfonyl group (e.g., benzoylaminosulfonyl), an alkylsulfonylaminocarbonyl group (e.g., methylsulfonylaminocarbonyl), and an arylsulfonylaminocarbonyl group (e.g., p-methylphenylsulfonylaminocarbonyl).

The silver halide color photographic light-sensitive material (hereinafter, sometimes referred to simply as "light-sensitive material"), to which the image-forming method of the present invention is to be applied, is explained in more detail below.

In the present invention, as described above, the constitution of silver halide color photographic light-sensitive material contains, on a support, at least one yellow dye-forming blue-sensitive silver halide emulsion layer, at least one magenta dye-forming green-sensitive silver halide emulsion layer, and at least one cyan dye-forming red-sensitive silver halide emulsion layer. In the first to forth embodiments of the present invention, it is preferable that the silver halide color photographic light-sensitive material further contains at least one light-insensitive hydrophilic colloid layer. The yellow dye-forming coupler functions as a yellow color-forming layer, the magenta dye-forming coupler functions as a magenta color-forming layer, and the cyan dye-forming coupler functions as a cyan color-forming layer. Preferably, the silver halide emulsions contained in the yellow color-forming layer, the magenta color-forming layer, and the cyan color-forming layer may have photo-sensitivities to mutually different wavelength regions of light (for example, light in a blue region, light in a green region, and light in a red region).

In addition to the light-insensitive dye-forming-coupler-containing layer and/or the non-color-forming intermediate layer, the light-sensitive material of the present invention may have an antihalation layer, an intermediate layer, and/or a coloring layer as a light-insensitive hydrophilic colloid layer illustrated hereinafter, if necessary.

In the photographic light-sensitive material of the present invention, preferably of the second embodiment of the present invention, at least one compound selected from those represented by the formula (IA) illustrated hereinafter may be contained as a cyan-dye-forming coupler and at least one compound selected from those represented by the formula (M-I) (especially the formula (M-III)) may be contained as a magenta-dye-forming coupler. In general, the cyan-dye-forming coupler is used in a red-sensitive silver halide emulsion layer and the magenta-dye-forming coupler is used in a green-sensitive silver halide emulsion layer.

The light-sensitive material of the present invention, preferably of the third embodiment of the present invention, may be a light-sensitive material containing at least one compound represented by formula (IA) as a cyan-dye-forming coupler in a red-sensitive silver halide emulsion layer and showing a photographic characteristic that a change in cyan density after the aforementioned development processing (Dc) is 0.02 or below. In addition, it is preferable that the light-sensitive material contains at least one compound represented by formula (M-1) (especially formula (M-II)) as shown hereinafter as a magenta-dye-forming coupler in a green-sensitive emulsion layer.

The compounds represented by formula (I) are illustrated below.

Formula (I)

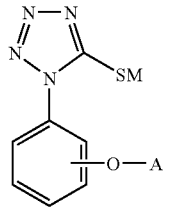

In formula (I), M represents a cation. M is preferably hydrogen ion, alkali metal ion (for example, sodium ion, potassium ion), ammonium ion, tetra-substituted ammonium ion (for example, tetramethyl ammonium ion, tetraethyl ammonium ion) or silver ion. A represents a substituted or unsubstituted alkyl group. The alkyl group as A is preferably an unsubstituted alkyl group, far preferably an unsubstituted alkyl group containing 1 to 6 (preferably 1 to 4) carbon atoms, particularly preferably methyl, ethyl or propyl. When A has a substitutent, the substituent may be a hydroxyl group for instance.

It is preferable that the compound represented by formula (I) is added to at least one of silver halide emulsion layers or at least one of light-insensitive hydrophilic colloid layers.

Herein, an amount of the compound of formula (I) is not particularly limited to its usage as far as it can produce effects of the present invention. However, it is preferable that the amount of the compound of formula (I) used in a silver halide color photographic light-sensitive material is from 0.1 $mg/m^2$ to 3.0 $mg/m^2$, particularly from 0.3 $mg/m^2$ to 2.5 $mg/m^2$.

Specific examples of the compound represented by formula (I) are shown below. However, the present invention is not limited thereto.

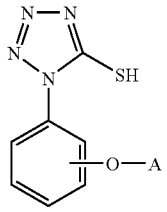

| Compound No. | Binding site of A—O— group | A |
|---|---|---|
| I-1 | 3-site | —$CH_3$ |
| I-2 | 3-site | —$C_2H_5$ |
| I-3 | 3-site | —$C_3H_7$(n) |
| I-4 | 3-site | —$C_4H_9$(n) |
| I-5 | 4-site | —$CH_3$ |

-continued

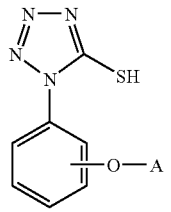

| Compound No. | Binding site of A—O— group | A |
|---|---|---|
| I-6 | 4-site | $—C_2H_5$ |
| I-7 | 4-site | $—C_3H_7(n)$ |
| I-8 | 4-site | $—C_4H_9(n)$ |

In the next place, compounds represented by formula (II) are illustrated.

When the compound represented by formula (II) in an amount of 1.4 mg/m$^2$ or greater is used in a photographic constituent layer of a silver halide color photographic light-sensitive material, it has been found to produce an effect of improving abrasion sensitivity of the photographic material in wet state when the photographic light-sensitive material is cut into sheets and conveyed at a speed of 40 mm/sec or higher in accordance with nip conveyance using two or more pairs of conveyor rollers.

The compounds represented by formula (II) are illustrated below in detail.

Formula (II)

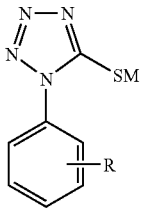

In formula (II), M represents a cation. M is preferably hydrogen ion, alkali metal ion (for example, sodium ion, potassium ion), ammonium ion, tetra-substituted ammonium ion (for example, tetramethyl ammonium ion, tetraethyl ammonium ion) or silver ion.

In formula (II), R represents a group with the atomic or molecular weight of 100 or less or group with the total of the atomic weight of 100 or less, specifically, hydrogen atom, halogen atom, alkyl group (e.g., methyl group, ethyl group, propyl group), alkoxy group (e.g., methoxy group, ethoxy group), carboxyl group, hydroxyl group, amino group, ureido group, aryl group, alkenyl group or amido group. These groups each may have substituents, provided that the sum total of atomic or molecular weight of R and those of the substituents is 100 or below. Preferred as R are a hydrogen atom, a halogen atom, an ureido group, an amido group and an alkoxy group, especially an ureido group, an amido group and an alkoxy group.

A substituent the group represented by R may have is, e.g., a hydroxyl group.

Specific examples of the compound represented by formula (II) are shown below. However, the present invention is not limited thereto.

1-phenyl-5-mercaptotetrazole, 1-(5-methylureidophenyl)-5-mercaptotetrazole, 1-(4-hydroxymethylphenyl)-5-mercaptotetrazole, 1-(4-sulfomethylphenyl)-5-mercaptotetrazole, 1-(4-acetylphenyl)mercaptotetrazole, 1-(3-hydroxymethylphenyl)-5-mercaptotetrazole, 1-(4-hydroxyphenyl)-5-mercaptotetrazole, 1-(4-methylsulfoaminophenyl)-5-mercaptotetrazole, 1-(2-aminophenyl)-5-mercaptotetrazole, 1-(4-dimethylaminophenyl)-5-mercaptotetrazole, 1-(4-methoxyphenyl)-5-mercaptotetrazole, 1-(4-hydroxyethylphenyl)-5-mercaptotetrazole, 1-(4-propylphenyl)-5-mercaptotetrazole, 1-(2-chlorophenyl)-5-mercaptotetrazole, 1-(4-methoxyphenyl)-5-mercaptotetrazole, 1-(4-carboxymethylphenyl)-5-mercaptotetrazole, 1-(5-acetamidophenyl)-5-mercaptotetrazole, 1-(5-ethoxyphenyl)-5-mercaptotetrazole, and the like can be mentioned.

Additionally, the hydrogen atoms of the mercapto groups as recited above may be replaced by cations other than those recited above. And these compounds may be used in combination of two or more thereof. Some of combinations can enhance effects of the present invention.

Of the compounds recited above as those represented by formula (II), 1-(5-acetamidophenyl)-5-mercaptotetrazole, 1-phenyl-5-merccaptotetrazole, 1-(5-methylureidophenyl)-5-mercaptotetrazole and 1-(5-ethoxyphenyl)-5-mercaptotetrazole are preferred over the others. And 1-(5-acetamidophenyl)-5-mercaptotetrazole and 1-(5-ethoxyphenyl)-5-mercaptotetrazole are more preferable.

It is preferable that the compound represented by formula (II) is added to at least one of silver halide emulsion layers or at least one of light-insensitive hydrophilic colloid layers.

When the compound represented by formula (II) is used in a silver halide photographic light-sensitive material, the content of the compound of formula (II) is at least 1.4 mg/m$^2$ (preferably from 1.4 to 4 mg/m$^2$). The far preferred content is from 1.5 mg/m$^2$ to 3.0 mg/m$^2$.

For the purpose of furthering image enhancements, speedy output and productivity improvements aimed at silver halide photographic light-sensitive material, especially color photographic paper designed for laser scanning exposure, and image formation methods using thereof, we have made an intensive study for shortening the high-density high-speed exposure time and the time between exposure and color development. As a result, it has turned out that, when conventional color photographic paper was used in such image formation methods, there arose a problem that streaked unevenness developed in prints made. As a result of analyzing causes of such a problem, it has been found that the streaked unevenness manifested itself in low-temperature surroundings in particular and arose from condensation on emulsion-side rollers for conveying photographic paper to a color developing apparatus after exposure. Therefore, we have made various consideration in order to resolve this problem, and have found that the streaked unevenness can be eliminated by forming a layer of silver bromide-containing phase, or forming a layer of silver iodide-containing phase or incorporating a hexacoordinate iridium complex having at least two different kinds of ligands in a silver halide emulsion for use in color photographic paper.

The silver halide emulsion is described below.

The silver halide emulsion or emulsions that can be used in the present invention preferably contain specific silver halide grains. The shape of the silver halide particles contained in the silver halide emulsion that can be used in the present invention, is not particularly limited. The shape is preferably such that the grains are composed of cubic or tetradecahedron crystal particles substantially having a {100} plane (these crystal particles may have a round particle top and high-order planes), octahedron crystal particles, or tabular particles in which 50% or more of all the projected areas thereof are comprised of a {100} or {111} plane and have an aspect ratio of 2 or more (in the present invention, preferably in the sixth or seventh embodiment of the present invention, the aspect ratio is preferably 3 or more). The aspect ratio is a value obtained by dividing the diameter of a circle having an area equivalent to the projected area of an individual grain by the thickness of the particle. Tabular grains having major surfaces made up of {100} planes or {111} planes are described in detail in JP-A-2000-352794, paragraph Nos. 0033 to 0044, and the descriptions therein are herein preferably incorporated by reference into the specification of the present application. In the present invention, cubic or tetradecahedron crystal particles or octahedron crystal particles are further preferable.

In the present invention, preferably in the forth embodiment of the present invention, cubic grains are most preferable. It is appropriate that the grain size be 0.5 μm or below (preferably from 0.1 to 0.5 μm), far preferably 0.4 μm or below (particularly preferably from 0.1 to 0.4 μm), based on cube-equivalent edge length.

The term "edge length of a cube" as used herein signifies the length of an edge calculated from a cube having the same volume as each individual grain, and has the same meaning as cube-equivalent edge length in this specification. Emulsion grains for use in the present invention are preferably monodisperse with respect to grain size distribution. The variation coefficient of the total emulsion grains for use in the present invention with respect to the cube-equivalent edge length is preferably 20% or below, far preferably 15% or below, particularly preferably 10% or below. The variation coefficient with respect to cubic-equivalent edge length is expressed in percentage of a standard deviation calculated from the cubic-equivalent edge lengths of individual grains on the average of the edge lengths. In this connection, for the purpose of obtaining broad latitude, it is preferred that the above-mentioned monodisperse emulsions be used as blended in the same layer, or coated by a multilayer coating method.

The silver halide emulsion that can be used in the present invention may contain silver halide grains other than the silver halide grains according to the present invention (i.e., the specific silver halide grains). In the silver halide emulsion for use in the present invention, however, a ratio of the specific silver halide grains according to the present invention in the total projected area of the all silver halide grains is preferably 50% or more, and it is more preferably 80% or more, still more preferably 90% or more.

A silver halide emulsion for use in the present invention generally contains a silver chloride, and the silver chloride content is preferably 90 mol % or more, more preferably 93 mol % or more in view of rapid processing performance, and still more preferably 95 mol % or more.

A silver halide emulsion for use in the present invention preferably contains a silver bromide and/or a silver iodide. The silver bromide content is preferably from 0.1 to 7 mol %, and more preferably from 0.5 to 5 mol %, in view of high contrast and excellent latent image stability. The silver iodide content is preferably from 0.02 to 1 mol %, more preferably from 0.05 to 0.50 mol %, and most preferably from 0.07 to 0.40 mol %, in view of high sensitivity and high contrast under high illumination intensity exposure.

In the present invention, preferably in the sixth or seventh embodiment of the present invention, the silver halide grains preferably have a silver chloride content of 90 mol % or above, and the silver chloride content is more preferably at least 95 mol %, particularly preferably at least 98 mol %. When the silver halide emulsion for use in the present invention has a silver bromide-containing phase, the silver bromide content therein is preferably from 0.1 to 4 mol %, more preferably from 0.5 to 2 mol %. When the silver halide emulsion for use in the present invention has a silver iodide-containing phase, the silver iodide content therein is preferably from 0.02 to 1 mol %, more preferably from 0.05 to 0.50 mol %, further preferably from 0.07 to 0.40 mol %.

The silver halide grains for use in the present invention are preferably silver chloroiodobromide grains, and more preferably silver chloroiodobromide grains having the above-described halogen composition.

The silver halide grains for use in the present invention may have a silver bromide-containing phase and/or a silver iodide-containing phase. Herein, a region where the content of silver bromide is higher than that in other regions will be referred to as a silver bromide-containing phase, and likewise, a region where the content of silver iodide is higher than that in other regions will be referred to as a silver iodide-containing phase. The halogen compositions of the silver bromide-containing phase or the silver iodide-containing phase and of its periphery may vary either continuously or drastically. Such a silver bromide-containing phase or a silver iodide-containing phase may form a layer which has an approximately constant concentration and has a certain width at a certain portion in the grain, or it may form a maximum point having no spread. The localized silver bromide content in the silver bromide-containing phase is preferably 5 mol % or more, more preferably from 10 to 80 mol %, and most preferably from 15 to 50 mol % in the present invention, preferably in the second or third embodiment of the present invention. The localized silver bromide content in the silver bromide-containing phase is preferably 2 mol % or more, more preferably from 3 to 50 mol %, and most preferably from 4 to 20 mol % in the present invention, preferably in the forth embodiment of the present invention. The localized silver bromide content in the silver bromide-containing phase is preferably 3 mol % or more, more preferably from 5 to 40 mol %, and most preferably from 5 to 25 mol % in the present invention, preferably in the sixth or seventh embodiment of the present invention. The localized silver iodide content in the silver iodide-containing phase is preferably 0.3 mol % or more, more preferably from 0.5 to 8 mol %, and most preferably from 1 to 5 mol %. Such silver bromide- or silver iodide-containing phase may be present in plural numbers in layer form, within the grain. In this case, the phases may have different silver bromide or silver iodide contents from each other. The silver halide grain for use in the present invention has at least one of the silver bromide-containing phase and silver iodide-containing phase. Preferably, it contains both at least one silver bromide-containing phase and at least one silver iodide-containing phase.

The silver bromide-containing phase or silver iodide-containing phase formed in the silver halide layer preferably form so as to surround the grain. One preferred embodiment is that the silver bromide-containing phase or the silver iodide-containing phase formed in the layer form has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain to have a concentration distribution. For example, when the emulsion grain has the silver bromide-containing phase or silver iodide-containing phase formed in the layer form so as to surround the grain in the vicinity of the grain surface, the silver bromide or silver iodide concentration of a corner portion or an edge of the grain can be different from that of a main plane of the grain. Further, aside from the silver bromide-containing phase and silver iodide-containing phase formed in the layer form so as to surround the grain, another silver bromide-containing phase or silver iodide-containing phase not surrounding the grain may exist in isolation at a specific portion of the surface of the grain.

In a case where the silver halide emulsion contains a silver bromide-containing phase, it is preferable that said silver bromide-containing phase is formed in a layer form so as to have a concentration maximum of silver bromide inside of the grain. Likewise, in a case where the silver halide emulsion for use of the present invention contains a silver iodide-containing phase, it is preferable that said silver iodide-containing phase is formed in a layer form so as to have a concentration maximum of silver iodide on the surface of the grain. Such a silver bromide-containing phase or silver iodide-containing phase is constituted preferably with a silver amount of 3% to 30%, more preferably with a silver amount of 3% to 15%, in terms of the grain volume, in the viewpoint of increasing the local concentration with a smaller silver bromide or silver iodide content.

The silver halide emulsion preferably contains both a silver bromide-containing phase and a silver iodide-containing phase. In this case, the silver bromide-containing phase and the silver iodide-containing phase may exist either at the same place in the grain or at different places thereof. It is preferred that these phases exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

A silver bromide content and/or a silver iodide content of a silver halide emulsion increase with the silver bromide-containing phase and/or the silver iodide-containing phase being formed in more inside of the grain. This causes the silver chloride content to decrease to more than necessary, resulting in the possibility of impairing rapid processing suitability. Accordingly, for putting together these phases or functions for controlling photographic actions, in the vicinity of the surface of the grain, it is preferred that the silver bromide-containing phase and the silver iodide-containing phase are placed adjacent to each other. From these points, it is preferred that the silver bromide-containing phase is formed at any of the position ranging from 50% to 100% of the grain volume measured from the inside, and that the silver iodide-containing phase is formed at any of the position ranging from 85% to 100% of the grain volume measured from the inside. Further, it is more preferred that the silver bromide-containing phase is formed at any of the position ranging from 70% to 95% of the grain volume measured from the inside, and that the silver iodide-containing phase is formed at any of the position ranging from 90% to 100% of the grain volume measured from the inside.

When the silver halide emulsion for use in the present invention has a silver bromide-containing phase, another suitable mode of the silver halide emulsion having a silver bromide-containing phase is a mode in which the silver halide emulsion has a region ranging in silver bromide content from 0.5 to 20 mol % at a depth of 20 nm or less below the emulsion grain surface. Herein, it is preferable for the silver bromide-containing phase to be at a depth of 10 nm or less below the emulsion grain surface and to range in silver bromide content preferably from 0.5 to 10 mol %, more preferably from 0.5 to 5 mol %. In this case, it is not always required that the silver bromide-containing phase take a layer form. For maximizing the effects of the present invention, however, it is appropriate that the silver bromide-containing phase be formed so as to take a layer form and ring itself round each emulsion grain.

When the silver halide emulsion for use in the present invention has a silver iodide-containing phase, another suitable mode of the silver halide emulsion having a silver iodide-containing phase is a mode in which the silver halide emulsion has a region ranging in silver iodide content from 0.3 to 10 mol % at a depth of 20 nm or less below the emulsion grain surface. Herein, it is preferable for the silver iodide-containing phase to be situated at a depth of 10 nm or less below the emulsion grain surface and to range in silver iodide content preferably from 0.5 to 10 mol %, more preferably from 0.5 to 5 mol %. In this case, it is not always required that the silver iodide-containing phase take a layer form. For maximizing the effects of the present invention, however, it is appropriate that the silver iodide-containing phase be formed so as to take a layer form and ring itself round each emulsion grain.

In order to introduce bromide ions or iodide ions, a bromide salt or iodide salt solution may be added alone, or it may be added in combination with both a silver salt solution and a high chloride salt solution. In the latter case, the bromide or iodide salt solution and the high chloride salt solution may be added separately, or as a mixture solution of these salts of bromide or iodide and high chloride. The bromide or iodide salt is generally added in a form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of an iodide ion to a high chloride emulsion may be limited. The deeper in the emulsion grain the iodide ion is introduced, the smaller is the increment of sensitivity. Accordingly, the addition of an iodide salt solution is preferably started at 50% or outer side of the volume of the grain, more preferably 70% or outer side, and most preferably 85% or outer side. Moreover, the addition of an iodide salt solution is preferably finished at 98% or inner side of the volume of the grain, more preferably 96% or inner side. When the addition of an iodide salt solution is finished at a little inner side of the grain surface, an emulsion having higher sensitivity and lower fog can be obtained.

On the other hand, the addition of a bromide salt solution is preferably started at 50% or outer side, more preferably 70% or outer side of the volume of the grain.

The distribution of a bromide ion concentration and iodide ion concentration in the depth direction of the grain can be measured, according to an etching/TOF-SIMS (Time of Flight-Secondary Ion Mass Spectrometry) method by means of, for example, TRIFT II Model TOF-SIMS apparatus (trade name, manufactured by Phi Evans Co.). ATOF-SIMS method is specifically described in, Nippon Hyomen Kagakukai edited, "Hyomen Bunseki Gijutsu Sensho Niji Ion Shitsuryo Bunsekiho (Surface Analysis Technique Selection—Secondary Ion Mass Analytical Method)", Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. In the analysis with the etching/TOF-SIMS method, it is preferred that the emulsion for use in the present invention has the maximum concentration of iodide ions at the surface of the grain, that the iodide ion concentration decreases inwardly in the grain, and that the bromide ions preferably have the maximum concentration in the inside of the grain. The local concentration of silver bromide can also be measured with X-ray diffractometry, as long as the silver bromide content is high to some extent.

The variation coefficient of sphere-equivalent diameter of the all grains in the silver halide emulsion is preferably 20% or less, more preferably 15% or less, and still more preferably 10% or less. The variation coefficient of sphere-equivalent diameter is expressed as a percentage of standard deviation of sphere-equivalent diameter of each grain, to an average of sphere-equivalent diameter. In this connection, for the purpose of obtaining broad latitude, it is preferred that the above-mentioned monodisperse emulsions be used as blended in the same layer, or coated by a multilayer coating method. In the present specification, the sphere-equivalent diameter is indicated by a diameter of a sphere having the same volume as that of individual grain. Preferably, the emulsion for use in the present invention comprises grains having a monodisperse-grain size-distribution.

The sphere-equivalent diameter of the emulsion grains in the silver halide emulsion layer containing a yellow-dye-forming coupler is preferably 0.7 μm or below, further preferably 0.6 μm or below, and most preferably 0.5 μm or below. Both the sphere-equivalent diameter of the emulsion grains in the silver halide emulsion layer containing a magenta-dye-forming coupler and that in the silver halide emulsion layer containing a cyan-dye-forming coupler are preferably 0.5 μm or below, further preferably 0.4 μm or below, and most preferably 0.3 μm or below. The lower limit of the sphere-equivalent diameter of the silver halide grains is preferably 0.05 μm, and more preferably 0.1 μm. The grain having a sphere-equivalent diameter of 0.6 μm corresponds to a cubic grain having a side length of approximately 0.48 μm, the grain having a sphere-equivalent diameter of 0.5 μm corresponds to a cubic grain having a side length of approximately 0.4 μm, the grain having a sphere-equivalent diameter of 0.4 μm corresponds to a cubic grain having a side length of approximately 0.32 μm, and the grain having a sphere-equivalent diameter of 0.3 μm corresponds to a cubic grain having a side length of approximately 0.24 μm, respectively. The silver halide emulsion defined in the present invention may contain silver halide grains other than the silver halide grains according to the present invention (i.e., the specific silver halide grains). In the silver halide emulsion defined in the present invention, however, a ratio of the specific silver halide grains in the total projected area of the all silver halide grains is preferably 50% or more, and it is more preferably 80% or more, still more preferably 90% or more.

The silver halide emulsion preferably contains iridium. Iridium preferably forms an iridium complex. A six-coordination complex having 6 ligands and containing iridium as a central metal is preferable, for uniformly incorporating iridium in a silver halide crystal. One embodiment of the present invention in which the specific silver halide grains in the silver halide emulsion are silver halide grains each of which contains a hexacoordinate iridium complex having at least two different kinds of ligands is particularly preferred. Of the hexacoordinate iridium complexes, hexacoordinate iridium complexes having both halogen (e.g., Cl, Br and I) and organic ligands in one and the same complex and hexacoordinate iridium complexes having both halogen and another inorganic ligands in one and the same complex are preferable. It is more preferred that the silver halide grains contain in each grain a combination of a haxacoordinate iridium complex having both halogen and organic ligands and a hexacoordinate iridium complex having both halogen and another inorganic ligands.

It is preferred that the specific silver halide grains in the silver halide emulsion that can be used in the present invention, contain a six-coordination complex having at least one ligand other than a halogen (nonhalogen ligand) or ligand other than a cyan and containing iridium as a central metal. A six-coordination complex having $H_2O$, OH, O, OCN or azole (preferably thiazole, a substituted thiazole, thiadiazole or a substituted thiadiazole, more preferably thiazole or a substituted thiazole) as a ligand and containing iridium as a central metal is preferable. A six-coordination complex in which at least one ligand is $H_2O$, OH, O, OCN, thiazole or substituted thiazoles and the remaining ligands are Cl, Br or I, and iridium is a central metal, is more preferable. A six-coordination complex in which one or two ligands are 5-methylthiazole, 2-chloro-5-fluorothiadiazole or 2-bromo-5-fluorothiadiazole and the remaining ligands are Cl, Br or I, and iridium is a central metal, is most preferable.

The six-coordination complex, in which iridium is a central metal, that can be preferably used in the present invention is a metal complex represented by the following formula (α);

$$[IrX^I_{n1}L^I_{(6-n1)}]^{m1} \qquad \text{Formula } (\alpha)$$

wherein $X^I$ represents a halogen ion or a pseudo halogen ion other than a cyanate ion; $L^I$ represents a ligand different from $X^I$; n1 represents an integer of 3 to 5; and m1 represents a charge of the metal complex and it is an integer of −4 to −1, 0 or +1. The term "an integer of −4 to −1" is employed to indicate −4, −3, −2 or −1.

Here, from 3 to 5 $X^I$s may be the same or different from each other. When $L^I$ is present in plurality, these plural $L^I$s may be the same or different from each other.

In formula (α), the pseudo halogen ion (halogenide) is an ion having a nature similar with that of halogen ion and can include, for example, cyanide ion ($CN^-$), thiocyanate ion ($SCN^-$), selenocyanate ion ($SeCN^-$), tellurocyanate ion ($TeCN^-$), azide dithiocarbonate ion ($SCSN_3^-$), cyanate ion ($OCN^-$), fulminate ion ($ONC^-$), and azide ion ($N_3^-$).

$X^I$ is preferably a fluoride ion, a chloride ion, a bromide ion, an iodide ion, a cyanide ion, an isocyanate ion, a thiocyanate ion, a nitrate ion, a nitrite ion, or an azide ion. A chloride ion and a bromide ion are particularly preferable. $L^I$ has no particular limitation so long as it is a ligand different from $X^I$, and it may be an organic or inorganic compound that may or may not have electric charges, with organic or inorganic compounds with no electric charge being preferable.

Among the metal complexes represented by formula (α), metal complexes represented by formula (αA) are preferred;

$$[IrX^{IA}_{n1}L^{IA}_{(6-n1)}]^{m1} \qquad \text{Formula } (\alpha A)$$

wherein, in formula (αA), $X^{IA}$ represents a halogen ion or a pseudo halogen ion other than a cyanate ion; $L^{IA}$ represents a ligand different from $X^{IA}$; n1 represents an integer of 3 to 5; and ml represents an integer of −4 to +1.

In formula (αA), $X^{IA}$ has the same meanings as $X^{I}$ in formula (α) and preferable ranges are also identical. $L^{IA}$ is preferably water, OCN, ammonia, phosphine and carbonyl, with water being particularly preferable.

Here, from 3 to 5 $X^{IA}$s may be the same or different from each other. When $L^{IA}$ is present in plurality, these plural $L^{IA}$s may be the same or different from each other.

Among the metal complexes represented by formula (α), metal complexes represented by formula (αB) are preferred;

$$[IrX^{IB}_{n1}L^{IB}_{(6-n1)}]^{m1} \quad \text{Formula (αB)}$$

In formula (αB), $X^{IB}$ represents a halogen ion or a pseudo halogen ion other than a cyanate ion; $L^{IB}$ represents a ligand having a chain or cyclic hydrocarbon as a basic structure, or in which a portion of carbon atoms or hydrogen atoms of the basic structure is substituted with other atoms or atom groups; n1 represents an integer of 3 to 5; and ml represents an integer of −4 to +1.

In formula (αB), $X^{IB}$ has the same meanings as $X^{I}$ in formula (α) and preferable ranges are also identical. $L^{IB}$ represents a ligand having a chain or cyclic hydrocarbon as a basic structure, or in which a portion of carbon atoms or hydrogen atoms of the basic structure is substituted with other atoms or atom groups, but it does not include a cyanide ion. $L^{IB}$ is preferably a heterocyclic compound, more preferably a 5-membered heterocyclic compound ligand. Among the 5-membered heterocyclic compound, compounds having at least one nitrogen atom and at least one sulfur atom in its 5-membered ring skeleton are further preferred.

Here, from 3 to 5 $X^{IB}$s may be the same or different from each other. When $L^{IB}$ is present in plurality, these plural $L^{IB}$s may be the same or different from each other.

Among the metal complexes represented by formula (αB), metal complexes represented by formula (αC) are more preferred;

$$[IrX^{IC}_{n1}L^{IC}_{(6-n1)}]^{m1} \quad \text{Formula (αC)}$$

In formula (αC), $X^{IC}$ represents a halogen ion or a pseudo halogen ion other than a cyanate ion; $L^{IC}$ represents a 5-membered ring ligand having at least one nitrogen atom and at least one sulfur atom in its ring skeleton that may have a substituent on the carbon atoms in said ring skeleton; n1 represents an integer of 3 to 5; and ml represents an integer of −4 to +1.

In formula (αC), $X^{IC}$ has the same meanings as $X^{I}$ in formula (α) and preferable ranges are also identical. The substituent on the carbon atoms in said ring skeleton in $L^{IC}$ is preferably a substituent having a smaller volume than n-propyl group. Preferable substituents are a methyl group, an ethyl group, a methoxy group, an ethoxy group, a cyano group, an isocyano group, a cyanate group, an isocyanate group, a thiocyanate group, a isothiocyanate group, a formyl group, a thioformyl group, a hydroxyl group, a mercapto group, an amino group, a hydrazine group, an azide group, a nitro group, a nitroso group, a hydrxyamino group, a carboxy group, a carbamoyl group, a fluoride group, a chloride group, a bromide group and an iodide group.

Here, from 3 to 5 $X^{IC}$s may be the same or different from each other. When $L^{IC}$ is present in plurality, these plural $L^{IC}$s may be the same or different from each other.

Preferable specific examples of the metal complexes represented by formula (a) are shown below. However, the present invention is not limited to these complexes.

$[IrCl_5(H_2O)]^{2-}$
$[IrCl_4(H_2O)_2]^{-}$
$[IrCl_5(H_2O)]^{-}$
$[IrCl_4(H_2O)_2]^{0}$
$[IrCl_5(OH)]^{3-}$
$[IrCl_4(OH)_2]^{2-}$
$[IrCl_5(OH)]^{2-}$
$[IrCl_4(OH)_2]^{2-}$
$[IrCl_5(O)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$
$[IrBr_4(OH)_2]^{2-}$
$[IrBr_5(OH)]^{2-}$
$[IrBr_4(OH)_2]^{2-}$
$[IrBr_5(O)]^{4-}$
$[IrBr_4(O)_2]^{5-}$
$[IrBr_5(O)]^{3-}$
$[IrBr_4(P)_2]^{4-}$
$[IrCl_5(OCN)]^{3-}$
$[IrBr_5(OCN)]^{3-}$
$[IrCl_5(\text{thiazole})]^{2-}$
$[IrCl_4(\text{thiazole})_2]^{-}$
$[IrCl_3(\text{thiazole})_3]^{0}$
$[IrBr_5(\text{thiazole})]^{2-}$
$[IrBr_4(\text{thiazole})_2]^{-}$
$[IrBr_3(\text{thiazole})_3]^{0}$
$[IrCl_5(\text{5-methylthiazole})]^{2-}$
$[IrCl_4(\text{5-methylthiazole})_2]^{-}$
$[IrBr_5(\text{5-methylthiazole})]^{2-}$
$[IrBr_4(\text{5-methylthiazole})_2]^{-}$
$[IrCl_5(\text{5-chlorothiadiazole})]^{2-}$
$[IrCl_4(\text{5-chlorothiadiazole})_2]^{-}$
$[IrBr_5(\text{5-chlorothiazole})]^{2-}$
$[IrBr_4(\text{5-chlorothiadiazole})_2]^{-}$
$[Ir(\text{2-chloro-5-fluorothiadiazole})Cl_5]^{2-}$
$[[Ir(\text{2-blomo-5-fluorothiadiazole})\ Cl_5]^{2-}$ A six coordination complex having 6 ligands, all of which are Cl, Br or I, and iridium as a central metal, is more preferred. In this case, Cl, Br or I may be a mixture of them in the six-coordination complex. The six-coordination complex having Cl, Br or I as a ligand, and iridium as a central metal is particularly preferably incorporated in a silver bromide-containing phase in order to obtain hard gradation upon high illuminance exposure.

Specific examples of the iridium complex in which all of 6 ligands are made of Cl, Br or I are shown below. However, Iridium in the present invention is not limited to these complexes.

$[IrCl_6]^{2-}$
$[IrCl_6]^{3-}$
$[IrBr_6]^{2-}$
$[IrBr_6]^{3-}$
$[IrI_6]^{3-}$

In addition to the above iridium complexes, it is preferred for a silver halide emulsion to contain six-coordinate complexes having CN as the ligands with Fe, Ru, Re or Os as the central metal, e.g., $[Fe(CN)_6]^{4-}$, $[Fe(CN)_6]^{3-}$, $[Ru(CN)_6]^{4-}$, $[Re(CN)_6]^{4-}$ and $[Os(CN)_6]^{4-}$. It is further preferred for a silver halide emulsion for use in the invention to contain pentachloronitrosyl complex or pentachlorothionitrosyl complex with Ru, Re or Os as the central metal, and six-coordinate complex having Cl, Br or I as the ligands with Rh as the central metal. These ligand may be subjected to partial aquation.

The foregoing metal complexes are anions. When these are formed into salts with cations, counter cations are preferably those easily soluble in water. Specifically, alkali metal ions, such as sodium ion, potassium ion, rubidium ion, cesium ion and lithium ion, an ammonium ion, and an alkylammonium ion are preferable. These metal complexes can be used by being dissolved in water or a mixed solvent of water and an appropriate water-miscible organic solvent (such as alcohols, ethers, glycols, ketones, esters and amides). These metal complexes are preferably added during grain formation in an amount of $1\times10^{10}$ mol to $1\times10^{-3}$ mol, more preferably $1\times10^{-9}$ mol to $1\times10^{-5}$ mol, most preferably $1\times10^{-8}$ mol to $1\times10^{-5}$ mol, per mol of silver, although the optimum amount may vary depending on the kind thereof.

It is preferable that the above-mentioned metal complex is incorporated into the silver halide grains, by directly adding the same to a reaction solution for the formation of the silver halide grains, or to an aqueous solution of the halide for the formation of the silver halide grains, or to another solution and then to the reaction solution for the grain formation. It is also preferable that a metal complex is incorporated into the silver halide grains by physical ripening with fine grains having metal complex previously incorporated therein. Further, the metal complex can be also contained into the silver halide grains by a combination of these methods.

In case where the metal complex is doped (incorporated) into the silver halide grains, the metal complex is preferably uniformly distributed in the inside of the grains. On the other hand, as disclosed in JP-A-4-208936, JP-A-2-125245 and JP-A-3-188437, the metal complex is also preferably distributed only in the grain surface layer. Alternatively, the metal complex is also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having the metal complex incorporated therein, to modify the grain surface phase. Further, these methods may be used in combination. Two or more kinds of complexes may be incorporated in the inside of an individual silver halide grain. The halogen composition at the position (portion) where the complexes are incorporated, is not particularly limited, but the six-cordination complex whose central metal is Ir and whose all six-ligands are Cl, Br, or I is preferably incorporated in a silver bromide concentration maximum portion.

In the present invention, metal ion other than the above-mentioned iridium can be doped in the inside and/or on the surface of the silver halide grains. As the metal ion to be used, a transition metal ion is preferable, and an ion of iron, ruthenium, osmium, rhodium, lead, cadmium or zinc is more preferable. It is further preferable that these metal ions are used in the form of six-coordination complexes of octahedron-type having ligands. When employing an inorganic compound as a ligand, cyanide ion, halide ion, thiocyanato, hydroxide ion, peroxide ion, azide ion, nitrite ion, water, ammonia, nitrosyl ion, or thionitrosyl ion is preferably used. Such a ligand is preferably coordinated to any metal ion selected from the group consisting of the above-mentioned iron, ruthenium, osmium, rhodium, lead, cadmium and zinc. Two or more kinds of these ligands are also preferably used in one complex molecule.

Further, an organic compound can also be preferably used as a ligand. Preferable examples of the organic compound include chain compounds having a main chain of 5 or less carbon atoms and/or heterocyclic compounds of 5- or 6 -membered ring. More preferable examples of the organic compound are those having at least a nitrogen, phosphorus, oxygen, or sulfur atom in the molecule as an atom which is capable of coordinating to the metal. Particularly preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Preferable combinations of a metal ion and a ligand are those of iron and/or ruthenium ion and cyanide ion. In the present invention, one of these compounds is preferably used in combination with iridium. Preferred of these compounds are those in which the number of cyanide ions accounts for the majority of the coordination number intrinsic to the iron or ruthenium that is the central metal. The remaining sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. These metal complexes having cyanide ion ligands are preferably added, during grain formation, in an amount of $1\times10^{-8}$ Mol to $1\times10^{-2}$ mol, most preferably $1\times10^{-6}$ mol to $5\times10^{-4}$ mol, per mol of silver. In case where ruthenium or osmium is used as the central metal, a nitrosyl ion, a thionitrosyl ion, or water molecule is preferably used as a ligand, together with a chloride ion. More preferably these ligands form a pentachloronitrosyl complex, a pentachlorothionitrosyl complex, or a pentachloroaquo complex. The formation of a hexachloro complex is also preferred. These complexes are preferably added, during grain formation, in an amount of $1\times10^{-10}$ mol to $1\times10^{-6}$ mol, more preferably $1\times10^{-9}$ mol to $1\times10^{-6}$ mol, per mol of silver.

In the present invention, preferably in the forth embodiment of the present invention, it is preferable to contain a rhodium compound. The use of a compound represented by the following formula (VI) is preferable by far.

$$[RhQ_{nb}L^{1E}_{(6-nb)}]^{mb} \qquad \text{Formula (VI)}$$

In formula (VI), Q represents a halogen atom, specifically a chlorine atom, a bromine atom or an iodine atom. And Q is preferably a bromide atom. $L^{1E}$ represents a ligand, other than a bromine atom. nb represents 3, 4, 5 or 6, and m preferably represents 3−, 2−, 1−, 0 or 1+. The ligand as $L^{1E}$ may be an inorganic or organic compound, and may have some charge or no charge. And $L^{1E}$ is preferably an inorganic compound. Preferable examples of $L^{1E}$ include $Cl^-$, $H_2O$, NO and NS. Of these ligands, $H_2O$ is more preferred. nb is preferably 5 or 6, more preferably 6. mb is preferably 3− or 2−, more preferably 3−.

Specific examples of the metal complex represented by formula (VI) are shown below. However, the present invention is not limited thereto.

$[RhBr_5Cl]^{3-}$ $[RhBr_6]^{3-}$ $[RhBr_5(H_2O)]^{2-}$ $[RhBr_4(H_2O)_2]^-$

In the case where the metal complexes represented by formula (VI) are anions, when these are formed into salts with cations, counter cations are preferably those easily soluble in water. Specifically, alkali metal ions, such as sodium ion, potassium ion, rubidium ion, cesium ion and lithium ion, an ammonium ion, and an alkylammonium ion are preferable.

These metal complexes can be used by being dissolved in water or a mixed solvent of water and an appropriate water-miscible organic solvent (such as alcohols, ethers, glycols, ketones, esters and amides).

These metal complexes are added during formation of silver halide grains in an amount of preferably $5\times10^{-10}$ to $1\times10^{-7}$ mol, more preferably $5\times10^{-10}$ to $8\times10^{-8}$ mol, particularly preferably $5\times10^{-10}$ to $5\times10^{-8}$ mol, per mol of silver, although the optimum amount may vary depending on the kind thereof.

The silver halide emulsion is generally subjected to chemical sensitization. As to the chemical sensitization method, sulfur sensitization typified by the addition of an unstable sulfur compound, noble metal sensitization typified by gold sensitization, and reduction sensitization may be used independently or in combination. As compounds used for the chemical sensitization, those described in JP-A-62-215272, page 18, right lower column to page 22, right upper column are preferably used. Of these chemical sensitization, gold-sensitized silver halide emulsion is particularly preferred, since a fluctuation in photographic properties which occurs when scanning exposure with laser beams or the like is conducted, can be further reduced by gold sensitization. The sensitizers and the sensitizing methods preferably used are those disclosed in JP-A-2003-295375, column 14, line 7, to column 28, line 40.

In order to conduct gold sensitization to the silver halide emulsion, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanato gold compounds (e.g., potassium dithiocyanatoaurate (I)), and dithiosulfato gold compounds (e.g., trisodium dithiosulfatoaurate (I)), can be used.

As the gold (I) compounds each having an organic ligand (an organic compound), use can be made of bis-gold (I) mesoionic heterocycles described in JP-A-4-267249, e.g. bis (1,4,5-trimethyl-1,2,4-triazolium-3-thiolato) aurate (I) tetrafluoroborate; organic mercapto gold (I) complexes described in JP-A-11-218870, e.g. potassium bis(1-[3-(2-sulfonatobenzamido)phenyl]-5-mercaptotetrazole potassium salt) aurate (I) pentahydrate; and gold (I) compound with a nitrogen compound anion coordinated therewith, as described in JP-A-4-268550, e.g. bis (1-methylhydantoinato) gold (I) sodium salt tetrahydrate. As these gold (I) compounds having organic ligands, use can be made of those which are synthesized in advance and isolated, as well as those which are generated by mixing an organic ligand and an Au compound (e.g., chlroauric acid or its salt), to add to an emulsion without isolating the Au compound. Moreover, an organic ligand and an Au compound (e.g., chlroauric acid or its salt) may be separately added to the emulsion, to generate the gold (I) compound having the organic ligand, in the emulsion.

Also, the gold (I) thiolate compound described in U.S. Pat. No. 3,503,749, the gold compounds described in JP-A-8-69074, JP-A-8-69075 and JP-A-9-269554, and the compounds described in U.S. Pat. Nos. 5,620,841, 5,912,112, 5,620,841, 5,939,245, and 5,912,111 may be used. The amount of the above compound to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, per mol of silver halide.

Further, in the present invention, colloidal gold sulfide can also be used. A method of producing the colloidal gold sulfide is described in, for example, Research Disclosure, No. 37154; Solid State Ionics, Vol. 79, pp. 60 to 66 (1995); and Compt. Rend. Hebt. Seances Acad. Sci. Sect. B, Vol. 263, p. 1328 (1966). In the above Research Disclosure, a method is described in which a thiocyanate ion is used in the production of colloidal gold sulfide. It is, however, possible to use a thioether compound, such as methionine or thiodiethanol, instead. The amount of the colloidal gold sulfide to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, in terms of gold atom, per mol of silver halide.

Chalcogen sensitization and gold sensitization can be conducted by using the same molecule such as a molecule capable of releasing $AuCh^-$, in which Au represents Au (I), and Ch represents a sulfur atom, a selenium atom or a tellurium atom. Examples of the molecule capable of releasing $AuCh^-$ include gold compounds represented by $AuCh\text{-}L^A$, in which $L^A$ represents a group of atoms bonding to AuCh to form the molecule. Further, one or more ligands may coordinate to Au together with $Ch\text{-}L^A$. The gold compounds represented by $AuCh\text{-}L^A$ have a tendency to form AgAuS when Ch is S, AgAuSe when Ch is Se, or AgAuTe when Ch is Te, when the gold compounds are reacted in a solvent in the presence of silver ions. Examples of these compounds include those in which $L^A$ is an acyl group. In addition, gold compounds represented by formula (AuCh1), formula (AuCh2), or formula (AuCh3) are exemplified.

$$R_{a1}\text{—}X^b\text{-}M^b\text{-}ChAu \qquad \text{Formula (AuCH1)}$$

In formula (AuCh1), Au represents Au (I); Ch represents a sulfur atom, a selenium atom or a tellurium atom; $M^b$ represents a substituted or unsubstituted methylene group; $X^b$ represents an oxygen atom, a sulfur atom, a selenium atom or $NR_{a2}$; $R_{a1}$ represents a group of atoms bonding to $X^b$ to form the molecule (e.g., an organic group, such as an alkyl group, an aryl group or a heterocyclic group); $R_{a2}$ represents a hydrogen atom or a substituent (e.g., an organic group, such as alkyl, aryl or heterocyclic group); and $R_{a1}$ and $M^b$ may combine together to form a ring.

Regarding the compound represented by formula (AuCh1), Ch is preferably a sulfur atom or a selenium atom; $X^b$ is preferably an oxygen atom or a sulfur atom; and $R_{a1}$ is preferably an alkyl group or an aryl group. Examples of more specific compounds include Au(I) salts of thiosugar (for example, gold thioglucose (such as α-gold thioglucose), gold peracetyl thioglucose, gold thiomannose, gold thiogalactose, gold thioarabinose), Au(I) salts of selenosugar (for example, gold peracetyl selenoglucose, gold peracetyl selenomannose), and Au(I) salts of tellurosugar. Herein, the terms "thiosugar", "selenosugar" and "tellurosugar" each mean the compound in which a hydroxy group in the anomer position of the sugar is substituted with a SH group, a SeH group or a TeH group.

$$W_1W_2C\text{=}CR_{a3}ChAu \qquad \text{Formula (AuCH2)}$$

In formula (AuCh2), Au represents Au(I); Ch represents a sulfur atom, a selenium atom or a tellurium atom; $R_{a3}$ and $W_2$ each independently represent a hydrogen atom or a substituent (e.g., a halogen atom, and an organic group such as alkyl, aryl or heterocyclic group); $W_1$ represents an electron-withdrawing group having a positive value of the Hammett's substituent constant $\sigma_p$ value; and $R_{a3}$ and $W_1$, $R_{a3}$ and $W_2$, or $W_1$ and $W_2$ may bond together to form a ring.

In the compound represented by formula (AuCh2), Ch is preferably a sulfur atom or a selenium atom; $R_{a3}$ is preferably a hydrogen atom or an alkyl group; and $W_1$ and $W_2$ each are preferably an electron-withdrawing group having the Hammett's substituent constant $\sigma_p$ value of 0.2 or more. Examples of the specific compound include $(NC)_2C{=}CHSAu$, $(CH_3OCO)_2C{=}CHSAu$, and $CH_3CO(CH_3OCO)C{=}CHSAu$.

$W_3$-E-ChAu Formula (AuCh3)

In formula (AuCh3), Au represents Au(l); Ch represents a sulfur atom, a selenium atom or a tellurium atom; E represents a substituted or unsubstituted ethylene group; $W_3$ represents an electron-withdrawing group having a positive value of the Hammett's substituent constant $\sigma_p$ value.

In the compound represented by formula (AuCh3), Ch is preferably a sulfur atom or a selenium atom; E is preferably an ethylene group having thereon an electron-withdrawing group whose Hammett's substituent constant $\sigma_p$ value is a positive value; and $W_3$ is preferably an electron-withdrawing group having the Hammett's substituent constant $\sigma_p$ value of 0.2 or more. Specific examples of such a compound include 3-mercaptocyclohexane-1-one gold(l) salts.

An addition amount of these compounds can vary over a wide range according to the occasions, and the amount is generally in the range of $5\times10^{-7}$ to $5\times10^{-3}$ mol, preferably in the range of $3\times10^{-6}$ to $3\times10^{-4}$ mol, per mol of silver halide.

Colloidal gold sulfide having various grain sizes are applicable, and it is preferable to use those having an average grain diameter of 50 nm or less, more preferably 10 nm or less, and further preferably 3 nm or less. The grain diameter can be measured from a TEM photograph. Also, the composition of the colloidal gold sulfide may be $Au_2S_1$ or may be sulfur-excess compositions such as $Au_2S_1$ to $Au_2S_2$ which are preferable. $Au_2S_{1.1}$ to $Au_2S_{1.8}$ are more preferable.

The composition of the colloidal gold sulfide can be analyzed in the following manner: for example, gold sulfide grains are taken out, to find the content of gold and the content of sulfur, by utilizing analysis methods such as ICP (Inductively Coupled Plasma) and iodometry, respectively. If gold ions and sulfur ions (including hydrogen sulfide and its salt) dissolved in the liquid phase exist in the gold sulfide colloid, this affects the analysis of the composition of the gold sulfide colloidal grains. Therefore, the analysis is made after the gold sulfide grains have been separated by ultrafiltration or the like. The amount of the colloidal gold sulfide to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, in terms of gold atom, per mol of silver halide.

In the silver halide emulsion, the above-mentioned gold sensitization may be combined with other sensitization, such as sulfur sensitization, selenium sensitization, tellurium sensitization, reduction sensitization, and noble metal sensitization using noble metals other than gold compounds. In particular, the gold sensitization is preferably combined with sulfur sensitization and/or selenium sensitization.

For effecting chalcogen-gold sensitization, such as selenium-gold sensitization or sulfur-gold sensitization, in the present invention, it is most preferable to use the sensitizers capable of releasing gold-chalcogen anion species as disclosed in U.S. Pat. No. 6,638,705B1. The compounds preferably used are described as examples of such sensitizers in that publication, and those examples are preferably incorporated into the present specification.

Various compounds or precursors thereof can be included in the silver halide emulsion to prevent fogging from occurring or to stabilize photographic performance during manufacture, storage or photographic processing of the photographic material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-withdrawing group) disclosed in European Patent No. 0447647 can also be preferably used.

Further, in the present invention, to enhance storage stability of the silver halide emulsion, it is also preferred to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (in particular, compounds represented by formula (S1); the description at paragraph Nos. 0036 to 0071 of JP-A-11-327094 is incorporated herein by reference); sulfo-substituted catecols or hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); hydroxylamines represented by formula (A) described in U.S. Pat. No. 5,556,741 (the description of line 56 in column 4 to line 22 in column 11 of U.S. Pat. No. 5,556,741 is preferably applied to the present invention and is incorporated herein by reference); and water-soluble reducing agents represented by formula (I), (II), or (III) of JP-A-11-102045.

Spectral sensitizing dyes can be contained in the silver halide emulsion for the purpose of imparting spectral sensitivity in a desired light wavelength region. Examples of spectral sensitizing dyes, for spectral sensitization of blue, green, and red light regions, include, for example, those disclosed by F. M. Harmer, in "Heterocyclic Compounds—Cyanine Dyes and Related Compounds", John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength, temperature dependency of exposure, and the like.

The amount of these spectral sensitizing dyes to be added can be varied in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide.

In order to solve this problem, inventors made various examinations, and have found that the streaked unevenness was ascribed to transport rollers installed for image exposure in a position upstream from the exposure point and the occurrence frequency thereof became high in the case of using photosensitive materials stored under conditions of high temperature and high humidity. It has been found that the streaked unevenness can be inhibited by developing by spectrally sensitizing silver halide emulsions used in color photographic paper with specific sensitizing dyes or incorporating inorganic sulfur or specified compounds into silver halide emulsions used in color photographic paper.

Next, the sensitizing dye that can be used in the present invention is described in detail below.

The silver halide emulsion that can be used in the present invention, preferably in the fifth or seventh embodiment of the present invention, is preferably spectrally sensitized by the sensitizing dye represented by formula (SI).

Formula (SI)

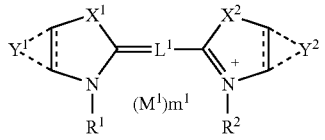

In formula (SI), $X^1$ and $X^2$ each represents an oxygen atom, a sulfur atom, a selenium atom, a tellurium atom, a nitrogen atom or a carbon atom; $Y^1$ represents a furan, pyrrole, thiophene ring or benzene ring which may be condensed with another 5- or 6-membered carbon ring or heterocycle or may have a substituent group; $Y^2$ represents an atomic group necessary for forming a benzene ring or a 5- or 6-membered unsaturated heterocycle, which may be further condensed with another 5- or 6-membered carbon ring or heterocycle or may have a substituent group; a bond between two carbon atoms by which $Y^1$ and $y^2$ are each condensed with the carbon ring or the heterocycle may be a single bond or a double bond; one of $R^1$ and $R^2$ is an alkyl group substituted by an acid group other than a sulfo group, and the other is an alkyl group substituted by a sulfo group.; $L^1$ represents a methine group; $M^1$ represents a counter ion; and $m^1$ represents a number of 0 or more necessary for neutralizing a charge in a molecule.

The sensitizing dye represented by formula (SI) that can be used in the present invention will be described below.

$X^1$ and $X^2$ each represents an oxygen atom, a sulfur atom, a selenium atom, a tellurium atom, a nitrogen atom or a carbon atom. The nitrogen atom can be preferably represented by —N(Rx)—, and the carbon atom can be preferably represented by —C(Ry)(Rz)—. Rx, Ry and Rz are each a hydrogen atom or a monovalent substituent group (for example, W described above), preferably an alkyl group, an aryl group or a heterocyclic group, similar to the group represented by W, and more preferably an alkyl group. $X^1$ and $X^2$ are each preferably an oxygen atom, a sulfur atom or a nitrogen atom, and more preferably an oxygen atom or a sulfur atom.

$Y^1$ represents a furan, pyrrole, thiophene ring or benzene ring which may be condensed with another 5- or 6-membered carbon ring or heterocycle or may have a substituent group. Although a bond between two carbon atoms by which $Y^1$ is condensed may be a single bond or a double bond, it is preferably a double bond. $Y^1$ can further form a condensed ring (e.g., a benzofuran ring, an indole ring, a benzothiophene ring and a naphthalene ring) together with another 5- or 6-membered carbon ring or heterocycle. $Y^1$ is preferably a thiophene ring. The substituent group for $Y^1$ may be any, and includes W described above. The substituent group is preferably an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano, an acyl group (for example, acetyl), an alkoxycarbonyl group (for example, methoxycarbonyl) or a halogen atom (for example, fluorine, chlorine, bromine or iodine), more preferably methyl, methoxy, cyano or a halogen atom, still more preferably a halogen atom, particularly preferably fluorine, chlorine or bromine, and most preferably chlorine. In particular, when $Y^1$ is a thiophene ring, it preferably has a halogen substituent group. The substituent group is preferably chlorine or bromine, and most preferably chlorine.

$Y^2$ represents an atomic group necessary for forming a benzene ring or a 5- or 6-membered unsaturated heterocycle, which may be further condensed with another 5- or 6-membered carbon ring or heterocycle or may have a substituent group. Although a bond between two carbon atoms by which $Y^2$ is condensed may be a single bond or a double bond, it is preferably a double bond. The 5-membered unsaturated heterocycles include a pyrrole ring, a pyrazole ring, an imidazole ring, a triazole ring, a furan ring, an oxazole ring, an isoxazole ring, a thiophene ring, a thiazole ring, an isothiazole ring, a thiadiazole ring, a selenophene ring, a selenazole ring, an isoselenazole ring, a tellurophene ring, a tellurazole ring and an isotellurazole ring, and the 6-membered unsaturated heterocycles include a pyridine ring, a pyridazine ring, a pyrimidine ring, a pyradine ring, a pyran ring and a thiopyran ring. $Y^2$ can be further condensed with another 5- or 6-membered carbon ring or heterocycle to form, for example, an indole ring, a benzofuran ring, a benzothiophene ring or a thienothiophene ring. However, it is preferred that the third condensed ring does not exist.

$Y^2$ is preferably a benzene ring, a pyrrole ring, a furan ring or a thiophene ring, particularly preferably a benzene ring, a furan ring or a pyrrole ring, and most preferably a benzene ring. The substituent group for $Y^2$ may be any, and includes W described above. The substituent group is preferably an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano, an acyl group (for example, acetyl), an alkoxycarbonyl group (for example, methoxycarbonyl) or a halogen atom (for example, fluorine, chlorine, bromine or iodine), more preferably methyl, methoxy, cyano or a halogen atom, still more preferably a halogen atom, particularly preferably fluorine, chlorine or bromine, and most preferably chlorine.

One of $R^1$ and $R^2$ is an alkyl group substituted by an acid group other than a sulfo group, and the other is an alkyl group substituted by a sulfo group.

The acid group will be described herein. The term "acid group" means a group having a dissociative proton.

Specific examples thereof include a group that dissociates a proton depending on the pKa and the surrounding pH, such as a sulfo group, a carboxyl group, a sulfato group, a —$CONHSO_2$— group (a sulfonylcarbamoyl or carbonylsulfamoyl group), a —CONHCO— group (a carbonylcarbamoyl group), an —$SO_2NHSO_2$— group (a sulfonylsulfamoyl group), a sulfonamido group, a sulfamoyl group, a phosphato group, a phosphono group, a boronic acid group or a phenolic hydroxyl group. For example, a proton-dissociative acidic group in which 90% or more dissociates between pH 5 and pH 11 is preferred.

Preferred one of the "alkyl group substituted by an acid group" represented by $R^1$ or $R^2$ in the sensitizing dye represented by general formula (SI) can be expressed in the form of a formula as follows:

Preferred Alkyl Group=-Qa-$T^1$

Qa represents a connecting group necessary for forming an alkyl group (preferably a divalent connecting group). $T^1$ represents —$SO_3^-$, —COOH, —$CONHSO_2Ra$, —$SO_2NHCORb$, —CONHCORc or —$SO_2NHSO_2Rd$. Herein, Ra, Rb, Rc and Rd each represents an alkyl group, an aryl group, a heterocyclic group, an alkoxyl group, an aryloxy group, a heterocyclyloxy group or an amino group.

Qa may be any connecting group, as long as it meets the above-mentioned requirements. It is preferably an atom or an atomic group containing at least one of a carbon atom, a nitrogen atom, a sulfur atom and an oxygen atom. It preferably represents a connecting group having from 0 to 10 carbon atoms, preferably from 1 to 8 carbon atoms, more preferably from 1 to 5 carbon atoms which is constituted by a combination of one or more of an alkylene group (for example, methylene, ethylene, trimethylene, tetramethylene, pentamethylene or methyltrimethylene), an alkenylene group (for example, ethenylene or propenylene), an alkynylene group (for example, ethynylene or propynylene), an amido group, an ester group, a sulfoamido group, a sulfonic ester group, a ureido group, a sulfonyl group, a sulfinyl group, a thioether group, an ether group, a carbonyl group or an —N(Wa)- group (wherein Wa represents a hydrogen atom or a monovalent substituent group, and the monovalent substituent group includes W described above).

The above-mentioned connecting group may further have the substituent group represented by W described above, and may have a ring (an aromatic or nonaromatic hydrocarbon ring or a heterocycle).

However, it is more preferred that the connecting group contains no heteroatom. It is still more preferred that the connecting group is not substituted by the substituent group represented by W described above.

More preferably, Qa is a divalent connecting group having from 1 to 5 carbon atoms which is constituted by a combination of one or more of an alkylene group having from 1 to 5 carbon atoms (for example, methylene, ethylene, trimethylene, tetramethylene, pentamethylene or methyltrimethylene), an alkenylene group having from 2 to 5 carbon atoms (for example, ethenyiene or propenylene) and an alkynylene group having from 2 to 5 carbon atoms (for example, ethynylene or propynylene). Particularly preferred is an alkylene group having from I to 5 carbon atoms (preferably methylene, ethylene, trimethylene or tetrametylene).

When $T^1$ is a sulfo group, Qa is more preferably ethylene, trimethylene, tetramethylene or methyltrimethylene, and particularly preferably trimethylene. When Xa is a carboxyl group, Qa is more preferably methylene, ethylene or trimethylene, and particularly preferably methylene.

When $T^1$ is —$CONHSO_2Ra$, —$SO_2NHCORb$, —CONHCORc or $SO_2NHSO_2Rd$, Qa is more preferably methylene, ethylene or trimethylene, and particularly preferably methylene.

Ra, Rb, Rc and Rd each represents an alkyl group, an aryl group, a heterocyclic group, an alkoxyl group, an aryloxy group, a heterocyclyloxy group or an amino group. Preferred examples thereof include an unsubstituted alkyl group having from 1 to 18 carbon atoms, preferably from 1 to 10 carbon atoms, more preferably from 1 to 5 carbon atoms (for example, methyl, ethyl, propyl or butyl), a substituted alkyl group having from 1 to 18 carbon atoms, preferably from 1 to 10 carbon atoms, more preferably from 1 to 5 carbon atoms (for example, hydroxymethyl, trifluoromethyl, benzyl, carboxyethyl, ethoxycarbonylmethyl or acetylaminomethyl, it shall be considered to include an unsaturated hydrocarbon group having preferably from 2 to 18, more preferably from 3 to 10 carbon atoms, particularly preferably from 3 to 5 (for example, a vinyl group, an ethynyl group, a 1-cyclohexenyl group, a benzylidyne group or a benzylidene group)), a substituted or unsubstituted aryl group having from 6 to 20 carbon atoms, preferably from 6 to 15 carbon atoms, more preferably from 6 to 10 carbon atoms (for example, phenyl, naphthyl, p-carboxyphenyl, p-nitrophenyl, 3,5-dichlorophenyl, p-cyanophenyl, m-fluorophenyl or p-tolyl), a heterocyclic group, which may be substituted, having from 1 to 20 carbon atoms, preferably from 2 to 10 carbon atoms, more preferably from 4 to 6 carbon atoms (for example, pyridyl, 5-methylpyridyl, thienyl, furyl, morpholino or tetrahydrofurfuryl), an alkoxyl group having from 1 to 10 carbon atoms, preferably from 1 to 8 carbon atoms (for example, methoxy, ethoxy, 2-methoxyethoxy, 2-hydroxyethoxy or 2-phenylethoxy), an aryloxy group having from 6 to 20 carbon atoms, preferably from 6 to 12 carbon atoms, more preferably from 6 to 10 carbon atoms (for example, phenoxy, p-methylphenoxy, p-chlorophenoxy or naphthoxy), a heterocyclyloxy group (which means an oxy group substituted by a heterocyclic group) having from 1 to 20 carbon atoms, preferably from 3 to 12 carbon atoms, more preferably from 3 to 10 carbon atoms (for example, 2-thienyloxy or 2-morpholinoxy) and an amino group having from 0 to 20 carbon atoms, preferably from 0 to 12 carbon atoms, more preferably from 0 to 8 carbon atoms (for example, amino, methylamino, dimethylamino, ethylamino, diethylamino, hydroxyethylamino, benzylamino, anilino, diphenylamino, ring-formed morpholino or pyrrolidino). These may be further substituted by W described above.

More preferred are methyl, ethyl and hydroxyethyl, and particularly preferred is methyl.

The acid group, for example, a carboxyl group or a dissociative nitrogen atom, may be showed either in the non-dissociated form (COOH or NH) or in the dissociated form ($COO^-$ or $N^-$). Actually, the acid group becomes either a dissociated state or a non-dissociated state, depending on the circumstances such as the pH under which a dye is placed.

When an anion exists as a counter ion, for example, it may be written as ($COO^-Na^+$) or ($N^-Na^+$). In the non-dissociated state, it is written as (COOH) or (NH). However, considering a cationic compound of the counter ion as a proton, it is also possible to write it as ($COO^-H^+$) or ($N^-H^+$).

In the sensitizing dye represented by formula (SI), one of $R^1$ and $R^2$ is an alkyl group substituted by an acid group other than a sulfo group, and the other is an alkyl group substituted by a sulfo group. In the above, the sulfo group-containing alkyl group is preferably a 3-sulfopropyl group, a 4-sulfobutyl group, a 3-sulfobutyl group or a 2-sulfoethyl group, and more preferably a 3-sulfopropyl group. The alkyl group substituted by an acid group other than a sulfo group is preferably an alkyl group substituted by a carboxyl group, a —$CONHSO_2$— group, an —$SO_2NHCO$— group, a —CONHCO— group or an —$SO_2NHSO_2$— group, and particularly preferably a carboxymethyl group or a methanesulfonylcarbamoylmethyl group.

As a combination of $R^1$ and $R^2$, it is preferred that one of $R^1$ and $R^2$ is a carboxymethyl group or a methanesulfonylcarbamoylmethyl group, and another is a 3-sulfopropyl group, a 4-sulfobutyl group, a 3-sulfobutyl group, or a 2-sulfoethyl group; and more preferred that one of $R^1$ and $R^2$ is a carboxymethyl group or a methanesulfonylcarbamoylmethyl group, and another is a 3-sulfopropyl group.

$L^1$ represents a methine group that may be unsubstituted or substituted with a substituent (e.g., the substituent W described above). Preferred examples of the substituent include aryl groups, unsaturated hydrocarbon groups, a carboxyl group, a sulfo group, a sulfato group, a cyano group, halogen atoms (e.g., fluorine, chlorine, bromine, iodine), a hydroxyl group, a mercapto group, alkoxy groups, aryloxy groups, alkylthio groups, arylthio groups, acyl groups, alkoxycarbonyl groups, aryloxycarbonyl groups, acyloxy groups, carbamoyl groups, sulfamoyl groups, heterocyclic groups, alkylsulfonylcarbamoyl groups, acylcarbamoyl groups, acylsulfamoyl groups and alkanesulfonylsulfamoyl groups.

$L^1$ is preferably an unsubstituted methine group.

$M^1$ represents a counter ion. When necessary for neutralizing an ionic charge of a dye, $M^1$ is contained in the formula for indicating the presence of a cation or an anion. It depends on the substituent group and the circumstances in a solution (such as the pH) whether a certain dye is a cation or an anion, or whether it has a net ionic charge or not. Typical examples of the cations include inorganic cations such as a hydrogen ion ($H^+$), an alkali metal ion (for example, a sodium ion, a potassium ion or a lithium ion) and an alkali earth metal ion (for example, a calcium ion), and organic cations such as an ammonium ion (for example, an ammonium ion, a tetraalkylammonium ion, a triethylammonium ion, a pyridinium ion, an ethylpyridinium ion or a 1,8-diazabicyclo[5.4.0]-7-undecenium ion). The anions, which may be either inorganic anions or organic anions, include a halide anion (for example, a fluoride ion, a chloride ion, a bromide ion or an iodide ion), a substituted arylsulfonate ion (for example, a p-toluenesulfonate ion or a p-chlorobenzenesulfonate ion), an aryldisulfonate ion (for example, a 1,3-benzenedisulfonate ion, a 1,5-naphthalenedisulfonate ion or a 2,6-naphthalenedisulfonateion) an alkylsulfate ion (for example, methylsulfate ion), a sulfate ion, a thiocyanate ion, a perchlorate ion, a tetrafluoroborate ion, a picrate ion, an acetate ion and a trifluoromethanesulfonate ion. Further, an ionic polymer or another dye having the charge reverse to that of the dye may also be used.

The cation is preferably a sodium ion, a potassium ion, a triethylammonium ion, a tetraethylammonium ion, a pyridinium ion, an ethylpyridinium ion or a methylpyridinium ion. The anion is preferably a perchlorate ion, an iodide ion, a bromide ion or a substituted arylsulfonate ion (for example, p-toluenesulfonate ion).

$m^1$ represents a number of 0 or more necessary for balancing a charge, and when an internal salt is formed, it is 0. It is preferably a number of from 0 to 4.

The sensitizing dye represented by the above-mentioned formula (SI) is more preferably represented by formula (SII) or (SIII), or represented by formula (SIV).

Formula (SII)

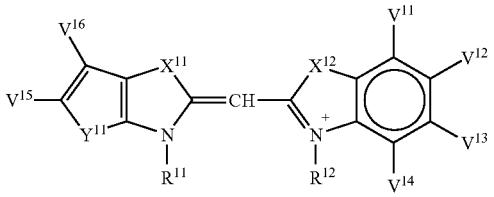

$(M^{11})m^{11}$

In formula (SII), $Y^{11}$ represents an oxygen atom, a sulfur atom or N—$R^{13}$ $R^{13}$ represents a hydrogen atom or an alkyl group; $V^{15}$ and $V^{16}$ each represents a hydrogen atom or a monovalent substituent group; $X^{11}$ and $X^{12}$ each represents an oxygen atom or a sulfur atom; one of $R^{11}$ and $R^{12}$ represents an alkyl group substituted by an acid group other than a sulfo group, and the other represents an alkyl group substituted by a sulfo group; $V^{11}$, $V^{12}$, $V^{13}$ and $V^{14}$ each represents a hydrogen atom or a monovalent substituent group; $M^{11}$ represents a counter ion; and $m^{11}$ represents a number of 0 or more necessary for neutralizing a charge in a molecule.

Formula (SIII)

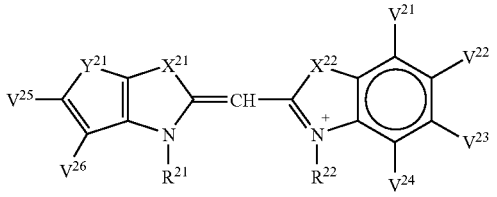

$(M^{21})m^{21}$

In formula (SIII), $Y^{21}$ represents an oxygen atom, a sulfur atom or N—$R^{23}$ in which $R^{23}$ represents a hydrogen atom or an alkyl group; $V^{25}$ and $V^{26}$ each represents a hydrogen atom or a monovalent substituent group; $X^{21}$ and $X^{22}$ each represents an oxygen atom or a sulfur atom; one of $R^{21}$ and $R^{22}$ represents an alkyl group substituted by an acid group other than a sulfo group, and the other represents an alkyl group substituted by a sulfo group; $V^{21}$, $V^{22}$, $V^{23}$ and $V^{24}$ each represents a hydrogen atom or a monovalent substituent group; $M^{21}$ represents a counter ion; and $m^{21}$ represents a number of 0 or more necessary for neutralizing a charge in a molecule.

Formula (SIV)

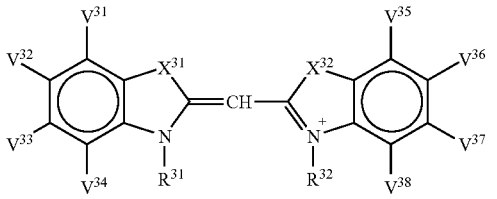

$(M^{31})m^{31}$

In formula (SIV), $X^{31}$ and $X^{32}$ each represents an oxygen atom or a sulfur atom; one of $R^{31}$ and $R^{32}$ represents an alkyl group substituted by an acid group other than a sulfo group, and the other represents an alkyl group substituted by a sulfo group; $V^{31}$, $V^{32}$, $V^{33}$, $V^{34}$, $V^{35}$, $V^{36}$, $V^{37}$ and $V^{38}$ each represents a hydrogen atom or a monovalent substituent group, in which two adjacent substituent groups of $V^{31}$, $V^{32}$, $V^{33}$, $V^{34}$, $V^{35}$, $V^{36}$, $V^{37}$ and $V^{38}$ may combine with each other to form a saturated or unsaturated condensed ring; $M^{31}$ represents a counter ion; and $m^{31}$ represents a number of 0 or more necessary for neutralizing a charge in a molecule.

These preferred compounds are described below.

In formula (SII), $Y^{11}$ represents an oxygen atom, a sulfur atom or N—$R^{13}$, wherein $R^{13}$ represents a hydrogen atom, an unsubstituted alkyl group or a substituted alkyl group (for example, an alkyl group substituted by W described above). The substituent group of the substituted alkyl group is preferably a substituent group higher in hydrophilicity than an iodine atom, more preferably a substituent group having hydrophilicity equal to or higher than that of a chlorine atom, and particularly preferably a substituent group having hydrophilicity equal to or higher than that of a fluorine atom. $R^{13}$ is more preferably a hydrogen atom or an unsubstituted alkyl group, and particularly preferably a hydrogen atom or a methyl group. It is particularly preferred that $Y^{11}$ is a sulfur atom.

$X^{11}$ and $X^{12}$ each represent an oxygen atom or a sulfur atom. At least one thereof is preferably a sulfur atom, and both are preferably sulfur atoms.

$V^{11}$, $V^{12}$, $V^{13}$, $V^{14}$, $V^{15}$ and $V^{16}$ each represents a hydrogen atom or a monovalent substituent group. Two adjacent substituent groups of $V^{11}$, $V^{12}$, $V^{13}$ and $V^{14}$, or $V^{15}$ and $V^{16}$ may combine with each other to form a saturated or unsaturated condensed ring. However, it is preferred that no condensed ring is formed. Although the monovalent substituent groups include W described above, preferred is an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferred is a methyl group, a methoxy group, a cyano group or a halogen atom, still more preferred is a halogen atom, particularly preferred is fluorine, chlorine or bromine, and most preferred is chlorine. $V^{11}$, $V^{12}$ and $V^{14}$ are each preferably a hydrogen atom.

When $Y^{11}$ is a sulfur atom, each or one of $V^{15}$ and $V^{16}$ is preferably a hydrogen atom or a halogen atom (for example, fluorine, chlorine, bromine or iodine). More preferably, $V^{16}$ is a hydrogen atom, and $V^{15}$ is a hydrogen atom or chlorine.

One of $R^{11}$ and $R^{12}$ is an alkyl group substituted by an acid group other than a sulfo group (preferably a carboxyl group or an alkanesulfonylcarbamoyl group) and the other is an alkyl group substituted by a sulfo group. Specific examples and preferred combinations of these alkyl groups each substituted by an acid group are the same as with $R^1$ described above. Still more preferably, one of $R^{11}$ and $R^{12}$ is a carboxymethyl group or a methanesulfonylcarbamoylmethyl group. Particularly preferably, $R^{11}$ is a carboxymethyl group or a methanesulfonylcarbamoylmethyl group, and $R^{12}$ is a 3-sulfopropyl group.

$M^{11}$ represents a counter ion, and $m^{11}$ represents a number of 0 or more necessary for neutralizing a charge in a molecule. $M^{11}$ and $m^{11}$ are the same as with $M^1$ and $m^1$ described above. $M^{11}$ is particularly preferably a cation, and preferred examples of the cations include sodium, potassium, triethylammonium, pyridinium and N-ethylpyridinium.

In formula (SIII), $Y^{21}$ represents an oxygen atom, a sulfur atom or N—$R^{23}$, wherein $R^{23}$ represents a hydrogen atom, an unsubstituted alkyl group or a substituted alkyl group (for example, an alkyl group substituted by W described above). The substituent group of the substituted alkyl group is preferably a substituent group higher in hydrophilicity than an iodine atom, more preferably a substituent group having hydrophilicity equal to or higher than that of a chlorine atom, and particularly preferably a substituent group having hydrophilicity equal to or higher than that of a fluorine atom. $R^{23}$ is more preferably a hydrogen atom or an unsubstituted alkyl group, and particularly preferably a hydrogen atom or a methyl group. It is particularly preferred that $y^{21}$ is a sulfur atom.

$X^{21}$ and $X^{22}$ each represent an oxygen atom or a sulfur atom. At least one thereof is preferably a sulfur atom, and both are preferably sulfur atoms.

$V^{21}$, $V^{22}$, $V^{23}$, $V^{24}$, $V^{25}$ and $V^{26}$ each represents a hydrogen atom or a monovalent substituent group. Two adjacent substituent groups of $V^{21}$, $V^{22}$, $V^{23}$ and $V^{24}$, or $V^{25}$ and $V^{26}$ may combine with each other to form a saturated or unsaturated condensed ring. However, it is better that no condensed ring is formed. Although the monovalent substituent groups include W described above, preferred is an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferred is a methyl group, a methoxy group, a cyano group or a halogen atom, still more preferred is a halogen atom, particularly preferred is fluorine, chlorine or bromine, and most preferred is chlorine. $V^{21}$, $V^{22}$ and $V^{24}$ are each preferably a hydrogen atom.

When $y^{21}$ is a sulfur atom, it is preferred that each of $V^{25}$ and $V^{26}$ is hydrogen or one of $V^{25}$ and $V^{26}$ is a halogen atom (for example, fluorine, chlorine, bromine or iodine). More preferably, $V^{26}$ is a hydrogen atom, and $V^{25}$ is a hydrogen atom or chlorine.

One of $R^{21}$ and $R^{22}$ is an alkyl group substituted by an acid group other than a sulfo group (preferably a carboxyl group or an alkanesulfonylcarbamoyl group) and the other is an alkyl group substituted by a sulfo group. Specific examples and preferred combinations of these alkyl groups each substituted by an acid group are the same as with $R^1$ described above. Still more preferably, one of $R^{21}$ and $R^{22}$ is a carboxymethyl group or a methanesulfonylcarbamoylmethyl group. Particularly preferably, $R^{21}$ is a carboxymethyl group or a methanesulfonylcarbamoylmethyl group, and $R^{22}$ is a 3-sulfopropyl group.

$M^{21}$ represents a counter ion, and $m^{21}$ represents a number of 0 or more necessary for neutralizing a charge in a molecule. $M^{21}$ and $m^{21}$ are the same as with $M^1$ and $m^1$ described above. $M^{21}$ is particularly preferably a cation, and preferred examples of the cations include sodium, potassium, triethylammonium, pyridinium and N-ethylpyridinium.

In general formula (SIV), $X^{31}$ and $X^{32}$ each represents an oxygen atom or a sulfur atom. At least one thereof is preferably a sulfur atom, and both are preferably sulfur atoms.

One of $R^{31}$ and $R^{32}$ is an alkyl group substituted by an acid group other than a sulfo group (preferably a carboxyl group or an alkanesulfonylcarbamoyl group) and the other is an alkyl group substituted by a sulfo group. Specific examples and preferred combinations of these alkyl groups each substituted by an acid group are the same as with $R^1$ described above. Still more preferably, one of $R^{31}$ and $R^{32}$ is a carboxymethyl group or a methanesulfonylcarbamoylmethyl group. Particularly preferably, $R^{31}$ is a carboxymethyl group or a methanesulfonylcarbamoylmethyl group, and $R^{32}$ is a 3-sulfopropyl group.

$V^{31}$, $V^{32}$, $V^{33}$, $V^{34}$, $V^{35}$, $V^{36}$, $V^{37}$ and $V^{38}$ each represent a hydrogen atom or a monovalent substituent independently. Any adjacent pair among these substituents may combine with each other to form a condensed ring. The condensed ring formed may be saturated or unsaturated one. As an example of such a condensed ring, a naphthalene ring formed by combining $V^{33}$ and $V^{34}$ can be given. Although the monovalent substituent groups include W described above, preferred is an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferred is a methyl group, a methoxy group, a cyano group or a halogen atom, still more preferred is a halogen atom, particularly preferred is fluorine, chlorine or bromine, and most preferred is chlorine. $V^{31}$, $V^{32}$, $V^{34}$, $V^{35}$, $V^{36}$ and $V^{38}$ are each preferably a hydrogen atom.

$M^{31}$ represents a counter ion, and $m^{31}$ represents a number of 0 or more necessary for neutralizing a charge in a molecule. $M^{31}$ and $m^{31}$ are the same as with $M^1$ and $m^1$ described above. $M^{31}$ is particularly preferably a cation, and preferred examples of the cations include sodium, potassium, triethylammonium, pyridinium and N-ethylpyridinium.

In the present invention, preferably in the fifth or seventh embodiment of the present invention, it is preferable that the sensitizing dye represented by formula (SI) is used in a blue-sensitive emulsion layer. The dye represented by formula (SII), (SIII) or (SIV) is more preferably selected, the sensitizing dye represented by formula (SII) or (SIII) is further preferably selected, and the sensitizing dye represented by formula (SII) is particularly preferred.

$X^{11}$, $X^{12}$ and $Y^{13}$ ($X^{21}$, $X^{22}$ and $Y^{21}$) ($X^{31}$ and $X^{32}$) are all preferably sulfur atoms. $V^{15}$ ($V^{25}$) is preferably a hydrogen atom or a chlorine atom, and $V^{16}$ ($V^{26}$) is preferably a hydrogen atom. $V^{11}$, $V^{12}$ and $V^{14}$ ($V^{21}$, $V^{22}$ and $V^{24}$) ($V^{31}$, $V^{32}$, $V^{34}$, $V^{35}$, $V^{36}$ and $V^{38}$) are each preferably a hydrogen atom,. and $V^{13}$ ($V^{23}$) ($V^{33}$ and $V^{37}$) is an alkyl group (for example, methyl), an alkoxyl group (for example, methoxy),an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferably a methyl group, a methoxy group, a cyano group, an acetyl group, a methoxycarbonyl group or a halogen atom, particularly preferably a halogen atom, and most preferably fluorine or chlorine.

It is preferred that one of $R^{11}$ and $R^{12}$ ($R^{21}$ and $R^{22}$) ($R^{31}$ and $R^{32}$) is a carboxymethyl group or a methanesulfonylcarbamoylmethyl group, and that the other is a 3-sulfopropyl group. Particularly preferably, $R^{11}$ ($R^{21}$) ($R^{31}$) is a carboxymethyl group or a methanesulfonylcarbamoylmethyl group, and $R^{12}$ ($R^{22}$) ($R^{32}$) is a 3-sulfopropyl group.

$M^{11}$ ($M^{21}$) ($M^{31}$) is preferably an organic or inorganic monovalent cation, and $m^{11}$ ($m^{21}$) ($m^{31}$) is preferably 0 or 1.

Specific examples of the sensitizing dyes represented by any of formula (SI), (SII), (SIII) or (SIV) that can be used in the present invention, preferably in the seventh embodiment of the present invention, are shown below, but the scope of the present invention is not limited thereby.

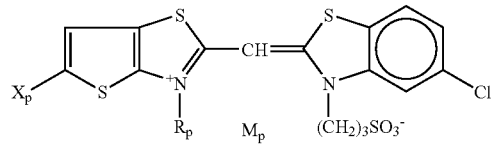

| | $X_p$ | $R_p$ | $M_p$ |
|---|---|---|---|
| S-1 | Cl | $CH_2CONHSO_2CH_3$ | — |
| S-2 | Cl | $CH_2CO_2H$ | — |
| S-3 | Br | $CH_2CO_2H$ | — |

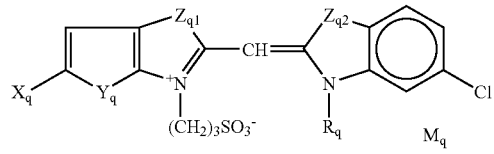

| | $X_q$ | $Y_q$ | $Z_{q1}$ | $Z_{q2}$ | $R_q$ | $M_q$ |
|---|---|---|---|---|---|---|
| S-4 | Cl | O | S | S | $CH_2CO_2H$ | — |
| S-5 | Cl | NH | S | S | $CH_2CONHSO_2CH_3$ | — |
| S-6 | Br | O | S | S | $CH_2CO_2H$ | — |

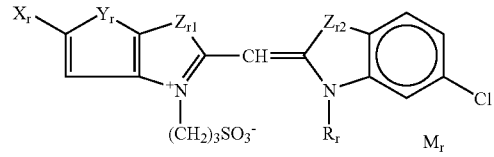

| | $X_r$ | $Y_r$ | $Z_{r1}$ | $Z_{r2}$ | $R_r$ | $M_r$ |
|---|---|---|---|---|---|---|
| S-7 | Cl | S | O | S | $CH_2CO_2H$ | — |
| S-8 | Cl | NH | S | S | $CH_2SO_2NHCOCH_3$ | — |
| S-9 | Br | O | S | S | $CH_2CO_2H$ | — |

S-10

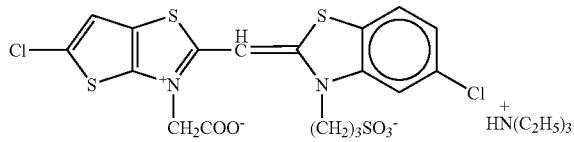

-continued
S-11
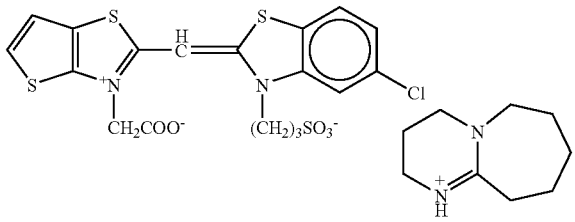
S-12
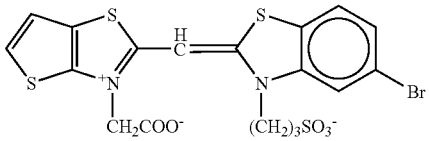
S-13
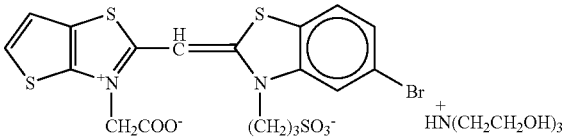
S-14
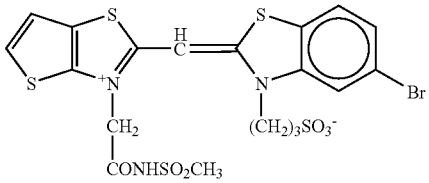
S-15
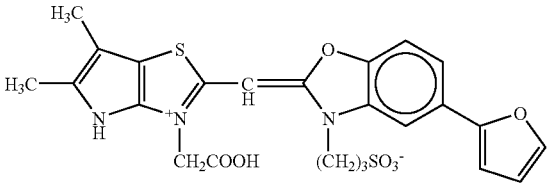
S-16
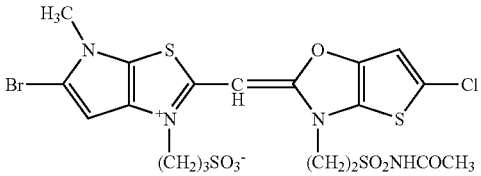
S-17
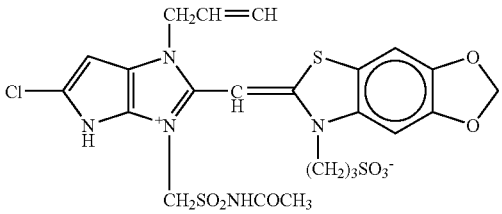
S-18
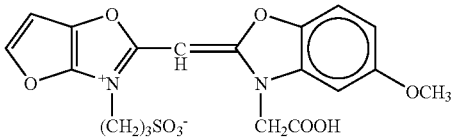

-continued
S-19
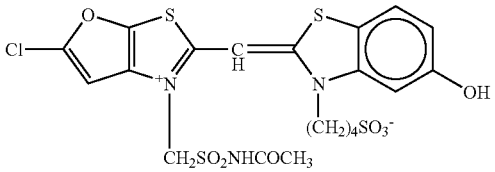
S-20
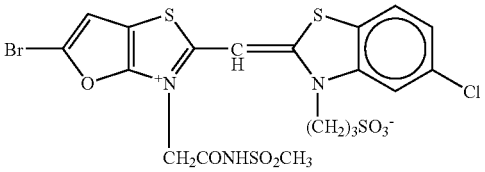
S-21
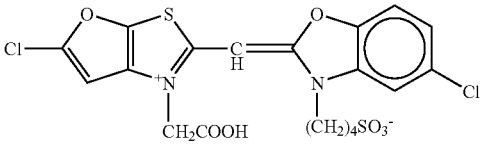
S-22
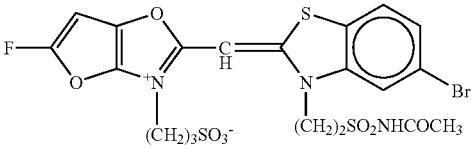
S-23
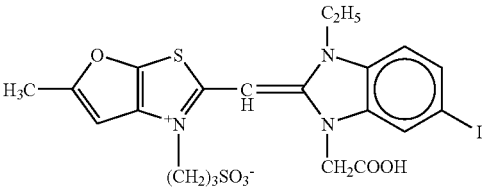
S-24
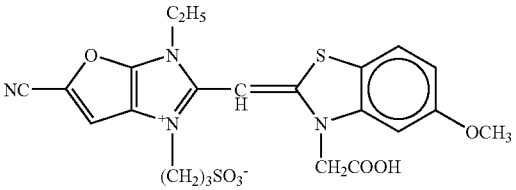
S-25
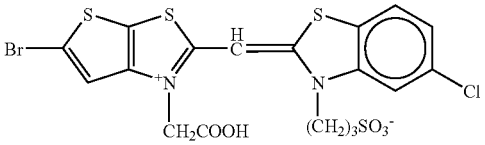
S-26
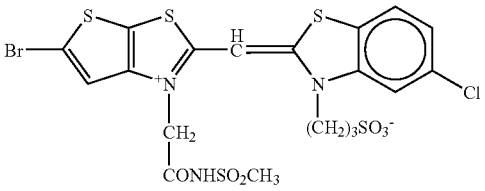
S-27
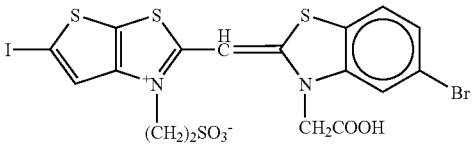

-continued
S-28
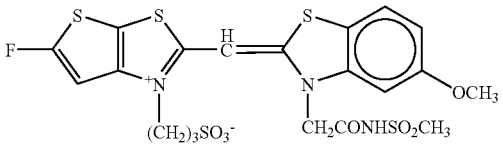
S-29
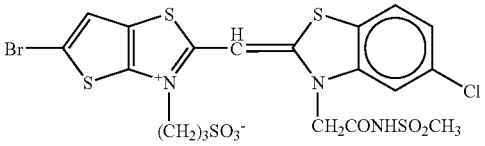
S-30
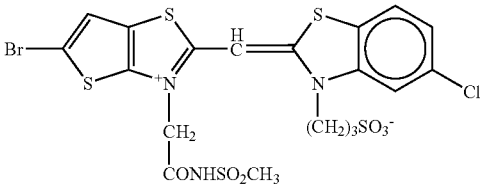
S-31
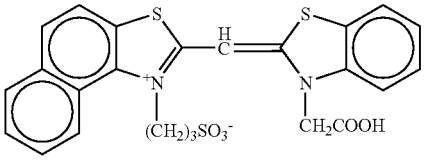
S-32
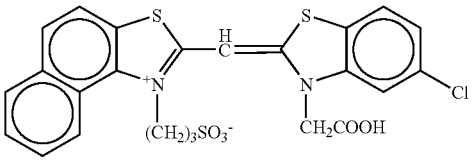
S-33
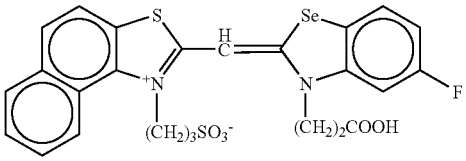
S-34
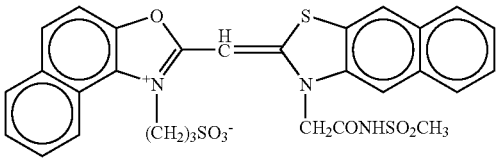
S-35
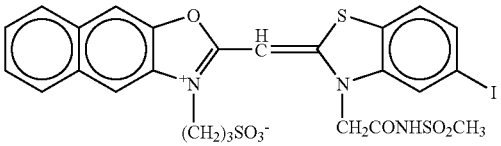
S-36
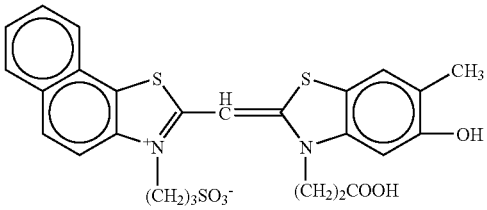

-continued
S-37
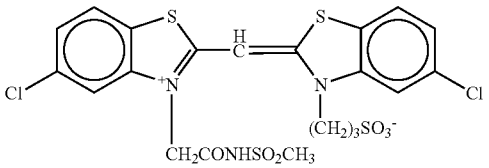
S-38
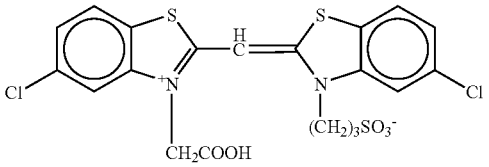
S-39
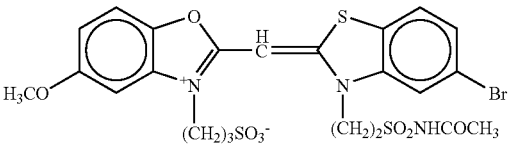
S-40
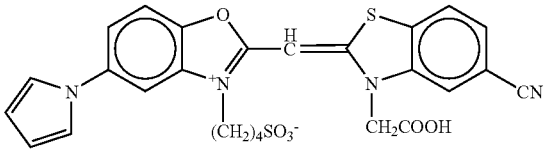
S-41
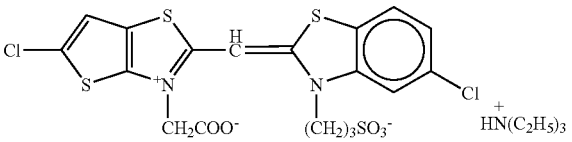
S-42
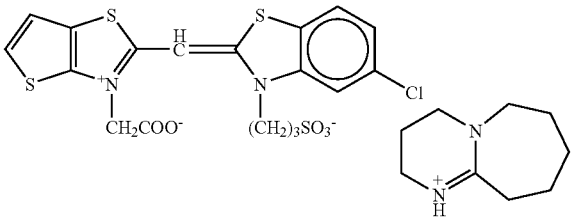
S-43
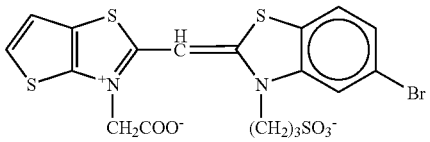
S-44
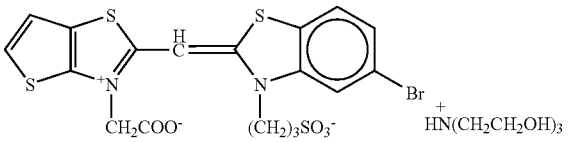
S-45
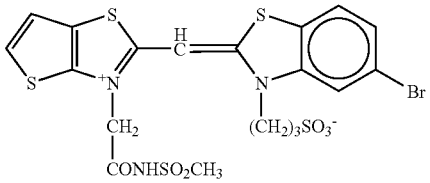

The sensitizing dye represented by formula (SI) (SII), (SIII) or (SIV) that can be used in the present invention, preferably in the seventh embodiment of the present invention, can be synthesized based on methods described in the following literatures:

a) F. M. Hamer, "Heterocyclic Compounds-Cyan dyes and related compounds" (John Wiley & Sons, New York, London, 1964);
b) D. M. Sturmer, "Heterocyclic Compounds-Special topics in heterocyclic chemistry" chapter 8, section 4, pages 482 to 515 (John Wiley & Sons, New York, London, 1977); and
c) "Rodd's Chemistry of Carbon Compounds", the second edition, volume 4, part B, chapter 15, pages 369 to 422 (Elsevier Science Publishing Company Inc., New York, 1977).

Heterocycles, raw materials for the sensitizing dye represented by any of formula (SI), (SIII), (SIII) or (SIV) that can be used in the present invention, preferably in the seventh embodiment of the present invention, can be synthesized with reference to, for example, descriptions of literatures such as Bulletin de la Societe Chimique de France, II-150 (1980) and Journal of Heterocyclic Chemistry, 16, 1563 (1979).

In adding the methine dye represented by any of formula (SI), (SII), (SII) or (SIV) that can be used in the present invention, preferably in the seventh embodiment of the present invention, to the silver halide emulsions used in the present invention, they may be directly dispersed in the emulsions, or may be added to the emulsions as solutions in which they are dissolved in sole or mixed solvents of solvents such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide.

Further, it is also possible to use a method of dissolving a dye in a volatile organic solvent, dispersing the resulting solution in water or a hydrophilic colloid, and adding the resulting dispersion to an emulsion as described in U.S. Pat. No. 3,469,987, a method of dispersing a water-insoluble dye in an aqueous solvent without dissolution, and adding the resulting dispersion to an emulsion as described in JP-B-46-24185, a method of dissolving a dye in an acid, and adding the resulting solution to an emulsion or adding it to an emulsion as an aqueous solution in which an acid or a base is allowed to coexist as described in JP-B-44-23389, JP-B-44-27555 and JP-B-57-22091, a method of adding to an emulsion an aqueous solution or a colloidal dispersion in which a surfactant is allowed to coexist as described in U.S. Pat. Nos. 3,822,135 and 4,006,026, a method of directly dispersing a dye in a hydrophilic colloid, and adding the resulting dispersion to an emulsion as described in JP-A-53-102733 and JP-A-58-105141, and a method of dissolving a dye using a compound allowing a red shift, and adding the resulting solution to an emulsion as described in JP-A-51-74624. It is also possible to use an ultrasonic wave for dissolving a dye.

The sensitizing dye represented by any of formula (SI), (SII), (SIII) or (SIV) that can be used in the present invention, preferably in the seventh embodiment of the present invention, may be added to the silver halide emulsions at any time or during any process of emulsion preparation which has hitherto been recognized to be useful. The sensitizing dyes may be added at any time or during any process before coating of the emulsions from chemical ripening to coating, for example, in the grain formation process of silver halide and/or before desalting, during the desalting process and/or in the time from after desalting to initiation of chemical ripening, as disclosed in U.S. Patent Nos. 2,735,766, 3,628,960, 4,183,756 and 4,225,666, JP-A-58-184142 and JP-A-60-196749, and just before chemical ripening or during the chemical ripening process as disclosed in JP-A-58-113920. The same compound may be added alone or in combination with a compound different in structure, for example, in parts during the grain formation process and during the chemical ripening process or after the completion of chemical ripening, or before chemical ripening or during the chemical ripening process and after the completion of chemical ripening, as disclosed in U.S. Pat. No. 4,225,666 and JP-A-58-7629. The kind of compound added in parts and the combination of compounds may be changed.

Although the amount added of the sensitizing dye represented by any of formula (SI), (SII), (SIII) or (SIV) that can be used in the present invention, preferably in the seventh embodiment of the present invention, varies depending on the form and size of silver halide grains, it is preferably from 0.1 to 4 mmol, and more preferably from 0.2 to 2.5 mmol, per mol of silver halide. Further, the sensitizing dye may be used in combination with another sensitizing dye.

In the present invention, other sensitizing dyes may be used, in addition to the methine dye represented by any of formula (SI), (SII), (SIII) or (SIV) that can be used in the present invention, preferably in the seventh embodiment of the present invention. The combination of sensitizing dyes is frequently used particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936 and JP-B-53-12375, JP-A-52-110618 and JP-A-52-109925.

The compound represented by formula (Z) will be described in detail below.

$$R^{41}—S—S—R^{42} \qquad \text{Formula (Z)}$$

The aliphatic groups represented by $R^{41}$ and $R^{42}$ in formula (Z) include an alkyl group, an alkenyl group, an alkynyl group, a cycloalkyl group, a cycloalkenyl group and an aralkyl group. Of these groups, those containing 1 to 18 carbon atoms are preferred over others, with examples including methyl, ethyl, n-propyl, i-propyl, i-butyl, t-pentyl, n-hexyl, n-decyl, allyl, 3-pentenyl, propargyl, cyclohexyl, cyclohexenyl, benzyl and phenethyl. The aromatic groups represented by $R^{41}$ and $R^{42}$ are monocyclic or condensed-ring aryl groups, preferably those containing 6 to 20 carbon atoms, with examples including phenyl and naphthyl groups. Alternatively, $R^{41}$ and $R^{42}$ may combine with each other to form a ring, preferably a 5- or 6-membered ring, together with —S—S—.

Each of the groups represented by $R^{41}$ and $R^{42}$ may have one substituent or two or more different substituents. Typical examples of such a substituent include a carboxyl group, an alkoxycarbonyl group (such as ethoxycarbonyl), an aryloxycarbonyl group (such as a phenoxycarbonyl group), an amino group, a substituted amino group (such as ethylamino, dimethylamino or methylphenylamino), a hydroxyl group, an alkoxy group (such as methoxy), an aryloxy group (such as phenoxy), an acyl group (such as acetyl), an acylamino group (such as acetamido), an ureido group (such as N,N-dimethylureido), a nitro group, a sulfonyl group (such as methylsulfonyl or phenylsulfonyl), a sulfo group, a mercapto group, an alkylthio group (such as methylthio), a cyano group, a phosphonyl group, a sulfamoyl group (such as unsubstituted sulfamoyl or N,N-dimethylsulfamoyl), a carbamoyl group (such as unsubstituted carbamoyl or N,N-diethylcarbamoyl), an alkyl group (such as ethyl), an aryl group (such as phenyl), a heterocyclic group (such as morphonyl or pyrazolyl) and a halogen atom (such as chlorine or bromine).

Specific examples of the compound represented by formula (Z) that can be used in the present invention, preferably in the seventh embodiment of the present invention, are shown below, but the scope of the present invention is not limited thereby.

Z-1

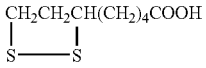

Z-2

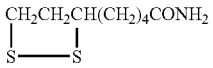

Z-3

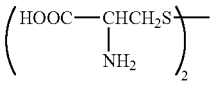

Z-4

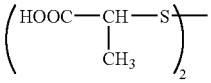

Z-5

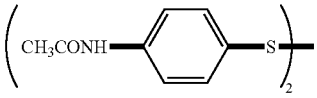

Z-6

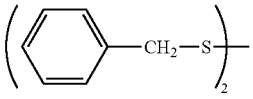

Z-7

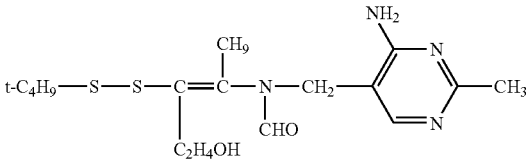

Z-8

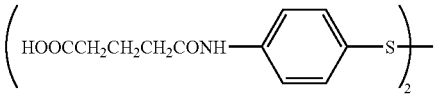

Z-9

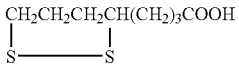

Z-10

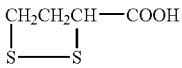

Z-11

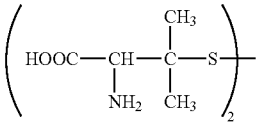

Z-12

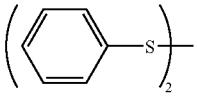

Z-13

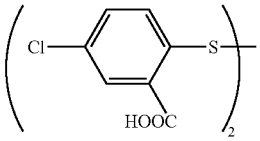

-continued

Z-14

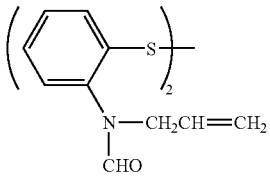

Z-15

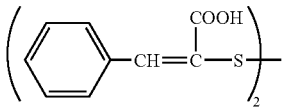

Z-16

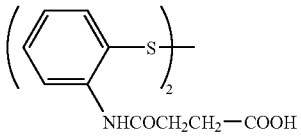

The addition time of the compound represented by formula (Z) for use in the present invention, may be within a period from preparation of silver halide to the completion of chemical sensitization. And it is preferable that the compound is present at the time of gold sensitization. The addition amount of the compound represented by formula (Z) can be determined properly depending on the species of silver halide used and the addition time of the compound. Specifically, the compound can be added in an amount of $1\times10^{-9}$ to $1\times10^{-5}$ mole, preferably $5\times10^{-6}$ to $1\times10^{-5}$ mole, per mole of silver halide. The compound represented by formula (Z) can be added in a state that it is dissolved in water or an organic solvent miscible with water (e.g., ethanol), or it is finely dispersed in a gelatin solution.

The photosensitive material of the present invention is illustrated below in further detail.

In the present invention, preferably in the third embodiment of the present invention, the total coating amount of silver in photographic constituent layers of the photosensitive material is preferably 0.50 g/m$^2$ or below (far preferably from 0.50 g/m$^2$ to 0.20 g/m$^2$), further preferably from 0.25 g/m$^2$ to 0.50 g/m$^2$. The range of 0.25 g/m$^2$ to 0.45 g/m$^2$ in particular is preferred, and the range of 0.25 g/m$^2$ to 0.40 g/m$^2$ is most preferred.

In the silver halide color photographic light-sensitive material according to the present invention, gelatin can be used as the hydrophilic binder, but hydrophilic colloids of other gelatin derivatives, graft polymers between gelatin and other polymers, proteins other than gelatin, sugar derivatives, cellulose derivatives and synthetic hydrophilic polymeric materials such as homopolymers or copolymers can also be used in combination with gelatin, if necessary. Gelatin to be used in the silver halide color photographic light-sensitive material according to the present invention may be either lime-treated or acid-treated gelatin or may be gelatin produced from any of cow bone, cowhide, pig skin, or the like, as the raw material, preferably lime-treated gelatin produced from cow bone or pig skin as the raw material. It is preferred for the gelatin that the content of heavy metals, such as Fe, Cu, Zn, and Mn, included as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

Although any of known gelatin hardeners can be used in the invention, preferably in the second embodiment of the present invention, it is preferable that the photographic light-sensitive material contains at least one vinyl sulfone-series hardener represented by the following formula (HI).

$$X^{a1}—SO_2\text{-}L\text{-}SO_1—X^{a2} \qquad \text{Formula (HI)}$$

In formula (HI), $X^{a1}$ and $X^{a2}$ each represent —CH═$CH_2$ or —$CH_2CH_2Y$ independently, and $X^{a1}$ and $X^{a2}$ may be the same or different. Y represents a group capable of being replaced with a nucleophilic group or released in the form of HY by reaction with a base (e.g., a halogen atom, a sulfonyloxy group, a sulfuric acid monoester). L represents a divalent linkage group, which may be substituted.

Examples of $X^{a1}$ and $X^{a2}$ in formula (HI) include the groups illustrated below:

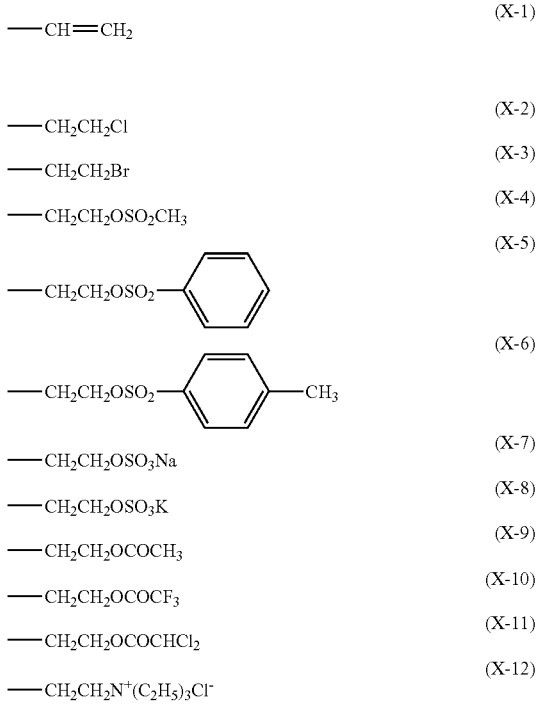

(X-1) —CH═$CH_2$ (X-2) —$CH_2CH_2Cl$ (X-3) —$CH_2CH_2Br$ (X-4) —$CH_2CH_2OSO_2CH_3$ (X-5) —$CH_2CH_2OSO_2$—

(X-6) —$CH_2CH_2OSO_2$—$CH_3$ (X-7) —$CH_2CH_2OSO_3Na$ (X-8) —$CH_2CH_2OSO_3K$ (X-9) —$CH_2CH_2OCOCH_3$ (X-10) —$CH_2CH_2OCOCF_3$ (X-11) —$CH_2CH_2OCOCHCl_2$ (X-12) —$CH_2CH_2N^+(C_2H_5)_3Cl^-$

Among these, (X-1), (X-2), (X-4), (X-7) and (X-12) are preferable, and (X-1) is particularly preferable.

Examples of L in formula (HI) include an alkylene group, an arylene group and divalent linkage groups formed by combining an alkylene or arylene group with one or a plurality of linkages shown below. Each of $R^{1a}$s in the following linkages represents a hydrogen atom, an alkyl group containing 1 to 15 carbon atoms or an aralkyl group containing 1 to 15 carbon atoms.

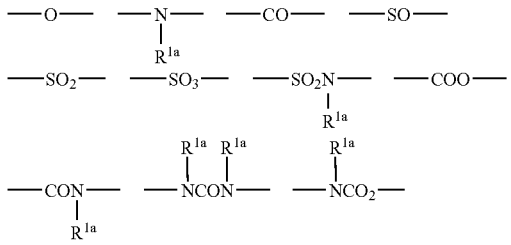

—O— —N(R$^{1a}$)— —CO— —SO—

—$SO_2$— —$SO_3$— —$SO_2$N(R$^{1a}$)— —COO—

—CON(R$^{1a}$)— —N(R$^{1a}$)CON(R$^{1a}$)— —N(R$^{1a}$)$CO_2$—

In special cases where L in formula (HI) contains two or more of the linkages shown below, $R^{1a}$s may combine with each other to form a ring.

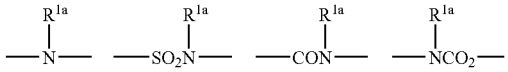

—N(R$^{1a}$)— —$SO_2$N(R$^{1a}$)— —CON(R$^{1a}$)— —N(R$^{1a}$)$CO_2$—

The L in formula (HI) may have a substituent. Examples of such a substituent include a hydroxyl group, an alkoxy group, a carbamoyl group a sulfamoyl group, an alkyl group and an aryl group. These substituents each may further be substituted with a group represented by $X^{3a}$—$SO_2$—. Herein, $X^{3a}$ has the same meaning as $X^{1a}$ or $X^{2a}$.

Typical examples of L in formula (HI) include the groups shown below. In these examples, each of a to r represents an integer of 1 to 6 and each of s to w represents 1 or 2. Herein, however, e alone may be 0 as well. Of these letters a to w, it is preferable that each of a, e, j, k and m is an integer of 1 to 3 and the letters other than a, e, j, k and m are each 1 or 2. $R^{1b}$ to $R^{5b}$ each represent a hydrogen atom or a substituted or unsubstituted alkyl group containing 1 to 6 carbon atoms independently. $R^{1b}$ and $R^{2b}$ may combine with each other to form a ring, and $R^{4b}$ and $R^{5b}$ may also combine with each other to form a ring. Each of $R^{1b}$ to $R^{5b}$ is preferably a hydrogen atom, a methyl group or an ethyl group.

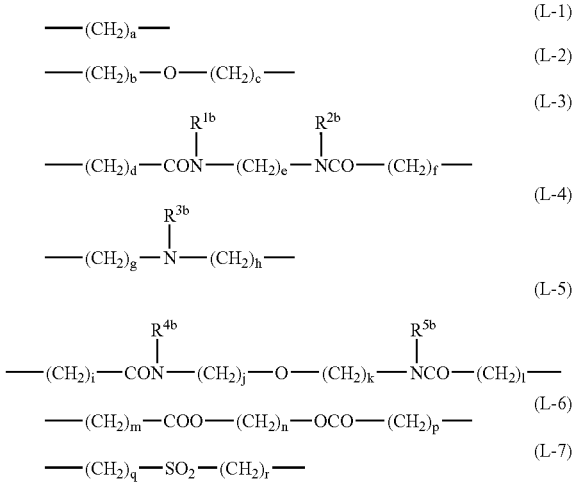

(L-1) —$(CH_2)_a$—

(L-2) —$(CH_2)_b$—O—$(CH_2)_c$—

(L-3) —$(CH_2)_d$—CON(R$^{1b}$)—$(CH_2)_e$—NCO(R$^{2b}$)—$(CH_2)_f$—

(L-4) —$(CH_2)_g$—N(R$^{3b}$)—$(CH_2)_h$—

(L-5) —$(CH_2)_i$—CON(R$^{4b}$)—$(CH_2)_j$—O—$(CH_2)_k$—NCO(R$^{5b}$)—$(CH_2)_l$—

(L-6) —$(CH_2)_m$—COO—$(CH_2)_n$—OCO—$(CH_2)_p$—

(L-7) —$(CH_2)_q$—$SO_2$—$(CH_2)_r$—

These groups represented by L may have substituents. Typical examples of L in a case where the group represented by L has a substituent and those of a case wherein $R^{1b}$ and $R^{2b}$ are combined include the following ones.

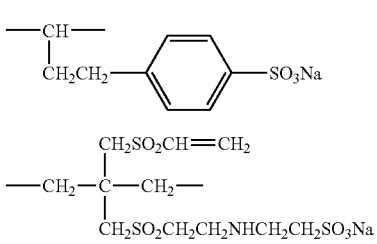

(L-8) —CH($CH_2CH_2$—$SO_3Na$)—

(L-9) —$CH_2$—C($CH_2SO_2CH$═$CH_2$)($CH_2SO_2CH_2CH_2NHCH_2CH_2SO_3Na$)—$CH_2$—

-continued (L-10)

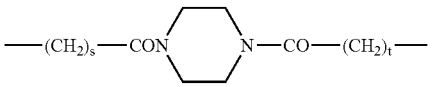

(L-11)

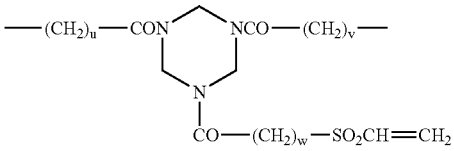

Specific examples of a vinyl sulfone-series hardener represented by formula (HI) are illustrated below. However, these examples should not be construed as limiting the scope of the invention.

(H-1)

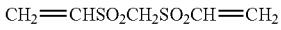

(H-2)

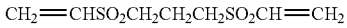

(H-3)

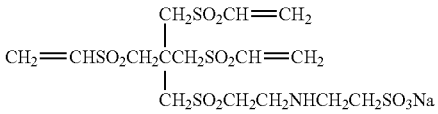

(H-4)

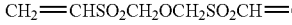

(H-5)

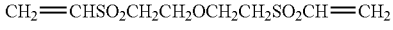

(H-6)

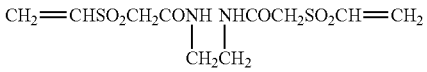

(H-7)

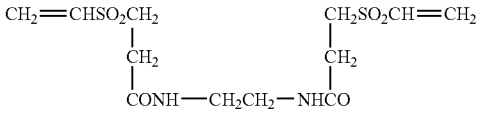

(H-8)

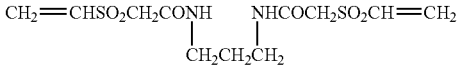

(H-9)

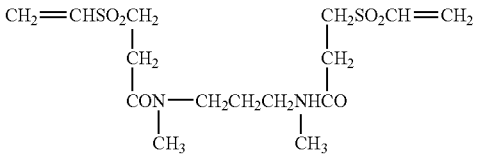

(H-10)

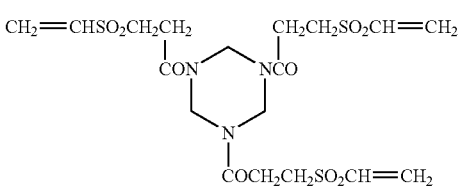

(H-11)

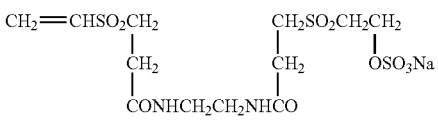

-continued (H-12)

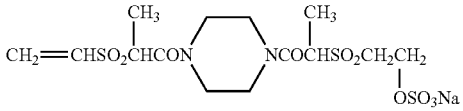

(H-13)

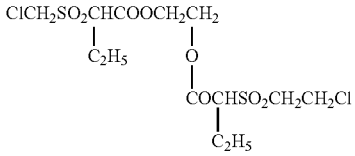

(H-14)

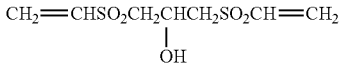

Among the exemplified examples of the vinyl sulfone-series hardener represented by formula (HI), particularly preferable examples of the compound include the compound represented by (H-1), (H-2), (H-3), (H-4) or (H-6).

In combination with the hardener represented by the formula (HI), hardeners described, for example, in JP-A No. 62-215272, from 146 page, upper right column, line 8 to 146 page, lower right column, line 2 and from 147 page, lower right column, line 6 to 155 page, lower left column, line 4 can also be used. The amount of hardeners added in the present invention is an amount required for a hydrophilic colloid layer to be formed of substantially hardened gelatin. The proportion of hardeners to dry gelatin is preferably from 0.01 to 10% by mass, far preferably from 0.1 to 5 % by mass, particularly preferably from 0.2 to 3.0% by mass. The most typical hardeners used in combination with the hardeners of formula (HI) are chlorotriazine-series hardeners. The amount of chlorotriazine-series hardeners used is preferably from 0 to 2.0% by mass, far preferably from 0 to 1.0% by mass, most preferably from 0 to 0.2% by mass.

The total coating amount of gelatin in photographic constituent layers of the photosensitive material, namely the total amount of hydrophilic binders contained in the light-sensitive silver halide emulsion layers and light-insensitive hydrophilic colloid layers which are provided in a range extending from the support to the hydrophilic colloid layer most distant from the support on the silver halide emulsion-coated side, is preferably from 4.0 g/m$^2$ to 7.0 g/m$^2$, far preferably from 4.5 g/m$^2$ to 6.5 g/m$^2$, particularly preferably from 5.0 g/m$^2$ to 6.0 g/m$^2$. When the amount of total hydrophilic binders exceeds the foregoing range, effects of the present invention is lowered in some cases because the rapidity of color-development processing is lost, blix discoloration is worsened, or the rapid processing suitability of the rinsing process (washing and/or stabilizing process) is impaired. On the other hand, the amount of total hydrophilic binders falling short of the foregoing range is undesirable because it tends to yield detrimental effects, such as pressure-induced fog streaks, caused by insufficient film strength.

In the light-sensitive material of the present invention, preferably of the sixth or seventh embodiment of the present invention, in order to improve, e.g., sharpness of an image, a dye (particularly an oxonole-series dye) that can be discolored by processing, as described in European Patent No. 0337490 A2, pages 27 to 76, is preferably added to the hydrophilic colloid layer such that an optical reflection density at 680 nm in the light-sensitive material is 0.70 or more. It is also preferable to add 12% by mass or more (more preferably 14% by mass or more) of titanium oxide that is surface-treated with, for example, dihydric to tetrahydric alcohols (e.g., trimethylolethane) to a water-proof resin layer of the support.

The light-sensitive material preferably contains, in the hydrophilic colloid layer, a dye (particularly oxonole dyes and cyanine dyes) that can be discolored by processing, as described in European Patent Application Publication No. 0337490A2, pages 27 to 76, in order to prevent irradiation or halation or enhance safelight safety, and the like. Further, a dye described in European Patent Publication No. 0819977 may also be preferably used in the present invention. Among these water-soluble dyes, some deteriorate color separation or safelight safety when used in an increased amount. Preferable examples of the dye which can be used and which does not deteriorate color separation, include water-soluble dyes described in JP-A-5-127324, JP-A-5-127325 and JP-A-5-216185.

In the light-sensitive material, it is possible to use a colored layer which can be discolored during processing, in place of the water-soluble dye, or in combination with the water-soluble dye. The colored layer that can be discolored with a processing, to be used, may contact with an emulsion layer directly, or indirectly through an interlayer containing an agent for preventing color-mixing during processing, such as hydroquinone or gelatin. The colored layer is preferably provided as a lower layer (closer to a support) with respect to the emulsion layer which develops the same primary color as the color of the colored layer. It is possible to provide colored layers independently, each corresponding to respective primary colors. Alternatively, only some layers selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is 0.2 or more but 3.0 or less, more preferably 0.5 or more but 2.5 or less, and particularly preferably 0.8 or more but 2.0 or less.

The colored layer may be formed by an arbitrary method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer; a method in which a dye is adsorbed onto fine grains of silver halide or the like and fixed in the layer; and a method in which a colloidal silver is used, as described in JP-A-1-239544. As to a method of dispersing fine-powder of a dye in solid state, for example, JP-A-2-308244, pages 4 to 13, describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing colloidal silver for use as a light absorber. Among these methods, preferred are the methods of incorporating fine particles of dye and of using colloidal silver.

It is preferable that the light-sensitive material has at least one yellow-color-forming silver halide emulsion layer, at least one magenta-color-forming silver halide emulsion layer and at least one cyan-color-forming silver halide emulsion layer. In general, the arranging order of these silver halide emulsion layers, from nearest the support to farthest from the support, is a yellow-color-forming silver halide emulsion layer, a magenta-color-forming silver halide emulsion layer and a cyan-color-forming silver halide emulsion layer.

However, other layer arrangements which are different from the above, may be adopted.

In the light-sensitive material, the silver halide emulsion contained in the blue-sensitive silver halide emulsion layer preferably has a relatively high sensitivity as compared with the green-sensitive silver halide emulsion and red-sensitive silver halide emulsion, in consideration of yellow mask of a negative or spectroscopic characteristics of halogen that is the source at the time of exposure. For this purpose, the side length of the grains in the blue-sensitive emulsion is greater than that of the grains in other layers. Further, the generally known molar extinction coefficient of the coloring dye formed by a yellow coupler is low as compared with those of the coloring dyes formed by the magenta coupler and the cyan coupler, so that increasing yellow coupler coating amount is accompanied by an increasing coating amount of the blue-sensitive emulsion. The yellow color-forming blue-sensitive layer is disadvantageous as compared with other layers when taking into consideration the resistance to pressure applied from the surface of the photosensitive material, such as scratching, and it is preferably positioned on a side closer to the support. More preferably, the yellow color-forming blue-sensitive layer is positioned closest to the support among the silver halide emulsion layers. Most preferably, it is positioned in the position closest to the support among all the layers.

In the present invention, a yellow coupler-containing silver halide emulsion layer may be provided at any position on a support. In the case where silver halide tabular grains are contained in the yellow-coupler-containing layer, it is preferable that the yellow-coupler-containing layer be positioned more apart from a support than at least one of a magenta-coupler-containing silver halide emulsion layer and a cyan-coupler-containing silver halide emulsion layer. Further, it is preferable that the yellow-coupler-containing silver halide emulsion layer be positioned most apart from a support than other silver halide emulsion layers, from the viewpoint of color-development acceleration, desilvering acceleration, and reducing residual color due to a sensitizing dye. Further, it is preferable that the cyan-coupler-containing silver halide emulsion layer be disposed in the middle of the other silver halide emulsion layers, from the viewpoint of reducing blix fading. On the other hand, it is preferable that the cyan-coupler-containing silver halide emulsion layer be the lowest layer, from the viewpoint of reducing light fading. Further, each of the yellow-color-forming layer, the magenta-color-forming layer, and the cyan-color-forming layer may be composed of two or three layers. It is also preferable that a color-forming layer be formed by providing a silver-halide-emulsion-free layer containing a coupler in adjacent to a silver halide emulsion layer, as described in, for example, JP-A-4-75055, JP-A-9-114035, JP-A-10-246940, and U.S. Pat. No. 5,576,159.

Preferred examples of silver halide emulsions that can be additionally used in combination with the silver halide emulsion of the present invention, and other materials (additives or the like) applicable to the present invention, photographic constitutional layers (arrangement of the layers or the like), and processing methods for processing the photographic materials and additives for processing, include those disclosed in JP-A-62-215272, JP-A-2-33144, and European Patent Application Publication No. 0,355,660A2. In particular, those disclosed in European Patent Application Publication No. 0,355,660A2 can be preferably used. Further, it is also preferred to use silver halide color photographic light-sensitive materials and processing methods thereof described, for example, in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and European Patent Application Publication No. 0520457A2.

In particular, as the above-described support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye-image-stability-improving agents (stain inhibitors and discoloration inhibitors), the dyes (coloring layers), the kinds of gelatin, the layer structure of the light-sensitive material, and the film pH of the light-sensitive material, those described in the patent publications as shown in the following table are particularly preferably used in the present invention.

TABLE 1

| Element | JP-A-7-104448 | JP-A-7-77775 | JP-A-7-301895 |
|---|---|---|---|
| Reflective type supports | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectral sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| Film pH of light-sensitive materials | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developer | Column 88, line 19 to Column 89, line 22 | | |

In the photosensitive material, the dye-forming coupler (herein, also referred to as "coupler") is generally added to a photographically useful substance or a high-boiling organic solvent, emulsified and dispersed together with the substance or solvent, and incorporated into a photosensitive material as a resulting dispersion. This solution (dispersion) is emulsified and dispersed in fine grain form, into a hydrophilic colloid, preferably into an aqueous gelatin solution, together with a dispersant which is, for example, a surfactant, by use of a known apparatus such as an ultrasonic device, a colloid mill, a homogenizer, a Manton-Gaulin, or a high-speed dissolver, to obtain a dispersion.

The high-boiling organic solvent that can be used in the present invention is not particularly limited, and an ordinary one may be used. Examples of which include those described in U.S. Pat. No. 2,322,027 and JP-A-7-152129.

Further, when dissolving the coupler, an auxiliary solvent may be used together with the high-boiling point organic solvent. Examples of the auxiliary solvent include acetates of a lower alcohol, such as ethyl acetate and butyl acetate; ethyl propionate, secondary butyl acetate, methyl ethyl ketone, methyl isobutyl ketone, β-ethoxyethyl acetate, methyl cellosolve acetate, methyl carbitol acetate, and cyclohexanone.

Further, if necessary, an organic solvent that completely admix with water, such as methyl alcohol, ethyl alcohol, acetone, tetrahydrofuran, and dimethylformamide, can be additionally used as a part of the auxiliary solvent. These organic solvents can be used in combination with two or more.

For the purpose of, for example, improving stability with the lapse of time at storage in the state of an emulsified dispersion, and improving stability with the lapse of time and inhibiting the fluctuation of photographic property of the end-composition for coating (applying) that is mixed with an emulsion, if necessary, from the thus-prepared emulsified dispersion, the auxiliary solvent may be removed in its entirety or part of it, for example, by distillation under reduced pressure, noodle washing, or ultrafiltration.

Preferably, the average particle size of the lipophilic fine-particle dispersion obtained in this way is 0.04 to 0.50 μm, more preferably 0.05 to 0.30 μm, and most preferably 0.08 to 0.20 μm. The average particle size can be measured by using Coulter Submicron Particle Analyzer Model N4 (trade name, manufactured by Coulter Electronics Co.) or the like.

In the oil-in-water droplet dispersing method using a high-boiling organic solvent, the ratio of the mass of the high-boiling organic solvent to the total mass of the cyan coupler used may be set arbitrarily, and it is preferably 0.1 or more and 10.0 or less, more preferably 0.3 or more and 7.0 or less, and most preferably 0.5 or more and 5.0 or less. Also, the method may be performed without using any high-boiling organic solvent.

Also, a pigment for coloration may be co-emulsified into the emulsion used in the present invention in order to adjust coloration of the white background, or it may coexist in an organic solvent that dissolves the photographically useful compound, such as the coupler, used in the photosensitive material of the present invention to be co-emulsified, thereby preparing an emulsion.

As cyan, magenta, and yellow couplers which can be used in the photosensitive material, in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it is preferred for the present invention to add compounds represented by formula (II) or (III) in WO 98/33760 and compounds represented by formula (D) described in JP-A-10-221825.

As the cyan dye-forming coupler (hereinafter also simply referred to as "cyan coupler") which can be used in the present invention, preferably in the forth, sixth or seventh embodiment of the present invention, pyrrolotriazole-series couplers are preferably used, and more specifically, couplers represented by formula (I) or (II) in JP-A-5-313324, and couplers represented by formula (I) in JP-A-6-347960 are preferred. Exemplified couplers described in these publications are particularly preferred. Further, phenol-series or naphthol-series cyan couplers are also preferred. For example, cyan couplers represented by formula (ADF) described in JP-A-10-333297 are preferred. Preferable examples of cyan couplers other than the foregoing cyan couplers, include pyrroloazole-type cyan couplers described in European Patent Nos. 0 488 248 and 0 491 197 (A1), 2,5-diacylamino phenol couplers described in U.S. Pat. No. 5,888,716; pyrazoloazole-type cyan couplers having an electron-withdrawing group or a group bonding via hydrogen bond at the 6-position, as described in U.S. Pat. Nos. 4,873,183 and 4,916,051; and particularly, pyrazoloazole-type cyan couplers having a carbamoyl group at the 6-position, as described in JP-A-8-171185, JP-A-8-311360, and JP-A-8-339060.

In addition, as a cyan coupler, use can also be made of a diphenylimidazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group, and couplers (6) and (9), enumerated as specific examples are particularly preferable) described in European patent 0333185 A2; a cyclic active methylene-series cyan coupler (particularly couplers 3, 8, and 34 enumerated as specific examples are particularly preferable) described in JP-A-64-32260; a pyrrolopyrazole-type cyan coupler described in European Patent No. 0456226 A1; and a pyrroloimidazole-type cyan coupler described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated herein by reference as a part of the present specification.

In the present invention, preferably in the second or third embodiment of the present invention, the light-sensitive material contains at least one compound represented by the following formula (IA) as a cyan-dye-forming coupler (simply referred to as a cyan coupler also). This compound may be used in combination with other cyan couplers.

The compounds represented by the following formula (IA) are described below.

Formula (IA)

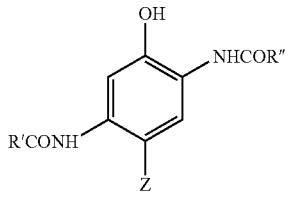

In formula (IA), R' and R" each independently represent a substituent, and Z represents a hydrogen atom, or a group capable of being split-off in a coupling reaction with an oxidized product of an aromatic primary amine color-developing agent.

The term "alkyl" as used herein throughout the present specification, unless otherwise indicated specifically, refers to an unsaturated or saturated, straight-chain or branched-chain alkyl group (including alkenyl and aralkyl), including a cyclic alkyl group having 3 to 8 carbon atoms (including cycloalkenyl), and the term "aryl" specifically includes a condensed aryl.

With respect to formula (IA), R' and R" each are preferably selected independently from an unsubstituted or substituted alkyl group, aryl group, amino group or alkoxy group, or 5- to 10-membered heterocycle containing at least one heteroatom selected from nitrogen, oxygen and sulfur (the ring being unsubstituted or substituted).

In formula (IA), when R' and/or R" are an amino group or an alkoxy group, they may be substituted with, for example, a halogen atom, an aryloxy group, or an alkyl- or aryl-sulfonyl group. Preferably, R' and R" are independently selected from unsubstituted or substituted, alkyl or aryl groups, or five to ten-membered heterocyclic groups, such as a pyridyl group, a morpholino group, an imidazolyl group, and a pyridazolyl group.

In formula (IA), R' is preferably an alkyl group substituted with, for example, a halogen atom, an alkyl group, an aryloxy group, or an alkyl- or aryl-sulfonyl group (which may be further substituted). When R" is an alkyl group, it may also be substituted in the same manner as described above.

However, R" is preferably an unsubstituted aryl group, or a heterocyclic group substituted with, for example, a cyano group, a halogen atom (chlorine, fluorine, bromine, or iodine), an alkyl- or aryl-carbonyl group, an alkyl- or aryl-oxycarbonyl group, an acyloxy group, a carbonamido group, an alkyl- or aryl-carbonamido group, an alkyl- or aryl-oxycarbonamido group, an alkyl- or aryl-sulfonyl group, an alkyl- or aryl-sulfonyloxy group, an alkyl- or aryl-oxysulfonyl group, an alkyl- or aryl-sulfoxide group, an alkyl- or aryl-sulfamoyl group, an alkyl- or aryl-sulfamoylamino group, an alkyl- or aryl-sulfonamido group, an aryl group, an alkyl group, an alkoxy group, an aryloxy group, a nitro group, an alkyl- or aryl-ureido group, or an alkyl- or aryl-carbamoyl group (each of which may by further substituted). Preferred substituent groups are a halogen atom, a cyano group, an alkoxycarbonyl group, an alkylsulfamoyl group, an alkylsulfonamido group, an alkylsulfonyl group, a carbamoyl group, an alkylcarbamoyl group, and an alkylcarbonamido group. When R' is an aryl group or a heterocyclic group, it may also be substituted in the same manner as described above.

Preferably, R" is a 4-chlorophenyl group, a 3,4-dichlorophenyl group, a 3,4-difluorophenyl group, a 4-cyanophenyl group, 3-chloro-4-cyano-phenyl group, a pentafluorophenyl group, or a 3- or 4-sulfonamido-phenyl group.

In formula (IA), Z represents a hydrogen atom or a group that can split off upon a coupling reaction with an oxidized product of an aromatic primary amine color-developing agent. Z is preferably a hydrogen atom, a chlorine atom, a fluorine atom, a substituted aryloxy or a mercaptotetrazole, more preferably a hydrogen atom or a chlorine atom.

Z determines the chemical equivalent of the coupler, that is, whether it is a two-equivalent coupler or a four-equivalent coupler, and the reactivity of the coupler can be changed depending on the kind of Z. Such a group can give advantageous effects on the layers on which the coupler is coated or other layers in a photographic recording material, by exhibiting a function, for example, of dye formation, dye hue adjustment, acceleration of development or inhibition of development, acceleration of bleaching or inhibition of bleaching, facilitation of electron mobilization, color correction, or the like, after it is released from the coupler.

Examples of representative class of such a coupling split-off group include halogen, alkoxy, aryloxy, heterocyclyloxy, sulfonyloxy, acyloxy, acyl, heterocyclyl, sulfonamido, heterocylylthio, benzothiazolyl, phosphonyloxy, alkylthio, arylthio, and arylazo groups. These coupling split-off groups are described, for example, in the following specifications: U.S. Pat. Nos. 2,455,169, 3,227,551, 3,432,521, 3,467,563, 3,617,291, 3,880,661, 4,052,212, and 4,134,766, as well as GB Patent No. 1,466,728, GB Patent No. 1,531,927, and GB Patent No. 1,533,039, and GB Patent application publication Nos. 2,066,755 and 2,017,704, the disclosure of which are incorporated herein by reference. Most preferred are a halogen atom, an alkoxy group, and an aryloxy group.

Preferable examples of the coupling split-off group are as follows: —Cl, —F, —Br, —SCN, —$OCH_3$, —$OC_6H_5$, —$OCH_2C(=O)NHCH_2CH_2O$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

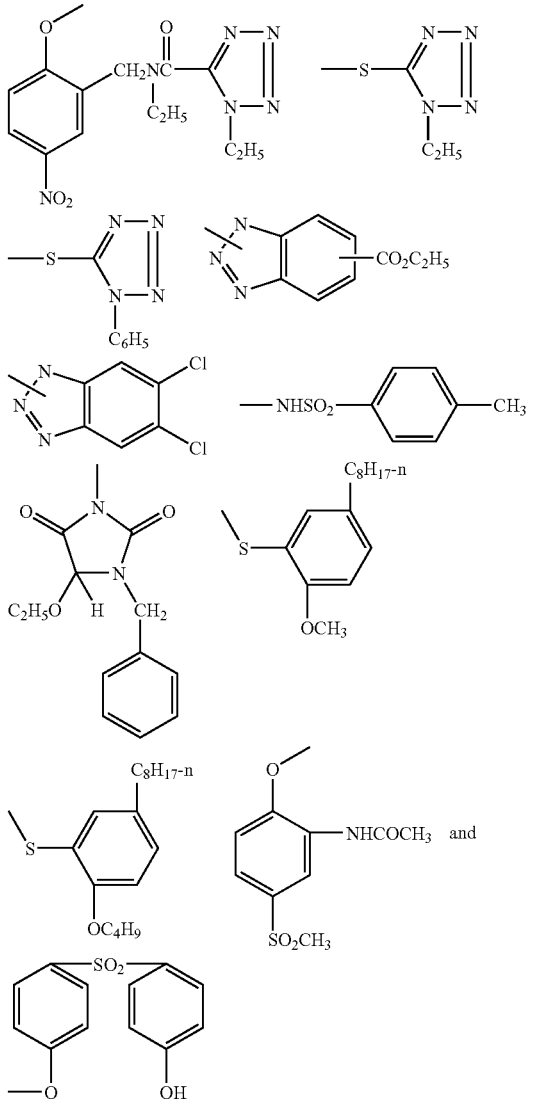

In general, the coupling split-off group is a chlorine atom, a hydrogen atom, or a p-methoxyphenoxy group.

Specific examples of the compound represented by formula (IA) are shown below. However, the present invention is not limited to these compounds.

IC-1

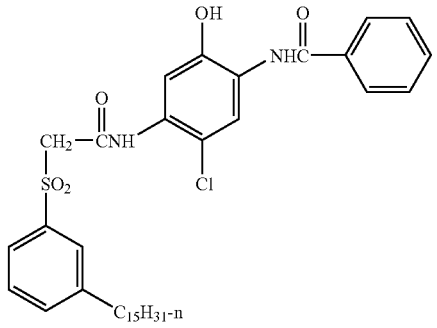

-continued
IC-2
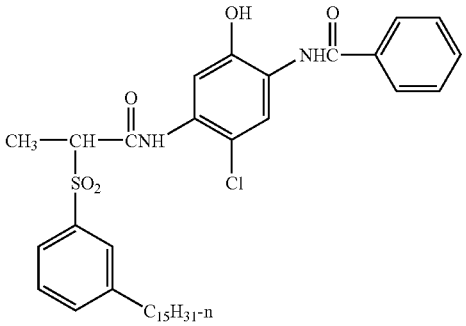
IC-3
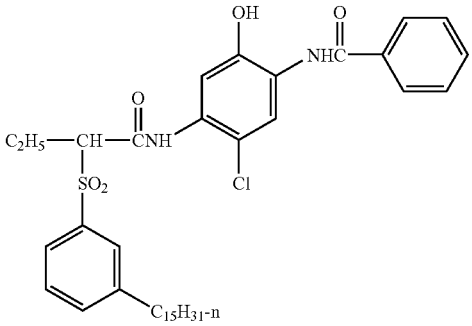
IC-4
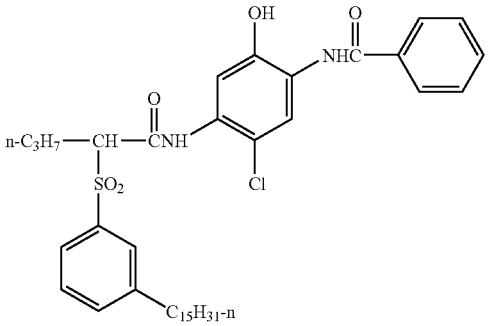
IC-5
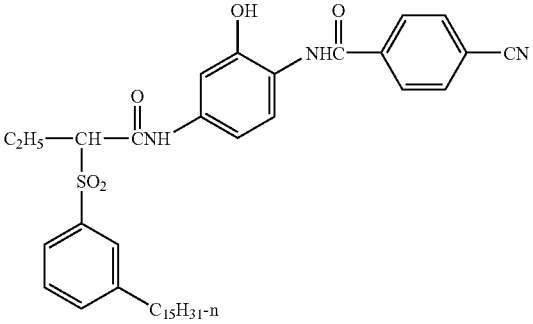
-continued
IC-6
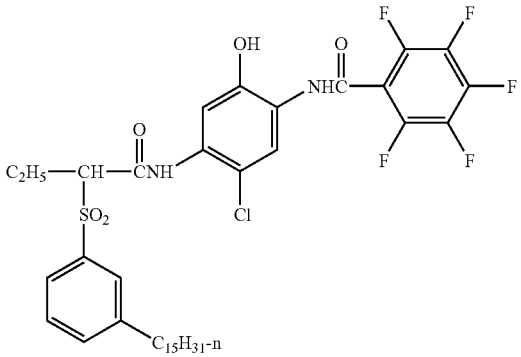
IC-7
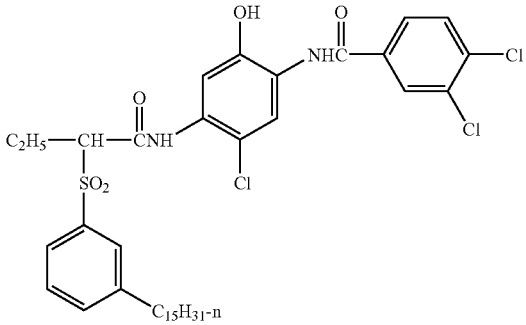
IC-8
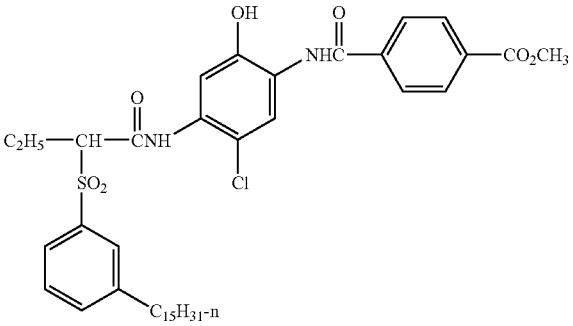
IC-9
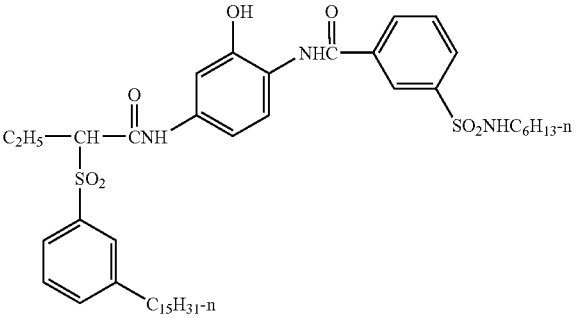

-continued
IC-10
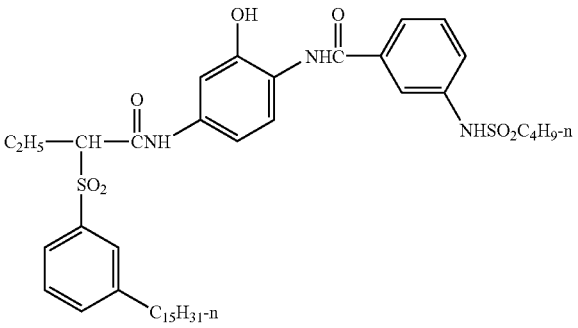
IC-11
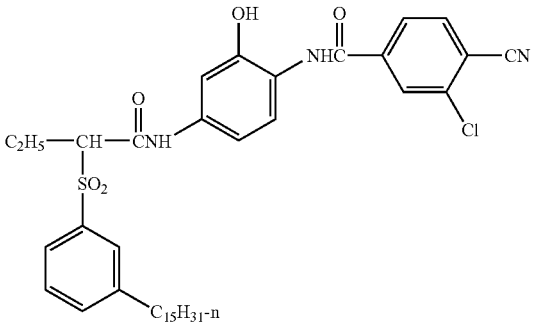
IC-12
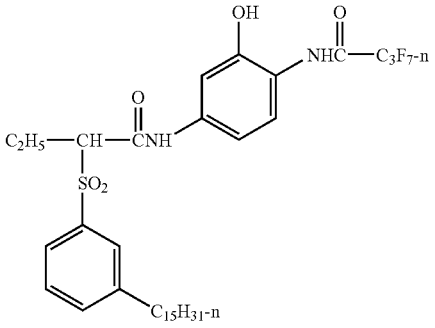
IC-13
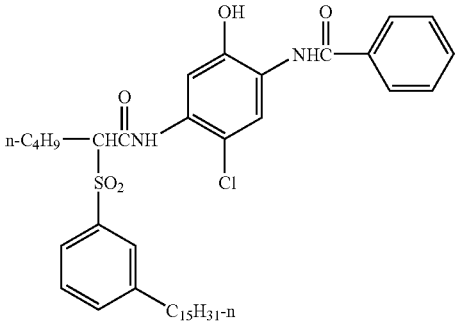
-continued
IC-14
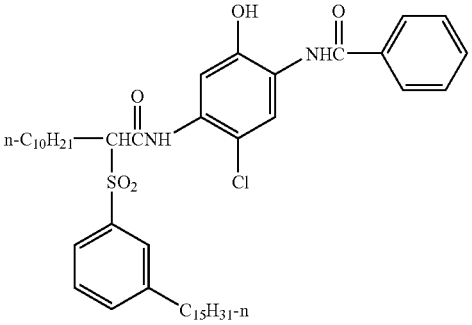
IC-15
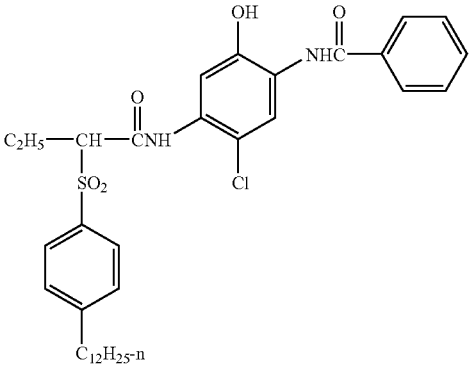
IC-16
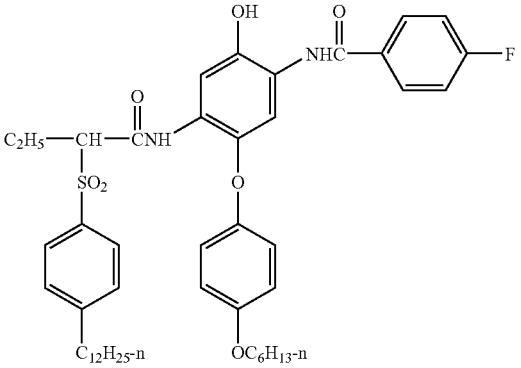
IC-17
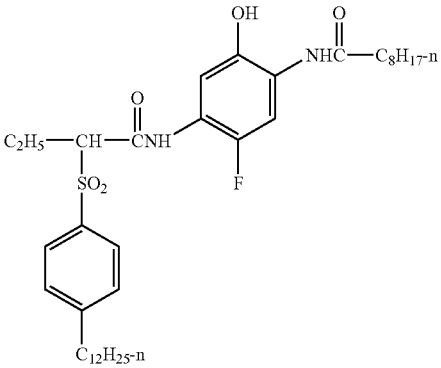

-continued
IC-18
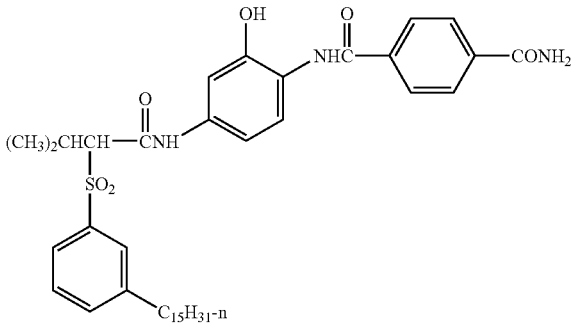
IC-19
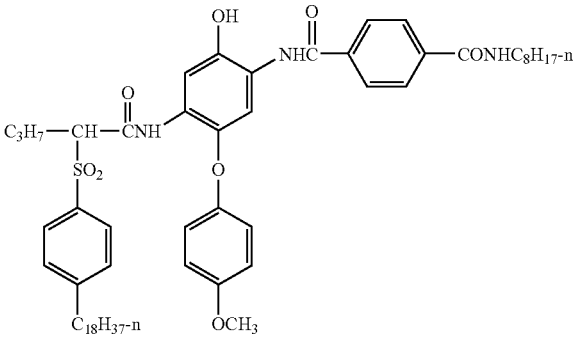
IC-20
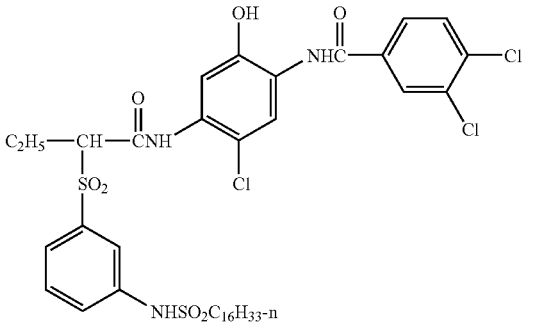
IC-21
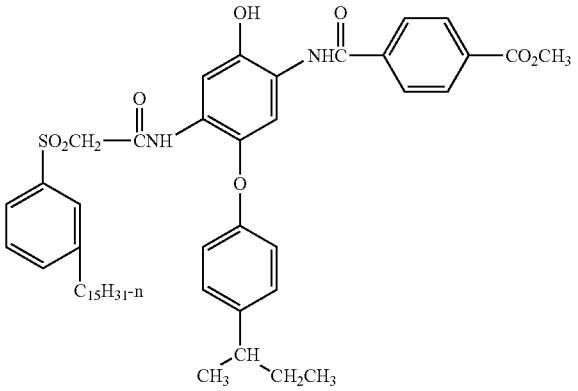
-continued
IC-22
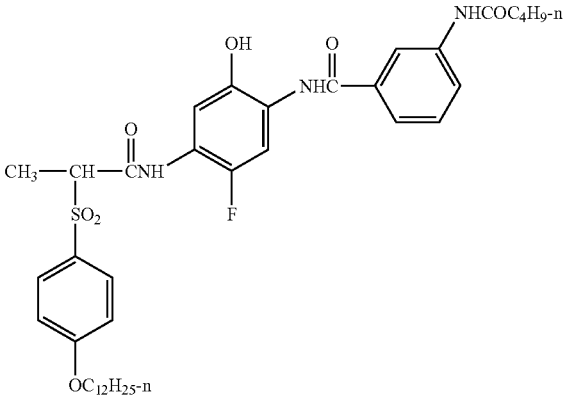
IC-23
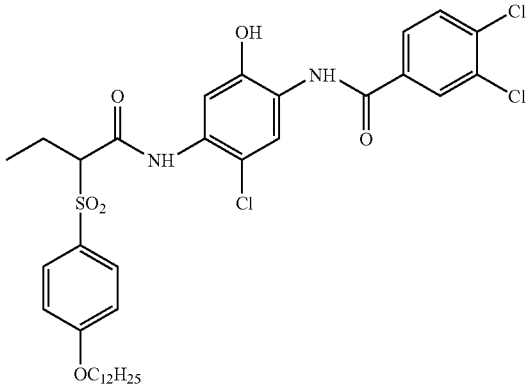
IC-24
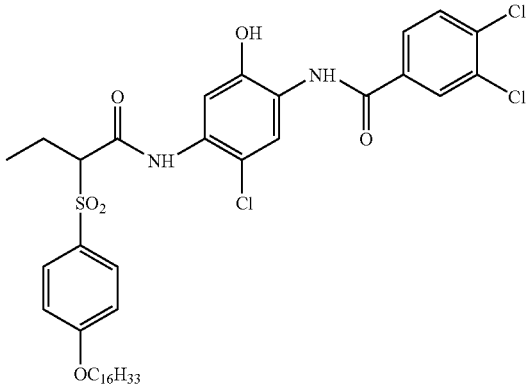

-continued
IC-25
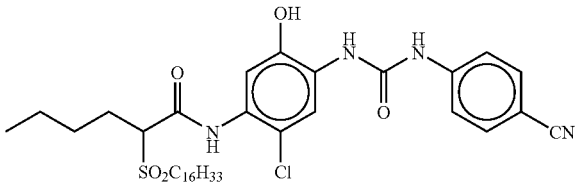
-continued
IC-27
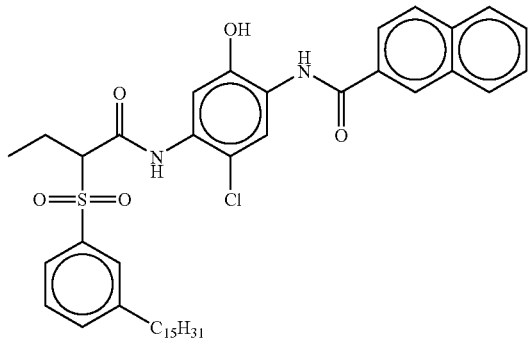
IC-26
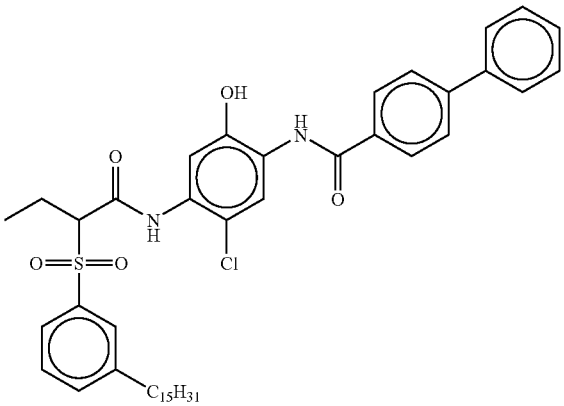
IC-28
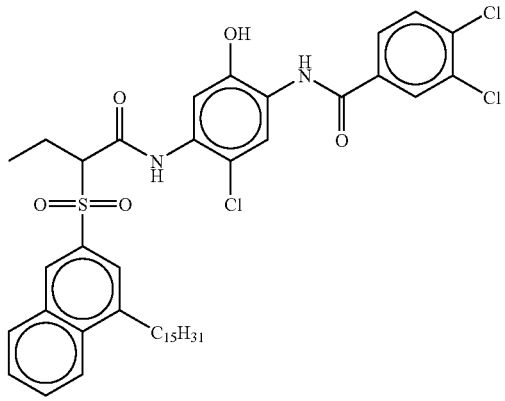
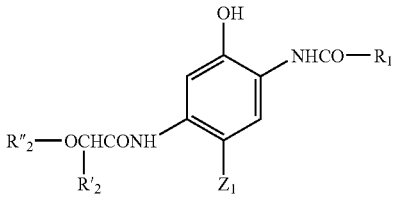
| Examplified cyan coupler No. | $R_1$ | $Z_1$ | $R'_2$ | $R''_2$ |
|---|---|---|---|---|
| IC-29 | 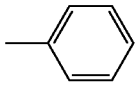 | —Cl | $—C_2H_5$ | 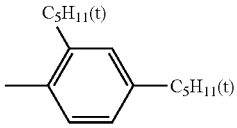 |
| IC-30 | 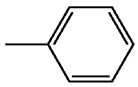 | —Cl | $—C_{12}H_{25}(n)$ | 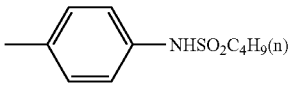 |

-continued
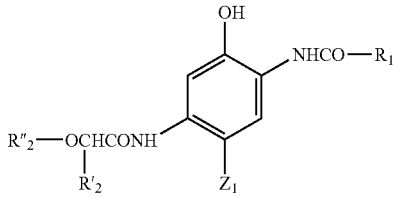
| Examplified cyan coupler No. | $R_1$ | $Z_1$ | $R'_2$ | $R''_2$ |
|---|---|---|---|---|
| IC-31 | 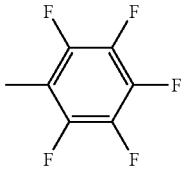 | —Cl | —$C_4H_9$(n) | 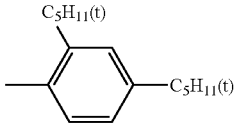 |
| IC-32 | 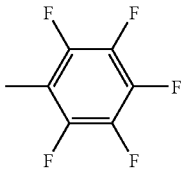 | —$OC_8H_{17}$ | —$C_{12}H_{25}$(n) | 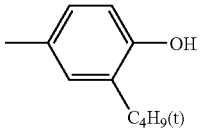 |
| IC-33 | 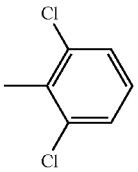 | 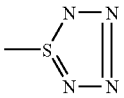 | —$C_{12}H_{25}$(n) | 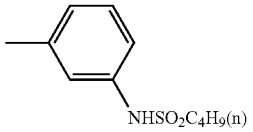 |
| IC-34 | 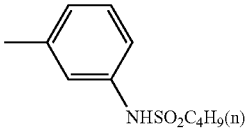 | —Cl | —$C_4H_9$(n) | 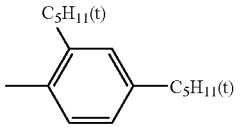 |
| IC-35 | 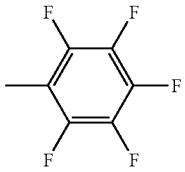 | —Cl | —$C_{12}H_{25}$(n) | 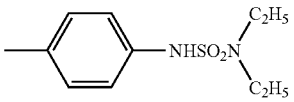 |
| IC-36 | 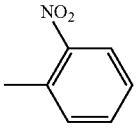 | 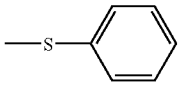 | —$C_4H_9$(n) | 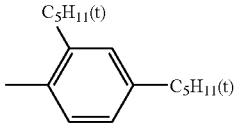 |
| IC-37 | 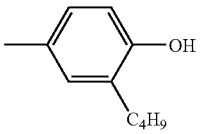 | —Cl | —$C_4H_9$(n) | 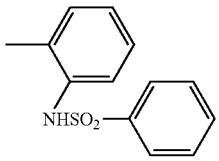 |

-continued

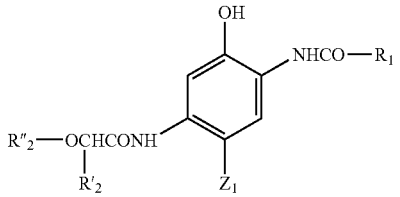

| Examplified cyan coupler No. | $R_1$ | $Z_1$ | $R'_2$ | $R''_2$ |
|---|---|---|---|---|
| IC-38 | 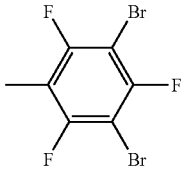 | —Cl | —$C_4H_9$(n) | 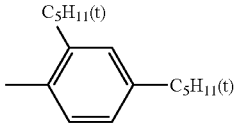 |
| IC-39 | 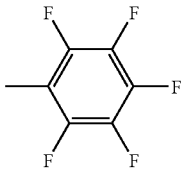 | —H | —$C_4H_9$(n) | 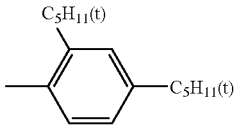 |
| IC-40 | 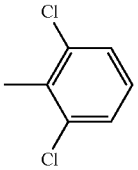 | —Cl | —$C_{12}H_{25}$(n) | 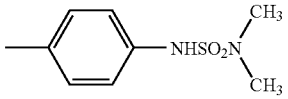 |
| IC-41 | 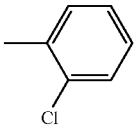 | —Cl | —$C_6H_{13}$(n) | 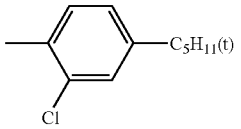 |
| IC-42 | 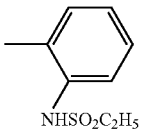 | —Cl | —$C_2H_5$ | 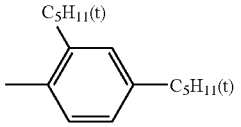 |
| IC-43 | 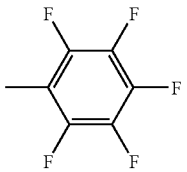 | —Cl | —$CH(CH_3)_2$ | 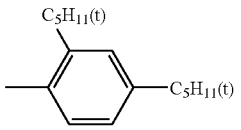 |
| IC-44 | 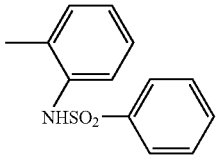 | —Cl | —$C_{10}H_{21}$(n) | 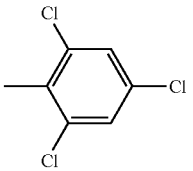 |

The magenta dye-forming couplers (which may be referred to simply as a "magenta coupler" hereinafter) that can be used in the present invention can be 5-pyrazQlone-series magenta couplers and pyrazoloazole-series magenta couplers, such as those described in the above-mentioned patent publications in the above table. Among these, preferred are pyrazolotriazole couplers in which a secondary or tertiary alkyl group is directly bonded to the 2-, 3-, or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 226849 A and 294785 A, in view of hue and stability of an image to be formed therefrom, and color-forming property of the couplers. Particularly, as the magenta coupler, pyrazoloazole couplers represented by formula (M-I) described in JP-A-8-122984 are preferred. The descriptions of paragraph Nos. 0009 to 0026 of the patent publication JP-A-8-122984 can be entirely applied to the present invention, and therefore are incorporated herein by reference as a part pf the present specification. In addition, pyrazoloazole couplers having a steric hindrance group at both the 3- and 6-positions, as described in European Patent Nos. 854384 and 884640, can also be preferably used.

In the present invention, preferably in the second or third embodiment of the present invention, the compound represented by formula (M-l) may be used.

The compound represented by formula (M-I) is described in detail below.

Formula (M-I)

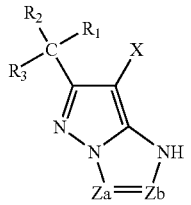

$R_1$, $R_2$, and $R_3$ in the above formula (M-I) each represent a hydrogen atom or a substituent. Examples of the substituent include a halogen atom, aliphatic group, aryl group, heterocyclic group, cyano group, hydroxy group, nitro group, carboxy group, sulfo group, amino group, alkoxy group, aryloxy group, acylamino group, alkylamino group, anilino group, ureido group, sulfamoylamino group, alkylthio group, arylthio group, alkoxycarbonylamino group, sulfonamido group, carbamoyl group, sulfamoyl group, sulfonyl group, alkoxycarbonyl group, heterocyclic oxy group, azo group, acyloxy group, carbamoyloxy group, silyloxy group, aryloxycarbonylamino group, imido group, heterocyclic thio group, sulfinyl group, phosphonyl group, aryloxycarbonyl group, acyl group and azolyl group. Among these groups, a group which may have a further substituent may be substituted with the above substituent.

To state in more detail, specific examples of the substituent include a halogen atom (e.g., a chlorine atom and bromine atom), an aliphatic group (e.g., straight chain or branched alkyl groups, aralkyl groups, alkenyl groups, alkinyl groups, cycloalkyl groups and cycloalkenyl groups having 1 to 32 carbon atoms, more concretely, a methyl group, ethyl group, propyl group, isopropyl group, tert-butyl group, tridecyl group, 2-methanesulfonylethyl group, 3-(3-pentadecylphenoxy)propyl group, 3-{4-{2-[4-(4-hydroxyphenylsulfonyl)phenoxy]dodecanamido}phenyl}propyl group, 2-ethoxytridecyl group, trifluoromethyl group, cyclopentyl group, 3-(2,4-di-tert-amylphenoxy)propyl group), an aryl group (e.g., a phenyl group, 4-tert-butylphenyl group, 2,4-di-tert-amylphenyl group, 2,4,6-trimethylphenyl group, 3-tridecaneamido-2,4,6-trimethylphenyl group, 4-tetradecaneamidophenyl group and tetrafluorophenyl group), a heterocyclic group (e.g., 2-furyl group, 2-thienyl group, 2-pyrimidinyl group and 2-benzothiazolyl group), a cyano group, a hydroxy group, a nitro group, a carboxy group, a sulfo group, an amino group, an alkoxy group (e.g., a methoxy group, ethoxy group, 2-methoxyethoxy group, 2-dodecylethoxy group and 2-methanesulfonylethoxy group), an aryloxy group (e.g., a phenoxy group, 2-methylphenoxy group, 4-tert-butylphenoxy group, 3-nitrophenoxy group, 3-tert-butoxycarbamoylphenoxy group and 3-methoxycarbamoylphenoxy group), an acylamino group (e.g., an acetamido group, benzamido group, tetradecanamido group, 2-(2,4-di-tert-amylphenoxy)butanamido group, 4-(3-tert-butyl-4-hydroxyphenoxy)butanamido group and 2-[4-(4-hydroxyphenylsulfonyl)phenoxy]decanamido group), an alkylamino group (e.g., a methylamino group, butylamino group, dodecylamino group, diethylamino group and methylbutylamino group), an anilino group (e.g., a phenylamino group, 2-chloroanilino group, 2-chloro-5-tetradecanaminoanilino group, 2-chloro-5-dodecyloxycarbonylanilino group, N-acetylanilino group and 2-chloro-5-[2-(3-tert-butyl-4-hydroxyphenoxy)dodecanamido]anilino group), a carbamoylamino group (e.g., an N-phenylcarbamoylamino group, N-methylcarbamoylamino group and N,N-dibutylcarbamoylamino group), a sulfamoylamino group (e.g., an N,N-dipropylsulfamoylamino group and N-methyl-N-decylsulfamoylamino group), an alkylthio group (e.g., a methylthio group, octylthio group, tetradecylthio group, 2-phenoxyethylthio group, 3-phenoxypropylthio group and 3-(4-tert-butylphenoxy)propylthio group), an arylthio group (e.g., a phenylthio group, 2-butoxy-5-tert-octylphenylthio group, 3-pentadecylphenylthio group, 2-carboxyphenylthio group and 4-tetradecanamidophenylthio group), an alkoxycarbonylamino group (e.g., a methoxycarbonylamino group and tetradecyloxycarbonylamino group), a sulfonamido group (e.g., a methanesulfonamido group, hexadecanesulfonamido group, benzenesulfonamido group, p-toluenesulfonamido group, octadecanesulfonamido group and 2-methoxy-5-tert-butylbenzenesulfonamido group), a carbamoyl group (e.g., an N-ethylcarbamoyl group, N,N-dibutylcarbamoyl group, N-(2-dodecyloxyethyl)carbamoyl group, N-methyl-N-dodecylcarbamoyl group and N-[3-(2,4-di-tert-amylphenoxy)propyl]carbamoyl group), a sulfamoyl group (e.g., an N-ethylsulfamoyl group, N,N-dipropylsulfamoyl group, N-(2-dodecyloxyethyl)sulfamoyl group, N-ethyl-N-dodecylsulfamoyl group and N,N-diethylsulfamoyl group), a sulfonyl group (e.g., a methanesulfonyl group, octanesulfonyl group, benzenesulfonyl group and toluenesulfonyl group), an alkoxycarbonyl group (e.g., a methoxycarbonyl group, butoxycarbonyl group, dodecyloxycarbonyl group and octadecyloxycarbonyl group), a heterocyclic oxy group (e.g., a 1-phenyltetrazole-5-oxy group and 2-tetrahydropyranyloxy group), an azo group (e.g., a phenylazo group, 4-methoxyphenylazo group, 4-pivaloylaminophenylazo group, and 2-hydroxy-4-propanoylphenylazo group), an acyloxy group (e.g., an acetoxy group), a carbamoyloxy group (e.g., an N-methylcarbamoyloxy group and N-phenylcarbamoyloxy group), a silyloxy group (e.g., a trimethylsilyloxy group and dibutylmethylsilyloxy group), an aryloxycarbonylamino group (e.g., a phenoxycarbonylamino group), an imido group (e.g., an N-succinimido group, N-phthalimido group and 3-octadecenylsuccinimido group), a heterocyclic thio group (e.g., a 2-benzothiazolylthio group, 2,4-di-phenoxy-1,3,5-triazole-6-thio group and 2-pyridylthio group), a sulfinyl group (e.g., a dodecanesulfinyl group, 3-pentadecylphenylsulfinyl group and 3-phenoxypropylsulfinyl group), a phosphonyl group (e.g., a phenoxyphosphonyl group, octylphosphonyl group and phenylphosphonyl group), an aryloxycarbonyl group (e.g., a phenoxycarbonyl group), an acyl group (e.g., an acetyl group, 3-phenylpropanoyl group, benzoyl group and 4-dodecyloxybenzoyl group), and an azolyl group (an imidazolyl group, pyrazolyl group, 3-chloro-pyrazole-1-yl group and triazolyl group).

Examples of preferable substituent among these substituents may include alkyl groups, cycloalkyl groups, aryl groups, alkoxy groups, aryloxy groups, alkylthio groups, carbamoylamino groups, aryloxycarbonylamino groups, alkoxycarbonylamino groups, alkylacylamino groups and arylacylamino groups.

In formula (M-1), one of Za and Zb represents a carbon atom having a hydrogen atom or a substituent, and the other represents a nitrogen atom. The substituent of Za or Zb may further have a substituent.

Examples of a substituent either Za or Zb may have include a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an arylthio group, an alkoxycarbonylamino group, a sulfonamido group, a carbamoyl group, a sulfamoyl group, a sulfonyl group, an alkoxycarbonyl group, a heterocyclyloxy group, an azo group, an acyloxy group, a carbamoyloxy group, a silyloxy group, an aryloxycarbonylamino group, an imido group, a heterocyclylthio group, a sulfinyl group, a phosphonyl group, an aryloxycarbonyl group, an acyl group and an azolyl group. These groups may further have substituents.

Examples of each of these groups include the groups recited in the descriptions of substituents regarding $R_1$ to $R_3$.

When the substituent attached to the carbon atom of either Za or Zb is a substituent capable of further having a substituent, it may further have an organic substituent forming a linkage via its carbon, oxygen, nitrogen or sulfur atom, or it may further have a halogen atom. Examples of such a substituent include the substituents recited in the descriptions of substituents regarding $R_1$ to $R_3$.

Suitable examples of a substituent attached to the carbon atom of either Za or Zb include an alkyl group, an aryl group, an alkoxy group, an aryloxy group, an alkylthio group, a ureido group, an alkoxycarbonylamino group and an acylamino group. Of these groups, an alkyl group containing 6 to 70 carbon atoms and a group containing an aryl group as a partial structure and 6 to 70 carbon atoms in total are preferable because they can render the couplers represented by formula (M-I) nondiffusible.

In formula (M-I), X represents a hydrogen atom or a group capable of being split-off upon a reaction with an oxidized product of an aromatic primary amine color-developing agent. To mention the group capable of being split-off in detail, examples of the group may include a halogen atom, alkoxy group, aryloxy group, acyloxy group, alkyl- or arylsulfonyloxy group, acylamino group, alkyl- or aryl-sulfonamido group, alkoxycarbonyloxy group, aryloxycarbonyloxy group, alkyl-, aryl- or heterocyclic-thio group, carbamoylamino group, five- or six-membered nitrogen-containing heterocyclic group, imido group and arylazo group. These groups may further be substituted with a group permitted as the substituent of $R_1$ to $R_3$.

Specific examples of X may include a halogen atom (e.g., a fluorine atom, chlorine atom and bromine atom), an alkoxy group (e.g., an ethoxy group, dodecyloxy group, methoxyethylcarbamoylmethoxy group, carboxypropyloxy group, methylsulfonylethoxy group and ethoxycarbonylmethoxy group), an aryloxy group (e.g., a 4-methylphenoxy group, 4-chlorophenoxy group, 4-methoxyphenoxy group, 4-carboxyphenoxy group, 3-ethoxycarboxyphenoxy group, 4-methoxycarbonylphenoxy group, 3-acetylaminophenoxy group and 2-carboxyphenoxy group), an acyloxy group (e.g., an acetoxy group, tetradecanoyloxy group and benzoyloxy group), an alkyl- or arylsulfonyloxy group (e.g., a methanesulfonyloxy group and toluenesulfonyloxy group), an acylamino group (e.g., a dichloroacetylamido group and heptafluorobutyrylamino group), an alkyl- or arylsulfonamido group (e.g., a methanesulfonamino group, trifluoromethanesulfonamino group and p-toluenesulfonylamino group), an alkoxycarbonyloxy group (e.g., an ethoxycarbonyloxy group and benzyloxycarbonyloxy group), an aryloxycarbonyloxy group (e.g., a phenoxycarbonyloxy group), an alkyl-, aryl- or heterocyclic-thio group (e.g., a dodecylthio group, 1-carboxydodecylthio group, phenylthio group, 2-butoxy-5-tert-octylphenylthio group, 2-benzyloxycarbonylaminophenylthio group and tetrazolylthio group), a carbamoylamino group (e.g., an N-methylcarbamoylamino group and N-phenylcarbamoylamino group), a five- or six-membered nitrogen-containing heterocyclic group (e.g., a 1-imidazolyl group, 1-pyrazolyl group, 1,2,4-triazole-1-yl group, tetrazolyl group, 3,5-dimethyl-1-pyrazolyl group, 4-cyano-1-pyrazolyl group, 4-methoxycarbonyl-1-pyrazolyl group, 4-acetylamino-1-pyrazolyl group and 1,2-dihydro-2-oxo-1-pyridyl group), an imido group (e.g., a succinimido group and hydantoinyl group), and an arylazo group (e.g., a phenylazo group and 4-methoxyphenylazo group). Preferable examples of X include halogen atoms, alkoxy groups, aryloxy groups, alkyl- or aryl-thio group, five- or six-membered nitrogen-containing heterocyclic groups bonded to a coupling active site by a nitrogen atom. Particularly preferable examples are halogen atoms, substituted aryloxy groups, substituted arylthio groups or substituted 1-pyrazolyl group.

Given as examples of preferable magenta couplers among the compounds represented by the aforementioned formula (M-I) are compounds represented by the following formula (M-II) or (M-III). In the present invention, preferably in the second embodiment of the present invention, the compounds represented by formula (M-III) is particularly preferable. In the present invention, preferably in the third embodiment of the present invention, the compounds represented by formula (M-II) is particularly preferable.

Formula (M-II)

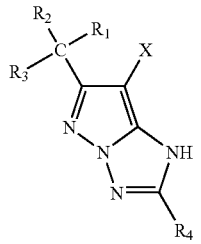

In formula (M-II), $R_1$, $R_2$, $R_3$ and X have the same meanings as those in formula (M-I), respectively, and $R_4$ has the same meaning as $R_1$, $R_2$ or $R_3$ in formula (M-I).

Formula (M-III)

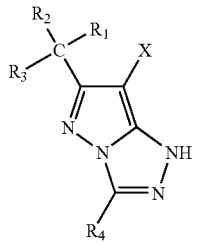

In formula (M-III), $R_1$, $R_2$, $R_3$ and X have the same meanings as those in formula (M-I), respectively, and $R_4$ has the same meaning as $R_1$, $R_2$ or $R_3$ in formula (M-I).

Preferred as groups in formulae (M-II) and (M-III) are as follows:

Given as preferable groups as X are halogen atoms, alkoxy groups and aryloxy groups. Among these groups, a chlorine atom is preferable. As preferable examples of the substituents as $R_1$ to $R_4$, alkyl groups, aryl groups, anilino groups and alkoxy groups are given. Among these groups, alkyl groups and aryl groups are preferable. In the present invention, it is preferable that $R_1$, $R_2$ and $R_3$ respectively be a methyl group and $R_4$ be alkyl group or an aryl group (each of which are preferably substituted with another substituent). The most preferable examples of $R_4$ are an aryl group in the above formula (M-II), and an alkyl group in the above formula (MIII). The magenta coupler for use in the present invention is used in an amount ranging generally between 0.001 and 1 mol, and preferably 0.003 and 0.3 mol, per mol of a light sensitive silver halide in the same layer. The molecular weight of the coupler is preferably 600 or less. Specific examples of the magenta coupler represented by the above formula (M-I) will be shown below, which, however, are not intended to be limiting of the present invention.

(Ma-1)

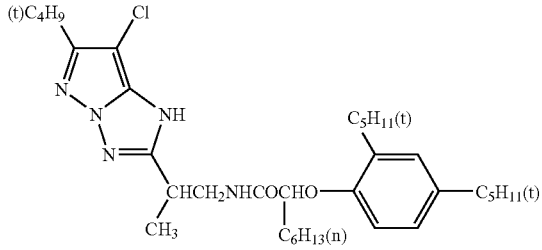

(Ma-2)

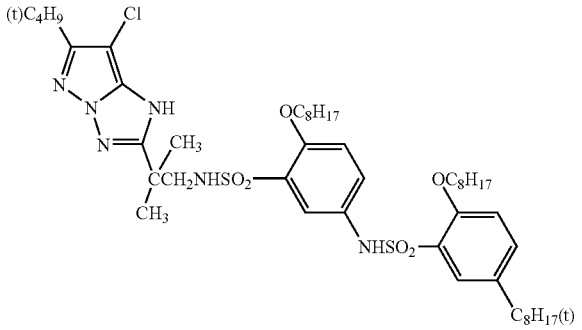

(Ma-3)

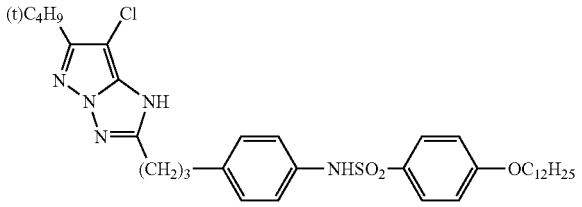

(Ma-4)

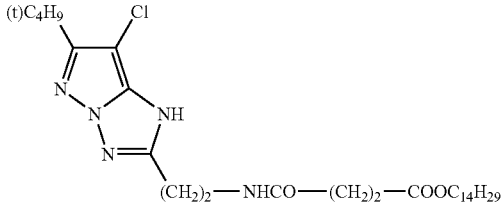

-continued
(Ma-5)
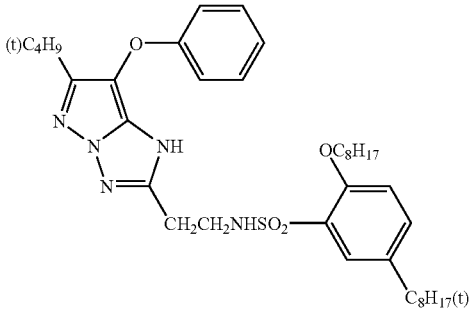
(Ma-6)
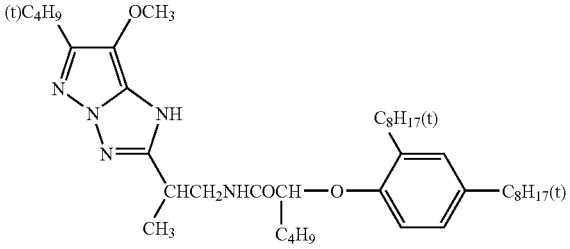
(Ma-7)
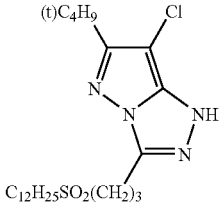
(Ma-8)
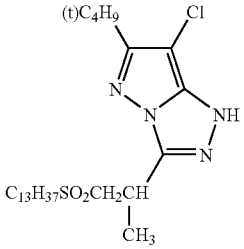
(Ma-9)
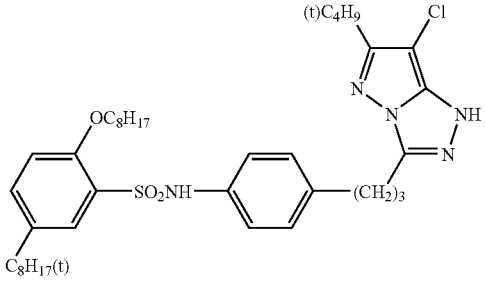

-continued
(Ma-10)
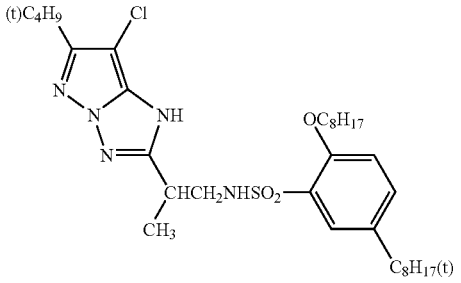
(Ma-11)
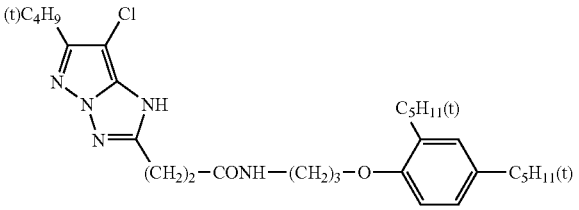
(Ma-12)
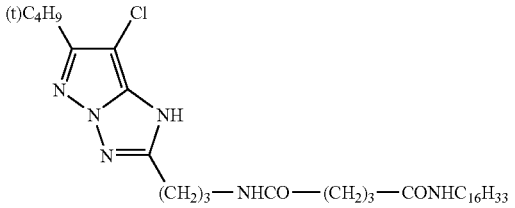
(Ma-13)
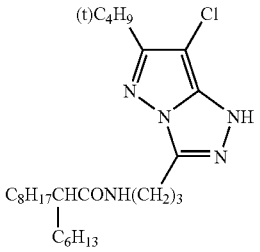
(Ma-14)
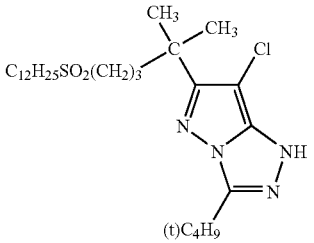
(Ma-15)
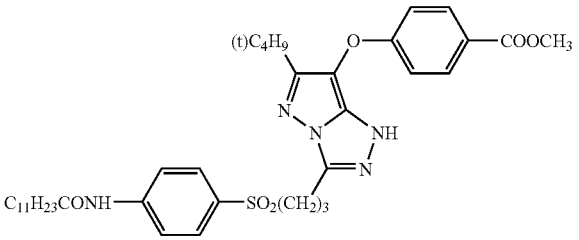

-continued
(Ma-16)
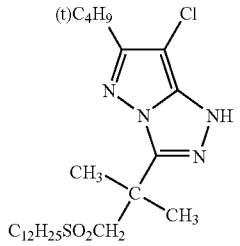
(Ma-17)
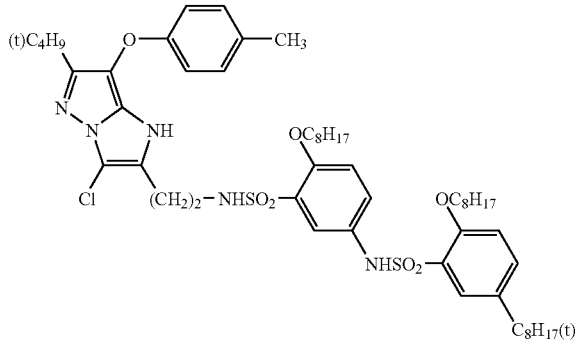
(Ma-18)
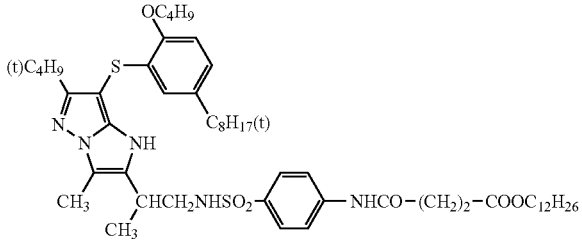
(Ma-19)
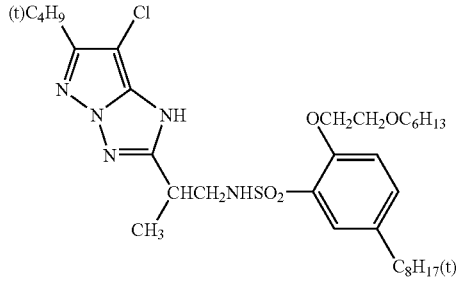
(Ma-20)
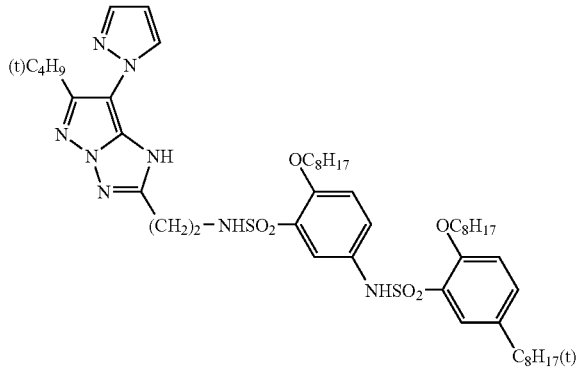

-continued
(Ma-21)
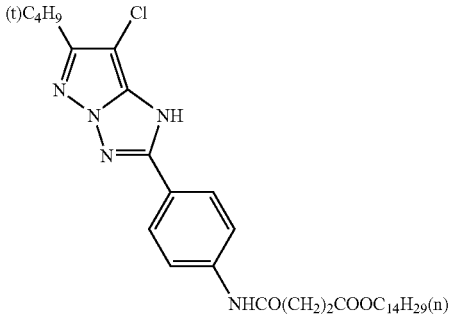
(Ma-22)
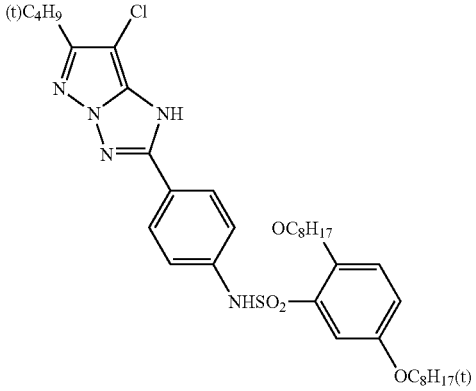
(Ma-23)
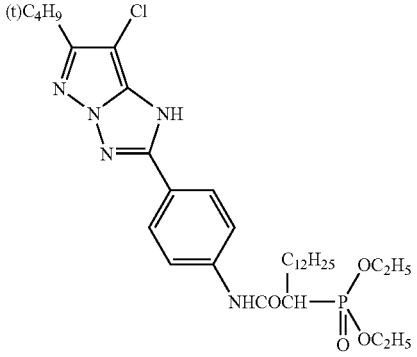
(Ma-24)
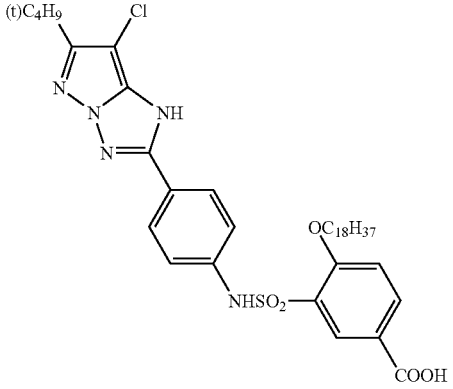

-continued
(Ma-25)
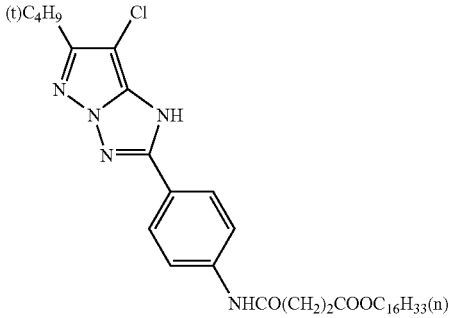
(Ma-26)
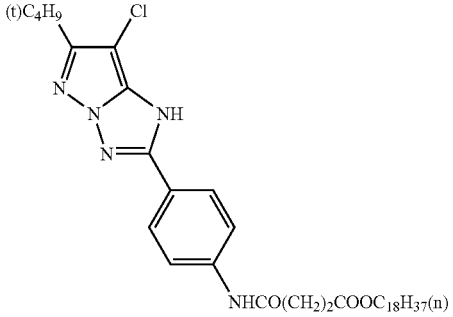
(Ma-27)
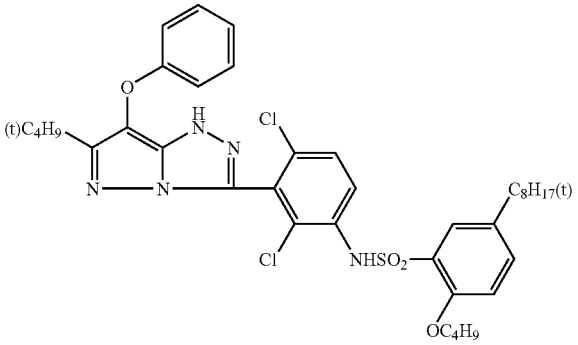
(Ma-28)
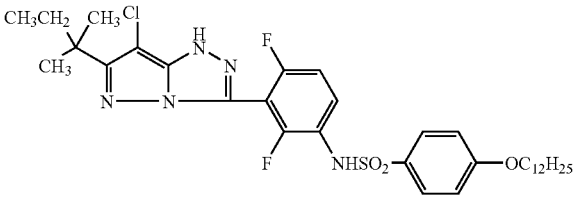
(Ma-29)
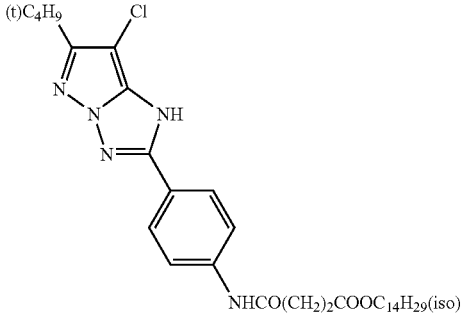

-continued
(Ma-30)
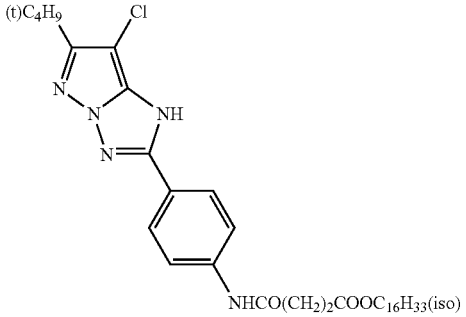
(Ma-31)
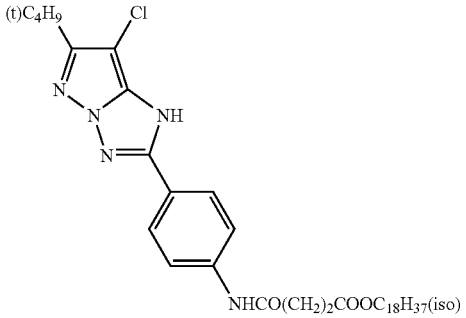
(Ma-32)
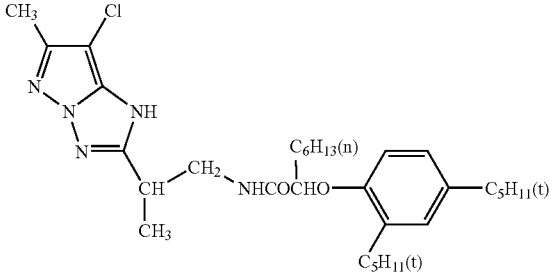
(Ma-33)
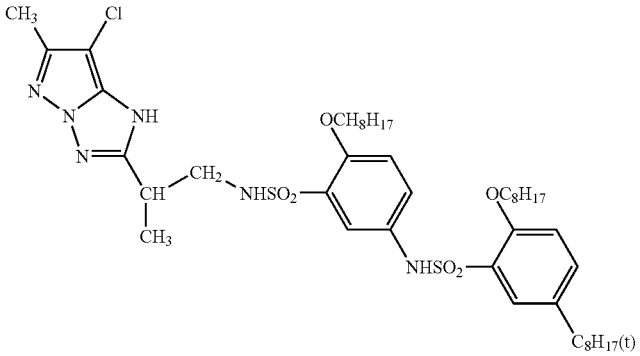
(Ma-34)
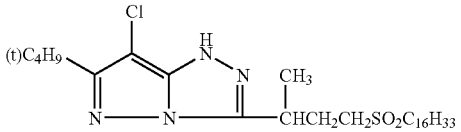
(Ma-35)
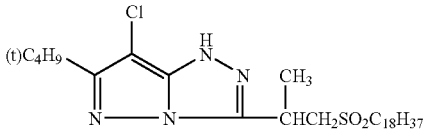

-continued
(Ma-36)
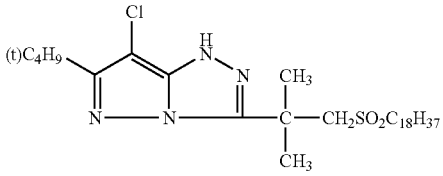
(Ma-37)
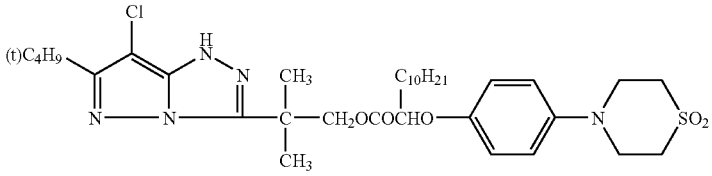
(Ma-38)
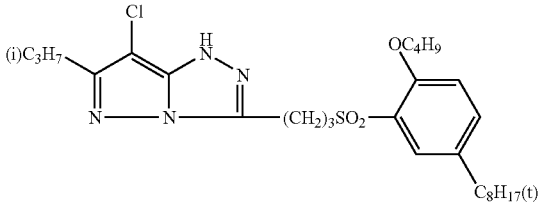
(Ma-39)
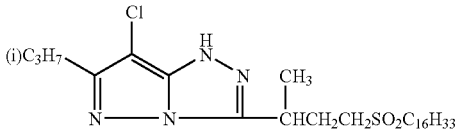
(Ma-40)
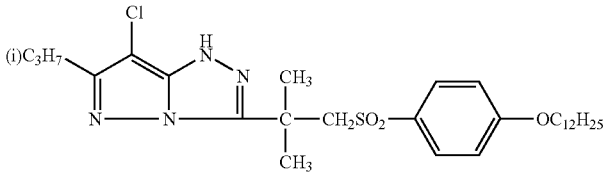
(Ma-41)
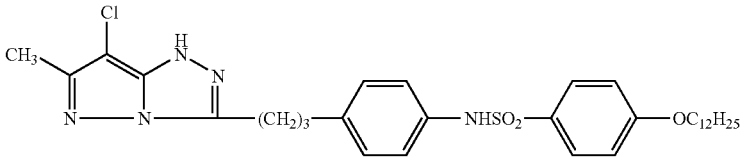
(Ma-42)
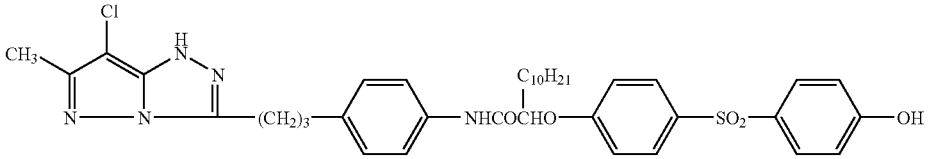
(Ma-43)
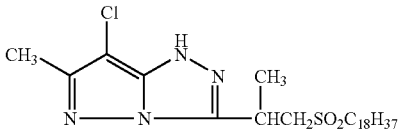

-continued
(Ma-44)
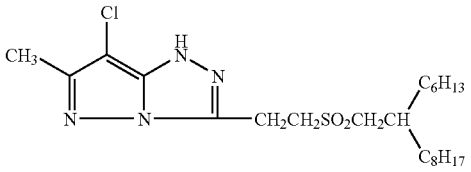
(Ma-45)
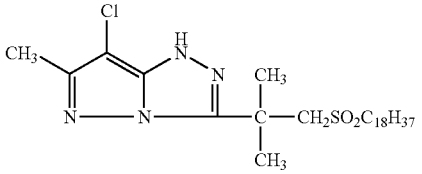
(Ma-46)
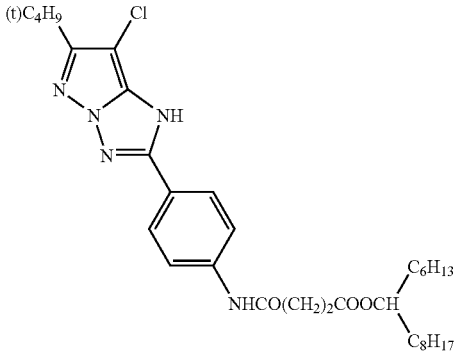
(Ma-47)
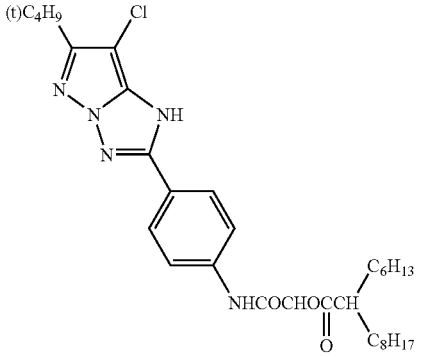
(Ma-48)
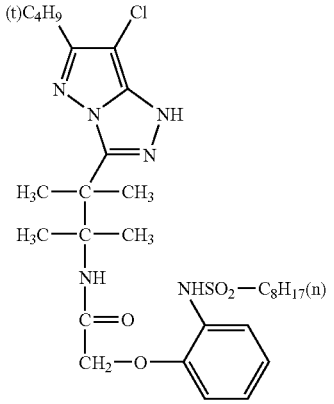

-continued
(Ma-49)

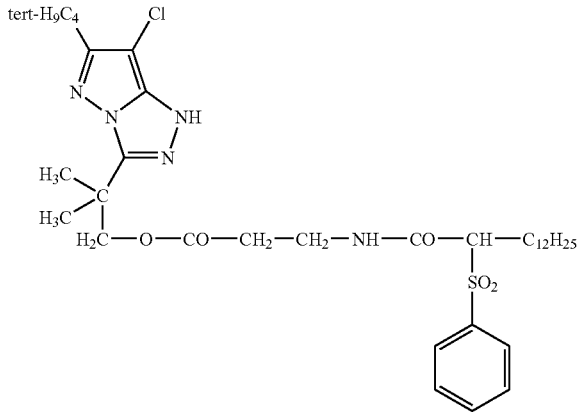

The compounds represented by formula (M-I) are pyrazoloazole-series magenta couplers, and they have higher color purity than pyrazolone-type magenta couplers because they contain unnecessary yellow and cyan components in lower proportions. So they are favorable for ageing stability of white background and can provide color images with stability.

Further, as yellow dye-forming couplers (which may be referred to simply as a "yellow coupler" herein), preferably use can be made, in the photosensitive material, of acylacetamide-type yellow couplers in which the acyl group has a 3-membered to 5-membered cyclic structure, such as those described in European Patent No. 0447969 A1; malondianilide-type yellow couplers having a cyclic structure, as described in European Patent No. 0482552 A1; pyrrol-2 or 3-yl or indol-2 or 3-yl carbonyl acetanilide-series couplers, as described in European Patent (laid open to public) Nos. 953870 A1, 953871 A1, 953872 A1, 953873 A1, 953874 A1, and 953875 A1; acylacetamide-type yellow couplers having a dioxane structure, such as those described in U.S. Pat. No. 5,118,599; and acetanilide-type couplers whose acyl groups have heterocyclicgrolic groups as their respective substituents, such as those described in JP-A-2003-173007, in addition to the compounds described in the above-mentioned table. Of these couplers, the acylacetamide-type yellow couplers whose acyl groups are 1-alkylcyclopropane-1-carbonyl groups, the malondianilide-type yellow couplers wherein either anilide forms an indoline ring, or the acetanilide yellow couplers whose acyl groups have heterocyclic groups as their respective substituents, can be preferably used. These couplers may be used singly or in combination.

It is preferred that couplers for use in the photosensitive material, are pregnated into a loadable latex polymer (as described, for example, in U.S. Pat. No. 4,203,716) in the presence (or absence) of the high-boiling-point organic solvent described in the foregoing table, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic-solvent-soluble polymer which can be preferably used, include the homo-polymers and copolymers as disclosed in U.S. Pat. No.4,857,449, from column 7 to column 15, and WO 88/00723, from page 12 to page 30. The use of methacrylate-series or acrylamide-series polymers, especially acrylamide-series polymers are more preferable, in view of color-image stabilization and the like.

In the photosensitive material, known color mixing-inhibitors may be used. Among these compounds, those described in the following patent publications are preferred.

For example, high-molecular weight redox compounds described in JP-A-5-333501; phenidone- or hydrazine-series compounds as described in WO 98/33760 pamphlet and U.S. Pat. No. 4,923,787 and the like; and white couplers as described in JP-A-5-249637, JP-A-10-282615, German Patent Application Publication No.19629142 A1 and the like, may be used. In particular, in order to accelerate developing speed by increasing the pH of a developing solution, redox compounds described in German Patent Application Publication No. 19618786A1, European Patent Application Publication Nos. 839623A1 and 842975A1, German PatentApplication Publication No. 19806846A1, French Patent Application Publication No. 2760460A1, and the like, are also preferably used.

In the photosensitive material, as an ultraviolet ray absorbent, it is preferred to use a compound having a triazine skeleton high in a molar extinction coefficient. For example, those described in the following patent publications can be used. This compound can be preferably used in the light-sensitive layer or/and the light-insensitive layer. For example, use can be made of the compound described, in JP-A46-3335, JP-A-55-152776, JP-A-5-197074, JP-A-5-232630, JP-A-5-307232, JP-A6-211813, JP-A-8-53427, JP-A-8-234364, JP-A-8-239368, JP-A-9-31067, JP-A-10-115898, JP-A-10-147577, JP-A-10-182621, German Patent No. 19739797A, European Patent No. 711804A, JP-T-8-501291 ("JP-T" means published searched patent publication), and the like.

As a binding agent or a protective colloid which can be used in the photosensitive material, a gelatin is used advantageously. Hydrophilic colloid other than gelatin may be used singly or in combination with the gelatin. It is preferable for the gelatin that the content of heavy metals, such as Fe, Cu, Zn and Mn, included as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

It is preferred to add an antibacterial (fungi-preventing) agent and antimold agent, as described in JP-A-63-271247, to the light-sensitive material, in order to destroy various kinds of molds and bacteria which propagate in a hydrophilic colloid layer and deteriorate the image. Further, the pH of the coating film of the light-sensitive material is preferably in the range of 4.0 to 7.0, more preferably in the range of 4.0 to 6.5.

In the present invention, a surface-active agent may be added to the light-sensitive material, in view of improvement in coating-stability, prevention of static electricity from being occurred, and adjustment of the charge amount. As the surface-active agent, there are anionic, cationic, betaine or nonionic surfactants. Examples thereof include those described in JP-A-5-333492. As the surface-active agent for use in the present invention, a fluorine-containing surface-active agent is preferred. In particular, a fluorine-containing surface-active agent is preferably used. The fluorine-containing surface-active agent may be used singly or in combination with known another surface-active agent. The fluorine-containing surfactant is preferably used in combination with known another surface-active agent. The amount of the surface-active agent to be added to the light-sensitive material is not particularly limited, but it is generally in the range of $1\times10^{-5}$ to 1 g/m$^2$, preferably in the range of $1\times10^{-4}$ to 133 $10^{-1}$ g/m$^2$, and more preferably in the range of $1\times10^{-3}$ to $1\times10^{-2}$ g/m$^2$.

The silver halide photosensitive material can be used for various materials, such as color negative films, color positive films, color reversal films, color reversal papers, color papers, display photosensitive materials, digital color proof photosensitive materials, motion-picture color positives, and motion-picture color negatives, and among these, display photosensitive materials, digital color proof photosensitive materials, motion-picture color positives, color reversal papers, color papers, are preferable, and color papers are more preferable.

In the light-sensitive material of the present invention, any of conventionally-known photographic materials or additives may be used.

For example, as a photographic support (base), a transmissive type support or a reflective type support may be used. As the transmissive type support, it is preferred to use a transparent support, such as a cellulose nitrate film, and a transparent film of polyethylene terephthalate, or a polyester of 2,6-naphthalenedicarboxylic acid (NDCA) and ethylene glycol (EG), or a polyester of NDCA, terephthalic acid and EG, provided thereon with an information-recording layer such as a magnetic layer. In the present invention, preferably in the sixth embodiment of the present invention, as the reflective type support, it is especially preferable to use a reflective support having a substrate laminated thereon with a plurality of polyethylene layers or polyester layers, at least one of the water-proof resin layers (laminate layers) contains a white pigment such as titanium oxide.

As the support for use in the light-sensitive material of the present invention, a support of the white polyester type, or a support provided with a white pigment-containing layer on the same side as the silver halide emulsion layer, may be adopted for display use. Further, it is preferable for improving sharpness that an antihalation layer is provided on the silver halide emulsion layer side or the reverse side of the support. In particular, it is preferable that the transmission density of support is adjusted to the range of 0.35 to 0.8 so that a display may be enjoyed by means of both transmitted and reflected rays of light.

Further, it is preferred that the above-described water-proof resin layer contains a fluorescent whitening agent. Further, the fluorescent whitening agent may be dispersed and contained in a hydrophilic colloid layer, which is formed separately form the above layers in the light-sensitive material. Preferred fluorescent whitening agents which can be used, include benzoxazole-series, coumarin-series, and pyrazoline-series compounds. Further, fluorescent whitening agents of benzoxazolylnaphthalene-series and benzoxazolylstilbene-series are more preferably used. Specific examples of the fluorescent whitening agent that is contained in a water-resistant resin layer, include, for example, 4,4'-bis(benzoxazolyl)stilbene, 4,4'-bis(5-methylbenzoxazolyl)stilbene, and mixture thereof. The amount of the fluorescent whitening agent to be used is not particularly limited, and preferably in the range of 1 to 100 mg/m$^2$. When a fluorescent whitening agent is mixed with a water-proof resin, a mixing ratio of the fluorescent whitening agent to be used in the water-proof resin is preferably in the range of 0.0005 to 3% by mass, and more preferably in the range of 0.001 to 0.5% by mass, to the resin.

Further, a transmissive type support or the foregoing reflective type support each having coated thereon a hydrophilic colloid layer containing a white pigment may be used as the reflective type support. Furthermore, a reflective type support having a mirror plate reflective metal surface or a secondary diffusion reflective metal surface may be employed as the reflective type support.

A more preferable reflective support is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/ml, more preferably in the range of 0.50 to 0.70 g/ml. Further, the thickness of the multi-layer or single-layer of polyolefin layer(s) existing between the paper substrate and photographic constituting layers is preferably in the range of 10 to 100 μm, more preferably in the range of 15 to 70 μm. Further, the ratio of thickness of the polyolefin layer(s) to the paper substrate is preferably in the range of 0.05 to 0.2, more preferably in the range 0.1 to 0.15.

Further, it is also preferable for enhancing rigidity of the reflective support, by providing a polyolefin layer on the surface of the foregoing paper substrate opposite to the side of the photographic constituting layers, i.e., on the back surface of the paper substrate. In this case, it is preferable that the polyolefin layer on the back surface is polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/ml. As to the reflective support for use in the present invention, preferable embodiments of the polyolefin layer provided on the paper substrate include those described in JP-A-10-333277, JP-A-1 0-333278, JP-A-11-52513, JP-A-11-65024, European Patent Nos. 0880065 and 0880066.

The photosensitive materials of the present invention can form images, as shown in the example of an image-forming equipment used for performing exposure processing of photosensitive materials, by undergoing an exposure process of irradiating the photosensitive materials with light responsive to image information and a development process of developing the exposed photosensitive materials.

The silver halide color photographic material according to the present invention can be preferably used in combination with the exposure and development systems described in the following patents. These development systems include the automatic printing and the developing system disclosed in JP-A-10-333253, the transporting apparatus of a photographic material disclosed in JP-A-2000-10206, the recording system including an image reader disclosed in JP-A-11-215312, the exposure systems comprising a color image-recording system disclosed in JP-A-11-88619 and JP-A-10-202950, the digital photo print system including a remote diagnostic system disclosed in JP-A-10-210206, and the photo print system including an image-recording apparatus disclosed in JP-A-2000-310822.

According to the color-image forming method of the present invention and the silver halide color photographic light-sensitive material of the present invention, excellent color generation can be achieved, as well as reduction in image quality by gradation change (uneven density) or scratches can be lessened, even when applying a conveying system in a form of sheet, a high-illumination laser scanning exposure and a rapid processing. Further, color prints of excellent image quality can be made stably, even after storage of the light-sensitive material in a raw state (storage with the lapse of time over a period from the end of manufacturing to the start of exposure of the light-sensitive material).

According to the color-image forming method of the present invention and the silver halide color photographic light-sensitive material of the present invention, rapid processing is possible with adoption of high-speed conveying in a sheet-conveying system, as well as it is also possible to ensure high productivity and to inhibit defects that may arise upon rapid processing (e.g. stains occurred in white background upon storage under a high-temperature-and-humidity condition, and quality degradation of a finished image (such as glossiness deterioration) at the time of making prints).

In other words, the image-forming method of the present invention and the silver halide color photographic light-sensitive material of the present invention enables compatibility between a high-speed sheet-transport type of automatic processing system, which ensures not only easy management of exposure and photographic processing operations but also high productivity, and an excellent image quality, including prevention of deterioration of white background with the lapse of time and improvement in glossiness, which are free of drops in developed color densities, poor leuco-dye-reciprocity characteristics, and desilvering inadequacy.

According to the present invention, it is possible to provide a silver halide color photographic light-sensitive material and a color image-forming method that can ensure stability with the lapse of time of white background and reticulation control, when a rinsing process is carried out by high-speed transport processing of sheet-form photographic material in a rinse bath structurally partitioned into a plurality of rooms (compartments) with blade-form members for passing the sheets through rinse solutions in a horizontal direction.

The silver halide color photographic light-sensitive material of the present invention can make prints in a high volume and in a short period of time, and besides, the prints thus made are less in unevenness and defects, while high in quality.

According to the image-forming method of the present invention, it is possible to form a high-quality image with rapidity and high productivity.

The present invention can provide a silver halide color photographic light-sensitive material and an image-forming method, each of which is capable of reducing in sensitivity variations that may occur upon continuous processing.

The present invention can provide a silver halide color photographic light-sensitive material improved in wet abrasion (sensitization or desensitization) and processing unevenness, about which apprehensions may be caused when rapid processing is carried out to increase print-processing efficiency per unit time; and it can also provide a method of processing such a photographic light-sensitive material.

EXAMPLES

The present invention will be described in more detail based on the following examples, but the invention is not intended to be limited thereto.

Example 1-1

(Preparation of Blue-sensitive Layer Emulsion BH-11)

Using a method of adding silver nitrate and sodium chloride simultaneously to a deionized distilled water containing a deionized gelatin to mix these, under stirring, cubic high silver chloride grains were prepared. In the course of this preparation, $Cs_2[OsCl_5(NO)]$ was added, over the step of from 60% to 80% addition of the entire silver nitrate amount. Over the step of from 80% to 90% addition of the entire silver nitrate amount, potassium bromide (1.5 mol % per mol of the finished silver halide) and $K_4[Fe(CN)_6]$ were added. Over the step of from 83% to 88% addition of the entire silver nitrate amount, $K_2[IrCl_6]$ was added. Over the step of from 92% to 98% addition of the entire silver nitrate amount, $K_2[IrCl_5(H_2O)]$ and $K[IrCl_4(H_2O)_2]$ were added. At the completion of 94% addi of the entire silver nitrate amount, potassium iodide (0.27 mol % per mol of the finished silver halide) was added under vigorous stirring. The thus-obtained emulsion grains were monodisperse cubic silver iodobromochloride grains having a side length of 0.54 μm and a variation coefficient of 8.5%. After flocculation desalting treatment, gelatin, Compounds Ab-1, Ab-2, and Ab-3 each set forth below, and calcium nitrate were added to the resulting emulsion for re-dispersion.

The re-dispersed emulsion was dissolved at 40° C., and Sensitizing dye SD-1, Sensitizing dye SD-2, and Sensitizing dye SD-3 were added for optimal spectral sensitization. Then, the resulting emulsion was ripened by adding sodium benzene thiosulfate, triethylthiourea as a sulfur sensitizer, and Compound-1 as a gold sensitizer for optimal chemical sensitization. Further, 1-(5-methylureidophenyl)-5-mercaptotetrazole; Compound-2; a mixture whose major components are compounds represented by Compound-3 in which the repeating unit (n) is 2 or 3 (both ends $X_1$ and $X_2$ are each a hydroxyl group); Compound-4, and potassium bromide were added, to finalize chemical sensitization. The thus-obtained emulsion was referred to as Emulsion BH-11.

(Ab-1) Antiseptic

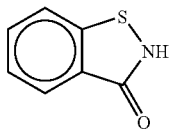

(Ab-2) Antiseptic

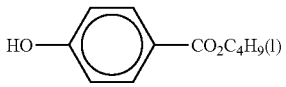

-continued (Ab-3) Antiseptic

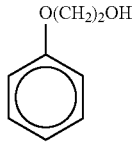

(Ab-4) Antiseptic

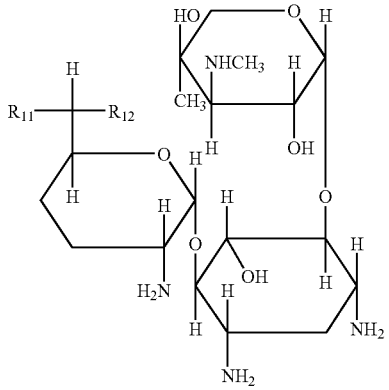

A mixture in 1:1:1:1 of a, b, c, and d (mol ratio)

| | $R_{11}$ | $R_{12}$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Sensitizing dye SD-1

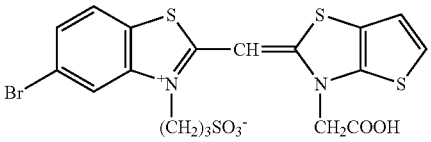

Sensitizing dye SD-2

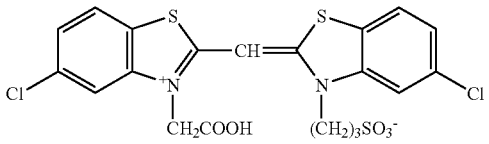

Sensitizing dye SD-3

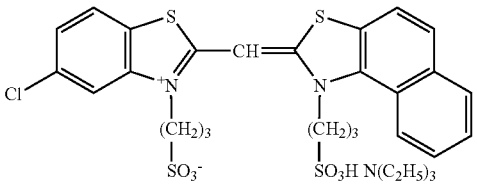

Compound-1

-continued

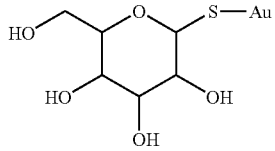

Compound-2

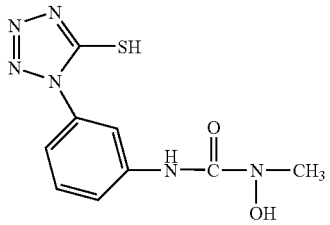

Compound-3

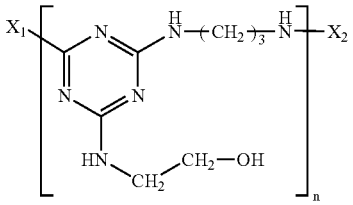

Compound-4

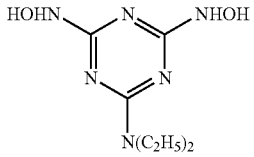

(Preparation of Blue-sensitive Layer Emulsion BL-11)

Emulsion grains were prepared in the same manner as in the preparation of Emulsion BH-11, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver iodobromochloride grains having a side length of 0.44 μm and a variation coefficient of 9.5%. After re-dispersion of this emulsion, Emulsion BL-11 was prepared in the same manner as Emulsion BH-11, except that the amounts of various compounds to be added in the preparation of Emulsion BH-11 were changed.

(Preparation of Green-Sensitive Layer Emulsion GH-11)

Using a method of adding silver nitrate and sodium chloride simultaneously to a deionized distilled water containing a deionized gelatin to mix these, under stirring, cubic high silver chloride grains were prepared. In the course of this preparation, $K_4[Ru(CN)_6]$ was added over the step of from 80% to 90% addition of the entire silver nitrate amount. Over the step of from 80% to 100% addition of the entire silver nitrate amount, potassium bromide (2 mol % per mol of the finished silver halide) was added. Over the step of from 83% to 88% addition of the entire silver nitrate amount, $K_2[IrCl_6]$ and $K_2[RhBr_5(H_2O)]$ were added. At the completion of 90% addition of the entire silver nitrate amount, potassium iodide (0.1 mol % per mol of the finished silver halide) was added under vigorous stirring. Further, over the step of from 92% to 98% addition of the entire silver nitrate amount, $K_2[IrCl_5(H_2O)]$ and $K[IrCl_4(H_2O)_2]$ were added. The thus-obtained emulsion grains were monodisperse cubic silver iodobromochloride grains having a side length of 0.42 μm and a variation coefficient of 8.0%. The resulting emulsion was subjected to flocculation desalting treatment and re-dispersing treatment in the same manner as described in the above.

This emulsion was dissolved at 40° C., and thereto, sodium benzenethiosulfate, p-glutaramidophenyldisulfide, sodium thiosulfate pentahydrate as a sulfur sensitizer, and (bis(1,4,5-trimethyl-1,2,4-triazolium-3-thiorato) aurate (I) tetrafluoroborate) as a gold sensitizer were added, and the emulsion was subjected to ripening for optimal chemical sensitization. Thereafter, 1-(3-acetoamidophenyl)-5-mercaptotetrazole, 1-(5-methylureidophenyl)-5-mercaptotetrazole, Compound-2, Compound4, and potassium bromide were added. Further, in a midway of the emulsion preparation process, Sensitizing dyes SD-4, SD-5, SD6 and SD-7 were added as sensitizing dyes, to conduct spectral sensitization. The thus-obtained emulsion was referred to as Emulsion GH-11.

Sensitizing dye SD-4

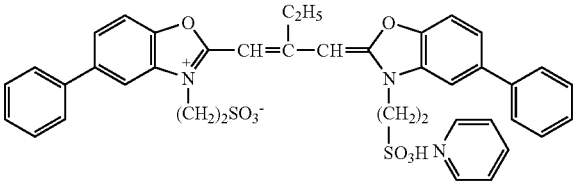

Sensitizing dye SD-5

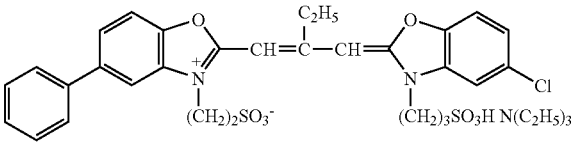

Sensitizing dye SD-6

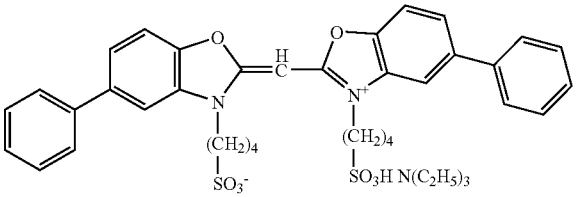

-continued

Sensitizing dye SD-7

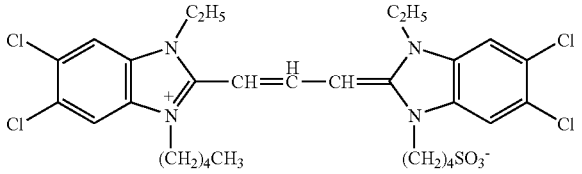

(Preparation of Green-Sensitive Layer Emulsion GL-11)

Emulsion grains were prepared in the same manner as in the preparation of Emulsion GH-11, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver iodobromochloride grains having a side length of 0.35 μm and a variation coefficient of 9.8%. After re-dispersion of this emulsion, Emulsion GL-11 was prepared in the same manner as Emulsion GH-11, except that the amounts of various compounds to be added in the preparation of Emulsion GH-11 were changed.

(Preparation of Red-Sensitive Layer Emulsion RH-11)

Using a method of adding silver nitrate and sodium chloride simultaneously to a deionized distilled water containing a deionized gelatin to mix these, under stirring, cubic high silver chloride grains were prepared. In the course of this preparation, $Cs_2[OsCl_5(NO)]$ was added over the step of from 60% to 80% addition of the entire silver nitrate amount. Over the step of from 80% to 90% addition of the entire silver nitrate amount, $K_4[Ru(CN)_6]$ was added. Over the step of from 80% to 100% addition of the entire silver nitrate amount, potassium bromide (1.3 mol % per mol of the finished silver halide) was added. Over the step of from 83% to 88% addition of the entire silver nitrate amount, $K_2[IrCl_5(5\text{-methylthiazole})]$ was added. At the completion of 88% addition of the entire silver nitrate amount, potassium iodide (in an amount that the silver iodide amount would be 0.05 mol % per mol of the finished silver halide) was added, under vigorous stirring. Further, over the step of from 92% to 98% addition of the entire silver nitrate amount, $K_2[IrCl_5(H_2O)]$ and $K[IrCl_4(H_2O)_2]$ were added. The thus-obtained emulsion grains were monodisperse cubic silver iodobromochloride grains having a cubic side length of 0.39 μm and a variation coefficient of 10%. The resulting emulsion was subjected to flocculation desalting treatment and re-dispersing treatment in the same manner as described in the above.

This emulsion was dissolved at 40° C., and Sensitizing dye SD-8, Compound-5, triethylthiourea as a sulfur sensitizer, and the above-described Compound-I as a gold sensitizer were added, and the resulting emulsion was ripened for optimal chemical sensitization. Thereafter, 1-(3-acetoamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion RH-11.

Sensitizing dye SD-8

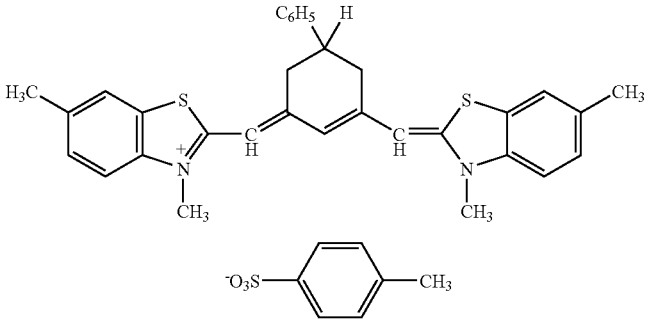

Compound-5

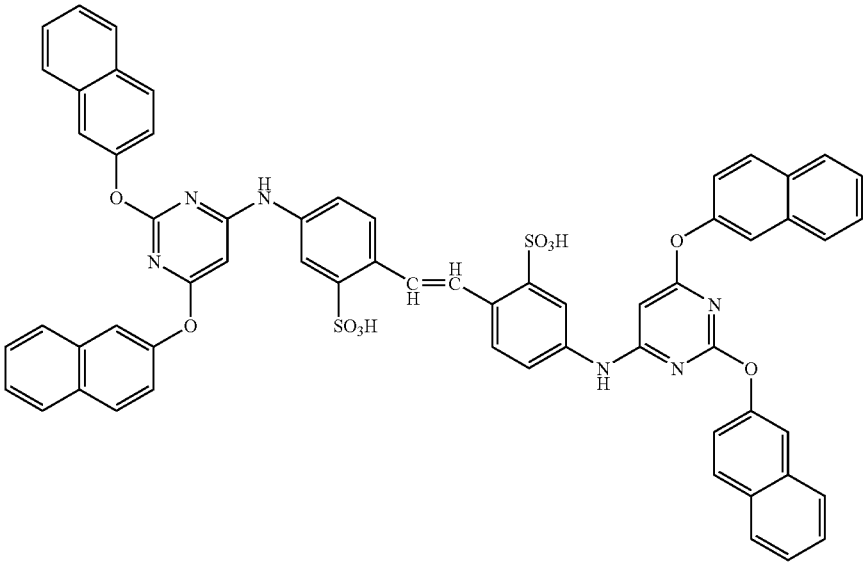

(SF-1) Emulsifying agent

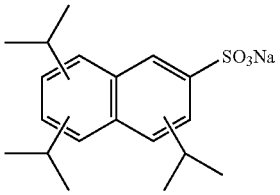

(Ex-H) Hardener

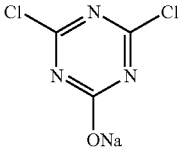

(Preparation of Red-Sensitive Layer Emulsion RL-11)

Emulsion grains were prepared in the same manner as in the preparation of Emulsion RH-11, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver iodobromochloride grains having a side length of 0.29 μm and a variation coefficient of 9.9%. After this emulsion was subjected to flocculation desalting treatment and re-dispersion, Emulsion RL-11 was prepared in the same manner as Emulsion RH-11, except that the amounts of various compounds to be added in the preparation of Emulsion RH-11 were changed.

(Preparation of a Coating Solution for the First Layer)

Into 21 g of a solvent (Solv-1) and 80 ml of ethyl acetate, were dissolved 45 g of a yellow coupler (Ex-Y), 7 g of a color-image stabilizer (Cpd-1), 4 g of a color-image stabilizer (Cpd-2), 7 g of a color-image stabilizer (Cpd-3), and 2 g of a color-image stabilizer (Cpd-8). This solution was emulsified and dispersed in 220 g of a 23.5 mass % aqueous gelatin solution containing 4 g of an emulsifying agent (SF-1), with a high-speed stirring emulsifier (dissolver). Then, water was added thereto, to prepare 900 g of Emulsified Dispersion A.

Separately, the above-described Emulsified Dispersion A, and the above-described Emulsions BH-11 and BL-11 were mixed and dissolved, to prepare a coating solution for the first layer having the composition shown below. The coating amounts of the emulsions are in terms of silver.

The coating solutions for the second to seventh layers were prepared in the similar manner as the coating solution for the first layer. As a gelatin hardener for each layer, (Ex-H) was used in an amount of 1.4 mass % of the gelatin content. Further, (Ab-1), (Ab-2), (Ab-3), (Ab-4) were added to each layer, so that their total amounts would be 14.0 mg/m$^2$, 62.0 mg/m$^2$, 5.0 mg/m$^2$, and 10.0 mg/m$^2$, respectively.

Further, 1-(3-methylureidophenyl)-5-mercaptotetrazole was added to the second layer, the fourth layer, and the sixth layer, in amounts of 0.2 mg/m$^2$, 0.2 Mg/m$^2$, and 0.6 mg/m$^2$, respectively. Further, 4-hydroxy-6-methyl-1,3,3a,7-tetrazaindene was added to the blue-sensitive emulsion layer and the green-sensitive emulsion layer, in amounts of $1\times10^{-4}$ mol and $2\times10^{-4}$ mol, respectively, per mol of the silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Further, disodium catecol-3,5-disulfonate was added to the second layer, the fourth layer, and the sixth layer, so that respective amounts would be 6 mg/m$^2$, 6 Mg/m$^2$, and 18 mg/m$^2$. Further, to each layer, sodium polystyrenesulfonate was optionally added to adjust viscosity of the coating solutions. Further, in order to prevent irradiation, the following dyes (coating amounts are shown in parentheses) were added.

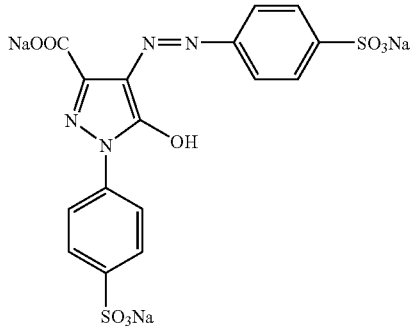

(2 mg/m$^2$)

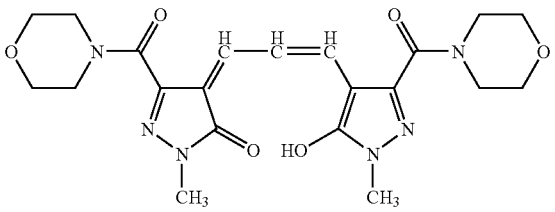

(3 mg/m$^2$)

-continued

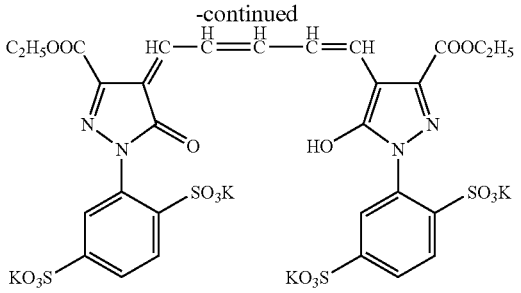

(10 mg/m$^2$)

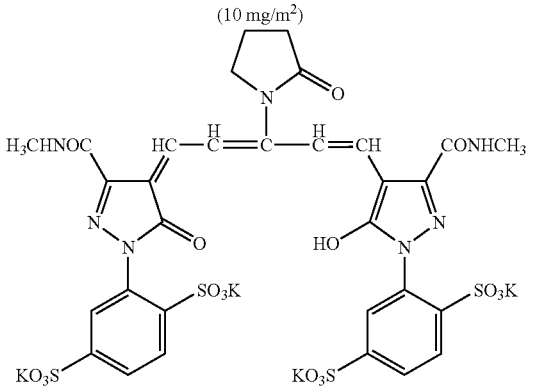

(16 mg/m$^2$)

(Layer Constitution)

The composition of each layer of Sample 1100 is shown below. The numbers show coating amounts (g/m$^2$). In the case of the silver halide emulsion, the coating amount is in terms of silver.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

| First layer (Blue-sensitive emulsion layer) | |
|---|---|
| Emulsion (a 5:5 mixture of BH-11 and BL-11 (molar ratio of silver)) | 0.24 |
| Gelatin | 1.25 |
| Yellow coupler (Ex-Y) | 0.45 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| **Second layer (Color-mixing-inhibiting layer)** | |
| Gelatin | 0.78 |
| Color-mixing inhibitor (Cpd-4) | 0.05 |
| Color-mixing inhibitor (Cpd-12) | 0.01 |
| Color image stabilizer (Cpd-5) | 0.006 |
| Color image stabilizer (Cpd-6) | 0.05 |
| Color image stabilizer (UV-A) | 0.06 |

-continued

| | |
|---|---|
| Color image stabilizer (Cpd-7) | 0.006 |
| Solvent (Solv-1) | 0.06 |
| Solvent (Solv-2) | 0.06 |
| Solvent (Solv-5) | 0.07 |
| Solvent (Solv-8) | 0.07 |
| Third layer (Green-sensitive emulsion layer) | |
| Emulsion (a 1:3 mixture of GH-11 and GL-11 (molar ratio of silver)) | 0.12 |
| Gelatin | 0.95 |
| Magenta coupler (Ma-29) | 0.12 |
| Ultraviolet absorber (UV-A) | 0.03 |
| Color image stabilizer (Cpd-2) | 0.01 |
| Color image stabilizer (Cpd-6) | 0.08 |
| Color image stabilizer (Cpd-7) | 0.005 |
| Color image stabilizer (Cpd-8) | 0.01 |
| Color image stabilizer (Cpd-9) | 0.01 |
| Color image stabilizer (Cpd-10) | 0.005 |
| Color image stabilizer (Cpd-11) | 0.0001 |
| Solvent (Solv-3) | 0.06 |
| Solvent (Solv-4) | 0.12 |
| Solvent (Solv-6) | 0.05 |
| Solvent (Solv-9) | 0.16 |
| Fourth layer (Color-mixing-inhibiting layer) | |
| Gelatin | 0.65 |
| Color-mixing inhibitor (Cpd-4) | 0.04 |
| Color-mixing inhibitor (Cpd-12) | 0.01 |
| Color image stabilizer (Cpd-5) | 0.005 |
| Color image stabilizer (Cpd-6) | 0.04 |
| Color image stabilizer (UV-A) | 0.05 |
| Color image stabilizer (Cpd-7) | 0.005 |
| Solvent (Solv-1) | 0.05 |
| Solvent (Solv-2) | 0.05 |
| Solvent (Solv-5) | 0.06 |
| Solvent (Solv-8) | 0.06 |
| Fifth layer (Red-sensitive emulsion layer) | |
| Emulsion (a 4:6 mixture of RH-11 and RL-11 (molar ratio of silver)) | 0.15 |
| Gelatin | 0.95 |
| Cyan coupler (ExC-1) | 0.038 |
| Cyan coupler (ExC-2) | 0.005 |
| Cyan coupler (ExC-3) | 0.14 |
| Color image stabilizer (Cpd-1) | 0.22 |
| Color image stabilizer (Cpd-7) | 0.003 |
| Color image stabilizer (Cpd-9) | 0.01 |
| Color image stabilizer (UV-5) | 0.10 |
| Solvent (Solv-10) | 0.05 |
| Sixth layer (Ultraviolet absorbing layer) | |
| Gelatin | 0.34 |
| Ultraviolet absorber (UV-B) | 0.24 |
| Compound (S1-4) | 0.0015 |
| Solvent (Solv-7) | 0.11 |
| Seventh layer (Protective layer) | |
| Gelatin | 0.82 |
| Additive (Cpd-22) | 0.03 |
| Liquid paraffin | 0.02 |
| AM (trademark, manufactured by Ludox Co.) (collidal silica) | 0.08 |
| Surfactant (Cpd-13) | 0.02 |

(Ex-Y) Yellow coupler A mixture in 1:2 (mol ratio) of (ExY-1) and (ExY-2)

(ExY-1)

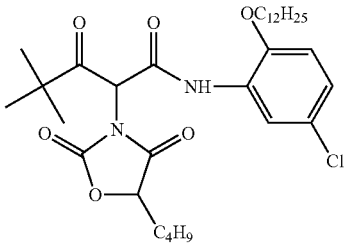

(ExY-2)

-continued
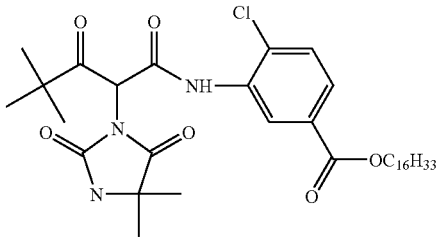
(ExC-1) Cyan coupler
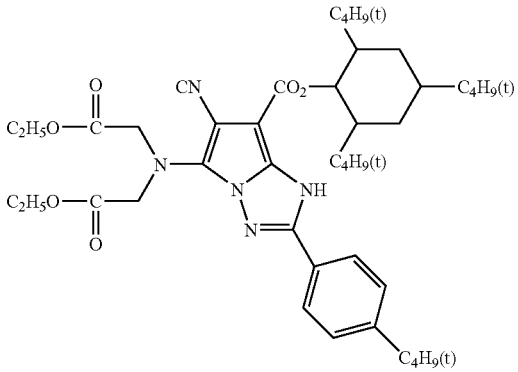
(ExC-2) Cyan coupler
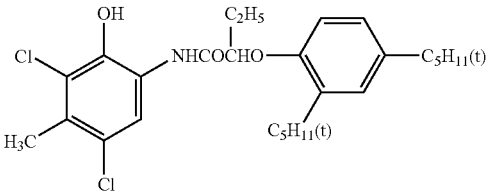
(ExC-3) Cyan coupler
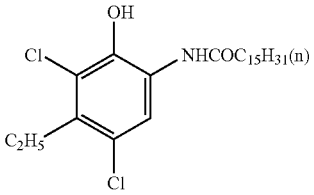
(ExC-4) Cyan coupler
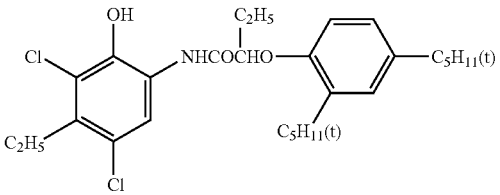
(Cpd-1) Color-image stabilizer
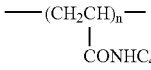
Number-average
molecular mass 60,000
(Cpd-2) Color-image stabilizer -continued
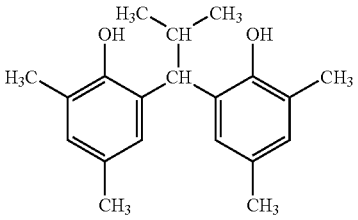
(Cpd-3) Color-image stabilizer
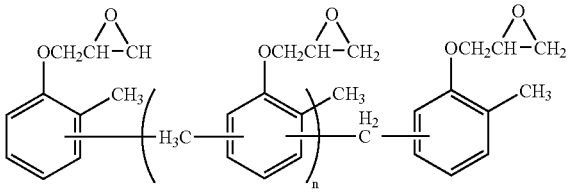
n = 7~8
(Average value)
(Cpd-4) Color-image stabilizer
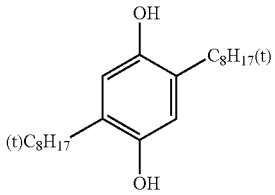
(Cpd-5) Color-image stabilizer
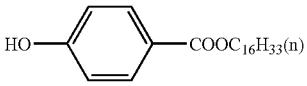
(Cpd-6) Color-image stabilizer
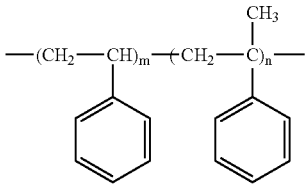
Number-average
molecular mass 600
m/n = 10/90
(Cpd-7) Color-image stabilizer
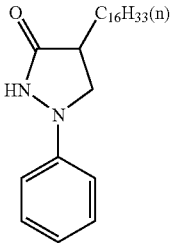
(Cpd-8) Color-image
stabilizer -continued
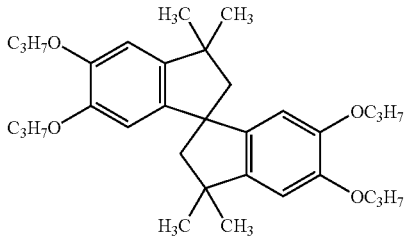
(Cpd-9) Color-image stabilizer
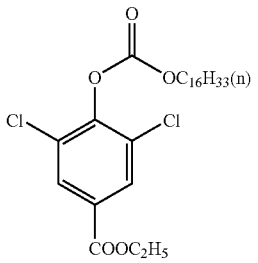
(Cpd-10) Color-image stabilizer
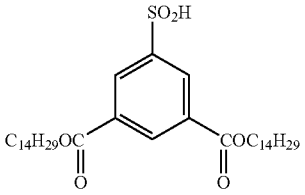
(Cpd-11)
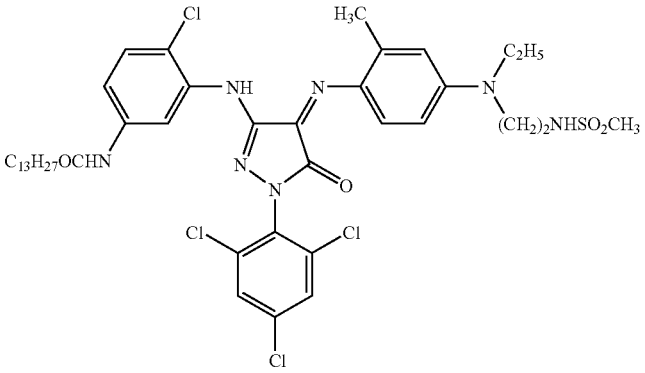
(Cpd-12)
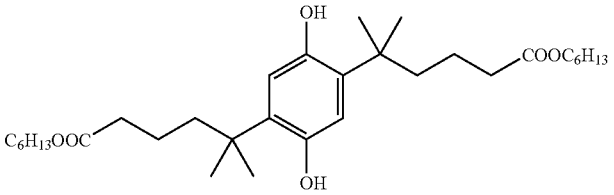
(Cpd-13) A mixture in 6:2:2 (mol ratio) of (a)/(b)/(c)
(a)

-continued
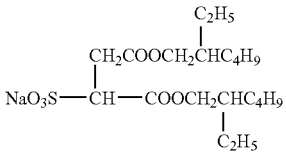
(b)
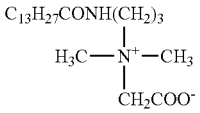
(c)
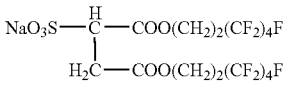
(Cpd-22)
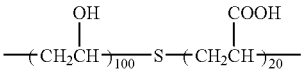
(Mass Ratio)
(Solv-1)
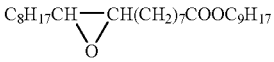
(Solv-2)
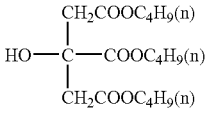
(Solv-3)
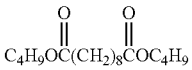
(Solv-4)
$O{=}P{-}(OC_6H_{13}(n))_3$
(Solv-5)
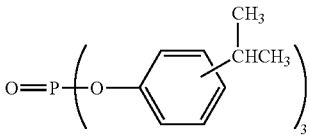
(Solv-6)
$C_8H_{17}CH{=}CHC_8H_{16}OH$
(Solv-7)
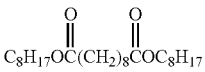
(Solv-8)
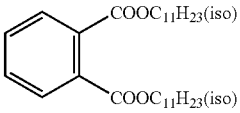

-continued
(Solv-9)
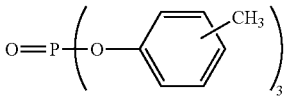
(Solv-10)
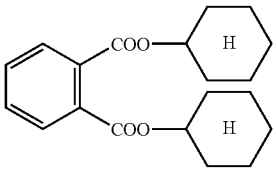
(S1-4)
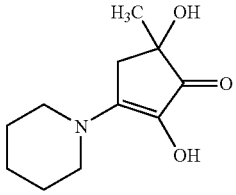
UV-A:
A mixture of UV-1/UV-4/UV-5 = 1/7/2 (mass ratio)
UV-B:
A mixture of UV-1/UV-2/UV-3/UV-4/UV-5 = 1/1/2/3/3.
(mass ratio)
(UV-1)
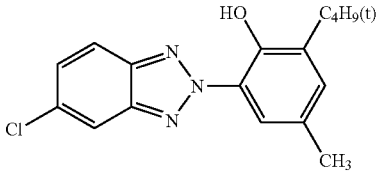
(UV-2)
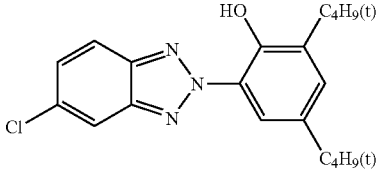
(UV-3)
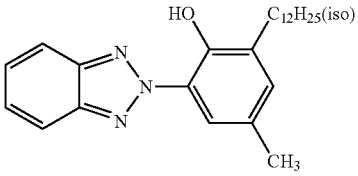
(UV-4)

-continued

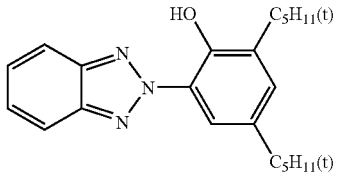

(UV-5)

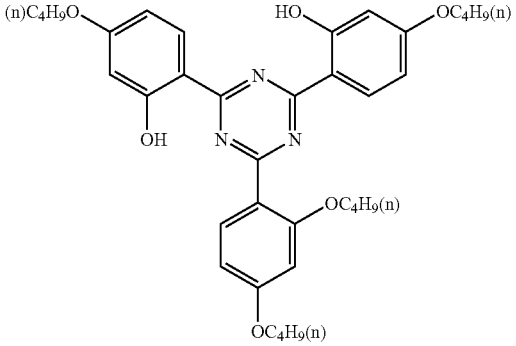

Preparation of Samples No. 1101 to No. 1108

Samples No. 1101 to No. 1108 were prepared in the same manner as Sample No. 1100, except that changes as shown in Table 2 were made. Specifically, the magenta coupler in the third layer of Sample 1100 was replaced with any of magenta couplers, as set forth in Table 2, in an equimolar amount, respectively; or/and the cyan couplers in the fifth layer of Sample 1100 were replaced with any of cyan couplers, as set forth in Table 2, in an equimolar amount, respectively; or/and the hardener in Sample 1100 was replaced with any of hardeners, as set forth in Table 2, in the same amount, respectively.

TABLE 2

| Sample No. | Magenta coupler in third layer | Cyan coupler in fifth layer | Hardener |
|---|---|---|---|
| 1100 | Ma-29 | ExC-1<br>ExC-2<br>ExC-3 | Ex-H |
| 1101 | Ma-1 | The same composition as the above | Ex-H |
| 1102 | Ma-48 | ExC-1 | Ex-H |
| 1103 | Ma-29 | IC-23 | Ex-H |
| 1104 | Ma-29 | IC-23 | H-6 |
| 1105 | Ma-48 | IC-23 | H-6 |
| 1106 | Ma-7 | IC-15 | H-1 |
| 1107 | Ma-48 | IC-23 | Ex-H |
| 1108 | Ma-7 | IC-23 | Ex-H |

Processing A

Each of the aforementioned Samples was made into a roll with a width of 127 mm, the resultant sample was exposed to light with a standard photographic image, using a digital minilab configured as shown in FIG. 1 (wherein the sheet-conveying speed was set at 45 mm/sec); and then, the exposed sample was continuously processed (running test) in the following processing steps, until an accumulated replenisher amount of the color developing solution reached to be equal to twice the color developer tank volume.

| Processing step | Temperature | Time | Replenisher amount |
|---|---|---|---|
| Color development | 45.0° C. | 17.8 sec | 45 mL/$m^2$ |
| Bleach-fixing | 40.0° C. | 17.8 sec | 35 mL/$m^2$ |
| Rinse 1 | 45.0° C. | 5.4 sec | — |
| Rinse 2 | 45.0° C. | 2.7 sec | — |
| Rinse 3 | 45.0° C. | 2.7 sec | — |
| Rinse 4 | 45.0° C. | 5.5 sec | 175 mL/$m^2$ |
| Drying | 80° C. | 26 sec | |

The drying time in the above Processing A is expressed in terms of the sum of a post-rinse squeegee time of 3 seconds, a drying-air-blowing time of 13 seconds and a conveyance-to-drying-section-exit time of 10 seconds.

Processing solutions used in the process steps respectively had the following compositions:

| | [Tank solution] | [Replenisher] |
|---|---|---|
| [Color developer] | | |
| Water | 800 mL | 800 mL |
| Fluorescent whitening agent (FL-3) | 4.0 g | 8.0 g |
| Residual-color-reducing agent (SR-1) | 3.0 g | 5.5 g |
| Triisopropanolamine | 8.8 g | 8.8 g |

-continued

| | | |
|---|---|---|
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.0 g |
| 4-Amino-3-methyl-N-ethyl-N-(β-methanesulfonamidoethyl)-aniline-3/2 sulfate-monohydrate | 7.0 g | 19.0 g |
| Potassium carbonate | 26.3 g | 26.3 g |
| Water to make | 1,000 mL | 1,000 mL |
| pH (25° C./adjusted by using sulfuric acid and KOH) | 10.25 | 12.6 |
| [Bleach-fixing solution] | | |
| Water | 800 mL | 800 mL |
| Ammonium thiosulfate (750 g/L) | 107 mL | 214 mL |
| Succinic acid | 29.5 g | 59.0 g |
| Ammonium iron (III) ethylenediaminetetraacetate | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 mL | 1,000 mL |
| pH (25° C./adjusted by using nitric acid and aqua ammonia) | 6.00 | 6.00 |
| [Rinse solution] | | |
| Sodium chlorinated-isocyanurate | 0.02 g | 0.02 g |
| Deionized water (conductivity: 5 μS/cm or less) | 1,000 ml | 1,000 ml |
| pH (25° C.) | 6.5 | 6.5 |

FL-1

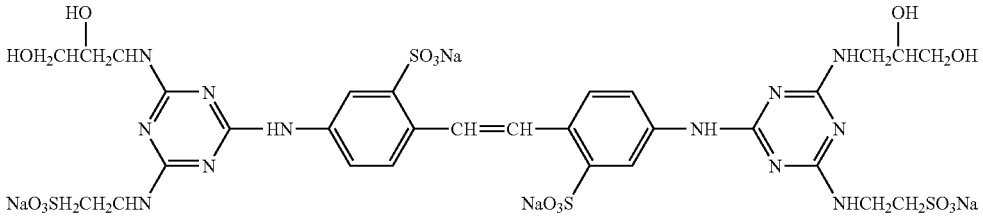

FL-2

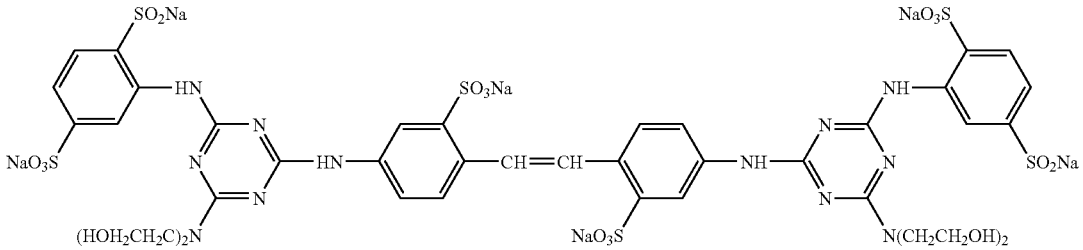

FL-3

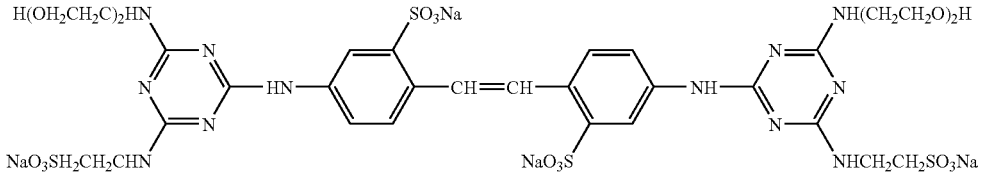

-continued

SR-1

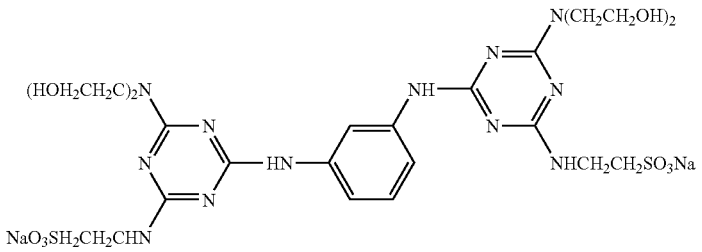

(Exposure of the Samples)

Each sample was subjected to gradation exposure to impart gray by means of the following exposure apparatus, and further to color-photographic processing by the foregoing processing after a 5-second lapse from completion of the exposure. As laser light sources, use were made of: a blue laser at a wavelength of about 470 nm pulled out by performing a wavelength conversion of a semiconductor laser (an oscillation wavelength of about 940 nm) using a SHG crystal of $LiNbO_3$ having a waveguide-like reverse domain structure; a green laser at a wavelength of about 530 nm pulled out by performing a wavelength conversion of a semiconductor laser (an oscillation wavelength of about 1060 nm) using a SHG crystal of $LiNbO_3$ having a waveguide-like reverse domain structure; and a red semiconductor laser at a wavelength of about 650 nm (Hitachi Type No. HL6501 MG). Each laser light of three colors moved perpendicularly to a scanning direction by a polygon mirror such that they would carry out sequential-scanning exposure on the sample. The change of light quantity of the semiconductor laser that could be caused by the temperature change was prevented by using a Peltier device and by keeping the temperature constant. An effectual beam diameter was 80 μm, a scanning pitch was 42.3 μm (600 dpi), and the average exposure time per pixel was $1.7\times10^{-7}$ sec. The temperature of the semiconductor laser was kept constant by using a Peltier device, to prevent the quantity of light from being changed by temperature.

(Evaluation 1)

<Unprocessed Stock Photographic Properties Achieved by Processing A>

After completion of coating operations, each sample was stored for 10 days under conditions of 25° C.-55% RH (control), and then some portions thereof were further stored for 3 days under conditions of 40° C.-75% RH (aging). In this way, samples stored under two different conditions were prepared.

These samples were subjected to gray gradation exposure by the above-described exposure, and then to development processing by means of the processing apparatus used in Processing A, thereby determining sensitometry. Measurements of magenta and cyan densities of the aging sample were made in the areas having received the same amounts of exposure as to provide the control sample with magenta and cyan densities of (the minimum density+1.8). Density differences (i.e. ΔG and ΔR) of the aging sample to the control sample were determined. The smaller the values of ΔG and ΔR are, the smaller the change of photographic properties by a rapid processing system is, which is preferable.

(Evaluation 2)

<Variation in Photographic Gradation by Processing>

In the magenta color-formation sensitometry of the control sample prepared in Evaluation 1, the logarithmic value of an exposure amount providing (the minimum density+0.2) (i.e. logE1) and the logarithmic value of an exposure amount providing (the minimum density+1.8) (i.e. logE2) were read, and SE=logE2−logE1 was determined. Large SE and small SE represent the so-called hard gradation and soft gradation, respectively.

Separately, sensitometry of the control sample was determined in the same manner as in Evaluation 1, except that the color developer and the bleach-fix bath were replaced with fresh solutions, respectively. Then, the gradation was examined in the same manner as described above, which is denoted by SE'. The ratio of SE to SE', i.e. SE/SE' (gradation ratio), of each sample was determined, and shown in the column G in Table 3. Likewise, the gradation ratio was determined with respect to cyan color-formation sensitometry also, and shown in the column R in Table 3.

The gradation ratio SE/SE' closer to 1 means the smaller change in gradation by deterioration of the processing solutions in the running processing, namely, attainment of the more consistent photographic properties.

The evaluation results thus obtained are shown in Table 3.

TABLE 3

| Sample | Unprocessed stock storage stability | | Photographic gradation ratio, SE/SE' | | |
|---|---|---|---|---|---|
| No. | ΔG | ΔR | G | R | Remarks |
| 1100 | −0.11 | −0.13 | 0.95 | 0.96 | Comparative example |
| 1101 | −0.12 | −0.13 | 0.95 | 0.96 | Comparative example |
| 1102 | −0.04 | −0.11 | 0.99 | 0.95 | Comparative example |
| 1103 | −0.05 | −0.04 | 0.98 | 0.99 | This invention |
| 1104 | −0.04 | −0.02 | 0.98 | 0.99 | This invention |
| 1105 | −0.03 | −0.02 | 1.00 | 1.00 | This invention |
| 1106 | −0.03 | −0.03 | 0.99 | 1.00 | This invention |
| 1107 | −0.05 | −0.04 | 0.98 | 0.98 | This invention |
| 1108 | −0.04 | −0.04 | 0.97 | 0.98 | This invention |

When the constitutions of the samples using a magenta coupler represented by formula (M-I) and a cyan coupler represented by formula (IA) were combined with the system of the rapid processing defined in the present invention, preferably in the second embodiment of the present invention, the present samples had an advantage that high-density areas thereof were resistant to density drop even after storage in unprocessed stock state, and besides, the samples according to the present invention was less in change that could be caused in photographic gradation upon running processing.

Example 1-2

Processing B

Samples 1100 and 1105 in Example 1-1 each were made into a roll with a width of 127 mm; the resultant samples were exposed to light with a standard photographic image, using Minilab Printer Processor Frontier 340 (trade name, manufactured by Fuji Photo Film Co., Ltd.; wherein the sheet-conveying speed was set at 28 mm/sec); and then, the exposed samples were continuously processed (running test) in the following processing steps, respectively, until an accumulated replenisher amount of the color developing solution reached to be equal to twice the color developer tank volume.

The above samples were evaluated according to the same methods as adopted in Example 1-1, except that the photographic processing was performed under the following conditions.

| Processing step | Temperature | Time | Replenisher amount |
|---|---|---|---|
| Color development | 43.0° C. | 25.5 sec | 45 mL/m$^2$ |
| Bleach-fixing | 40.0° C. | 25.5 sec | 35 mL/m$^2$ |
| Rinse 1 | 40.0° C. | 7.3 sec | — |
| Rinse 2 | 40.0° C. | 3.5 sec | — |
| Rinse 3 | 40.0° C. | 3.5 sec | — |
| Rinse 4 | 40.0° C. | 7.2 sec | 175 mL/m$^2$ |
| Drying | 80° C. | 26 sec | |

Processing C

Samples 1100 and 1105 in Example 1-1 each were made into a roll with a width of 127 mm; the resultant samples were exposed to light with a standard photographic image, using Digital Minilab Printer Processor Frontier 340 (trade name, manufactured by Fuji Photo Film Co., Ltd.; wherein the sheet-conveying speed was set at 16 mm/sec, and the processing time in each step is shown below); and then, the exposed samples were continuously processed (running test) in the following processing steps, respectively, until an accumulated replenisher amount of the color developing solution reached to be equal to twice the color developer tank volume.

| Processing step | Temperature | Time | Replenisher amount |
|---|---|---|---|
| Color development | 38.5° C. | 45 sec | 45 mL/m$^2$ |
| Bleach-fixing | 38.0° C. | 45 sec | 35 mL/m$^2$ |
| Rinse 1 | 38.0° C. | 13 sec | — |
| Rinse 2 | 38.0° C. | 6.2 sec | — |

-continued

| Processing step | Temperature | Time | Replenisher amount |
|---|---|---|---|
| Rinse 3 | 38.0° C. | 6.2 sec | — |
| Rinse 4 | 38.0° C. | 12.7 sec | 175 mL/m$^2$ |
| Drying | 80° C. | 45.9 sec | |

After coating, a set of specimens of the Sample No. 1100 and No. 1105 were stored for 5 days under the condition of 25° C.-55% RH, and then stored at −5° C. in a frozen state. After coating, another set of specimens of the Sample No. 1100 and No. 1105 were stored for 8 days under the condition of 25° C.-55% RH, and then stored at −5° C. in a frozen state. After coating, still another set of specimens of the Sample No. 1100 and No. 1105 were stored for 12 days under the condition of 25° C.-55% RH. The thus stored Samples were evaluated at the same time.

(Evaluation 3)

<Scratch Resistance in Wet Condition>

Each set of specimens was exposed to uniform white light. The thus-exposed samples each were immersed in the color developer for 30 seconds. Thereafter, the coated surface of each specimen was scratched using a sapphire stylus with a 0.8-mm-dia round tip while imposing thereon a load increased from 50 to 200 g in 10 g steps. Evaluation of film strength was expressed in terms of the minimum of loads making scratches on the coated surface in these tests. So the greater the minimum load value, the higher the film strength.

(Evaluation 4)

<Evaluation of Scratch Made on Film Surface by Use of Actual Processing Machine>

Each set of specimens was exposed to uniform white light. One half of the thus-exposed samples was subjected to the Processing A described in Example 1-1 and the other half thereof was subjected to the Processing C, to prepare black specimens. The scratches on the black surfaces of these specimens were examined with the naked eye.

(Evaluation 5)

<Difference in Maximum Gray Density Between Processing Systems>

Three sheets of each set of specimens were exposed to uniform white light. The thus-exposed samples were subjected to any of the Processing A, Processing B, and Processing C, to prepare black specimens, respectively. G-densities of these black specimens were measured with X-rite (status A). Then, they were examined for rate of density variation between Processing A and Processing C (DA/DC) and rate of density variation between Processing A and Processing B (DA/DB). The closer to 1.0 these rates are, the more consistent the black densities are from one processing system to another.

Results obtained are shown in Table 4.

TABLE 4

| Sample No. | Number of consecutive days spent on storage in unprocessed stock state | Scratch resistance in wet condition (g) | Scratches (sensory evaluation) Processing A | Scratches (sensory evaluation) Processing C | Difference in the maximum density between processing systems DA/DB | Difference in the maximum density between processing systems DA/DC |
|---|---|---|---|---|---|---|
| 1100 | 5 days | 90 | Bad | Fair | 0.95 | 0.94 |
| (Comparative | 8 days | 120 | Fair | Good | 0.97 | 0.97 |
| example) | 12 days | 130 | Fair | Good | 0.97 | 0.98 |
| 1105 | 5 days | 120 | Fair | Fair | 0.98 | 0.97 |
| (This | 8 days | 130 | Good | Good | 1.00 | 0.99 |
| invention) | 12 days | 130 | Good | Good | 1.00 | 0.99 |

In the Processing C having the development time and drying time longer than those periods of time preferable in the present invention (e.g. longer than those preferable periods of time defined in the second embodiment of the present invention), the present specimens were equal in scratch evaluations to the specimens for comparison. However, in the Processing A which is a preferred embodiment of the present invention, the present specimens were superior in scratch evaluations to the specimens for comparison. Further, the maximum densities of gray colors developed in the present specimens by the Processing A were almost equal to those by the Processing B and Processing C, so the differences between processing systems were quite small. On the contrary, as to the specimens for comparison, differences in maximum gray density between the processing systems were conspicuously large when the number of consecutive days spent on raw or unprocessed stock-state storage was short.

Example 1-3

Sample No. 1301 and Sample No. 1302 as described below were prepared. These Samples were processed according to the Processing A described in Example 1-1. As a result of making evaluations following Example 1-1, it is shown that these Samples were able to achieve the similar effects as the samples prepared in Example 1-1 according to the present invention.

—Preparation of Sample 1301—

A sample 1301 was prepared in the same manner as Sample 1105, except that the compositions of the third and fifth layers were changed as described below.

| Third layer (Green-sensitive emulsion layer) | |
|---|---|
| Emulsion (a 1:3 mixture of GH-11 and GL-11 (mol ratio of silver)) | 0.12 |
| Gelatin | 0.95 |
| Magenta coupler (Ma-48) | 0.21 |
| Oleyl alcohol | 0.33 |
| Color-image stabilizer (ST-1) | 0.04 |
| Color-image stabilizer (ST-2) | 0.28 |
| **Fifth layer (Red-sensitive emulsion layer)** | |
| Emulsion (a 4:6 mixture of RH-11 and RL-11 (mol ratio of silver)) | 0.15 |
| Gelatin | 0.95 |
| Cyan coupler (IC-23) | 0.30 |
| Ultraviolet absorber (UV-5) | 0.36 |
| Dibutyl sebacate | 0.44 |
| Tris(2-ethylhexyl) phosphate | 0.15 |

—Preparation of Sample 1302—

A sample 1302 was prepared in the same manner as Sample 1105, except that the compositions of the third and fifth layers were changed as described below.

| Third layer (Green-sensitive emulsion layer) | |
|---|---|
| Emulsion (a 1:3 mixture of GH-11 and GL-11 (mol ratio of silver)) | 0.12 |
| Gelatin | 0.95 |
| Al-2 | 0.01 |
| Magenta coupler (Ma-49) | 0.20 |
| Color-image stabilizer (ST-1) | 0.10 |
| Color-image stabilizer (ST-3) | 0.02 |
| Di-i-decyl phthalate | 0.10 |
| Dibutyl phthalate | 0.10 |
| **Fifth layer (Red-sensitive emulsion layer)** | |
| Emulsion (a 4:6 mixture of RH-11 and RL-11 (mol ratio of silver)) | 0.15 |
| Gelatin | 0.95 |
| Cyan coupler (ExC-4) | 0.20 |
| Cyan coupler (IC-29) | 0.10 |
| Color-image stabilizer (ST-4) | 0.06 |
| 2,5-di-t-octylhydroquinone | 0.003 |
| Dibutyl phthalate | 0.10 |
| Dioctyl phthalate | 0.20 |

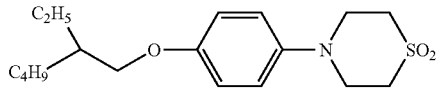

ST-1

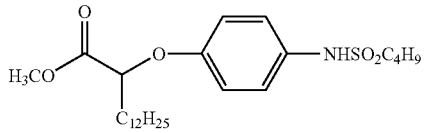

ST-2

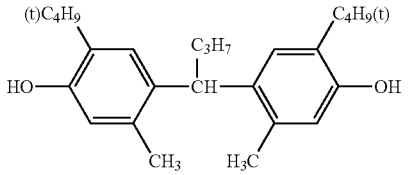

ST-3

-continued

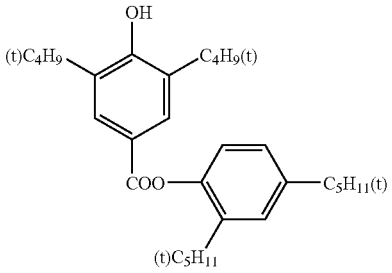

ST-4

Example 2-1

1. Preparation of Light-Sensitive Material Samples (Making of Blue-Sensitive Layer Emulsion A)

To 1.06 liter of deionized distilled water containing 5.7 mass % of deionized gelatin placed in a reaction vessel, 46.3 mL of a 10% NaCl solution was added, and further 46.4 mL of $H_2SO_4$ (1N) was added, and then 0.012 g of Compound X illustrated below was added. The temperature of the admixture obtained was adjusted to 60° C., and immediately thereafter 0.1 mole of silver nitrate and 0.1 mole of NaCl were added to the reaction vessel over a 10-minute period with stirring at a high speed. Subsequently thereto, 1.5 moles of silver nitrate and a NaCl solution were further added over a 60-minute period at a flow rate increased so that the final addition speed reached 4 times larger than the initial addition speed. Then, 0.2 mole % of silver nitrate and a NaCl solution were added at a constant flow rate over a 6-minute period. To the NaCl solution used herein, $K_3IrCl_5(H_2O)$ was added in an amount corresponding to $5\times10^{-7}$ mole on a basis of the total silver amount, thereby doping grains with aquated iridium.

Further, 0.2 mole of silver nitrate, a solution containing 0.18 mole of NaCl and 0.02 mole of KBr were added over a 6-minute period. At that time, $K_4Ru(CN)_6$ and $K_4Fe(CN)_6$ were each dissolved into the aqueous halide solution in an amount corresponding to $0.5\times10^{-5}$ mole on a basis of the total silver amount, and thereby they were added to silver halide grains.

During this grain growth at the final stage, an aqueous KI solution corresponding to 0.001 mole on a basis of the total silver amount was added to the reaction vessel over a 1-minute period. The addition started at the time that 93% of total grain formation finished.

Thereafter, the reaction vessel was adjusted to 40° C., and thereto Compound Y as a precipitant was added. Then, the pH of the resulting emulsion was adjusted to around 3.5, followed by desalting and washing.

Compound X

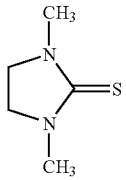

-continued

Compound Y

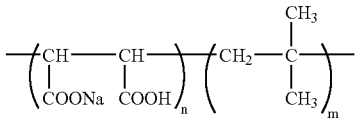

n and m each are an integer.

To the thus-desalted-and-washed emulsion, deionized gelatin, an aqueous NaCl solution and an aqueous NaOH solution were added. The resultant mixture was heated up to 50° C. and adjusted to pAg 7.6 and pH 5.6.

Thus was obtained a gelatin containing silver halide cubic grains having a halide composition composed of 98.9 mole % silver chloride, 1 mole % silver bromide and 0.1 mole % silver iodide; an average side length of 0.70 μm, and a variation coefficient of 8% with respect to the side length.

The emulsion grains thus formed was kept at 60° C., and thereto the following spectral sensitizing dye-1 and spectral sensitizing dye-2 were added in amounts of $2.5\times10^{-4}$ mole/mole silver and $2.0\times10^{-4}$ mole/mole silver, respectively. Further thereto, the following thiosulfonic acid compound-1 was added in an amount of $1\times10^{-5}$ mole/mole silver, and further was added a fine-grain emulsion doped with iridium hexachloride, having an average grain diameter of 0.05 μm and a halide composition composed of 90 mole % silver bromide and 10 mole % silver chloride. The resulting emulsion was ripened for 10 minutes. Further, fine grains having an average grain diameter of 0.05 Jim and a halide composition composed of 40 mole % silver bromide and 60 mole % silver chloride were added thereto, and the resulting emulsion was ripened for 10 minutes. Thus, the fine grains were dissolved, and the silver bromide content in the host cubic grains was increased to 1.3 moles. Also, the resulting emulsion was doped with $1\times10^{-7}$ mole/mole silver of iridium hexachloride.

Subsequently, the emulsion was admixed with $1\times10^{-5}$ mole/mole silver of sodium thiosulfate and $2\times10^{-5}$ mole/mole silver of the following gold sensitizer-1, and immediately thereafter the mixture was heated up to 60° C., and followed by 40-minute ripening. Then, the temperature of the resulting emulsion was lowered to 50° C., and immediately thereafter the following mercapto compound-1 and mercapto compound-2 were each added in an amount of $6\times10^{-4}$ mole/mole silver. Then, after ripening for 10 minutes, a KBr aqueous solution was added in an amount of 0.008 mole on a basis of the total silver amount, and then, the mixture was ripened for 10 minutes, and cooled. The emulsion thus obtained was stored.

In the manner described above, an emulsion on the high-speed layer side (high-sensitivity emulsion), Emulsion A-1, was prepared.

Cubic grains having an average side length of 0.55 μm and a variation coefficient of 9% with respect to the side length were formed in the same manner as in the above-mentioned emulsion-making, except that the temperature throughout the grain formation was changed to 55° C.

Spectral sensitization and chemical sensitization of the cubic grains obtained were carried out using the same sensitizers in amounts corrected for specific area (from the side length ratio of 0.7/0.55=1.27). Thus, an emulsion on the low-speed layer side (low-sensitivity emulsion), Emulsion A-2, was prepared.

Spectral sensitizing dye-1

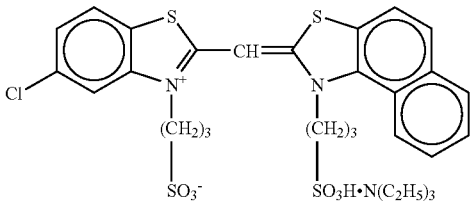

Spectral sensitizing dye-2

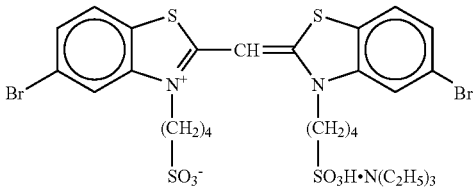

Thiosulfonic acid compound-1

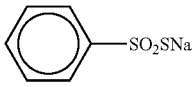

Mercapto compound-1

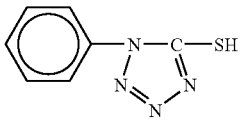

Mercapto compound-2

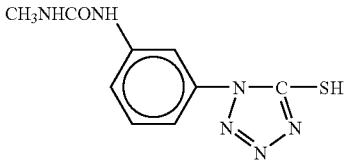

Gold sensitizer-1

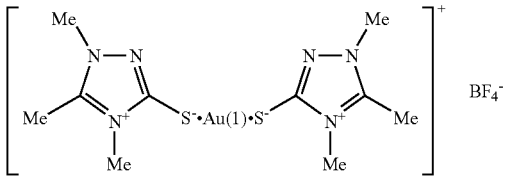

(Preparation of Blue-Sensitive Layer Emulsion B)

A silver halide emulsion was prepared in the same manner as the Emulsion A-1, except that the following changes were made to the emulsion-making conditions for Emulsion A-1. The temperature at the time of grain formation was changed to 68° C.; as a result, the grains formed had an average side length of 0.85 μm, as a grain size, and a variation coefficient of 12% with respect to the side length. The iodide introduction at the final stage of grain formation was replaced by chloride introduction; as a result, the halide composition at the completion of grain formation was composed of 99 mole % silver chloride and 1 mole % silver bromide. The addition amount of Spectral sensitizing dye-1 and that of Spectral sensitizing dye-2 were changed to 1.25 times those used in making Emulsion A-1, respectively. The Thiosulfonic acid compound-1 was utilized in the equi-amount.

The chemical sensitization was changed as follows:

A fine-grain emulsion having an average grain diameter of 0.05 μm and a halide composition composed of 90 mole % silver bromide and 10 mole % silver chloride and containing iridium hexachloride as a dopant was added, and the mixture was ripened for 10 minutes. Further, fine grains having an average grain diameter of 0.05 μm and a halide composition composed of 40 mole % silver bromide and 60 mole % silver chloride were added, and the mixture was ripened for 10 minutes. Thus, the fine grains were dissolved, and thereby the silver bromide content in host cubic grains was increased to 2.0 mole % and the amount of the iridium hexachloride doped was $2\times10^{-7}$ mole/mole Ag.

Then, sodium thiosulfate was added in an amount of $1\times10^{-5}$ mole/mole Ag. Immediately thereafter, the temperature was raised to 55° C. and the ripening was continued for 70 minutes. Then, the temperature was lowered to 50° C. Any gold sensitizer was not added. Immediately after lowering the temperature, the Mercapto compound-1 and the Mercapto compound-2 were each added in an amount of $4\times10^{-4}$ mole/mole Ag. Then, after 10-minute ripening, a KBr aqueous solution was added in an amount of 0.010 mole on a basis of the total silver amount. Then, the mixture was ripened for 10 minutes, and cooled. The emulsion thus obtained was stored.

In the manner described above, an emulsion on the high-speed layer side, Emulsion B-1, was prepared.

Grains having an average side length of 0.68 μm and a variation coefficient of 12% with respect to the side length were formed in the same manner as in Emulsion B-1, except that the temperature throughout the grain formation was lowered. The amounts of the spectral sensitizers and chemical sensitizers used were each increased to 1.25 times those in Emulsion, B-1 by taking the specific area into account. Thus, an emulsion on the low-speed layer side, Emulsion B-2, was prepared.

(Preparation of Green-Sensitive Layer Emulsion C)

Under the same preparation conditions for Emulsions A-1 and A-2 in the above Emulsion A, except that the temperature at the time of forming grains was lowered, and that the kind of sensitizing dyes were changed as described below, a high-sensitivity emulsion C-1 and a low-sensitivity emulsion C-2 were prepared, respectively.

(Sensitizing dye D)

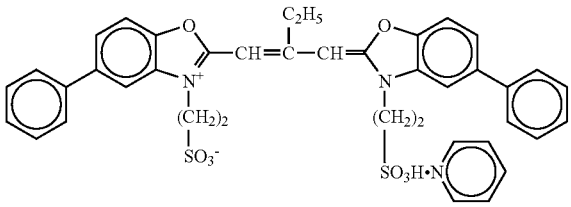

(Sensitizing dye E)

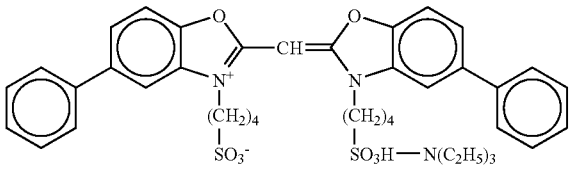

As for the grain size, the high-sensitivity emulsion C-1 had the average side length of 0.40 μm and the low-sensitivity emulsion C-2 had the average side length of 0.30 μm, each with the variation coefficient of average side length of 8%.

The sensitizing dye D was added to the large-size emulsion (high-sensitivity emulsion C-1) in an amount of $3.0\times10^{-4}$ mol, and to the small-size emulsion (low-sensitivity emulsion C-2) in an amount of $3.6\times10^{-4}$ mol, per mol of the silver halide; and the sensitizing dye E was added to the large-size emulsion in an amount of $4.0\times10^{-5}$ mol, and to the small-size emulsion in an amount of $7.0\times10^{-5}$ mol, per mol of the silver halide.

(Preparation of Green-Sensitive Layer Emulsion D)

Under the same preparation conditions for Emulsions B-1 and B-2 in the above Emulsion B, except that the temperature at the time of forming grains was lowered, and that the kind of sensitizing dyes were changed as described below, a high-sensitivity emulsion D-1 and a low-sensitivity emulsion D-2 were prepared, respectively. As for the grain size, the high-sensitivity emulsion D-1 had the average side length of 0.50 μm and the low-sensitivity emulsion D-2 had the average side length of 0.40 μm, each with the variation coefficient of side length of 10%. The sensitizing dye D was added to the large-size emulsion (high-sensitivity emulsion D-1) in an amount of 4.0×104 mol, and to the small-size emulsion (low-sensitivity emulsion D-2) in an amount of $4.5\times10^{-4}$ mol, per mol of the silver halide; and the sensitizing dye E was added to the large-size emulsion in an amount of $5.0\times10^{5}$ mol, and to the small-size emulsion in an amount of $8.8\times10^{-5}$ mol, per mol of the silver halide.

(Preparation of Red-Sensitive Layer Emulsion E)

Under the same preparation conditions for Emulsions A-1 and A-2 in the above Emulsion A, except that the temperature at the time of forming grains was lowered, and that the kind of sensitizing dyes were changed as described below, a high-sensitivity emulsion E-1 and a low-sensitivity emulsion E-2 were prepared, respectively.

(Sensitizing dye G)

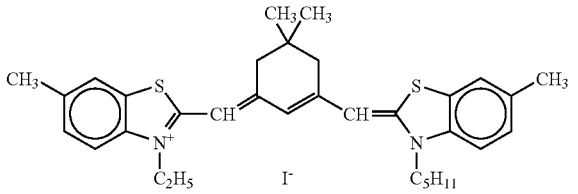

(Sensitizing dye H)

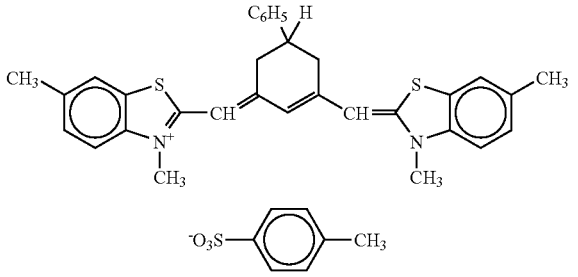

As for the grain size, the high-sensitivity emulsion E-1 had the average side length of 0.38 μm and the low-sensitivity emulsion E-2 had the average side length of 0.32 μm, with the variation coefficient of side length of 9% and 10%, respectively. The sensitizing dyes G and H were added to the large-size emulsion (high-sensitivity emulsion E-1) in an amount of $8.0\times10^{-5}$ mol, and to the small-size emulsion (low-sensitivity emulsion E-2) in an amount of $10.7\times10^{-5}$ mol, per mol of the silver halide, respectively.

Further, Compound I below was added to the red-sensitive emulsion layer in an amount of $3.0\times10^{-3}$ mol per mol of the silver halide.

(Compound I)

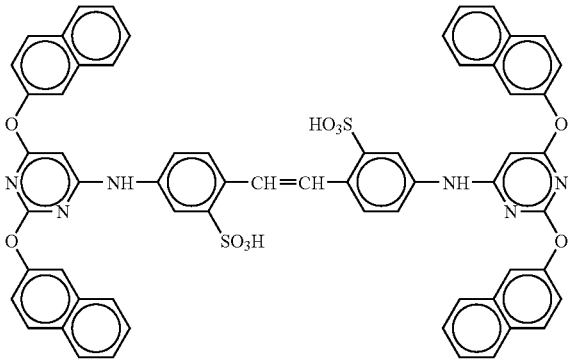

(Preparation of Red-Sensitive Layer Emulsion F)

Under the same preparation conditions for Emulsions B-1 and B-2 in the above Emulsion B, except that the temperature at the time of forming grains was lowered, and that the kind of sensitizing dyes were changed as described below, a high-sensitivity emulsion F-1 and a low-sensitivity emulsion F-2 were prepared, respectively.

As for the grain size, the high-sensitivity emulsion F-1 had the average side length of 0.57 μm and the low-sensitivity emulsion F-2 had the average side length of 0.43 μm, with the variation coefficient of side length of 9% and 10%, respectively.

The sensitizing dyes G and H were added to the large-size emulsion (high-sensitivity emulsion F-1) in an amount of $1.0\times10^{-4}$ mol, and to the small-size emulsion (low-sensitivity emulsion F-2) in an amount of $1.34\times10^{-4}$ mol; per mol of the silver halide, respectively. Further, Compound I above was added to the red-sensitive emulsion layer in an amount of $3.0\times10^{-3}$ mol per mol of the silver halide.

(Preparation of a Coating Solution for the First Layer)

Into 80 ml of ethyl acetate, were dissolved 27.6 g of Yellow coupler (Y-1), 31.5 g of Color image stabilizer (ST-23), 31.5 g of tributyl citrate, 7.9 g of Color image stabilizer (ST-24), 0.6 g of Color image stabilizer (ST-16) and 0.1 g of piperidinohexose reductone. This solution was emulsified and dispersed in 220 g of a 23.5-mass % aqueous gelatin solution containing 1.4 g of Surfactant (SF-1) and 1.4 g of potassium chloride, with a high-speed stirring emulsifier (dissolver). Then, water was added thereto, to prepare 900 g of Emulsified Dispersion B.

Separately, the above-described Emulsified Dispersion B, and the above-described Emulsions A-1 and A-2 were mixed and dissolved, to prepare a coating solution for the first layer having the composition shown below. The coating amounts of the emulsions are in terms of silver.

(Preparation of coating Solutions for the Second Layer to the Seventh Layer)

The coating solutions for the second layer to the seventh layer were prepared in the similar manner as that for the first-layer coating solution. As a gelatin hardener for each layer, 1-oxy-3,5-dichloro-s-triazine sodium salt (HA-11), (H-6), and (H-8) were used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(HA-11)

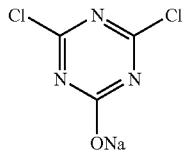

Hardener
(used in an amount of
1.4 mass% per gelatin)

Further, 1-(3-methylureidophenyl)-5-mercaptotetrazole was added to the second layer, the fourth layer, the sixth layer, and the seventh layer, in amounts of 0.2 mg/m$^2$, 0.2 mg/m$^2$, 0.6 mg/m$^2$, and 0.1 mg/m$^2$, respectively. Further, 4-hydroxy-6-methyl-1,3,3a,7-tetrazaindene was added to the blue-sensitive emulsion layer and the green-sensitive emulsion layer, in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Further, disodium catecol-3,5-disulfonate was added to the second layer, the fourth layer, and the sixth layer, so that respective amounts would be 6 mg/m$^2$, 6 mg/m$^2$, and 18 mg/m$^2$. Further, in order to prevent irradiation, the following dyes (coating amounts are shown in parentheses) were added.

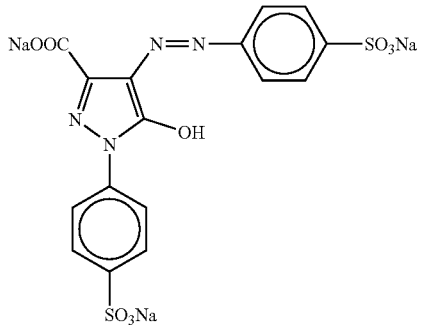

(2 mg/m$^2$)

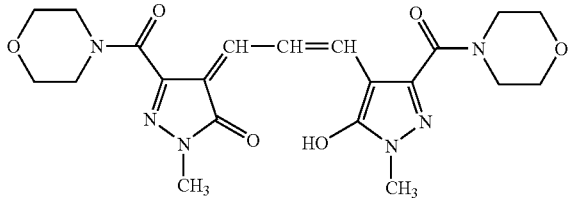

(2 mg/m$^2$)

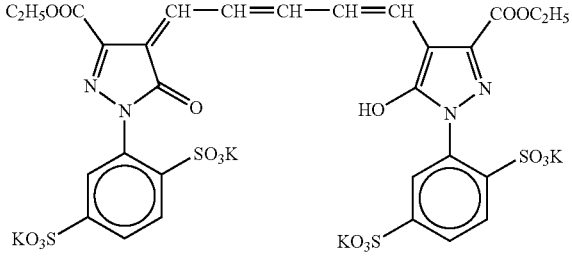

(3 mg/m$^2$)

-continued

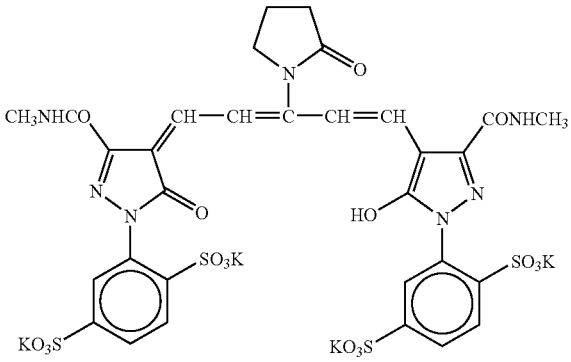

(7 mg/m$^2$)

Preparation of Sample No. 2101

(Layer Constitution)

The composition of each layer is shown below. The numbers show coating amounts (g/m$^2$). In the case of the silver halide emulsion, the coating amount is in terms of silver.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

| | |
|---|---|
| First layer (Blue-sensitive emulsion layer) | |
| Emulsion A (gold-sulfur sensitized cubic form, a mixture in a ratio of 3:7 (Ag mole ratio) of the large grain size emulsion A-1 and the small grain size emulsion A-2, the average grain size of the emulsion: 0.15 μm) | 0.20 |
| Gelatin | 1.31 |
| Yellow coupler (Y-1) | 0.42 |
| Color image stabilizer (ST-23) | 0.48 |
| Tributyl citrate | 0.48 |
| Color image stabilizer (ST-24) | 0.12 |
| Color image stabilizer (ST-16) | 0.01 |
| Piperidinohexose reductone | 0.002 |
| Surfactant (SF-1) | 0.02 |
| Potassium chloride | 0.02 |
| Second layer (Color-mixing-inhibiting layer) | |
| Gelatin | 0.75 |
| Color-mixing inhibitor (ST-5) | 0.10 |
| Solvent (Diundecyl phosphate) | 0.11 |
| Surfactant (SF-1) | 0.008 |
| Third layer (Green-sensitive emulsion layer) | |
| Emulsion C (gold-sulfur sensitized cubic form, a mixture in a ratio of 1:3 (Ag mole ratio) of the large grain size emulsion C-1 and the small grain size emulsion C-2; the average grain size of the emulsion: 0.25 μm) | 0.10 |
| Gelatin | 1.19 |
| Magenta coupler (Ma-48) | 0.21 |
| Oleyl alcohol | 0.22 |
| Solvent (Diundecyl phosphate) | 0.11 |
| Color image stabilizer (ST-21) | 0.04 |
| Color image stabilizer (ST-22) | 0.28 |
| Surfactant (SF-1) | 0.023 |

-continued

| | |
|---|---|
| Potassium chloride | 0.02 |
| Sodium phenylmercaptotetrazole | 0.0007 |
| Fourth layer (Color-mixing-inhibiting layer) | |
| Gelatin | 0.75 |
| Color-mixing inhibitor (ST-5) | 0.11 |
| Solvent (Diundecyl phosphate) | 0.20 |
| Copolymer of acrylamide/t-butylacrylamidosulfonate | 0.05 |
| Bis-vinylsulfonylmethane | 0.14 |
| Catechol disulfonate | 0.03 |
| Fifth layer (Red-sensitive emulsion layer) | |
| Emulsion E (gold-sulfur sensitized cubic form, a mixture in a ratio of 5:5 (Ag mole ratio) of the large grain size emulsion E-1 and the small grain size emulsion E-2; the average grain size of the emulsion: 0.19 μm) | 0.19 |
| Gelatin | 1.36 |
| Cyan coupler (IC-23) | 0.23 |
| Cyan coupler (IC-24) | 0.02 |
| Ultraviolet absorber (UV-4) | 0.36 |
| Dibutyl sebacate | 0.44 |
| Solvent (tris(2-ethylhexyl) phosphate) | 0.15 |
| Sodium phenylmercaptotetrazole | 0.0005 |
| Surfactant (SF-1) | 0.05 |
| Sixth layer (Ultraviolet absorbing layer) | |
| Gelatin | 0.82 |
| Ultraviolet absorber (UV-1) | 0.035 |
| Ultraviolet absorber (UV-4) | 0.20 |
| Solvent (tris(2-ethylhexyl) phosphate) | 0.08 |
| Surfactant (SF-1) | 0.01 |
| Seventh layer (Protective layer) | |
| Gelatin | 0.64 |
| AM (trade name) manufactured by Ludox Co. (Collidal silica) | 0.16 |
| Polydimethylcyloxane [DC200 (trade name)] | 0.02 |
| Surfactant (SF-2) | 0.003 |
| Surfactant (SF-13) | 0.003 |
| Surfactant Tergitol 15-S-5 (trade name) | 0.002 |
| Surfactant (SF-1) | 0.008 |
| Surfactant Aerosol OT (trade name) | 0.003 |

As described above, Sample 2101 was prepared.

Preparation of Sample No. 2001

A sample 2001 was prepared in the same manner as Sample 2101, except that the compositions of the third and fifth layers of Sample 2101 were changed as described below.

| | |
|---|---|
| Third layer (Green-sensitive emulsion layer) | |
| Emulsion C (gold-sulfur sensitized cubic form, a mixture in a ratio of 1:3 (Ag mole ratio) of the large grain size emulsion C-1 and the small grain size emulsion C-2; the average grain size of the emulsion: 0.25 μm) | 0.13 |
| Gelatin | 1.10 |
| Magenta coupler (Ma-7) | 0.27 |
| Solvent (Dibutyl phosphate) | 0.08 |
| Solvent (Diundecyl phosphate) | 0.03 |
| Color image stabilizer (ST-8) | 0.02 |
| Color image stabilizer (ST-21) | 0.17 |
| Color image stabilizer (ST-22) | 0.53 |
| Dye-2 | 0.007 |
| Surfactant (SF-1) | 0.023 |
| Potassium chloride | 0.02 |
| Sodium phenylmercaptotetrazole | 0.0007 |
| Fifth layer (Red-sensitive emulsion layer) | |
| Emulsion E (gold-sulfur sensitized cubic form, a mixture in a ratio of 5:5 (Ag mole ratio) of the large grain size emulsion E-1 and the small grain size emulsion E-2, the average grain size of the emulsion: 0.19 μm) | 0.18 |

-continued

| | |
|---|---|
| Gelatin | 1.20 |
| Cyan coupler (C-1) | 0.37 |
| Ultraviolet absorber (UV-4) | 0.24 |
| Solvent (dibutyl phosphate) | 0.36 |
| Solvent (2-(2-butoxyethoxy)ethyl acetate) | 0.03 |
| Dye-3 | 0.02 |
| Sodium phenylmercaptotetrazole | 0.0005 |
| Surfactant (SF-1) | 0.05 |

Preparation of Sample No. 2002

A sample 2002 was prepared in the same manner as Sample 2101, except that the compositions of the third and fifth layers of Sample 2101 were changed as described below.

| | |
|---|---|
| Third layer (Green-sensitive emulsion layer) | |
| Emulsion C (gold-sulfur sensitized cubic form, a mixture in a ratio of 1:3 (Ag mole ratio) of the large grain size emulsion C-1 and the small grain size emulsion C-2, the average grain size of the emulsion: 0.25 μm) | 0.12 |
| Gelatin | 0.95 |
| Magenta coupler (EXM) | 0.12 |
| Ultraviolet absorber (UV-A) | 0.03 |
| Color image stabilizer (Cpd-2) | 0.01 |
| Color image stabilizer (Cpd-6) | 0.08 |
| Color image stabilizer (Cpd-7) | 0.005 |
| Color image stabilizer (Cpd-8) | 0.01 |
| Color image stabilizer (Cpd-9) | 0.001 |
| Color image stabilizer (Cpd-10) | 0.001 |
| Color image stabilizer (Cpd-11) | 0.0001 |
| Color image stabilizer (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.16 |
| Fifth layer (Red-sensitive emulsion layer) | |
| Emulsion E (gold-sulfur sensitized cubic form, a mixture in a ratio of 5:5 (Ag mole ratio) of the large grain size emulsion E-1 and the small grain size emulsion E-2, the average grain size of the emulsion: 0.19 μm) | 0.15 |
| Gelatin | 1.11 |
| Cyan coupler (ExC-1) | 0.11 |
| Cyan coupler (ExC-2) | 0.01 |
| Cyan coupler (ExC-3) | 0.04 |
| Color image stabilizer (Cpd-1) | 0.03 |
| Color image stabilizer (Cpd-7) | 0.002 |
| Color image stabilizer (Cpd-9) | 0.003 |
| Color image stabilizer (Cpd-10) | 0.001 |
| Color image stabilizer (Cpd-14) | 0.001 |
| Color image stabilizer (Cpd-15) | 0.18 |
| Color image stabilizer (Cpd-16) | 0.002 |
| Color image stabilizer (Cpd-17) | 0.001 |
| Color image stabilizer (Cpd-18) | 0.05 |
| Color image stabilizer (Cpd-19) | 0.04 |
| Color image stabilizer (UV-5) | 0.10 |
| Solvent (Solv-5) | 0.19 |

Further, thereto was added a copolymer latex of methacrylic acid and butyl acrylate (1:1 in mass ratio; average molecular weight, 200,000 to 400,000) in an amount of 0.05 g/m$^2$.

Preparation of Sample No. 2102

A sample 2102 was prepared in the same manner as Sample 2101, except that the compositions of the third and fifth layers of the sample 2101 were changed as described below.

| Third layer (Green-sensitive emulsion layer) | |
|---|---|
| Emulsion C (gold-sulfur sensitized cubic form, a mixture in a ratio of 1:3 (Ag mole ratio) of the large grain size emulsion C-1 and the small grain size emulsion C-2, the average grain size of the emulsion: 0.25 μm) | 0.08 |
| Gelatin | 1.25 |
| Magenta coupler (Ma-48) | 0.21 |
| Oleyl alcohol | 0.33 |
| Color image stabilizer (ST-21) | 0.04 |
| Color image stabilizer (ST-22) | 0.28 |
| Surfactant (SF-1) | 0.035 |
| Potassium chloride | 0.02 |
| Sodium phenylmercaptotetrazole | 0.0007 |
| **Fifth layer (Red-sensitive emulsion layer)** | |
| Emulsion E (gold-sulfur sensitized cubic form, a mixture in a ratio of 5:5 (Ag mole ratio) of the large grain size emulsion E-1 and the small grain size emulsion E-2, the average grain size of the emulsion: 0.19 (μm) | 0.14 |
| Gelatin | 1.36 |
| Cyan coupler (IC-23) | 0.30 |
| Ultraviolet absorber (UV-4) | 0.36 |
| Dibutyl sebacate | 0.44 |
| Solvent (tris(2-ethylhexyl) phosphate) | 0.15 |
| Sodium phenylmercaptotetrazole | 0.0005 |
| Surfactant (SF-1) | 0.05 |

Preparation of Sample No. 2103

A-sample 2103 was prepared in the same manner as Sample 2102, except that the composition of the third layer of Sample 2102 was changed as described below.

Third Layer (Green-Sensitive Emulsion Layer)

Emulsion C (gold-sulfur sensitized cubic form, a mixture in a ratio of 1:3 (Ag mole ratio) of the large grain size emulsion C-1 and the small grain size emulsion C-2, the average grain size of the emulsion: 0.25 μm) 0.08

| Third layer (Green-sensitive emulsion layer) | |
|---|---|
| Emulsion C (gold-sulfur sensitized cubic form, a mixture in a ratio of 1:3 (Ag mole ratio) of the large grain size emulsion C-1 and the small grain size emulsion C-2, the average grain size of the emulsion: 0.25 μm) | 0.08 |
| Gelatin | 1.25 |
| Magenta coupler (EXM) | 0.15 |
| Oleyl alcohol | 0.55 |
| Color image stabilizer (ST-21) | 0.04 |
| Color image stabilizer (ST-22) | 0.28 |
| Surfactant (SF-1) | 0.040 |
| Potassium chloride | 0.02 |
| Sodium phenylmercaptotetrazole | 0.0007 |

The compounds used in Example 2-1 and the above samples are shown below.

Y-1

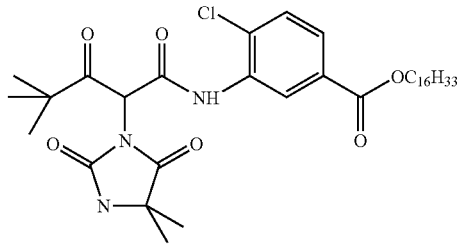

C-1

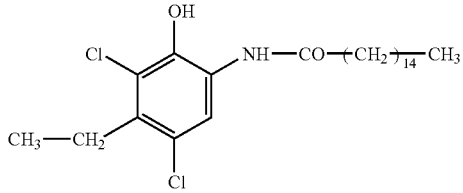

and

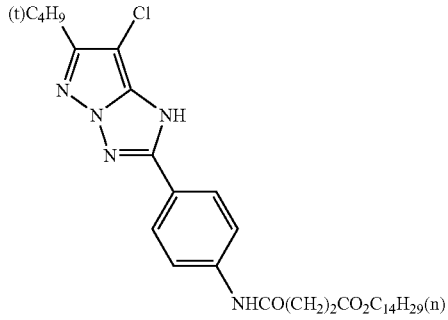

(EXM) Magenta coupler
A mixture in 50:50 (mol ratio)

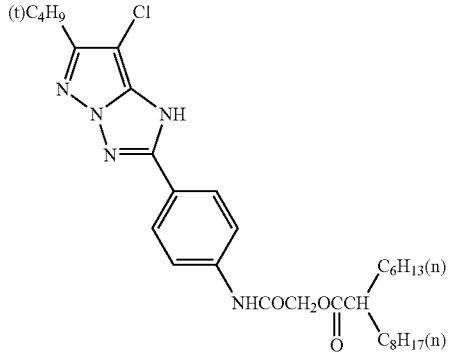

ST-5

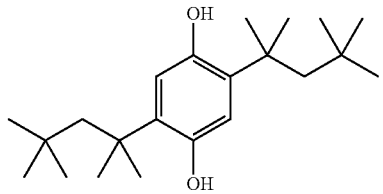

ST-8

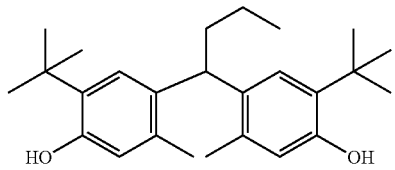

-continued
ST-16
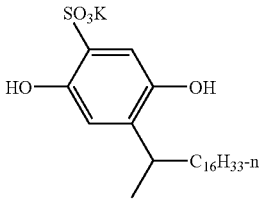
ST-21
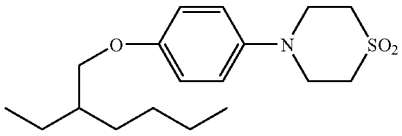
ST-22
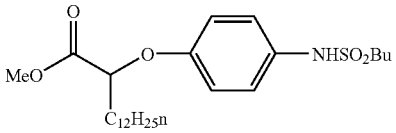
ST-23
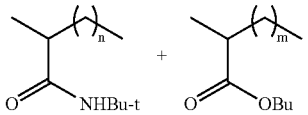
n:m 1:1 mw = 75–100,000
ST-24
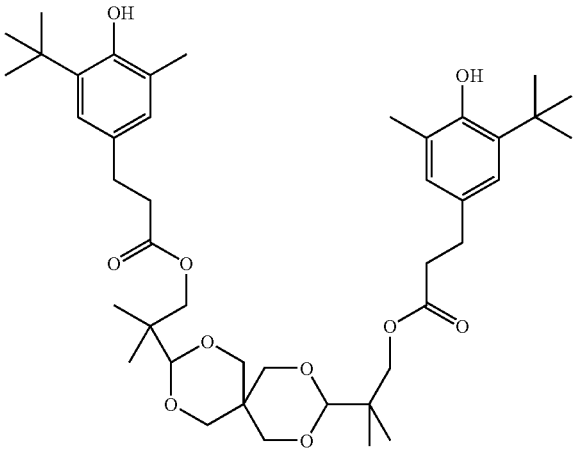
SF-2
SF-13
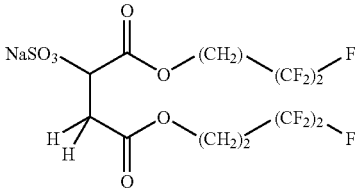
-continued
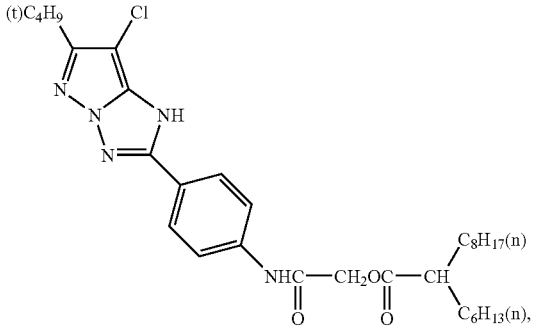
(Ex-M) Magenta coupler
A mixture in 40:40:20 (mol ratio) of
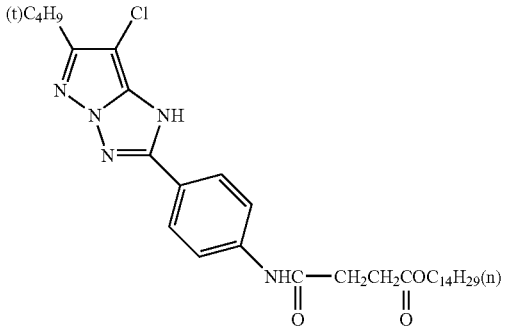
and
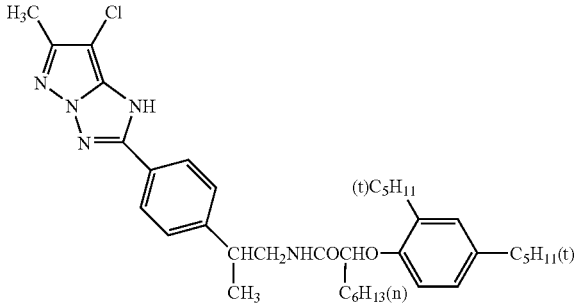
(Cpd-14)
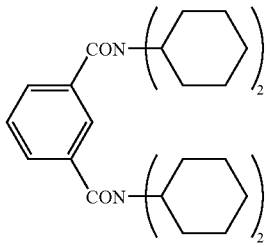
(Cpd-15)
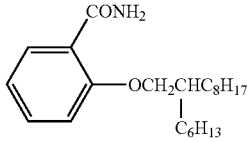
(Cpd-16)
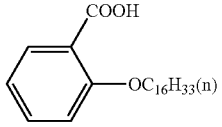

-continued (Cpd-17)

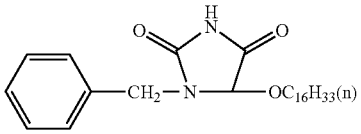

(Cpd-18)

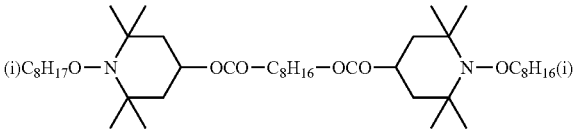

(Cpd-19)

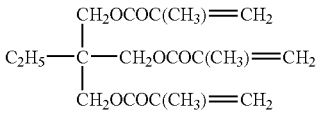

(Cpd-20)

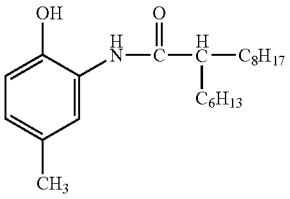

(Cpd-23)

KAYARAD DPCA-30
(trade name, manufactured
by Nippon Kayaku Co., Ltd.)

The light-sensitive material samples Nos. 2001-1 to 2001-2, 2002-1 to 2001-2, 2101-1 to 2101-8, 2102-1 to 2102-2, and 2103-1 to 2103-4 were prepared in the same manners as in the light-sensitive material sample Nos. 2001, 2002, 2101, 2102, and 2103, respectively, except that the magenta coupler in the third layer, and/or that the cyan coupler in the fifth layer were replaced by equimolar amounts of couplers as shown in Table 5, and/or that the total coating amounts of silver were changed as shown in Table 5. In changing the total coating amounts of silver, the coating silver amount in each layer was adjusted to keep the same ratio in silver among the layers, based on the ratio in Sample Nos. 2001, 2002, 2101, 2102, and 2103, respectively.

The following development processing test was made on each of the samples prepared in the foregoing manners.

Color-Photographic Processing A

Each of the light-sensitive material samples described above after providing the layers by coating, was worked into 127-mm-wide rolls, and stored for 10 days under a condition of 25° C.-55% RH. Then, each roll was cut into sheets in a minilab printer processor, Frontier 330 (trade name, manufactured by Fuji Photo Film Co., Ltd.), and continuous processing was performed using the following processing compositions in accordance with the following process steps until the volume of the color developer replenisher reached three times the volume of the color developing tank. This processing is referred to as Processing A. The conveyance speed in Frontier 330 was set at 27.9 mm/sec, and modifications were made to the Frontier 330 so as to render the conveyance speed variable. Further, adaptations were made on the processing racks used in a color developing tank, a bleach-fixing processing tank and rinse processing so as to meet the processing time conditions described below. In the thus adapted processor, each sheet was conveyed in the air between racks in rinsing tanks (1) and (2), between racks in rinsing tanks (2) and (3), and between racks in rinsing tanks (3) and (4), as is the case with Frontier 330.

<Processing condition-A>

| Processing step | Temperature | Time | Replenisher amount |
|---|---|---|---|
| Color development | 43.0° C. | 25 sec | 45 ml/m$^2$ |
| Bleach-fixing | 40.0° C. | 25 sec | Replenisher A 17.5 ml/m$^2$ Replenisher B 17.5 ml/m$^2$ |
| Rinse (1) | 45.0° C. | 5 sec | — |
| Rinse (2) | 45.0° C. | 5 sec | — |
| Rinse (3) | 45.0° C. | 5 sec | — |
| Rinse (4) | 45.0° C. | 5 sec | 175 ml/m$^2$ |
| Drying | 80° C. | 20 sec | |

| <Color developer> | Tank solution | Replenisher |
|---|---|---|
| Cation exchanged water | 800 ml | 800 ml |
| Dimethylpolysiloxane-series surfactant (Silicone KF351A (trade name), manufactured by Shin-Etsu Chemical Co., Ltd.) | 0.05 g | 0.05g |
| Potassium hydroxide | 4.0 g | 9.0 g |
| Sodium hydroxide | 2.0 g | 6.0 g |
| Ethylenediamine tetraacetic acid | 4.0 g | 4.0 g |
| Tylon | 0.5 g | 0.5 g |
| Potassium chloride | 9.0 g | — |
| Sodium bromide | 0.036g | — |
| P-1 (The compound described below) | 1.5 g | 2.9 g |
| SB-1 (The compound described below) | 3.5 g | 9.0 g |
| Sodium p-toluenesulfonate | 15.0 g | 15.0 g |
| Sodium sulfite | 0.2 g | 0.2 g |
| m-Carboxybenzenesulfinic acid | 2.0 g | 3.6 g |

-continued

| | | |
|---|---|---|
| Disodium-N,N-bis(sulfonatoethyl)hydroxylamine | 5.0 g | 10.8 g |
| N-ethyl-N-(β-methanesulfonamidoethyl)-3-methyl-4-aminoaniline.3/2 sulfate-1 hydrate | 6.7 g | 17.3 g |
| Potassium carbonate | 26.3 g | 26.3 g |
| Water to make | 1,000 ml | 1,000 ml |
| pH (25° C./adjusted using potassium hydroxide and sulfuric acid) | 10.12 | 10.26 |

| <Bleach-fixing solution> | Tank solution | Replenisher A | Replinisher B |
|---|---|---|---|
| Water | 650 ml | 300 ml | 300 ml |
| Ammonium thiosulfate (750 g/L) | 97.0 ml | — | 376.0 ml |
| Ammonium bisulfite (65%) | 13.0 g | — | 185.5 ml |
| Ammonium sulfite | 21.0 g | — | — |
| Ethylenediamine tetraacetate iron (III) ammonium | 37.0 g | 184.0 g | — |
| Ethylenediamine tetraacetic acid | 1.6 g | 0.4 g | 10.0 g |
| m-Carboxybenzenesulfinic acid | 3.0 g | 14.0 g | — |
| Nitric acid | 5.2 g | 25.0 g | — |
| Succinic acid | 6.7 g | 33.0 g | — |
| Imidazole | 1.3 g | — | — |
| Aqua ammonium (27%) | 3.4 g | — | 36.0 g |
| Water to make | 1,000 ml | 1,000 ml | 1,000 ml |
| pH (25° C./adjusted using ammonia and nitric acid) | 5.9 | 2.5 | 5.75 |

<Rinse solution>

| | |
|---|---|
| The tank solution was the same as the Replenisher | |
| Sodium chlorinated-isocyanurate | 0.02 g |
| Deionized water (conductivity: 5 μS/cm or less) | 1,000 ml |

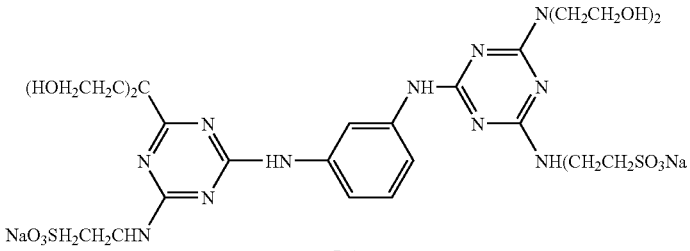

P-1

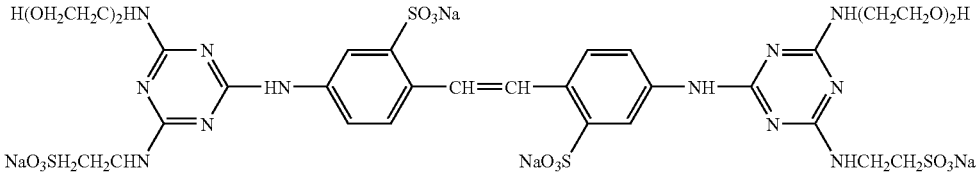

SB-1

The samples were also each subjected to the following Color-photographic processing B in the same manner as the above -described Processing A, and a processing-to-processing comparison was made.

Color-Photographic Processing B

After providing each layer by coating, each of the light-sensitive material samples described above was worked into 127-mm-wide rolls and stored for 10 days under a condition of 25° C-55% RH in the same manner as in the case with the Color-photographic processing A, and then exposed to light via standard photographic images by means of a digital minilab configured as shown in FIG. 1. Thereafter, continuous processing (running test) was performed, according to the following process steps (wherein the sheet-conveying speed was set at 45 mm/sec), until the volume of the color developer replenisher reached twice the volume of the color-developer tank.

| Processing step | Temperature | Time | Replenisher amount* |
|---|---|---|---|
| Color development | 43.0° C. | 17.8 sec | 45 mL |
| Bleach-fixing | 40.0° C. | 17.8 sec | 35 mL |
| Rinse (1) | 45.0° C. | 5.4 sec | — |
| Rinse (2) | 45.0° C. | 2.7 sec | — |
| Rinse (3) | 45.0° C. | 2.7 sec | — |
| Rinse (4) | 45.0° C. | 5.5 sec | 175 mL |
| Drying | 80° C. | 26 sec | |

(Note)
*Replenishment rate per $m^2$ of the light-sensitive material to be processed.
**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day.
***The drying time in the above is expressed in terms of the sum of a post-rinse squeegee time of 3 seconds, a drying-air-blowing time of 13 seconds, and a conveyance-to-drying-section-exit time of 10 seconds.

The same processing solutions as in Example 1-1 were -used.

In the digital minilab shown in FIG. 1, the exposed photosensitive material 10*a* was allocated so as to form a single line in the allocation section 9, and conveyed to the processor unit 4 in this example. A Di Controller (trade name) manufactured by Fuji Photo Film Co., Ltd. was linked to the digital data transmitted to the exposure section 8, and made so as to transmit electronic images to the exposure section as is the case with Frontier 330.

Each sample was subjected to gradation exposure to impart gray via the above processing by means of the exposure apparatus used in Example 1-1, and further to the foregoing color-photographic processing after a 5-second lapse from completion of the exposure.

With respect to each of the thus-prepared photosensitive material Sample Nos. 2001 to 2103-4, after performing a calibration operation 5 times by using the print processor as shown in FIG. 1 or Frontier 330, 300 sheets of uniform gray sample were made in 2L-size so as to have an R-density of 1.0, a G-density of 1.0, and a B-density of 1.0, when measured with an X-rite densitometer equipped with a reflection optical system defined by ISO-5 (including Status A-R, -G and -B filters). The image input data was made by using Photoshop (trade name) produced by Adobe Systems Incorporated, and each sample was allowed to stand together with the processor for one day under a condition of 25° C.-55% RH, and then the following tests were carried out thereon.

<Evaluation of Aging Stain by Storage at High Humidity>

Uniform gray samples made in L-size so as to have an R-density of 1.0, a G-density of 1.0 and a B-density of 1.0 when measured with the X-rite densitometer (including Status A-R, G and B filters) were output continuously for 6 hours, and immediately thereafter two sheets of L-size patch with white background were made using 8 bits×3 of data from Photoshop (trade name) produced by Adobe Systems Incorporated. The chromaticity value input to Photoshop for forming white background was set to [(R,G,B)=(255,255,255)]. One sheet was washed with water having a temperature of 40° C. for additional 5 minutes, squeezed and then dried at 50° C. The other unwashed sheet was stored together with the washed sheet for 30 days under a condition that the temperature and the humidity were kept at 40° C. and 70%, respectively. Density changes caused in R and G densities by the storage under the humid-and-hot condition, ΔR and ΔG, were each measured with the X-rite densitometer. Further, differences in ΔR and ΔG between the washed sheet and the unwashed sheet were calculated and symbolized by dΔR and dΔG, respectively. The greater difference between the washed sheet and the unwashed sheet, the more undesirable results are brought about. This is because the stain attributed to residues in a photosensitive material is the more increased and the white-background stability becomes the lower.

When a sample change was made and new patches with white background were prepared, the processing solutions were allowed to stand for 1 day for keeping the condition of the processing solutions constant.

The sheet conveyance speed was changed so that the sample to be tested had a specified linear speed. When the linear speed is increased, the number of sheets to be processed is increased on one hand, but on the other hand the time of each processing steps is shortened, thereby the lowering of developed color densities and the deterioration of white background tend to occur.

<Evaluation of the Number of Prints Per Hour>

By counting L-size prints produced in the above aging stain evaluation, the number of L-size prints per hour was calculated, which is adopted as the number of prints per unit time. The greater the number of prints per unit time, the more excellent the light-sensitive material sample and the processing are evaluated.

<Evaluation of Surface Glossiness>

For evaluation of glossiness of the printed samples, 2L-size black patches were prepared by inputting chromaticity values for forming black color ((R,G,B)=(0,0,0)) to Photoshop. Surface glossiness was examined by using, as a light source, a 1,000-lux fluorescent lamp for color evaluation (made by Toshiba Corporation). In a sensory evaluation, the printed patches were rated on 1-to-5 five-step scales ("5" being the best black color and the best glossiness, while "1" being whitish black and inferior glossiness).

<Evaluation of Developed Color Density>

In order to make sure that each sample satisfied the maximum developed-color density requirements set by each print system, color patches 3 cm x 3 cm in size were prepared separately by inputting chromaticity values for cyan pure color formation ((R,G,B)=(0,255,255)), chromaticity values for magenta pure color formation ((R,G,B)=(255,0,255), and chromaticity values for yellow pure color formation ((R,G, B)=(255,255,0)) to Photoshop. Immediately after print formation, it was ascertained with X-rite that those colors had the same density.

Evaluation results of those tests are shown in Table 5.

TABLE 5

| Sample No. | Number of original samples to which modification was made | Cyan coupler in fifth layer | Magenta coupler in third layer | Coating amount of silver ($g/m^2$) | Color photographic processing | Linear speed throughout processing (mm/sec) | dΔR | dΔG | Number of prints per unit time | Surface glossiness |
|---|---|---|---|---|---|---|---|---|---|---|
| 2001 | — | C-1 | Ma-7 | 0.53 | A | 27.9 | 0.029 | 0.018 | 900 | 4 |
| 2001-1 | 2001 | " | " | " | A | 19.9 | 0.011 | 0.015 | 650 | 5 |
| 2001-2 | 2001 | " | " | " | B | 45.0 | 0.039 | 0.021 | 1485 | 2 |
| 2002 | — | ExC-1, ExC-2, ExC-3 | EXM | 0.51 | A | 27.9 | 0.031 | 0.015 | 900 | 4 |
| 2002-1 | 2002 | " | " | " | A | 19.9 | 0.029 | 0.010 | 650 | 5 |
| 2002-2 | 2002 | " | " | " | B | 45.0 | 0.045 | 0.020 | 1485 | 2 |
| 2101-1 | 2101 | IC-23, IC-24 | Ma-48 | 0.53 | A | " | 0.039 | 0.020 | " | 2 |
| 2101-2 | " | " | " | 0.49 | A | " | 0.040 | 0.019 | " | 2 |
| 2101-3 | " | " | " | 0.53 | B | " | 0.011 | 0.010 | " | 4 |
| 2101-4 | " | " | " | 0.49 | B | " | 0.008 | 0.006 | " | 4 |
| 2101-5 | " | " | Ma-1 | 0.42 | B | " | 0.006 | 0.003 | " | 5 |
| 2101-6 | " | " | Ma-47 | " | B | " | 0.007 | 0.004 | " | 4 |
| 2101-7 | " | IC-22 | Ma-25 | " | B | " | 0.005 | 0.003 | " | 4 |
| 2101-8 | " | IC-6 | Ma-21 | 0.40 | B | " | 0.004 | 0.003 | " | 5 |
| 2102 | — | IC-23 | Ma-48 | 0.42 | B | " | 0.006 | 0.005 | " | 5 |
| 2102-1 | 2102 | " | Ma-25 | " | B | " | 0.004 | 0.003 | " | 5 |
| 2102-2 | " | " | Ma-21 | " | B | " | 0.003 | 0.002 | " | 4 |
| 2103 | — | IC-23 | EXM | 0.42 | B | " | 0.003 | 0.004 | " | 5 |
| 2103-1 | 2103 | " | Ma-25 | 0.40 | B | " | 0.004 | 0.003 | " | 5 |
| 2103-2 | " | IC-22 | Ma-21 | " | B | " | 0.004 | 0.002 | " | 5 |
| 2103-3 | " | IC-6 | Ma-47 | " | B | " | 0.005 | 0.005 | " | 4 |
| 2103-4 | " | IC-29 | Ma-49 | 0.53 | B | " | 0.007 | 0.004 | " | 4 |

As can be seen from the results shown in Table 5, Sample Nos. 2001, 2001-2, 2002, 2002-1 and 2002-2 each for comparison had conspicuous rises in the stain defined as dΔR and suffered deterioration in surface glossiness when the number of prints per unit time was increased. Further, the data set forth in Table 5 indicates that, though it had good dΔR and surface glossiness, Sample No. 2001-1 for comparison had a problem of being inferior in the number of prints per unit time. In addition, it is shown that, when the number of prints per unit time was increased, Sample Nos. 2101-1 and 2101-2 for comparison, though contained diacylamino-type phenol couplers represented by formula (IA) in their respective fifth layers, had no substantial improvements and remained as they had inferior surface glossiness.

Contrary to the above, the results shown in Table 5 demonstrate that the embodiments according to the present invention, specifically those in which the samples according to the present invention (Sample Nos. 2101-3 to 2103-4) containing diacylamino-type phenol couplers in their respective fifth layers as cyan couplers, were subjected to the Color-photographic processing B and printing thereon was performed with high productivity under the increased linear speed, achieved both substantial improvements in dΔR and enhancement of surface glossiness. Likewise, the results have proved that the present embodiments achieved substantial improvements in dΔG also.

Notably in Sample Nos. 2101-4 to 2103-3 having the total silver coating amount reduced to 0.50 $g/m^2$ or below, it has been found that greater improvements in dΔR and dΔG were achieved than in the sample No. 2101-3.

Example 2-2

Samples were prepared in the same manner as in Example 2-1, except that the composition of the first layer was changed as shown below. The thus-prepared samples were subjected to the tests and evaluations in the same manner as in Example 2-1, to bring about the similar results as in Example 2-1.

| First layer (Blue-sensitive layer) | |
|---|---|
| Emulsion A (gold-sulfur sensitized cubic form, a mixture in a ratio of 3:7 (Ag mole ratio) of the large grain size emulsion A-1 and the small grain size emulsion A-2; the average grain size of the emulsion, 0.15 μm) | 0.20 |
| Yellow coupler (Y-2) | 0.45 |
| Color image stabilizer (ST-25) | 0.05 |
| Color image stabilizer (ST-26) | 0.05 |
| Color image stabilizer (ST-24) | 0.10 |
| 2,5-di-t-octylhydroquinone | 0.005 |
| p-t-Octylphenol | 0.08 |
| Poly(t-butylacrylamide) | 0.04 |
| Di-nonyl phthalate | 0.05 |
| Di-butyl phthalate | 0.15 |

-continued

First layer (Blue-sensitive layer)

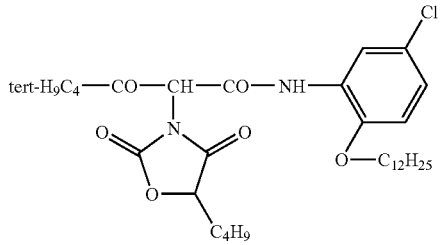

Y-2

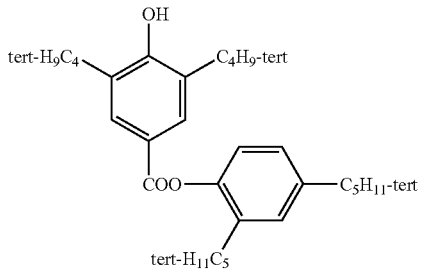

ST-25

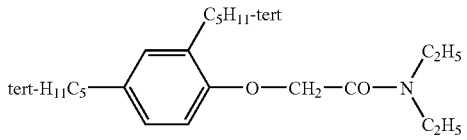

ST-26

Example 2-3

Samples were prepared in the same manner as in Example 2-1, except that the composition of the first layer was changed as shown below. The thus-prepared samples were subjected to the tests and evaluations in the same manner as in Example 2-1, to bring about the similar results as in Example 2-1.

First Layer (Blue-Sensitive Emulsion Layer)

Emulsion A (gold-sulfur sensitized cubic form, a mixture in a ratio of 3:7 (Ag mole ratio) of the large grain size emulsion A-1 and the small grain size emulsion A-2, the average grain size of the emulsion: 0.15 μm) 0.16

| | |
|---|---|
| Gelatin | 1.32 |
| Yellow coupler (Ex-Y) | 0.34 |
| Color image stabilizer (Cpd-1) | 0.01 |
| Color image stabilizer (Cpd-2) | 0.01 |
| Color image stabilizer (Cpd-8) | 0.08 |
| Color image stabilizer (Cpd-18) | 0.01 |
| Color image stabilizer (Cpd-19) | 0.02 |
| Color image stabilizer (Cpd-20) | 0.15 |
| Color image stabilizer (Cpd-21) | 0.01 |
| Color image stabilizer (Cpd-23) | 0.15 |
| Additive (ExC-1) | 0.001 |
| Color image stabilizer (UV-A) | 0.01 |
| Solvent (Solv-4) | 0.23 |

-continued

| | |
|---|---|
| Solvent (Solv-6) | 0.04 |
| Solvent (Solv-9) | 0.23 |

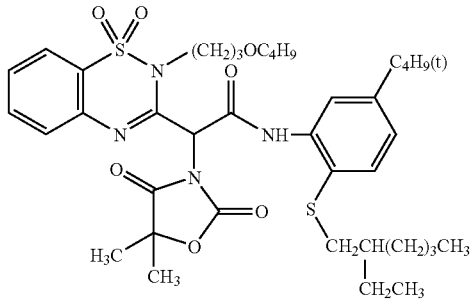

(Ex-Y) Yellow coupler

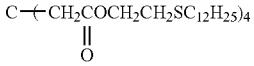

(Cpd-21)

Example 3-1

(Preparation of Blue-Sensitive Layer Emulsion BH-31)

Using a method of adding silver nitrate, sodium chloride, and potassium bromide (0.5 mol% per mol of the finished silver halide) simultaneously to a deionized distilled water containing a deionized gelatin to mix these, under stirring, cubic high silver chloride grains were prepared. In the course of this preparation, $Cs_2[OsCl_5(NO)]$ was added, over the step of from 60% to 80% addition of the entire silver nitrate amount. Over the step of from 80% to 90% addition of the entire silver nitrate amount, $K_4[Fe(CN)_6]$ was added. Over the step of from 83% to 88% addition of the entire silver nitrate amount, $K_2[IrCl_6]$ was added. At the completion of 94% addition of the entire silver nitrate amount, potassium iodide (0.27 mol % per mol of the finished silver halide) was added under vigorous stirring. The thus-obtained emulsion grains were monodisperse cubic silver iodobromochloride grains having a side length of 0.50 μm and a variation coefficient of 8.5%. After flocculation desalting treatment, gelatin, Compounds Ab-1, Ab-2, and Ab-3, and calcium nitrate were added to the resulting emulsion for re-dispersion.

The re-dispersed emulsion was dissolved at 40° C., and sensitizing dye SD-1, sensitizing dye SD-2, and sensitizing dye SD-3 were added for optimal spectral sensitization. Then, the resulting emulsion was ripened by adding sodium benzenethiosulfate, triethylthiourea as a sulfur sensitizer, and Compound-1 as a gold sensitizer, for optimal chemical sensitization. Further, 1-(5-acetamidophenyl)-5-mercaptotetrazole; a mixture whose major components are compounds represented by Compound-3 in which the repeating unit (n) is 2 or 3 (both ends $X_1$ and $X_2$ are each a hydroxyl group); Compound-4, and potassium bromide were added, to finalize chemical sensitization. The thus-obtained emulsion was referred to as Emulsion BH-31.

(Preparation of Blue-Sensitive Layer Emulsion BL-31)

Emulsion grains were prepared in the same manner as in the preparation of Emulsion BH-31, except that the temperature and the addition speed at the step of mixing silver nitrate, sodium chloride, and potassium bromide (0.5 mol % per mol of the finished silver halide) by simultaneous addition were changed, and that the amounts of respective metal complexes that were to be added during the addition of the silver nitrate, sodium chloride, and potassium bromide were changed. The thus-obtained emulsion grains were monodisperse cubic silver iodobromochloride grains having a side length of 0.44 μm and a variation coefficient of 9.8%. After re-dispersion of this emulsion, Emulsion BL-31 was prepared in the same manner as Emulsion BH-31, except that the-amounts-of various compounds to be added in the preparation of BH-31 were changed so as to become the same amounts per unit area as those in Emulsion BH-31, respectively.

(Preparation of Green-Sensitive Layer Emulsion GH-31)

Cubic high silver chloride grains were prepared in the same manner as the cubic high silver chloride grains used in the green sensitive emulsion GH-11 in Example 1-1. The resulting emulsion was subjected to flocculation desalting treatment and re-dispersing treatment in the same manner as described in the above.

This emulsion was dissolved at 400C, and sodium benzenethiosulfate, p-glutaramidophenyidisulfide, sodium thiosulfate pentahydrate as a sulfur sensitizer, and (bis(1,4,5-trimethyl-1,2,4triazolium-3-thiorato) aurate (I) tetrafluoroborate) as a gold sensitizer were added, and the emulsion was subjected to ripening for optimal chemical sensitization. Thereafter, 1-(5-acetoamidophenyl)-5-mercaptotetrazole, Compound-3, Compound4, and potassium bromide were added. Further, in a midway of the emulsion preparation process, Sensitizing dyes SD-4, SD-5, SD6, and SD-7 were added as sensitizing dyes, to conduct spectral sensitization. The thus-obtained emulsion was referred to as Emulsion GH-31.

(Preparation of Green-Sensitive Layer Emulsion GL-31)

Emulsion grains were prepared in the same manner as in the preparation of Emulsion GH-31, except that the temperature and the addition speed at the step of mixing silver nitrate, sodium chloride, and potassium bromide (2 mol % per mol of the finished silver halide) by simultaneous addition were changed, and that the amounts of respective metal complexes that were to be added in the course of the addition of silver nitrate, sodium chloride, and potassium bromide were changed. The thus-obtained emulsion grains were monodisperse cubic silver iodobromochloride grains having a side length of 0.37 μm and a variation coefficient of 9.8%. After re-dispersion of this emulsion, Emulsion GL-31 was prepared in the same manner as Emulsion GH-31, except that the amounts of various compounds to be added in the preparation of Emulsion GH-31 were changed.

(Preparation of Red-Sensitive Layer Emulsion RH-31)

Cubic high silver chloride grains were prepared in the same manner as the cubic high silver chloride grains used in the red-sensitive-layer emulsion RH-11 in Example 1-1. The thus-obtained emulsion grains were monodisperse cubic silver iodobromochloride grains having a cubic side length of 0.39 μm and a variation coefficient of 10%. The resulting emulsion was subjected to flocculation desalting treatment and re-dispersing treatment in the same manner as described in the above.

This emulsion was dissolved at 40° C., and Sensitizing dye SD-8, Compound-5, triethylthiourea as a sulfur sensitizer, and the above-described Compound-1 as a gold sensitizer were added, and the resulting emulsion was ripened for optimal chemical sensitization. Thereafter, 1-(5-acetoamidophenyl)-5-mercaptotetrazole, Compound-3, Compound4, and potassium bromide were added. The thus-obtained emulsion was referred to as Emulsion RH-31.

(Preparation of Red-Sensitive Layer Emulsion RL-31)

Emulsion grains were prepared in the same manner as in the preparation of Emulsion RH-31, except that the temperature and the addition speed at the step of mixing silver nitrate, sodium chloride, and potassium bromide by simultaneous addition were changed, and that the amounts of respective metal complexes that were to be added in the course of the addition of silver nitrate, sodium chloride, and potassium bromide were changed. The thus-obtained emulsion grains were monodisperse cubic silver iodobromochloride grains having a side length of 0.34 μm and a variation coefficient of 9.8%. After re-dispersion of this emulsion, Emulsion RL-31 was prepared in the same manner as Emulsion RH-31, except that the amounts of various compounds to be added in the preparation of Emulsion RH-31 were changed in amounts so as to become the same amounts per unit area as those in Emulsion RH-31, respectively.

(Preparation of a Coating Solution for the First Layer)

Into 23 g of a solvent (Solv-4), 4 g of a solvent (Solv-6), 23 g of a solvent (Solv-9), and 60 ml of ethyl acetate, were dissolved 34 g of a yellow coupler (Ex-Y), 1 g of a color-image stabilizer (Cpd-1), 1 g of a color-image stabilizer (Cpd-2), 8 g of a color-image stabilizer (Cpd-8), 1 g of a color-image stabilizer (Cpd-18), 2 g of a color-image stabilizer (Cpd-19), 15 g of a color-image stabilizer (Cpd-20), 1 g of a color-image stabilizer (Cpd-21), 15 g of a color-image stabilizer (Cpd-23), 0.1 g of an additive (ExC-5), and 1 g of a color-image stabilizer (UV-A). This solution was emulsified and dispersed in 270 g of a 20 mass % aqueous gelatin solution containing 4 g of sodium dodecylbenzenesulfonate, with a high-speed stirring emulsifier (dissolver). Then, water was added thereto, to prepare 900 g of Emulsified Dispersion A.

Separately, the above-described Emulsified Dispersion A, and the above-described Emulsions BH-31 and BL-31 were mixed and dissolved, to prepare a coating solution for the first layer having the composition shown below. The coating amounts of the emulsions are in terms of silver.

The coating solutions for the second to seventh layers were prepared in the similar manner as the coating solutions for the second to seventh layers prepared in Example 1-1, except that (HA-11), (H-6), and (H-8) were used as gelatin hardeners in each layer.

These emulsions were prepared in the same manner in Example 1-1, except that, in place of I-(3-methylureidophenyl)-5-mercaptotetrazole, 1-(5-acetamidophenyl)-5-mercaptotetrazole was added to the second, the fourth and the sixth layers in amounts such that the sum total of these amounts and the amounts of 1-(5-acetamidophenyl)-5-mercaptotetrazole used in the blue-, the green- and red-sensitive emulsions reached 0.5 mg/m$^2$.

(Layer Constitution)

The composition of each layer is shown below. The numbers show coating amounts (g/m$^2$). In the case of the silver halide emulsion, the coating amount is in terms of silver.

Support

Polyethylene-resin-laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %), and a bluish dye (ultramarine, content of 0.33 mass %); and the amount of the polyethylene resin was 29.2 g/m$^2$.}

| | |
|---|---|
| First layer (Blue-sensitive emulsion layer) | |
| Emulsion | 0.16 |
| (a 5:5 mixture of BH-31 and BL-31 (mol ratio of silver)) | |
| Gelatin | 1.32 |
| Yellow coupler (Ex-Y) | 0.34 |
| Color image stabilizer (Cpd-1) | 0.01 |
| Color image stabilizer (Cpd-2) | 0.01 |
| Color image stabilizer (Cpd-8) | 0.08 |
| Color image stabilizer (Cpd-18) | 0.01 |
| Color image stabilizer (Cpd-19) | 0.02 |
| Color image stabilizer (Cpd-20) | 0.15 |
| Color image stabilizer (Cpd-21) | 0.01 |
| Color image stabilizer (Cpd-23) | 0.15 |
| Additive (ExC-5) | 0.001 |
| Color image stabilizer (UV-A) | 0.01 |
| Solvent (Solv-4) | 0.23 |
| Solvent (Solv-6) | 0.04 |
| Solvent (Solv-9) | 0.23 |
| Second layer (Color-mixing-inhibiting layer) | |
| Gelatin | 0.78 |
| Color-mixing inhibitor (Cpd-4) | 0.05 |
| Color-mixing inhibitor (Cpd-12) | 0.01 |
| Color image stabilizer (Cpd-5) | 0.006 |
| Color image stabilizer (Cpd-6) | 0.05 |
| Color image stabilizer (UV-A) | 0.06 |
| Color image stabilizer (Cpd-7) | 0.006 |
| Antiseptic (Ab-3) | 0.006 |
| Solvent (Solv-1) | 0.06 |
| Solvent (Solv-2) | 0.06 |
| Solvent (Solv-5) | 0.07 |
| Solvent (Solv-8) | 0.07 |
| Third layer (Green-sensitive emulsion layer) | |
| Emulsion | 0.12 |
| (a 1:3 mixture of GH-31 and GL-31 (mol ratio of silver)) | |
| Gelatin | 0.95 |
| Magenta coupler (Ex-M) | 0.12 |
| Ultraviolet absorber (UV-A) | 0.03 |
| Color image stabilizer (Cpd-2) | 0.01 |
| Color image stabilizer (Cpd-6) | 0.08 |
| Color image stabilizer (Cpd-7) | 0.005 |
| Color image stabilizer (Cpd-8) | 0.01 |
| Color image stabilizer (Cpd-9) | 0.01 |
| Color image stabilizer (Cpd-10) | 0.005 |
| Color image stabilizer (Cpd-11) | 0.0001 |
| Color image stabilizer (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.16 |
| Fourth layer (Color-mixing-inhibiting layer) | |
| Gelatin | 0.65 |
| Color-mixing inhibitor (Cpd-4) | 0.04 |
| Color-mixing inhibitor (Cpd-12) | 0.01 |
| Color image stabilizer (Cpd-5) | 0.005 |
| Color image stabilizer (Cpd-6) | 0.04 |
| Color image stabilizer (UV-A) | 0.05 |
| Color image stabilizer (Cpd-7) | 0.005 |
| Antiseptic (Ab-3) | 0.005 |
| Solvent (Solv-1) | 0.05 |
| Solvent (Solv-2) | 0.05 |
| Solvent (Solv-5) | 0.06 |
| Solvent (Solv-8) | 0.06 |
| Fifth layer (Red-sensitive emulsion layer) | |
| Emulsion | 0.10 |
| (a 4:6 mixture of RH-31 and RL-31 (mol ratio of silver)) | |
| Gelatin | 1.11 |
| Cyan coupler (ExC-5) | 0.11 |
| Cyan coupler (ExC-2) | 0.01 |
| Cyan coupler (ExC-3) | 0.04 |
| Color image stabilizer (Cpd-1) | 0.03 |
| Color image stabilizer (Cpd-7) | 0.01 |
| Color image stabilizer (Cpd-9) | 0.04 |
| Color image stabilizer (Cpd-10) | 0.001 |
| Color image stabilizer (Cpd-14) | 0.001 |

-continued

| | |
|---|---|
| Color image stabilizer (Cpd-15) | 0.18 |
| Color image stabilizer (Cpd-16) | 0.002 |
| Color image stabilizer (Cpd-17) | 0.001 |
| Color image stabilizer (Cpd-18) | 0.05 |
| Color image stabilizer (Cpd-19) | 0.04 |
| Color image stabilizer (UV-5) | 0.10 |
| Solvent (Solv-5) | 0.19 |
| Sixth layer (Ultraviolet absorbing layer) | |
| Gelatin | 0.34 |
| Ultraviolet absorber (UV-B) | 0.24 |
| Compound (S1-4) | 0.0015 |
| Solvent (Solv-7) | 0.11 |
| Seventh layer (Protective layer) | |
| Gelatin | 0.82 |
| Additive (Cpd-22) | 0.03 |
| Liquid paraffin | 0.02 |
| Surfactant (Cpd-13) | 0.02 |

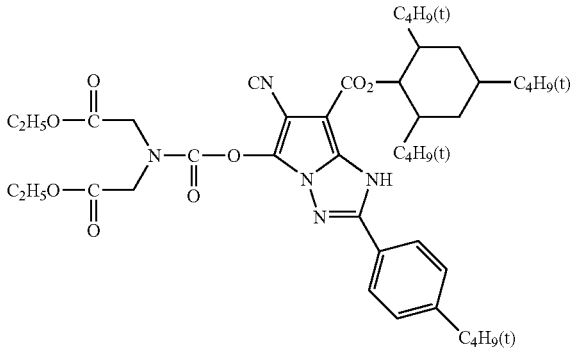

(ExC-5) Cyan coupler

The thus-prepared sample was referred to as Sample No. 3101. Further, other coating samples, Sample Nos. 3102 to 3108, were prepared in the same manner as Sample No. 3101, except that 1-(5-acetamidophenyl)-5-mercaptotetrazole used in the emulsions constituting the second, the fourth and the sixth layers was replaced with the compounds shown in Table 6, respectively, and/or the amount thereof was adjusted to the values shown in Table 6, respectively.

TABLE 6

| Coating sample | Chemical species used | Amount of compound used |
|---|---|---|
| 3101 | 1-(5-Acetoamidophenyl)-5-mercaptotetrazole | 0.5 mg/m$^2$ |
| 3102 | Compound A-1 | " |
| 3103 | Compound 1-6 | " |
| 3104 | 1-Phenyl-5-mercaptotetrazole | " |
| 3105 | 1-(5-Acetoamidophenyl)-5-mercaptotetrazole | 1.5 mg/m$^2$ |
| 3106 | Compound A-1 | " |
| 3107 | Compound 1-2 | " |
| 3108 | " | 1.9 mg/m$^2$ |

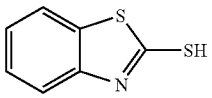

Compound A-1

Each of Sample Nos. 3101 to 3108 was worked into 127-mm-wide rolls, followed by subjecting to uniform gray exposure by means of a testing machine made by modifying a digital minilab, Frontier 350 (trade name, manufactured by Fuji Photo Film Co., Ltd.). The laser light sources used herein were a blue laser of 473 nm, which was a second harmonic generating light source (SHG) including a combination of a nonlinear optical crystal with a solid state laser using a semiconductor laser as an excitation light source; a green laser of 532 nm; and a red semiconductor laser of about 685 nm (Hitachi Type No. HL6738MG). Each laser light of three colors moved perpendicularly to a scanning direction by a polygon mirror such that they would carry out sequential-scanning exposure on the sample. The change of light quantity of the semiconductor laser that could be caused by the temperature change was prevented by using a Peltier device and by keeping the temperature constant. An effectual beam diameter was 80 μm, a scanning pitch was 42.3 μm (600 dpi), and the average exposure time per pixel was $7\times10$ to $8\times10^{-8}$ sec. Calibration for standard gray output was carried out in advance, and, on the basis of calibration data thus obtained, exposures were controlled so as to provide each sample with the uniform gray density.

Continuous processing (running test) was performed using Sample No. 3101 according to the following process steps until the volume of the color-developer replenisher reached twice the volume of the color-developer tank: The processing solution obtained by the foregoing continuous processing was referred to as Processing Solution A.

| Processing step | Temperature | Time | Replenisher* amount |
|---|---|---|---|
| Color development | 45.0° C. | 17 sec | 35 mL |
| Bleach-fixing | 40.0° C. | 17 sec | 30 mL |
| Rinse (1) | 45.0° C. | 4 sec | — |
| Rinse (2) | 45.0° C. | 4 sec | — |
| Rinse (3)** | 45.0° C. | 3 sec | — |
| Rinse (4) | 45.0° C. | 5 sec | 121 mL |
| Drying | 80° C. | 15 sec | |

(Note)
*Replenishment rate per $m^2$ of the light-sensitive material to be processed.
**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated inthe reverse osmosis module would be maintained in an amount of 50 to 300 ml/min, and the rinse solution was circulated under controlled temperature for 10 hours a day. The rinse was made in a four-tank counter-current system from (1) to (4).

The same processing solutions used in Example 1-1 were used.

In the processor unit of a digital minilab printer processor, Frontier 350 (trade name) manufactured by Fuji Photo Film Co., Ltd., modifications were made to the racks constituting the conveyance section so as to enable changes in conveyance speed, and thereby it became possible to set the color-development time and the bleach-fix time at respectively fixed length. Further, modifications were also made to the racks having staggered-format rollers in the roller part so as to make the conveyance speed variable. For the purpose of making evaluations of abrasion property (sensitivity modification) at a wet condition, protuberances were bonded to the rack surface in each conveyance section so that the silver halide emulsion-coated side of each coating sample was brought into contact with the rack surface with high reproducibility, and each coating sample was conveyed at variously changed speeds. Accordingly, evaluation was made on abrasion property at a wet condition at each conveyance speed. Herein, the processing was performed via the same processing steps as mentioned above, except that Processing Solution A was used and the conveyance speed was changed. For evaluation of each coating sample, 5 sheets measuring 127mm×254mm in size were subjected to the processing, and sensory evaluations of their abrasion property at a wet condition were made according to the criterion described below:

◎: Sensitization or desensitization by abrasion in wet state was hardly observed.

○: Sensitization or desensitization by abrasion in wet state was slightly observed, but negligible.

Δ: Sensitization or desensitization by abrasion in wet state was observed, but it was on a practically acceptable level.

X: Sensitization or desensitization by abrasion in wet state was observed to a considerable extent, and it was on an obtrusive level, which was practically unacceptable.

XX: Very strong sensitization or desensitization by abrasion in wet state was observed.

The evaluation results obtained are shown in Table 7.

TABLE 7

| Coating sample | Conveyance method | Wet abrasion under each conveyance speed 20 mm/sec | 45 mm/sec | 60 mm/sec | Conveyance consistency |
|---|---|---|---|---|---|
| 3101 | Staggered-format roller conveyance | ○ | Δ | XX | Slight processing unevenness resulted |
| 3101 | Roller pair conveyance | Δ | Δ | XX | No processing unevenness developed |
| 3102 | The same to the above | Δ | X | XX | No processing unevenness developed |
| 3103 | The same to the above | ○ | Δ | Δ | No processing unevenness developed |
| 3104 | The same to the above | ○ | X | X | No processing unevenness developed |
| 3105 | The same to the above | ○ | Δ | Δ | No processing unevenness developed |
| 3106 | The same to the above | ○ | X | XX | No processing unevenness developed |
| 3107 | The same to the above | ○ | ○ | ○ | No processing unevenness developed |
| 3108 | The same to the above | ◎ | ○ | ○ | No processing unevenness developed |

Even when the productivity per unit time was enhanced by high-speed conveyance in the high-speed conveyance-type processing system of the present example, it has been demonstrated that the use of the compounds represented by formula (I) prevented processing unevenness from occurring and produced improvements in wet abrasion resistance of the resulting light-sensitive materials. Further, it has been shown that the use of the compounds represented by formula (II) according to the present invention (preferably the fourth embodiment of the present invention) also yielded improvements in wet abrasion property under high-speed conveyance conditions as far as they were used in amounts of 1.4 mg/$m^2$ or greater. In addition, it has been found that the compounds represented by formula (I) in particular had great improvement effects.

Example 3-2

The present coating Sample Nos. 3103, 3105, 3107 and 3108 prepared in Example 3-1 were each exposed to laser light based on image information by use of the testing machine used in Example 3-1, namely the digital minilab Frontier 350 to which the modifications were made, followed by subjecting to processing under the condition that the color-development time was set at 17 seconds as was the case with Example 3-1. As a result, it has been shown that images of good quality were obtained and the test results on wet abrasion property under high-speed conveyance conditions were excellent.

Example 4-1

(Preparation of Blue-Sensitive Layer Emulsion BH-41)

Using a method of adding silver nitrate, sodium chloride, and potassium bromide (0.5 mol % per mol of the finished silver halide) simultaneously to a deionized distilled water containing a deionized gelatin to mix these, under stirring, cubic high silver chloride grains were prepared. In the course of this preparation, $Cs_2[OsCl_5(NO)]$ was added, over the step of from 60% to 80% addition of the entire silver nitrate amount. Over the step of from 80% to 90% addition of the entire silver nitrate amount, $K_4[Fe(CN)_6]$ was added. Over the step of from 83% to 88% addition of the entire silver nitrate amount, $K_2[IrCl_6]$ was added. The thus-obtained emulsion grains were monodisperse cubic silver bromochloride grains having a side length of 0.68 μm and a variation coefficient of 8.5%. After flocculation desalting treatment, gelatin, Compounds Ab-1, Ab-2, and Ab-3, and calcium nitrate were added to the resulting emulsion for re-dispersion.

The re-dispersed emulsion was dissolved at 40° C., and the sensitizing dye SD-1, the sensitizing dye SD-2, and the sensitizing dye SD-3 were added for optimal spectral sensitization. Then, the resulting emulsion was ripened by adding sodium benzene thiosulfate, triethylthiourea as a sulfur sensitizer, and Compound-1 as a gold sensitizer, for optimal chemical sensitization. Then, 1-(5-methylureidophenyl)-5-mercaptotetrazole; Compound-2; a mixture whose major components were compounds represented by Compound-3 in which the repeating unit (n) was 2 or 3 (both ends $X_1$ and $X_2$ were each a hydroxyl group); Compound-4, and potassium bromide were added, to finalize chemical sensitization. The thus-obtained emulsion was referred to as Emulsion BH41.

(Preparation of Blue-Sensitive Layer Emulsion BL-41)

Emulsion grains were prepared in the same manner as in the preparation of Emulsion BH-41, except that the temperature and the addition speed at the step of mixing silver nitrate, sodium chloride, and potassium bromide (0.5 mol % per mol of the finished silver halide) by simultaneous addition were changed, and that the amounts of respective metal complexes that were to be added in the course of the addition of silver nitrate, sodium chloride, and potassium bromide were changed. The thus-obtained emulsion grains were monodisperse cubic silver bromochloride grains having a side length of 0.59 μm and a variation coefficient of 9.5%. After re-dispersion of this emulsion, Emulsion BL-41 was prepared in the same manner as Emulsion BH-41, except that the amounts of various compounds to be added in the preparation of Emulsion BH-41 were changed.

(Preparation of Blue-Sensitive Layer Emulsion BH-42)

Using a method of adding silver nitrate and sodium chloride simultaneously to a deionized distilled water containing a deionized gelatin to mix these, under stirring, cubic high silver chloride grains were prepared. In the course of this preparation, $Cs_2[OsCl_5(NO)]$ was added, over the step of from 60% to 80% addition of the entire silver nitrate amount. Over the step of from 83% to 95% addition of the entire silver nitrate amount, potassium bromide (1.5 mol % per mol of the finished silver halide) and $K_4[Fe(CN)_6]$ were added. Over the step of from 83% to 88% addition of the entire silver nitrate amount, $K_2[IrCl_6]$ was added. The thus-obtained emulsion grains were monodisperse cubic silver bromochloride grains having a side length of 0.64 μm and a variation coefficient of 8.5%. After flocculation desalting treatment, gelatin, Compounds Ab-1, Ab-2, and Ab-3, and calcium nitrate were added to the resulting emulsion for re-dispersion The re-dispersed emulsion was dissolved at 40° C., and the sensitizing dye SD-1, the sensitizing dye SD-2, and the sensitizing dye SD-3 were added for optimal spectral sensitization. Then, the resulting emulsion was ripened by adding sodium benzene thiosulfate, triethylthiourea as a sulfur sensitizer, and Compound-1 as a gold sensitizer, for optimal chemical sensitization. Then, 1-(5-methylureidophenyl)-5-mercaptotetrazole; Compound-2; a mixture whose major components were compounds represented by Compound-3 in which the repeating unit (n) was 2 or 3 (both ends $X_1$ and $X_2$ were each a hydroxyl group); Compound4, and potassium bromide were added, to finalize chemical sensitization. The thus-obtained emulsion was referred to as Emulsion BH-42.

(Preparation of Blue-Sensitive Layer Emulsion BL-42)

Emulsion grains were prepared in the same manner as in the preparation of Emulsion BH-42, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver bromochloride grains having a side length of 0.54 μm and a variation coefficient of 9.5%. After re-dispersion of this emulsion, Emulsion BL-42 was prepared in the same manner as Emulsion BH-42, except that the amounts of various compounds to be added in the preparation of Emulsion BH-42 were changed.

(Preparation of Blue-Sensitive Layer Emulsion BH-43)

Using a method of adding silver nitrate, sodium chloride, and potassium bromide (0.5 mol % per mol of the finished silver halide) simultaneously to a deionized distilled water containing a deionized gelatin to mix these, under stirring, cubic high silver chloride grains were prepared. In the course of this preparation, $Cs_2[OsCl_5(NO)]$ was added, over the step of from 60% to 80% addition of the entire silver nitrate amount. Over the step of from 80% to 90% addition of the entire silver nitrate amount, $K_4[Fe(CN)_6]$ was added. Over the step of from 83% to 88% addition of the entire silver nitrate amount, $K_2[IrCl_6]$ was added. At the completion of 94% addition of the entire silver nitrate amount, potassium iodide (0.27 mol % per mol of the finished silver halide) was added under vigorous stirring. The thus-obtained emulsion grains were monodisperse cubic silver iodobromochloride grains having a side length of 0.54 μm and a variation coefficient of 8.5%. After flocculation desalting treatment, gelatin, Compounds Ab-1, Ab-2 and Ab-3, and calcium nitrate were added to the resulting emulsion for re-dispersion.

The re-dispersed emulsion was dissolved at 40° C., and Sensitizing dye SD-1, Sensitizing dye SD-2, and Sensitizing dye SD-3 were added for optimal spectral sensitization. Then, the resulting emulsion was ripened by adding sodium benzene thiosulfate, triethylthiourea as a sulfur sensitizer, and Compound-1 as a gold sensitizer, for optimal chemical sensitization. Then, 1-(5-methylureidophenyl)-5-mercaptotetrazole; Compound-2; a mixture whose major components were compounds represented by Compound-3 in which the repeating unit (n) was 2 or 3 (both ends $X_1$ and $X_2$ were each a hydroxyl group); Compound-4, and potassium bromide were added, to finalize chemical sensitization. The thus-obtained emulsion was referred to as Emulsion BH-43.

(Preparation of Blue-Sensitive Layer Emulsion BL-43)

Emulsion grains were prepared in the same manner as in the preparation of Emulsion BH-43, except that the temperature and the addition speed at the step of mixing silver nitrate, sodium chloride, and potassium bromide (0.5 mol % per mol of the finished silver halide) by simultaneous addition were changed, and that the amounts of respective metal complexes that were to be added in the course of the addition of silver nitrate, sodium chloride, and potassium bromide were changed. The thus-obtained emulsion grains were monodisperse cubic silver iodobromochloride grains having a side length of 0.44 μm and a variation coefficient of 9.5%. After re-dispersion of this emulsion, Emulsion BL-43 was prepared in the same manner as Emulsion BH-43, except that the amounts of various compounds to be added in the preparation of Emulsion BH-43 were changed.

(Preparation of Blue-Sensitive Layer Emulsion BH-44)

Using a method of adding silver nitrate, sodium chloride, potassium bromide (0.5 mol % per mol of the finished silver halide) simultaneously to a deionized distilled water containing a deionized gelatin to mix these, under stirring, cubic high silver chloride grains were prepared. In the course of this preparation, $Cs_2[OsCl_5(NO)]$ was added, over the step of from 60% to 80% addition of the entire silver nitrate amount. Over the step of from 80% to 90% addition of the entire silver nitrate amount, $K_4[Fe(CN)_6]$ was added. Over the step of from 83% to 88% addition of the entire silver nitrate amount, $K_2[IrCl_6]$ was added. Over the step of from 92% to 98% addition of the entire silver nitrate amount, $K_2[IrCl_5(H_2O)]$ and $K[IrCl_4(H_2O)_2]$ were added. The thus-obtained emulsion grains were monodisperse cubic silver bromochloride grains having a side length of 0.68 μm and a variation coefficient of 8.5%. After flocculation desalting treatment, gelatin, Compounds Ab-1, Ab-2, and Ab-3, and calcium nitrate were added to the resulting emulsion for re-dispersion.

The re-dispersed emulsion was dissolved at 40° C., and the sensitizing dye SD-1, the sensitizing dye SD-2, and the sensitizing dye SD-3 were added for optimal spectral sensitization. Then, the resulting emulsion was ripened by adding sodium benzene thiosulfate, triethylthiourea as a sulfur sensitizer, and Compound-1 as a gold sensitizer, for optimal chemical sensitization. Then, 1-(5-methylureidophenyl)-5-mercaptotetrazole; Compound-2; a mixture whose major components were compounds represented by Compound-3 in which the repeating unit (n) was 2 or 3 (both ends $X_1$ and $X_2$ were each a hydroxyl group); Compound-4, and potassium bromide were added, to finalize chemical sensitization. The thus-obtained emulsion was referred to as Emulsion BH-44.

(Preparation of Blue-Sensitive Layer Emulsion BL-44)

Emulsion grains were prepared in the same manner as in the preparation of Emulsion BH-44, except that the temperature and the addition speed at the step of mixing silver nitrate, sodium chloride, and potassium bromide (0.5 mol % per mol of the finished silver halide) by simultaneous addition were changed, and that the amounts of respective metal complexes that were to be added in the course of the addition of silver nitrate, sodium chloride and potassium bromide were changed. The thus-obtained emulsion grains were monodisperse cubic silver bromochloride grains having a side length of 0.59 μm and a variation coefficient of 9.5%. After re-dispersion of this emulsion, Emulsion BL-44 was prepared in the same manner as Emulsion BH-44, except that the amounts of various compounds to be added in the preparation of Emulsion BH-44 were changed.

(Preparation of Blue-Sensitive Layer Emulsion BH-45)

Using a method of adding silver nitrate, sodium chloride, and potassium bromide (0.5 mol % per mol of the finished silver halide) simultaneously to a deionized distilled water containing a deionized gelatin to mix these, under stirring, cubic high silver chloride grains were prepared. In the course of this preparation, $Cs_2[OsCl_5(NO)]$ was added over the step of from 60% to 80% addition of the entire silver nitrate amount. Over the step of from 80% to 90% addition of the entire silver nitrate amount, $K_4[Fe(CN)_6]$ was added. Over the step of from 83% to 88% addition of the entire silver nitrate amount, $K_2[IrCl_6]$ was added. Over the step of from 92% to 98% addition of the entire silver nitrate amount, $K_2[IrCl_5(5\text{-methylthiazole})]$ was added. The thus-obtained emulsion grains were monodisperse cubic silver bromochloride grains having a side length of 0.68.μm and a variation coefficient of 8.5%. After flocculation desalting treatment, gelatin, Compounds Ab-1, Ab-2, and Ab-3, and calcium nitrate were added to the resulting emulsion for re-dispersion.

The re-dispersed emulsion was dissolved at 40° C., and the sensitizing dye SD-1, the sensitizing dye SD-2, and the sensitizing dye SD-3 were added for optimal spectral sensitization. Then, the resulting emulsion was ripened by adding sodium benzenethiosulfate, triethylthiourea as a sulfur sensitizer, and Compound-1 as a gold sensitizer, for optimal chemical sensitization. Then, 1-(5-methylureidophenyl)-5-mercaptotetrazole; Compound-2; a mixture whose major components were compounds represented by Compound-3 in which the repeating unit (n) was 2 or 3 (both ends $X_1$ and $X_2$ were each a hydroxyl group); Compound-4, and potassium bromide were added, to finalize chemical sensitization. The thus-obtained emulsion was referred to as Emulsion BH-45.

(Preparation of Blue-Sensitive Layer Emulsion BL-45)

Emulsion grains were prepared in the same manner as in the preparation of Emulsion BH-45, except that the temperature and the addition speed at the step of mixing silver nitrate, sodium chloride, and potassium bromide (0.5 mol % per mol of the finished silver halide) by simultaneous addition were changed, and that the amounts of respective metal complexes that were to be added in the course of the addition of silver nitrate, sodium chloride, and potassium bromide were changed. The thus-obtained emulsion grains were monodisperse cubic silver bromochloride grains having a side length of 0.59 μm and a variation coefficient of 9.5%. After re-dispersion of this emulsion, Emulsion BL-45 was prepared in the same manner as Emulsion BH-45, except that the amounts of various compounds to be added in the preparation of Emulsion BH-45 were changed.

(Preparation of Blue-Sensitive Layer Emulsion BH-46)

Using a method of adding silver nitrate and sodium chloride simultaneously to a deionized distilled water containing a deionized gelatin to mix these, under stirring, cubic high silver chloride grains were prepared. In the course of this preparation, $Cs_2[OsCl_5(NO)]$ was added over the step of from 60% to 80% addition of the entire silver nitrate amount. Over the step of from 80% to 90% addition of the entire silver nitrate amount, potassium bromide (1.5 mol % per mol of the finished silver halide) and $K_4[Fe(CN)_6]$ were added. Over the step of from 83% to 88% addition of the entire silver nitrate amount, $K_2[IrCl_5(5\text{-methylthiazole})]$ and $K_2[IrCl_6]$ were added. Over the step of from 92% to 98% addition of the entire silver nitrate amount, $K_2[IrCl_5(H_2O)]$ and $K[IrCl_4(H_2O)_2]$ were added. At the completion of 94% addition of the entire silver nitrate amount, potassium iodide (in an amount that the silver iodide amount would be 0.27 mol % per mol of the finished silver halide) was added, under vigorous stirring. The thus-obtained emulsion grains were monodisperse cubic silver iodobromochloride grains having a side length of 0.54 μm and a variation coefficient of 8.5%. After flocculation desalting treatment, gelatin, Compounds Ab-1, Ab-2, and Ab-3, and calcium nitrate were added to the resulting emulsion for re-dispersion.

The re-dispersed emulsion was dissolved at 40° C., and the sensitizing dye SD-1, the sensitizing dye SD-2, and the sensitizing dye SD-3 were added for optimal spectral sensitization. Then, the resulting emulsion was ripened by adding sodium benzenethiosulfate, triethylthiourea as a sulfur sensitizer, and Compound-1 as a gold sensitizer, for optimal chemical sensitization. Then, 1-(5-methylureidophenyl)-5-mercaptotetrazole; Compound-2; a mixture whose major components were compounds represented by Compound-3 in which the repeating unit (n) was 2 or 3 (both ends $X_1$ and $X_2$ were each a hydroxyl group); Compound-4, and potassium bromide were added, to finalize chemical sensitization. The thus-obtained emulsion was referred to as Emulsion BH46.

(Preparation of Blue-Sensitive Layer Emulsion BL-46)

Emulsion grains were prepared in the same manner as in the preparation of Emulsion BH-46, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver iodobromochloride grains having a side length of 0.44 μm and a variation coefficient of 9.5%. After re-dispersion of this emulsion, Emulsion BL-46 was prepared in the same manner as Emulsion BH-46, except that the amounts of various compounds to be added in the preparation of Emulsion BH-46 were changed.

(Preparation of Green-Sensitive Layer Emulsion GH-41)

Using a method of adding silver nitrate, sodium chloride, and potassium bromide (0.5 mol % per mol of the finished silver halide) simultaneously to a deionized distilled water containing a deionized gelatin to mix these, under stirring, cubic high silver chloride grains were prepared. In the course of this preparation, $K_4[Ru(CN)_6]$ was added over the step of from 80% to 90% addition of the entire silver nitrate amount. Over the step of from 83% to 88% addition of the entire silver nitrate amount, $K_2[IrCl_6]$ and $K_2[RhBr_5(H_2O)]$ were added. The thus-obtained emulsion grains were monodisperse. cubic silver bromochloride grains having a side length of 0.45 μm and a variation coefficient of 8.0%. The resulting emulsion was subjected to the flocculation desalting treatment and the re-dispersing treatment in the same manner as described in the above.

The re-dispersed emulsion was dissolved at 40° C., and sodium benzenethiosulfate, p-glutaramidophenyidisulfide, sodium thiosulfate pentahydrate as a sulfur sensitizer, and (bis(1,4,5-trimethyl-1,2,4-triazolium-3-thiolate)aurate (I)-tetrafluoroborate) as a gold sensitizer, were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. Further, in a midway of the emulsion preparation step, Sensitizing dye SD-4, Sensitizing dye SD-5, Sensitizing dye SD-6, and Sensitizing dye SD-7 were added as sensitizing dyes, to conduct spectral sensitization. The thus-obtained emulsion was referred to as Emulsion GH-41.

(Preparation of Green-Sensitive Layer Emulsion GL-41)

Emulsion grains were prepared in the same manner as in the preparation of Emulsion GH41, except that the temperature and the addition speed at the step of mixing silver nitrate, sodium chloride, and potassium bromide (0.5 mol % per mol of the finished silver halide) by simultaneous addition were changed, and that the amounts of respective metal complexes that were to be added in the course of the addition of silver nitrate, sodium chloride, and potassium bromide were changed. The thus-obtained emulsion grains were monodisperse cubic silver bromochloride grains having a side length of 0.37 μm and a variation coefficient of 9.8%. After re-dispersion of this emulsion, Emulsion GL-41 was prepared in the same manner as Emulsion GH-41, except that the amounts of various compounds to be added in the preparation of Emulsion GH-41 were changed.

(Preparation of Green-Sensitive Layer Emulsion GH-42)

Emulsion GH-42 was prepared in the same manner as the green-sensitive layer emulsion GH-11 in Example 1-1.

(Preparation of Green-Sensitive Layer Emulsion GL-42)

Emulsion GL-42 was prepared in the same manner as the green-sensitive layer emulsion GL-11 in Example 1-1.

(Preparation of Red-Sensitive Layer Emulsion RH-41)

Using a method of adding silver nitrate, sodium chloride, and potassium bromide (0.5 mol % per mol of the finished silver halide) simultaneously to a deionized distilled water containing a deionized gelatin to mix these, under stirring, cubic high silver chloride grains were prepared. In the course of this preparation, $Cs_2[OsCl_5(NO)]$ was added over the step of from 60% to 80% addition of the entire silver nitrate amount. Over the step of from 80% to 90% addition of the entire silver nitrate amount, $K_4[Ru(CN)_6]$ was added. Over the step of from 83% to 88% addition of the entire silver nitrate amount, $K_2[IrCl_6]$ was added. The thus-obtained emulsion grains were monodisperse cubic silver bromochloride grains having a cubic side length of 0.40 μm and a variation coefficient of 10%. The resulting emulsion was subjected to flocculation desalting treatment and re-dispersing treatment in the same manner as described in the above.

This emulsion was dissolved at 40° C., and Sensitizing dye SD-8, Compound-5, triethylthiourea as a sulfur sensitizer, and Compound-1 as a gold sensitizer, were added, and the resulting emulsion was ripened for optimal chemical sensitization. Thereafter, 1-(3-acetoamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion RH41.

(Preparation of Red-Sensitive Layer Emulsion RL-41)

Emulsion grains were prepared in the same manner as in the preparation of Emulsion RH-41, except that the temperature and the addition speed at the step of mixing silver nitrate, sodium chloride, and potassium bromide (0.5 mol % per mol of the finished silver halide) by simultaneous addition were changed, and that the amounts of respective metal complexes that were to be added in the course of the addition of silver nitrate, sodium chloride, and potassium bromide were changed. The thus-obtained emulsion grains were monodisperse cubic silver bromochloride grains having a side length of 0.30 μm and a variation coefficient of 9.9%. After this emulsion was subjected to flocculation desalting treatment and re-dispersion, Emulsion RL-41 was prepared in the same manner as Emulsion RH-41, except that the amounts of various compounds to be added in the preparation of Emulsion RH-41 were changed.

(Preparation of Red-Sensitive Layer Emulsion RH-42)

Emulsion RH-42 was prepared in the same manner as the red-sensitive layer emulsion RH-11 in Example 1-1.

(Preparation of Red-Sensitive Layer Emulsion RL-42)

Emulsion RL-42 was prepared in the same manner as the red-sensitive layer emulsion RL-11 in Example 1-1.

Preparation of a coating Solution for the First Layer

With respect to the first layer coating solution, Emulsified Dispersion D was prepared in the same manner as Emulsified Dispersion A in Example 3-1. Then, the Emulsified Dispersion D, and the above-described Emulsions BH-41 and BL-41 were mixed and dissolved, to prepare a coating solution for the first layer having the composition shown below. The coating amounts of the emulsions are in terms of silver.

The coating solutions for the second to seventh layers were prepared in the similar manner as those in Example 3-1, except that, in place of 1-(5-acetamidophenyl)-5-mercaptotetrazole, 1-(3-methylureidophenyl)-5-mercaptotetrazole was added to the second layer, the fourth layer, and the sixth layer, in amounts of 0.2 mg/m$^2$, 0.2 mg/m$^2$, and, 0.6 mg/m$^2$, respectively.

Sample 4001 was prepared in the same manner as Sample 3101 in Example 3-1, except for the following changes: the emulsion in the first layer was changed to an emulsion (a 5:5 mixture of BH-41 and BL-41 (mol ratio of silver)); the emulsion in the third layer was changed to an emulsion (a 1:3 mixture of GH-41 and GL-41 (mol ratio of silver)); the emulsion in the fifth layer was changed to an emulsion (a 4:6 mixture of RH-41 and RL-41 (mol ratio of silver)); and 0.006 g/m$^2$ of Antiseptic (Ab-3) in the second layer and 0.005 g/m$^2$ of Antiseptic (Ab-3) in the fourth layer were not added at all.

Sample Nos. 4002 to 4006 were prepared in the same manner as Sample No. 4001, except that the silver halide emulsions in the light-sensitive emulsion layers of Sample No. 4001 were replaced with the emulsions, as shown in Table 8, respectively. Herein, the mol ratio of silver between the two emulsions of each layer was adjusted to the same value of mol ratio as in Sample No. 4001. In addition, characteristics of each silver halide emulsion are summarized in Table 9.

TABLE 8

| Sample No. | Blue-sensitive emulsion layer | Green-sensitive emulsion layer | Red-sensitive emulsion layer |
|---|---|---|---|
| 4001 | BH-41/BL-41 | GH-41/GL-41 | RH-41/RL-41 |
| 4002 | BH-42/BL-42 | GH-42/GL-42 | RH-42/RL-42 |
| 4003 | BH-43/BL-43 | GH-42/GL-42 | RH-42/RL-42 |
| 4004 | BH-44/BL-44 | GH-42/GL-42 | RH-42/RL-42 |
| 4005 | BH-45/BL-45 | GH-42/GL-42 | RH-42/RL-42 |
| 4006 | BH-46/BL-46 | GH-42/GL-42 | RH-42/RL-42 |

TABLE 9

| Silver halide emulsion | Silver bromide layer | Silver iodide layer | Inorganic ligand-coordinated Ir | Organic ligand-coordinated Ir |
|---|---|---|---|---|
| BH-41/BL-41 | — | — | — | — |
| BH-42/BL-42 | ○ | — | — | — |
| BH-43/BL-43 | — | ○ | — | — |
| BH-44/BL-44 | — | — | ○ | — |
| BH-45/BL-45 | — | — | — | ○ |
| BH-46/BL-46 | ○ | ○ | ○ | ○ |
| GH-41/GL-41 | — | — | — | — |
| GH-42/GL-42 | ○ | ○ | ○ | — |
| RH-41/RL-41 | — | — | — | — |
| RH-42/RL-42 | ○ | ○ | ○ | ○ |

(Note)
Each circle indicates that the emulsion concerned had the element.
Silver bromide layer: Silver bromide-containing phase in layer form
Silver iodide layer: Silver iodide-containing phase in layer form
Inorganic ligand-coordinated Ir: Hexacoordinate iridium complex having a halogen ligand(s) and an inorganic ligand(s) other than halogen, each coordinated to iridium as a central atom, in the complex molecule
Organic ligand-coordinated Ir: Hexacoordinate iridium complex having a halogen ligand(s) and an organic ligand(s), each coordinated to iridium as a central atom, in the complex molecule Each of the samples thus prepared was worked into 127-mm-wide roll, and subjected to uniform gray exposure separately under four conditions described below, with a testing machine made by modifying a digital minilab, Frontier 350 (trade name, manufactured by Fuji Photo Film Co., Ltd.):

A: sub-scan conveyance speed, 80 mm/sec; raster interval, 529 μsec; latent image retention time, 16 sec B: sub-scan conveyance speed, 80 mm/sec; raster interval, 529 μsec; latent image retention time, 10 sec C: sub-scan conveyance speed, 100 mm/sec; raster interval, 423 μsec; latent image retention time, 12.8 sec D: sub-scan conveyance speed, 100 mm/sec; raster interval, 423 μsec; latent image retention time, 8 sec As the exposure apparatus, the same one as used in Example 1-1 was used. Each laser light of three colors moved to a main scanning direction and perpendicularly to the scanning direction by a polygon mirror such that they would carry out sequential-scanning exposure on the sample. The average exposure time per pixel was $7\times10^{-8}$ to $8\times10^{-8}$ sec. The exposure was carried out in a temperature-controlled room, specifically in low-temperature surroundings of 15° C.-55% RH. Under this condition, the rollers conveying each sample to the processing section after light exposure caused moisture condensation, to result moisture-condensation unevenness by the rollers.

Continuous processing (running test) was performed using Sample No. 4006, in accordance with the process steps as in Example 3-1, until the volume of the color developer replenisher reached twice the volume of the color developing tank. The same processing solutions used in Example 1-1 were used. By use of the thus obtained running processing solutions, each light-sensitive material sample was processed through the process steps as in Example 3-1.

(Evaluation of Print Productivity)

The number of prints processed per the unit time was evaluated, by judging whether the processing time per sheet be shortened or not, assuming the case of setting a sub-scan conveyance speed at 80 mm/sec as standard.

Evaluation was made in accordance with the following criterions:

◎: Very high, Δ: Rather low, X: Low (Evaluation of Moisture Condensation Unevenness)

By passing each Sample between sub-scan rollers in pairs without light exposure, and then by subjecting to the above-described photographic processing, one hundred 2L-size white sample sheets were output in succession, and examined for frequency of occurrence of streaked unevenness having a yellow color with the naked eye.

Evaluation was made in accordance with the following criterions:

◎: No streaked unevenness was observed;

○: There were streaked unevenness to a slight extent; and

X: A great number of streak unevenness was observed.

The test results on print productivity and moisture condensation unevenness are shown in Table 10. As can be seen from Table 10, the silver halide color photographic light-sensitive material and the image-forming method of the present invention, preferably as defined in the sixth embodiment of the present invention, caused no moisture condensation unevenness, and besides, they provided defect-free high-quality prints, even with high print-productivity.

TABLE 10

| Sample No. | Sub-scan conveyance speed (mm/sec) | Raster interval (μsec) | Latent image retention time (sec) | Print productivity | Moisture condensation unevenness (Yellow) |
|---|---|---|---|---|---|
| 4001 | 80 | 529 | 16 | X | ◎ |
| 4001 | 80 | 529 | 10 | Δ | ◎ |
| 4001 | 100 | 423 | 12.8 | Δ | ○ |
| 4001 | 100 | 423 | 8 | ◎ | X |
| 4002 | 100 | 423 | 8 | ◎ | ○ |
| 4003 | 100 | 423 | 8 | ◎ | ○ |
| 4004 | 100 | 423 | 8 | ◎ | ○ |
| 4005 | 100 | 423 | 8 | ◎ | ○ |
| 4006 | 80 | 529 | 16 | X | ◎ |
| 4006 | 80 | 529 | 10 | Δ | ◎ |
| 4006 | 100 | 423 | 12.8 | Δ | ◎ |
| 4006 | 100 | 423 | 8 | ◎ | ◎ |

(Note)
Print productivity: "◎" very high, "Δ" rather low, "X" low
Moisture condensation unevenness: "◎" not observed at all, "○" slightly observed, "X" many streaks of unevenness were observed Example 4-2

(Preparation of Emulsion B-41 for Blue-Sensitive Layer)

To a deionized distilled water containing a deionized gelatin, with stirring, silver nitrate, sodium chloride and potassium bromide were added simultaneously at 40° C., while controlling pAg and pH, to prepare cubic high silver chloride grains having a silver chloride content of 99.8 mole % and a silver bromide content of 0.2 mole %. In the course of this grain preparation, $K_2[IrCl_6]$ and $K_4[Fe(CN)_6]\cdot 3H_2O$ were added, over the step of from 3% to 92% addition of the entire silver nitrate. Further, the grains formed was desalted using a 5% aqueous solution of DEMOL-N (trade name, produced by Kao Corporation) and a 20% aqueous solution of magnesium sulfate, and then mixed with an aqueous gelatin solution. The emulsion grains thus obtained were monodisperse cubic silver chlorobromide grains having a circle-equivalent diameter (i.e. a diameter of a circle having an area equivalent to the projected area of an individual grain) of 0.64 μm and a variation coefficient of 0.07 with respect to the grain diameter distribution.

The emulsion obtained was dissolved, admixed with sodium thiosulfate, chloroauric acid, Sensitizing dye SD-2, Sensitizing dye B-2, 1-(3-acetoamidophenyl)-5-mercaptotetrazole, 1-phenyl-5-mercaptotetrazole, and 1-(4-ethoxyphenyl)-5-mercpatotetrazozle, followed by subjecting to chemical sensitization at 60° C. The thus-obtained emulsion was referred to as Emulsion BH411.

Sensitizing dye B-2

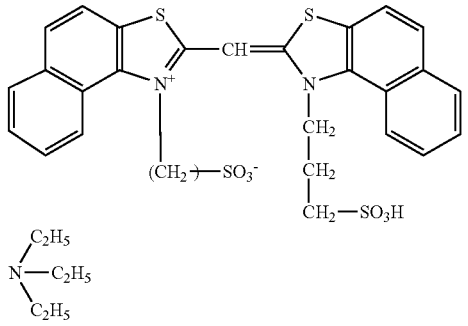

Another monodisperse cubic emulsion, Emulsion BL-411, having a circle-equivalent diameter of 0.50 Am, a variation coefficient of 0.07 with respect to grain diameter distribution, a silver chloride content of 99.8 mole % and a silver bromide content of 0.2 mole %, was prepared, in the same manner as Emulsion BH-411, except that the addition periods of time of silver nitrate, sodium chloride and potassium bromide were changed.

Emulsion BH-411 and Emulsion BL-411 were mixed at a ratio of 1:1 on a silver basis, to prepare Emulsion B-41 for a blue-sensitive layer.

(Preparation of Emulsion G-41 for Green-Sensitive Layer)

To a deionized distilled water containing a deionized gelatin, with stirring, silver nitrate, sodium chloride and potassium bromide were added simultaneously at 40° C. while controlling pAg and pH, to prepare cubic high-silver-chloride grains having a silver chloride content of 99.7 mole % and a silver bromide content of 0.3 mole %. In the course of this grain preparation, $K_2[IrCl_6]$ and $K_4[Fe(CN)_6]\cdot 3H_2O$ were added, over the step of from 3% to 92% addition of the entire silver nitrate. Further, the grains formed was desalted using a 5% aqueous solution of DEMOL-N (trade name, produced by Kao Atlas) and a 20% aqueous solution of magnesium sulfate, followed by mixing with an aqueous gelatin solution. The emulsion grains thus obtained were monodisperse cubic silver chlorobromide grains having a circle-equivalent diameter of 0.50 μm and a variation coefficient of 0.08 with respect to the grain diameter distribution.

The emulsion obtained was dissolved, admixed with sodium thiosulfate, chloroauric acid, 1-(3-acetoamidophenyl)-5-mercaptotetrazole, 1-phenyl-5-mercaptotetrazole, 1-(4-ethoxyphenyl)-5-mercpatotetrazozle, and Sensitizing dye G-1, followed by subjecting to chemical sensitization at 60° C. The thus-obtained emulsion was referred to as Emulsion GH-411.

Sensitizing dye G-1

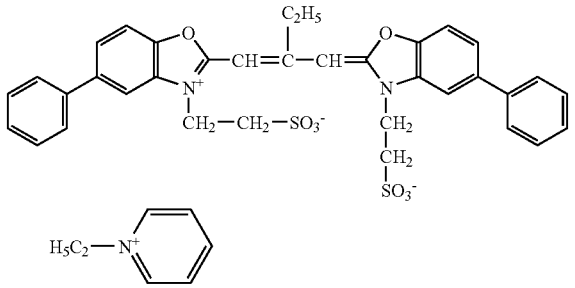

Another monodisperse cubic emulsion, Emulsion GL-411, having a circle-equivalent diameter of 0.45 μm, a variation coefficient of 0.07 with respect to grain diameter distribution, a silver chloride content of 99.7 mole % and a silver bromide content of 0.3 mole %, was prepared in the same manner as Emulsion GH-411, except that the addition periods of time of silver nitrate, sodium chloride and potassium bromide were changed.

Emulsion GH-411 and Emulsion GL-411 were mixed at a ratio of 1:1 on a silver basis, to prepare Emulsion G-41 for a green-sensitive layer.

(Preparation of Emulsion G-42 for Green-Sensitive Layer)

Another emulsion, Emulsion GH-412, was prepared in the same manner as Emulsion GH-411, except that the amount of potassium bromide added at the latter stage of grain formation was changed, thereby forming a region of silver bromide content 5 mole %, in the region of from the grain surface to the depth of 20 nm.

Another emulsion, Emulsion GL-412, was prepared in the same manner as Emulsion GL-411, except that the amount of potassium bromide added at the latter stage of grain formation was changed, thereby forming a region of silver bromide content 5 mole %, in the region of from the grain surface to the depth of 20 nm.

Emulsion GH-412 and Emulsion GL-412 were mixed at a ratio of 1:1 on a silver basis, to prepare Emulsion G-42 for a green-sensitive layer.

(Preparation of Emulsion R-41 for Red-Sensitive Layer)

To a deionized distilled water containing a deionized gelatin, with stirring, silver nitrate, sodium chloride, and potassium bromide were added simultaneously at 40° C. while controlling pAg and pH, to prepare cubic high-silver-chloride grains having a silver chloride content of-99.8-mole % and a silver bromide content of 0.2 mole %. In the course of this grain preparation, $K_2[IrCl_6]$ and $K_4[Fe(CN)_6]\cdot 3H_2O$ were added, over the step of from 3% to 92% addition of the entire silver nitrate. Further, the grains formed was desalted using a 5% aqueous solution of DEMOL-N (trade name, produced by Kao Atlas) and a 20% aqueous solution of magnesium sulfate, followed by mixing with an aqueous gelatin solution. The emulsion grains thus obtained were monodisperse cubic silver chlorobromide grains having a circle-equivalent diameter of 0.40 μm and a variation coefficient of 0.08 with respect to the grain diameter distribution.

The emulsion obtained was dissolved, admixed with sodium thiosulfate, chloroauric acid, 1-(3-acetoamidophenyl)-5-mercaptotetrazole, 1-phenyl-5-mercaptotetrazole, 1-(4-ethoxyphenyl)-5-mercpatotetrazozle, Sensitizing dye R-1, Sensitizing dye R-2, and Stabilizer SB-11, followed by subjecting to chemical sensitization at 60° C. The thus-obtained emulsion was referred to as Emulsion RH-411.

Sensitizing dye R-1

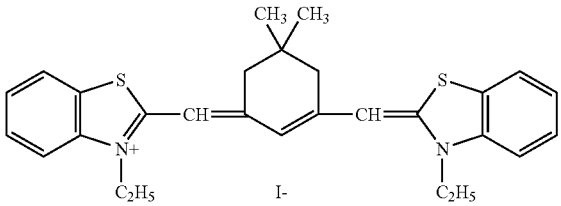

Sensitizing dye R-2

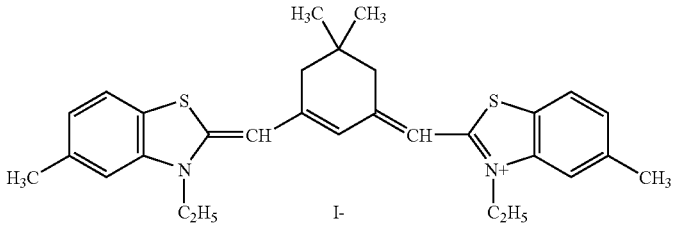

-continued

Stabilizer S B-11

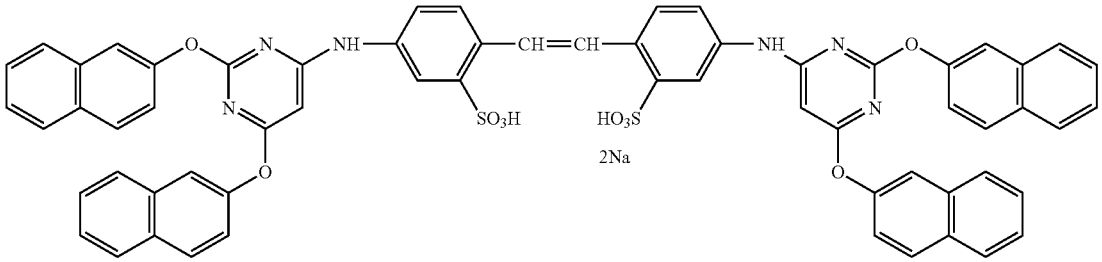

Another monodisperse cubic emulsion, Emulsion RL-411, having a circle-equivalent diameter of 0.35 μm, a variation coefficient of 0.07 with respect to grain diameter distribution, a silver chloride content of 99.7 mole %, and a silver bromide content of 0.3 mole %, was prepared in the same manner as Emulsion RH-411, except that the addition periods of time of silver nitrate, sodium chloride and potassium bromide were changed.

Emulsion RH-411 and Emulsion RL-411 were mixed at a ratio of 1:1 on a silver basis, to prepare Emulsion R-41 for a red-sensitive layer.

(Preparation of Sample No. 4101)

A reflective support was prepared by laminating pulp paper having a basis mass of 180 g/m$^2$ with high-density molten polyethylene containing surface-treated anatase-type titanium dioxide in a content of 15 mass % in a dispersed state, on the side to be coated with emulsion layers, and further by laminating the resultant paper with high-density polyethylene, on the backing side. Then, the support was subjected to corona discharge treatment, coated with a subbing layer of gelatin, and further coated with the following photographic constituent layers, to prepare a silver halide color photographic light-sensitive material, Sample No. 4101. The coating amounts of silver halide emulsions set forth in the below are values in terms of silver.

Further, to the second layer, the fourth layer, and the seventh layer tetrakis(vinylsulfonylmethyl)methane and 2,4-dichloro--hydroxy-s-triazine sodium were added as hardeners. Further, to each layer, were added surfactants, sodium di(2-ethylhexyl) sulfosuccinate and sodium di(2,2,3,3,4,4,5,5-octafluoropentyl)sulfosuccinate, as coating aids for adjustment of surface tension. Further, to each layer, were added Ab-1, Ab-2, Ab-3, and Ab-4, so that the total amounts would be 14.0 mg/m$^2$, 62.0 mg/m$^2$, 5.0 mg/m$^2$, and 10.0 mg/m$^2$, respectively. Further, in order to prevent irradiation, the following dyes (coating amounts are shown in parentheses) were added.

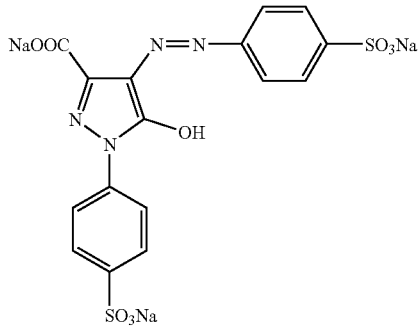

(2 mg/m$^2$)

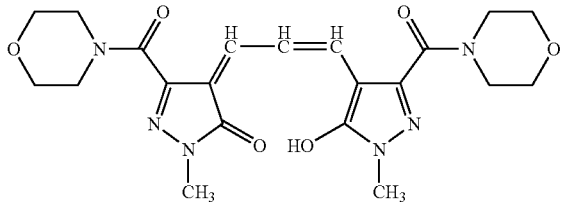

(3 mg/m$^2$)

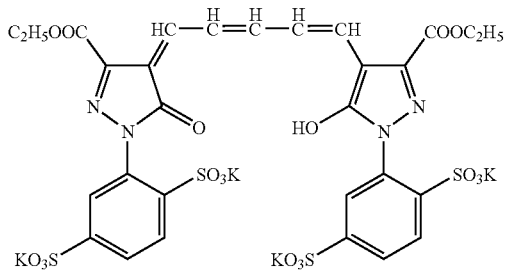

(25 mg/m$^2$)

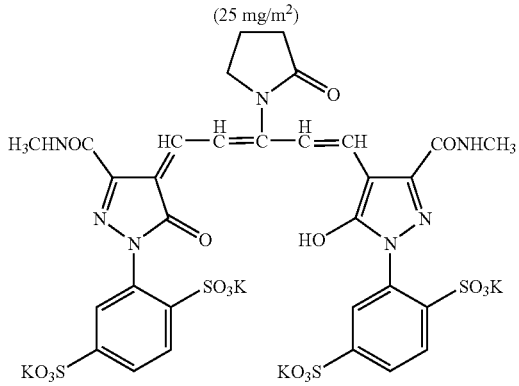

(3 mg/m$^2$)

| First layer (Blue-sensitive layer) | |
|---|---|
| Gelatin | 1.10 |
| Emulsion (B-41) | 0.24 |
| Yellow coupler (ExY-1) | 0.45 |
| Color image stabilizer (ST-25) | 0.05 |
| Color image stabilizer (ST-26) | 0.05 |
| Color image stabilizer (ST-24) | 0.10 |
| 2,5-Di-t-octylhydroquinone | 0.005 |
| p-t-Octylphenol | 0.08 |
| Poly(t-butylacrylamide) | 0.04 |
| Dinonyl phthalate | 0.05 |
| Dibutyl phthalate | 0.15 |
| **Second layer (Intermediate layer)** | |
| Gelatin | 1.20 |
| 2,5-Di-t-octylhydroquinone | 0.02 |
| 2,5-Di-sec-dodecylhydroquinone | 0.03 |
| 2,5-Di-sec-tetradecylhydroquinone | 0.06 |
| 2-Sec-dodecyl-5-sec-tetradecylhydroquinone | 0.03 |
| 2,5-Di[(1,1-dimethyl-4-hexyloxycarbonyl)butyl]hydroquinone | 0.03 |
| Di-i-decyl phthalate | 0.04 |
| Dibutyl phthalate | 0.02 |
| **Third layer (Green-sensitive layer)** | |
| Gelatin | 1.30 |
| Emulsion (G-41) | 0.12 |
| Magenta coupler (M-1) | 0.20 |
| Color image stabilizer (ST-13) | 0.10 |
| Color image stabilizer (ST-3) | 0.02 |
| Di-i-decyl phthalate | 0.10 |
| Dibutyl phthalate | 0.10 |
| **Fourth layer (Ultraviolet absorbing layer)** | |
| Gelatin | 0.94 |
| Ultraviolet absorber (UV-4) | 0.17 |
| Ultraviolet absorber (UV-3) | 0.27 |
| 2,5-Di[(1,1-dimethyl-4-hexyloxycarbonyl)butyl]hydroquinone | 0.06 |
| **Fifth layer (Red-sensitive layer)** | |
| Gelatin | 1.00 |
| Emulsion (R-41) | 0.17 |
| Cyan coupler (ExC-4) | 0.22 |
| Cyan coupler (C-12) | 0.06 |
| Color image stabilizer (ST-25) | 0.06 |
| 2,5-Di-t-octylhydroquinone | 0.003 |
| Dibutyl phthalate | 0.10 |
| Dioctyl phthalate | 0.20 |
| **Sixth layer (Ultraviolet absorbing layer)** | |
| Gelatin | 0.40 |
| Ultraviolet absorber (UV-4) | 0.07 |
| Ultraviolet absorber (UV-3) | 0.12 |
| 2,5-Di[(1,1-dimethyl-4-hexyloxycarbonyl)butyl]hydroquinone | 0.02 |
| **Seventh layer (Protective layer)** | |
| Gelatin | 0.70 |
| Di-i-decyl phthalate | 0.002 |
| Dibutyl phthalate | 0.002 |
| Silicon dioxide | 0.003 |

-continued

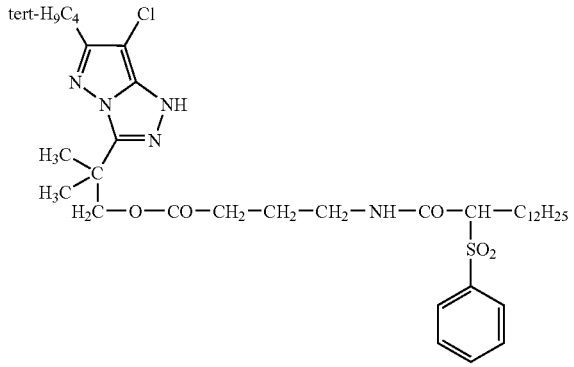

M-1

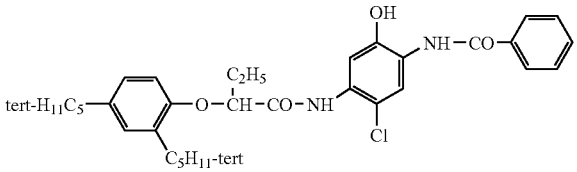

C-12

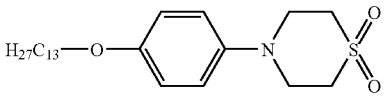

ST-13

Another sample No. 4102 was prepared in the same manner as Sample No. 4101, except that the emulsion in the green-sensitive layer was changed to Emulsion G-42.

Each of these samples was worked into 127-mm-wide rolls, followed by subjecting to uniform gray exposure under -the same four conditions as in Example 4-1 with a testing machine made by modifying a digital minilab, Frontier 350 (trade name, manufactured by Fuji Photo Film Co., Ltd.), and print productivity and moisture condensation unevenness evaluations were carried out. At that time, the exposure was carried out in a temperature-controlled room, specifically in low-temperature surroundings of 15° C.-55% RH. Under this condition, the rollers for conveying each sample to the processing section after light-exposure suffered moisture condensation, thereby resulting moisture condensation unevenness by the rolls.

Continuous processing (running test) was performed using Sample No. 4102 in accordance with the following process steps until the volume of the color developer replenisher reached twice the volume of the color developing tank. By use of the thus-obtained running processing solutions, each light-sensitive material sample was processed through the following process steps.

| Processing step | Temperature | Time | Replenisher amount |
|---|---|---|---|
| Color development | 38.5° C. | 45 sec | 45 mL |
| Bleach-fixing | 38.0° C. | 45 sec | 35 mL |
| Rinse (1) | 38.0° C. | 20 sec | — |

-continued

| Processing step | Temperature | Time | Replenisher amount |
|---|---|---|---|
| Rinse (2) | 38.0° C. | 20 sec | — |
| Rinse (3) | 38.0° C. | 20 sec | — |
| Rinse (4) | 38.0° C. | 20 sec | 121 mL |
| Drying | 80° C. | | |

(Note)
*Replenishment rate per $m^2$ of the light-sensitive material to be processed.
**A rinse cleaning system RC50D (trade name), manufactured by Fuji Photo Film Co., Ltd., was installed in the rinse (3), and the rinse solution was taken out from the rinse (3) and sent to a reverse osmosis module (RC50D) by using a pump. The permeated water obtained in that tank was supplied to the rinse (4), and the concentrated water was returned to the rinse (3). Pump pressure was controlled such that the water to bepermeated in the reverse osmosis module would be maintained in an amount of 50 to 300 ml/min, and the rinse solution was circulated under controlled temperature for 10 hours a day. The rinse was made in a four-tank counter-current system from (1) to (4).

Processing solutions used in the process steps respectively had the following compositions:

| (Color developer) | (Tank solution) | (Replenisher) |
|---|---|---|
| Water | 800 ml | 800 ml |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethyleneglycol (Average molecular mass: 300) | 10.0 g | 10.0 g |
| Ethylenediaminetetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.0 g |
| 4-Amino-3-methyl-N-ethyl-N-(β-methanesulfonamidoethyl)aniline•3/2 sulfate•monohydrate | 4.8 g | 14.0 g |
| Potassium carbonate | 26.3 g | 26.3 g |
| Water to make | 1,000 ml | 1,000 ml |
| pH (25° C., adjusted using sulfuric acid and KOH) | 10.15 | 12.40 |

| (Bleach-fixing solution) | (Tank solution) | (Replenisher) |
|---|---|---|
| Water | 800 ml | 800 ml |
| Ammonium thiosulfate (750 g/l) | 107 ml | 214 ml |
| m-Carboxybenzenesulfinic acid | 8.3 g | 16.5 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 ml | 1,000 ml |
| pH (25° C., adjusted using nitric acid and aqueous ammonia) | 6.5 | 6.5 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1,000 ml | 1,000 ml |
| pH (25° C.) | 6.5 | 6.5 |

The test results on print productivity and moisture condensation unevenness are shown in Table 11. As can be seen from Table 11, the silver halide color photographic light-sensitive materials and the image-forming methods of the present invention, preferably as defined in the sixth embodiment of the present invention, caused less moisture condensation unevenness, and besides, they provided defect-free and high-quality prints, with high print productivity.

TABLE 11

| Sample No. | Sub-scan conveyance speed (mm/sec) | Raster interval (μsec) | Latent image retention time (sec) | Print productivity | Moisture condensation unevenness (Magenta) |
|---|---|---|---|---|---|
| 4101 | 80 | 529 | 16 | X | ◎ |
| 4101 | 80 | 529 | 10 | Δ | ◎ |
| 4101 | 100 | 423 | 12.8 | Δ | ○ |
| 4101 | 100 | 423 | 8 | ◎ | X |
| 4102 | 80 | 529 | 16 | X | ◎ |
| 4102 | 80 | 529 | 10 | Δ | ◎ |
| 4102 | 100 | 423 | 128 | Δ | ○ |
| 4102 | 100 | 423 | 8 | ◎ | ○ |

(note)
Print productivity: "◎" very high, "Δ" rather low, "X" low
Moisture condensation unevenness: "◎" not observed at all, "○" slightly observed, "X" many streaks of unevenness were observed

Example 4-3

The samples prepared in Example 4-1 were each subjected to uniform gray exposure by means of the following exposure unit, and moisture condensation unevenness evaluation was carried out in the same manner as in Example 4-1. At that time, the light source was changed from the blue laser of about 470 nm used in Example 4-1, to a blue semiconductor laser with wavelength about 440 nm (Presentation by Nichia Corporation at the 48th Applied Physics Related Joint Meeting, in March of 2001).

In this case also, the silver halide color photographic light-sensitive materials and the image-forming methods of the present invention suffered no moisture condensation unevenness, and besides, they provided defect-free high-quality prints, with high print productivity.

Example 5-1

(Preparation of Blue-Sensitive Layer Emulsion BH-51)

Cubic high silver chloride grains were prepared in the same manner as the cubic high silver chloride grains used in the blue-sensitive emulsion BH-46 in Example 4-1. After flocculation desalting treatment, gelatin, Compounds Ab-1, Ab-2, and Ab-3, and calcium nitrate were added to the resulting emulsion for re-dispersion.

The thus re-dispersed emulsion was dissolved at 40° C., and Sensitizing dye SD-3 was added thereto, for optimal spectral sensitization. Then, the resulting emulsion was ripened by adding sodium benzenethiosulfate, triethylthiourea as a sulfur sensitizer, and Compound-1 as a gold sensitizer, for optimal chemical sensitization. Then, 1-(5-methylureidophenyl)-5-mercaptotetrazole, Compound-2; a mixture whose major components were compounds represented by Compound-3 in which the repeating unit (n) was 2 or 3 (both ends $X_1$ and $X_2$ were each a hydroxyl group); Compound-4, and potassium bromide were added, to finalize chemical sensitization. The thus-obtained emulsion was referred to as Emulsion BH-51.

(Preparation of Blue-Sensitive Layer Emulsion BL-51)

Emulsion grains were prepared in the same manner as in the preparation of Emulsion BH-51, except that the temperature and the addition speed at the step of mixing silver nitrate and sodium chloride by simultaneous addition were changed, and that the amounts of, respective metal complexes that were to be added in the course of the addition of silver nitrate and sodium chloride were changed. The thus-obtained emulsion grains were monodisperse cubic silver iodobromochloride grains having a side length of 0.44 μm and a variation coefficient of 9.5%. After re-dispersion of this emulsion, Emulsion BL-51 was prepared in the same manner as Emulsion BH-51, except that the amounts of various compounds to be added in the preparation of Emulsion BH-51 were changed.

(Preparation of Blue-Sensitive Layer Emulsions BH-52 to BH-54)

Emulsions BH-52, BH-53 and BH-54 were prepared in the same manner as Emulsion BH-51, except that the sensitizing dye SD-3 added at the time of post-ripening was replaced with an equimolar amount (the entire amount) of S-12, S-26, or S-38, respectively.

(Preparation of Blue-Sensitive Layer Emulsions BL-52 to BL-54)

Emulsions BL-52, BL-53 and BL-54 were prepared in the same manner as Emulsion BL-51, except that the sensitizing dye SD-3 added at the time of post-ripening was replaced with an equimolar amount (the entire amount) of S-12, S-26, or S-38, respectively.

(Preparation of Blue-Sensitive Layer Emulsion BH-55)

Emulsion BH-55 was prepared in the same manner as Emulsion BH-51, except that the sodium benzenethiosulfate added at the time of post-ripening was replaced with inorganic sulfur.

(Preparation of Blue-Sensitive Layer Emulsion BL-55)

Emulsion BL-55 was prepared in the same manner as Emulsion BL-51, except that the sodium benzenethiosulfate added at the time of post-ripening was replaced with inorganic sulfur.

(Preparation of Blue-Sensitive Layer Emulsion-BH-56)

Emulsion BH-56 was prepared in the same manner as Emulsion BH-51, except that a 80mol % amount of the sodium benzenethiosulfate added at the time of post-ripening was replaced with Compound Z-8.

(Preparation of Blue-Sensitive Layer Emulsion BL-56)

Emulsion BL-56 was prepared in the same manner as Emulsion BL-51, except that a 80mol % amount of the sodium benzenethiosulfate added at the time of post-ripening was replaced with Compound Z-8.

(Preparation of Blue-Sensitive Layer Emulsion BH-57)

Emulsion BH-57 was prepared in the same manner as Emulsion BH-51, except that a 80mol % amount of the sensitizing dye SD-3 added at the time of post-ripening was replaced with a 1:1 (by mole) mixture of S-12 and S-38.

(Preparation of Blue-Sensitive Layer Emulsion BL-57)

Emulsion BL-57 was prepared in the same manner as Emulsion BL-51, except that a 80mol % amount of the sensitizing dye SD-3 added at the time of post-ripening was replaced with a 1:1 (by mole) mixture of S-12 and S-38.

(Preparation of Green-Sensitive Layer Emulsion GH-51)

Emulsion GH-51 was prepared in the same manner as the green-sensitive emulsion GH41 in Example 4-1.

(Preparation of Red-Sensitive Layer Emulsion RH-51)

Emulsion RH-51 was prepared in the same manner as the red-sensitive emulsion RH-41 in Example 4-1.

(Preparation of Coating Solution for First Layer)

With respect to the first layer coating solution, Emulsified Dispersion E w a s prepared in the same manner as the Emulsified Dispersion in Example 4-1, and then, the Emulsified Dispersion E, and the above-described Emulsions BH-51 and BL-51 were mixed and dissolved, to prepare a coating solution for the first layer having the composition shown below.

(Preparation of Coating Solutions for the Second to Seventh Layers)

The coating solutions for the second to seventh layers, respectively, were prepared in the same manner as in Example 4-1.

Sample 5001 was prepared in the same manner as Sample 4001 in Example 4-1, except for the following changes: the emulsion in the first layer was changed to an emulsion (a 5:5 mixture of BH-51 and BL-51 (mol ratio of silver)); the emulsion in the third layer was changed to Emulsion (GH-51); and the emulsion in the fifth layer was changed to Emulsion (RH-51).

Sample Nos. 5002 to 5007 were prepared in the same manner as Sample No. 5001, except that the silver halide emulsions in the blue-sensitive emulsion layer of Sample No. 5001 were replaced with emulsions, as shown in Table 12, respectively. The mol ratio of silver between the two emulsions in the blue-sensitive emulsion layer was adjusted to the same value on a mole basis as in Sample No. 5001.

TABLE 12

| Sample No. | Blue sensitive emulsion layer | Green sensitive emulsion layer | Red sensitive emulsion layer |
|---|---|---|---|
| 5001 | BH-51/BL-51 | GH-51 | RH-51 |
| 5002 | BH-52/BL-52 | GH-51 | RH-51 |
| 5003 | BH-53/BL-53 | GH-51 | RH-51 |
| 5004 | BH-54/BL-54 | GH-51 | RH-51 |
| 5005 | BH-55/BL-55 | GH-51 | RH-51 |
| 5006 | BH-56/BL-56 | GH-51 | RH-51 |
| 5007 | BH-57/BL-57 | GH-51 | RH-51 |

Each of the samples described above was worked into a 127-mm-width roll, followed by storing for 7 days under the condition of 40° C./60% RH as it was in the roll form. Then, each roll was mounted in a testing machine made by modifying a digital minilab, Frontier 350 (trade name, manufactured by Fuji Photo Film Co., Ltd.), followed by subjecting to uniform gray exposure at the following sub-scan conveyance speed A or B:

A, Sub-scan conveyance speed of 80 mm/sec; and

B, Sub-scan conveyance speed of 100 mm/sec.

Separately, another sets of each sample were passed through the conveyance section at the same sub-scan conveyance speed A or B, without undergoing exposure. As to the sub-scan roller pairs, the roller pairs installed in Frontier 350 were used as they were.

After the digital minilab and the light-sensitive materials were placed in a room controlled to 35° C.-80% RH, the above tests were commenced when the apparatus and samples reached sufficiently equilibrium with the environment.

Then, the above experiments were carried out in the same manner as above, except for using the testing machine as modified in below. That is, the sub-scan roller pairs of the machine were modified such that the driving roller installed in the sub-scan exposure section of the Frontier 350 was replaced with a hard roller having a urethane coating of thickness about 50 μm and containing resin beads, which coating was provided on the surface of a metal shaft of the roller (i.e. the driving side), and that the nip roller was replaced with a roller having a rubber layer, which was made of EPDM, and which had 55 degrees in Hardness A (i.e. the nip roller side).

As the exposure apparatus, the same one as used in Example 1-1 was used. Each laser light of three colors moved by a polygon mirror, in a direction (i.e. a main scanning direction) perpendicularly to a sub-scanning conveyance direction such that they would carry out sequential-scanning exposure on the sample. The exposure time per pixel was $7\times10^{-8}$ to $8\times10^{-8}$ sec.

Continuous processing (running test) was performed using Sample No. 5007 according to the process steps as in Example 3-1, until the volume of the color developer replenisher reached twice the volume of the color developing tank. By using the thus-obtained running processing solutions, each light-sensitive material sample was processed through the process steps as in Example 3-1.

The same processing solutions used in Example 1-1 were used.

<Evaluation of Productivity>

The productivity evaluation was carried out in the same manner as in Example 4-1

<Evaluation of Exposure Unevenness>

Ten 2L-size uniform gray sample sheets providing an R-density of 1.0, a G-density of 1.0 and a B-density of 1.0 when measured with an X-rite densitometer (equipped with Status A-R, -G and -B filters) were output in succession, and evaluations of exposure unevenness were conducted thereon. At that time, separately, Sample No. 5001 was subjected to exposure and photographic processing so as to provide the same uniform gray condition as mentioned above, by use of a commercially available Frontier 350 (manufactured by Fuji Photo Film Co., Ltd.), and the prints thus output were adopted as reference sample. The extent of exposure unevenness was observed with the naked eye. Specifically, the case where the extent was regarded as the same level to the reference sample is designated as "○", the case where the extent was on a level slightly lower than that of the reference sample is designated as "Δ", and the case where the extent was inferior to that of the reference sample is designated as "X".

<Evaluation of Streaked Unevenness>

By passing each unexposed sample between the sub-scan roller pair, followed by subjecting to the above-described photographic processing, one hundred 2L-size white sample sheets were provided by outputting in succession. The resultant sheets were observed with the naked eye, to evaluate frequency of occurrence of streaked unevenness of yellow.

Evaluation was carried out, in accordance with the following criterions:

◎: No streaked unevenness was observed at all;

○: There were some sample sheets on which streaked unevenness was observed to a slight extent; and X: A great number of streak unevenness was observed.

The results are shown in Table 13.

TABLE 13

| Sample No. | Sub-scan conveyance speed (mm/sec) | Hard Roller | Productivity | Exposure unevenness | Streak unevenness (Yellow) |
|---|---|---|---|---|---|
| 5001 | 80 | X | X | ○ | ◎ |
| 5002 | 80 | X | X | ○ | ◎ |
| 5001 | 100 | X | ○ | X | ○ |

TABLE 13-continued

| Sample No. | Sub-scan conveyance speed (mm/sec) | Hard Roller | Productivity | Exposure unevenness | Streak unevenness (Yellow) |
|---|---|---|---|---|---|
| 5002 | 100 | X | ○ | X | ○ |
| 5001 | 80 | ○ | X | ○ | ◎ |
| 5002 | 80 | ○ | X | ○ | ◎ |
| 5001 | 100 | ○ | ○ | ○ | X |
| 5002 | 100 | ○ | ○ | ○ | ○ |
| 5003 | 100 | ○ | ○ | ○ | ○ |
| 5004 | 100 | ○ | ○ | ○ | ○ |
| 5005 | 100 | ○ | ○ | ○ | ○ |
| 5006 | 100 | ○ | ○ | ○ | ○ |
| 5007 | 100 | ○ | ○ | ○ | ◎ |

(Note)
Hard roller: "○" the hard roller was utilized, "X" no hard roller was utilized
Productivity: Simplified expression of the number of prints processed per unit hour. Assuming the case of setting a sub-scan conveyance speed at 80 mm/sec in Example 5-1 as standard, the case where the processing time per sheet was shortened is designated by "○", while the case where the above time was not shortened is designated by "X".
Exposure unevenness: "○" the same level to the reference case, "X" unevenness was observed
Streaked unevenness: "◎" not observed at all, "○" slightly observed, "X" many streaks of unevenness were observed As can be seen from Table 13, the silver halide color photographic light-sensitive materials and the image-forming methods of the present invention, preferably in the seventh embodiment if the present invention, provided prints on which exposure unevenness and streaked unevenness were hardly observed, namely defect-free and high-quality prints, even when the sub-scan conveyance speed was increased (or productivity was enhanced).

Example 5-2

(Preparation of Blue-Sensitive Layer Emulsion B-51)

Monodisperse cubic silver chloribromide grains were prepared in the same manner as the emulsion grains used in the blue-sensitive emulsion B-41 in Example 4-2. The emulsion obtained was dissolved, admixed with sodium thiosulfate, chloroauric acid, Sensitizing dye B-2, 1-(3-acetoamidophenyl)-5-mercaptotetrazole, 1-phenyl-5-mercaptotetrazole, and 1-(4-ethoxyphenyl)-5-mercpatotetrazozle, followed by subjecting to chemical sensitization at 60° C. The thus-obtained emulsion was referred to as Emulsion BH-511.

Another monodisperse cubic emulsion, Emulsion BL-511, having a circle-equivalent diameter of 0.50 μm, a variation coefficient of 0.07 with respect to grain diameter distribution, a silver chloride content of 99.8 mole %, and a silver bromide content of 0.2 mole %, was prepared in the same manner as Emulsion BH-511, except that the addition periods of time of silver nitrate, sodium chloride and potassium bromide were changed.

Emulsion BH-511 and Emulsion BL-511 were mixed at a ratio of 1:1 on a silver basis, to prepare Emulsion B-51 for a blue-sensitive layer.

(Preparation of Blue-Sensitive Layer Emulsion B-52)

Emulsion BH-522 was prepared in the same manner as Emulsion BH-511, except that a 80mol % amount of the sensitizing dye B-2 added at the time of post-ripening was replaced with S-38.

Emulsion BL-522 was prepared in the same manner as Emulsion BL-511, except that a 80mol % amount of the sensitizing dye B-2 added at the time of post-ripening was replaced with S-38.

Emulsion BH-522 and Emulsion BL-522 were mixed at a ratio of 1:1 on a silver basis, to prepare Emulsion B-52 for a blue-sensitive layer.

(Preparation of Green-Sensitive Layer Emulsion G-51)

Green-sensitive layer emulsion G-51 was prepared in the same manner as the Green-sensitive layer emulsion G41 in Example 4-2.

(Preparation of Red-Sensitive Layer Emulsion R-51)

Red-sensitive layer emulsion R-51 was prepared in the same manner as the Red-sensitive layer emulsion R-41 in Example 4-2.

(Preparation of Sample 5101)

Sample 5101 was prepared in the same manner as Sample 4101 in Example 4-2, except for the following changes: the emulsion in the first layer was changed to an emulsion (a 5:5 mixture of BH-511 and BL-511 (mol ratio of silver)); the emulsion in the third layer was changed to Emulsion (G-51); and the emulsion in the fifth layer was changed to Emulsion (R-51).

Sample No. 5102 was prepared in the same manner as Sample No. 5101, except that the silver halide emulsion in the blue-sensitive emulsion layer of Sample No. 5101 was replaced with B-52.

Each of the samples described above was worked into a 127-mm-width roll, and the resultant sample was stored for 14 days under a condition of 35° C.-55% RH as it was in roll form, followed by subjecting to the exposure tests and conveyance tests under the same conditions as in Example 5-1.

Continuous processing (running test) was performed using Sample No. 5102 in accordance with the following process steps-until the volume of the color developer replenisher reached twice the volume of the color developing tank. By using the thus-obtained running processing solutions, each light-sensitive material sample was processed through the following process steps.

| Processing step | Temperature | Time | Replenisher* amount |
|---|---|---|---|
| Color development | 45.0° C. | 27 sec | 35 mL |
| Bleach-fixing | 40.0° C. | 27 sec | 30 mL |
| Rinse 1 | 45.0° C. | 7 sec | — |
| Rinse 2 | 45.0° C. | 7 sec | — |
| Rinse 3** | 45.0° C. | 5 sec | — |
| Rinse 4 | 45.0° C. | 8 sec | 121 mL |
| Drying | 80° C. | 24 sec | |

(Note)
*Replenishment rate per $m^2$ of the light-sensitive material to be processed.
**A rinse cleaning system RC50D (trade name), manufactured by Fuji Photo Film Co., Ltd., was installed in the rinse 3, and the rinse solution was taken out from the rinse 3 and sent to a reverse osmosis membrane module (RC50D) by using a pump. The permeated water obtained in that tank was supplied to the rinse 4, and the concentrated water was returned to the rinse 3. Pump pressure was controlled such that the water to bepermeated in the reverse osmosis module would be maintained in an amount of 50 to 300 ml/min, and the rinse solution was circulated under controlled temperature for 10 hours a day. The rinse was made in a four-tank counter-current system from 1 to 4.

The same processing solutions used in Example 4-2 were used.

The results are shown in the following Table 14.

As can be seen from Table 14, the silver halide color photographic light-sensitive materials and the image-forming methods of the present invention provided prints on which exposure unevenness and streaked unevenness were hardly perceived, namely defect-free high-quality prints, even when the sub-scan conveyance speed was increased.

TABLE 14

| Sample No. | Sub-scan conveyance speed (mm/sec) | Hard Roller | Productivity | Exposure unevenness | Streak unevenness (Yellow) |
|---|---|---|---|---|---|
| 5101 | 80 | X | X | ○ | ◎ |
| 5102 | 80 | X | X | ○ | ◎ |
| 5101 | 100 | X | ○ | X | ○ |
| 5102 | 100 | X | ○ | X | ○ |
| 5101 | 80 | ○ | X | ○ | ○ |
| 5102 | 80 | ○ | X | ○ | ◎ |
| 5101 | 100 | ○ | ○ | ○ | X |
| 5102 | 100 | ○ | ○ | ○ | ◎ |

(Note)
Hard roller: "○" the hard roller was utilized, "X" no hard roller was utilized
Productivity: Simplified expression of the number of prints processed per unit hour. Assuming the case of setting a sub-scan conveyance speed at 80 mm/sec in Example 5-1 as standard, the case where the processing time per sheet was shortened is designated by "○", while the case where the above time was not shortened is designated by "X".
Exposure unevenness: "○" the same level to the reference case, "X" unevenness was observed
Streaked unevenness: "◎" not observed at all, "○" slightly observed, "X" many streaks of unevenness were observed Example 5-3

The samples prepared in Example 5-1 were each subjected to uniform gray exposure by means of the following exposure unit, and streak unevenness evaluation was carried out as in the same manner as in Example 5-1. At that time, the light source was changed from the blue laser of about 470 nm used in Example 5-1, to a blue semiconductor laser with wavelength about 440 nm (Presentation by Nichia Corporation at the 48th Applied Physics Related Joint Meeting, in March of 2001).

In this case also, the silver halide color photographic light-sensitive materials and the image-forming methods of the present invention suffered no streak unevenness, and besides, they provided defect-free and high-quality prints, even when the sub-scan conveyance speed was increased.

INDUSTRIAL APPLICABILITY

The silver halide color photographic light-sensitive material of the present invention is preferable for high-speed conveying processing. Further, the color image-forming method of the present invention using the aforesaid material is preferable for high-speed conveying processing.

More specifically, the color image-forming method of the present invention, in which the silver halide color photographic light-sensitive material is conveyed in sheet form at a high speed in photographic processing, can ensure to provide a color image with high quality and improved in developer streaks. Further, the silver halide color photographic light-sensitive material of the present invention is preferable for the aforesaid method.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. § 119 (a) on Patent Application No.-2004-023003 filed in Japan on Jan. 30, 2004, Patent Application No.2004-023260 filed in Japan on Jan. 30, 2004, Patent Application No. 2004-024595 filed in Japan on Jan. 30, 2004, Patent Application No. 2004-087485 filed in Japan on Mar. 24, 2004, and Patent Application No. 2004-087745 filed in Japan on Mar. 24, 2004, each of which is entirely herein incorporated by reference.

The invention claimed is:

1. A color-image forming method in a silver halide color photographic light-sensitive material comprising a support and photographic constituent layers including at least one blue-sensitive silver halide emulsion layer containing a yellow-dye-forming coupler, at least one green-sensitive silver halide emulsion layer containing a magenta-dye-forming coupler, at least one red-sensitive silver halide emulsion layer containing a cyan-dye-forming coupler, and at least one light-insensitive hydrophilic colloid layer, which comprises the steps of:

performing image-wise exposure of the light-sensitive material cut into sheets; and subjecting the exposed light-sensitive material sheets to photographic processing including a color development process, a bleach-fix process, a rinsing process and a drying process, while conveying the exposed light-sensitive material sheets by means of pairs of conveying rollers;

wherein the sheet conveying speed in the photographic processing being 40.0 mm/sec to 100 mm/sec;

wherein the rinsing process uses a tank structurally partitioned into a plurality of rooms with blade-form members for passing the photographic material cut into sheets through rinse solutions in a horizontal direction; and wherein the silver halide color photographic light-sensitive material to be exposed contains any one component selected from the group consisting of:

1) at least one dye-forming coupler represented by the following formula (IA), 2) at least one compound represented by the following formula (I), and 3) 1.4 mg/m$^2$ or more of at least one compound represented by the following formula (II);

Formula (IA)

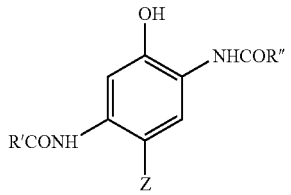

wherein, in formula (IA), R' and R" each independently represent a substituent, and Z represents a hydrogen atom, or a group capable of being split-off in a coupling reaction with an oxidized product of an aromatic primary amine color-developing agent;

Formula (I)

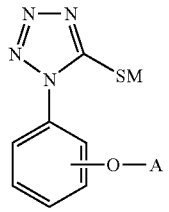

wherein, in formula (I), A represents a substituted or unsubstituted alkyl group, and M represents a cation; and Formula (II)

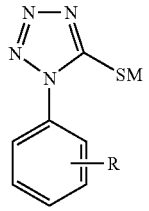

wherein, in formula (II), M represents a cation; and R represents an atom having an atomic weight of 100 or lower, or a group having a total molecular weight of 100 or lower.

2. The color-image forming method as claimed in claim 1, wherein the silver halide color photographic light-sensitive material to be exposed contains at least one dye-forming coupler represented by the following formula (M-1) and the at least one dye-forming coupler represented by formula (IA) described above; and wherein the color development process, the bleach-fix process and the drying process in the photographic processing are finished within 18 seconds, 18 seconds and 26 seconds, respectively;

Formula (M-I)

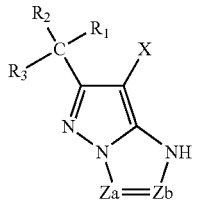

wherein, in formula (M-I), $R_1$, $R_2$, and $R_3$ each independently represent a hydrogen atom or a substituent; one of Za and Zb represents a carbon atom having a hydrogen atom or a substituent, and the other represents a nitrogen atom; the substituent of Za or Zb may further have a substituent; and X represents a hydrogen atom or a group capable of being split-off upon a reaction with an oxidized product of an aromatic primary amine color-developing agent.

3. The color-image forming method as claimed in claim 2, wherein the conveying speed in the photographic processing is from 45.0 mm/sec to 95 mm/sec.

4. The color-image forming method as claimed in claim 2, wherein the dye-forming coupler represented by the formula (M-1) is a dye-forming coupler represented by the following formula (M-III);

Formula (M-III)

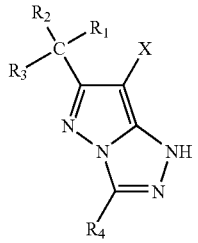

wherein, in formula (M-III), $R_1$, $R_2$, $R_3$ and $R_4$ each independently represent a hydrogen atom or a substituent; and X represents a hydrogen atom or a group capable of being split-off upon a reaction with an oxidized product of an aromatic primary amine color-developing agent.

5. The color-image forming method as claimed in claim 2, wherein the hydrophilic colloid layer is a layer made up of gelatin hardened substantially with a hardener represented by the following formula (HI);

$$X^{a1}—SO_2\text{-}L\text{-}SO_2—X^{a2}$$ Formula (HI)

wherein, in formula (HI), $X^{a1}$ and $X^{a2}$ each represent —CH═$CH_2$ or —$CH_2CH_2Y$ independently; $X^{a1}$ and $X^{a2}$ may be the same or different; Y represents a group capable of being replaced with a nucleophilic group or released in the form of HY by reaction with a base; and L represents a divalent linkage group, which may be substituted.

6. The color-image forming method as claimed in claim 1, wherein the silver halide color photographic light-sensitive material comprises at least one compound represented by formula (I) described above, and wherein the silver halide color photographic light-sensitive material is processed by use of a processing machine in which conveying of the silver halide color photographic material is performed by nipping conveying with two or more pairs of conveying rollers.

7. The color-image forming method as claimed in claim 1, wherein the silver halide color photographic light-sensitive material contains a compound represented by the above formula (II) in an amount of 1.4 mg/$m^2$ or more, and wherein conveying of the silver halide color photographic light-sensitive material is performed by nipping conveying with two or more pairs of conveying rollers.

8. The color-image forming method as claimed in claim 6, wherein the image-wise exposure is performed using a scanning exposure method on a per-pixel exposure time setting of $1\times10^{-4}$ second or shorter.

9. The color-image forming method as claimed in claim 6, wherein the color-development process is performed at a processing time setting of 20 seconds or below.

* * * * *